US010291983B2

(12) United States Patent
Baym et al.

(10) Patent No.: US 10,291,983 B2
(45) Date of Patent: May 14, 2019

(54) PORTABLE ELECTRONIC DEVICE DIRECTED AUDIO SYSTEM AND METHOD

(71) Applicant: Elwha LLC, Bellevue, WA (US)

(72) Inventors: Michael H. Baym, Cambridge, MA (US); William David Duncan, Kirkland, WA (US); Roderick A. Hyde, Redmond, WA (US); Edward K. Y. Jung, Bellevue, WA (US); Richard T. Lord, Tacoma, WA (US); Robert W. Lord, Seattle, WA (US); Nathan P. Myhrvold, Medina, WA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 0 days.

(21) Appl. No.: 13/920,280

(22) Filed: Jun. 18, 2013

(65) Prior Publication Data

US 2014/0270305 A1 Sep. 18, 2014

Related U.S. Application Data

(63) Continuation of application No. 13/844,525, filed on Mar. 15, 2013, now abandoned, and a (Continued)

(51) Int. Cl.

*H04R 3/00* (2006.01)
*H04R 1/40* (2006.01)

(Continued)

(52) U.S. Cl.

CPC ..... *H04R 1/403* (2013.01); *H04R 5/02* (2013.01); *H04R 17/00* (2013.01); *H04R 2217/03* (2013.01); *H04R 2499/11* (2013.01)

(58) Field of Classification Search

CPC ..... H04R 1/403; H04R 5/02; H04R 17/00; H04R 2217/03; H04R 2499/11; H04R 1/32; H04R 1/323; H04R 1/40; F41H 13/0081

(Continued)

(56) References Cited

U.S. PATENT DOCUMENTS 4,263,484 A 4/1981 Hisatsune et al.
4,823,908 A * 4/1989 Tanaka et al. ..... 181/175

(Continued)

FOREIGN PATENT DOCUMENTS

DE 10004029 A1 * 8/2001 ..... H04M 1/0202
JP 02253800 A * 10/1990 ..... H04R 27/00

(Continued)

OTHER PUBLICATIONS

PCT International Search Report; International App. No. PCT/US2014/028899; dated Jul. 17, 2014; pp. 1-6.

*Primary Examiner* — Mark Fischer

(57) ABSTRACT

A computationally implemented system and method that is designed to, but is not limited to: electronically providing audio output information to one or more portions of a portable electronic device to be outputted from said portable electronic device via one or more acoustic ultrasonic signals; and electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements.

(Continued)

In addition to the foregoing, other method aspects are described in the claims, drawings, and text forming a part of the present disclosure.

42 Claims, 90 Drawing Sheets

Related U.S. Application Data continuation-in-part of application No. 13/844,615, filed on Mar. 15, 2013, now abandoned, and a continuation-in-part of application No. 13/844,678, filed on Mar. 15, 2013, now abandoned, and a continuation-in-part of application No. 13/844,732, filed on Mar. 15, 2013, now abandoned, and a continuation-in-part of application No. 13/920,296, filed on Jun. 18, 2013, and a continuation-in-part of application No. 13/920,305, filed on Jun. 18, 2013, now Pat. No. 10,181,314, and a continuation-in-part of application No. 13/920,312, filed on Jun. 18, 2013.

(51) Int. Cl.
*H04R 5/02* (2006.01)
*H04R 17/00* (2006.01)

(58) Field of Classification Search
USPC ..... 726/17–20, 26–28
See application file for complete search history.

(56) References Cited

U.S. PATENT DOCUMENTS 6,011,470 A * 1/2000 Schulte ..... G07F 7/10 340/5.31
6,044,257 A * 3/2000 Boling et al. ..... 455/404.2
6,384,414 B1 5/2002 Fisher et al.
6,434,239 B1 8/2002 DeLuca
6,445,804 B1 9/2002 Hirayanagi
6,766,036 B1 7/2004 Pryor
6,807,281 B1 10/2004 Sasaki et al.
6,850,623 B1 2/2005 Norris et al.
7,424,118 B2 9/2008 Mori et al.
7,429,935 B1 9/2008 Brenner
7,693,288 B2 4/2010 Mergler
7,801,315 B2 9/2010 Watanabe et al.
7,907,740 B2 3/2011 Matsuzawa
8,009,838 B2 8/2011 Lee et al.
8,199,960 B2 6/2012 Eaton
8,208,970 B2 6/2012 Cheung et al.
8,243,944 B2 8/2012 Almagro
8,306,244 B2 11/2012 Okamura et al.
8,311,233 B2 11/2012 Kinghorn
8,358,321 B1 * 1/2013 Weidner ..... G09G 5/00 345/619
8,582,789 B2 11/2013 Cheung et al.
8,681,951 B1 * 3/2014 Lavian et al. ..... 379/88.18
8,879,766 B1 11/2014 Zhang
8,891,783 B2 11/2014 Tan et al.
8,903,104 B2 12/2014 Norris
8,983,098 B2 3/2015 Norris
9,078,055 B2 7/2015 Nguyen et al.
9,129,515 B2 9/2015 Xiang et al.
9,197,974 B1 11/2015 Clark et al.
9,197,977 B2 11/2015 Mahabub et al.
9,226,053 B2 12/2015 Okamura et al.
9,251,428 B2 2/2016 Rozumyanskiy et al.
9,354,310 B2 5/2016 Visser et al.
9,432,785 B2 8/2016 Kappus et al.
2002/0178390 A1 * 11/2002 Lee ..... 713/320
2003/0039370 A1 2/2003 Norris
2003/0091200 A1 5/2003 Pompei
2003/0215103 A1 11/2003 Norris et al.
2004/0032399 A1 2/2004 Sekiguchi et al.
2004/0114770 A1 6/2004 Pompei
2004/0114772 A1 6/2004 Zlotnick
2004/0170086 A1 9/2004 Mayer et al.
2004/0202339 A1 10/2004 O'Brien, Jr. et al.
2004/0204168 A1 10/2004 Laurila
2004/0208324 A1 10/2004 Cheung et al.
2004/0208325 A1 * 10/2004 Cheung et al. ..... 381/79
2004/0209654 A1 10/2004 Cheung et al.
2004/0234080 A1 11/2004 Hernandez et al.
2004/0264707 A1 * 12/2004 Yang et al. ..... 381/77
2005/0009583 A1 1/2005 Cheung et al.
2005/0089176 A1 4/2005 Norris et al.
2005/0152562 A1 7/2005 Holmi et al.
2005/0185800 A1 8/2005 Croft, III
2005/0195985 A1 9/2005 Croft, III et al.
2005/0207568 A1 9/2005 Wu
2005/0244016 A1 * 11/2005 Norris et al. ..... 381/77
2005/0261589 A1 11/2005 Daft et al.
2006/0210090 A1 9/2006 Shennib
2006/0291667 A1 12/2006 Watanabe et al.
2007/0140505 A1 6/2007 Tribble et al.
2007/0154036 A1 7/2007 Matsuzawa
2007/0169555 A1 * 7/2007 Gao et al. ..... 73/620
2007/0172076 A1 7/2007 Mori et al.
2007/0183618 A1 * 8/2007 Ishii et al. ..... 381/387
2007/0286433 A1 12/2007 Yoshino
2007/0287516 A1 12/2007 Cheung et al.
2008/0063214 A1 3/2008 Spencer et al.
2008/0159571 A1 7/2008 Hooley
2008/0226087 A1 9/2008 Kinghorn
2008/0252595 A1 * 10/2008 Boillot ..... G06F 3/011 345/156
2008/0279410 A1 11/2008 Cheung et al.
2008/0285777 A1 11/2008 Pompei
2008/0304677 A1 12/2008 Abolfathi et al.
2009/0046864 A1 2/2009 Mahabub et al.
2009/0089717 A1 * 4/2009 Cho et al. ..... 715/863
2009/0105586 A1 4/2009 Daft et al.
2009/0214049 A1 8/2009 Lee et al.
2009/0298430 A1 12/2009 Cheung et al.
2010/0036926 A1 * 2/2010 Ahart et al. ..... 709/206
2010/0135504 A1 6/2010 Almagro
2010/0172511 A1 7/2010 Togawa et al.
2010/0239101 A1 9/2010 Okamura et al.
2010/0284525 A1 11/2010 Sander et al.
2011/0015880 A1 1/2011 Kajitani et al.
2011/0103614 A1 5/2011 Cheung et al.
2011/0129101 A1 6/2011 Hooley
2011/0172793 A1 7/2011 Richards et al.
2011/0182445 A1 * 7/2011 Atsmon et al. ..... 381/123
2011/0188672 A1 * 8/2011 Tada et al. ..... 381/98
2011/0202302 A1 8/2011 Park et al.
2011/0211035 A1 9/2011 Ota et al.
2011/0279366 A1 * 11/2011 Lohbihler ..... G01S 5/0247 345/157
2011/0303014 A1 12/2011 Kajitani
2012/0120218 A1 * 5/2012 Flaks ..... G10L 21/028 348/77
2012/0128196 A1 * 5/2012 Watanabe ..... H04R 1/2896 381/386
2012/0148053 A1 6/2012 Tan et al.
2012/0224456 A1 9/2012 Visser et al.
2012/0237037 A1 9/2012 Ninan et al.
2012/0243708 A1 9/2012 Tsutsui et al.
2012/0268563 A1 10/2012 Chou et al.
2012/0308056 A1 12/2012 Nakayama
2012/0321112 A1 12/2012 Schubert et al.
2013/0035582 A1 2/2013 Radulescu et al.
2013/0058503 A1 3/2013 Kato et al.
2013/0066636 A1 * 3/2013 Singhal ..... H04R 1/32 704/275
2013/0077803 A1 3/2013 Konno et al.
2013/0094331 A1 4/2013 Watanabe et al.
2013/0094666 A1 4/2013 Haff et al.
2013/0121516 A1 5/2013 Lamb et al.
2013/0202130 A1 * 8/2013 Zurek et al. ..... 381/94.3
2013/0294637 A1 * 11/2013 Kitatani et al. ..... 381/387

(56) References Cited

U.S. PATENT DOCUMENTS

| | | | | |
|---|---|---|---|---|
| 2013/0321625 | A1* | 12/2013 | Yanagihara | H04R 1/32 348/143 |
| 2014/0044286 | A1 | 2/2014 | Coles et al. | |
| 2014/0050325 | A1 | 2/2014 | Norris | |
| 2014/0079242 | A1 | 3/2014 | Nguyen et al. | |
| 2014/0104988 | A1 | 4/2014 | Norris | |
| 2014/0133665 | A1 | 5/2014 | Xiang et al. | |
| 2014/0141836 | A1 | 5/2014 | Rozumyanskiy et al. | |
| 2014/0205134 | A1 | 7/2014 | Yagihashi et al. | |
| 2014/0254820 | A1 | 9/2014 | Gardenfors et al. | |
| 2014/0254840 | A1 | 9/2014 | Norris | |
| 2014/0269207 | A1 | 9/2014 | Baym et al. | |
| 2014/0269208 | A1 | 9/2014 | Baym et al. | |
| 2014/0269212 | A1 | 9/2014 | Xiang et al. | |
| 2014/0307898 | A1 | 10/2014 | Norris | |
| 2014/0369538 | A1 | 12/2014 | Norris et al. | |
| 2015/0003624 | A1 | 1/2015 | Sato | |
| 2016/0044402 | A1 | 2/2016 | Okamura et al. | |
| 2016/0233966 | A1 | 8/2016 | Kappus et al. | |
| 2016/0269831 | A1 | 9/2016 | Kappus et al. | |
| 2016/0269833 | A1 | 9/2016 | Norris et al. | |
| 2016/0373864 | A1 | 12/2016 | Hecht et al. | |

FOREIGN PATENT DOCUMENTS

| | | | | | |
|---|---|---|---|---|---|
| JP | 2007159042 | A | * | 6/2007 | H04R 3/00 |
| JP | 2007189627 | A | * | 7/2007 | H04R 3/00 |
| JP | 2011-010224 | A | | 1/2011 | |
| JP | 2012134589 | A | * | 7/2012 | H04R 3/12 |
| WO | WO 2011/007685 | A1 | | 1/2011 | |
| WO | WO 2011/117903 | A2 | | 9/2011 | |
| WO | WO 2012/091185 | A1 | | 7/2012 | |
| WO | WO 2012105183 | A1 | * | 8/2012 | H04S 7/00 |
| WO | WO 2012133058 | A1 | * | 10/2012 | H04R 1/32 |

* cited by examiner

PORTABLE ELECTRONIC DEVICE DIRECTED AUDIO SYSTEM AND METHOD

CROSS-REFERENCE TO RELATED APPLICATIONS

The present application is related to and/or claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)). In addition, the present application is related to the "Related Applications," if any, listed below.

PRIORITY APPLICATIONS

For purposes of the USPTO extra-statutory requirements, the present application constitutes a continuation of U.S. patent application Ser. No. 13/844,525, entitled PORTABLE ELECTRONIC DEVICE DIRECTED AUDIO SYSTEM AND METHOD, naming Michael H. Baym, William David Duncan, Roderick A. Hyde, Edward K. Y. Jung, Richard T. Lord, Robert W. Lord, Nathan P. Myhrvold and Lowell L. Wood, Jr. as inventors, filed 15 Mar. 2013, which is currently co-pending or is an application of which a currently co-pending application is entitled to the benefit of the filing date.

For purposes of the USPTO extra-statutory requirements, the present application constitutes a continuation-in-part of U.S. patent application Ser. No. 13/920,296, entitled PORTABLE ELECTRONIC DEVICE DIRECTED AUDIO TARGETED USER SYSTEM AND METHOD, naming Michael H. Baym, William David Duncan, Roderick A. Hyde, Edward K. Y. Jung, Richard T. Lord, Robert W. Lord, Nathan P. Myhrvold and Lowell L. Wood, Jr. as inventors, filed 18 Jun. 2013, which is currently co-pending or is an application of which a currently co-pending application is entitled to the benefit of the filing date.

For purposes of the USPTO extra-statutory requirements, the present application constitutes a continuation-in-part of U.S. patent application Ser. No. 13/920,305, entitled PORTABLE ELECTRONIC DEVICE DIRECTED AUDIO TARGETED MULTI-USER SYSTEM AND METHOD, naming Michael H. Baym, William David Duncan, Roderick A. Hyde, Edward K. Y. Jung, Richard T. Lord, Robert W. Lord, Nathan P. Myhrvold and Lowell L. Wood, Jr. as inventors, filed 18 Jun. 2013, which is currently co-pending or is an application of which a currently co-pending application is entitled to the benefit of the filing date.

For purposes of the USPTO extra-statutory requirements, the present application constitutes a continuation-in-part of U.S. patent application Ser. No. 13/920,312, entitled PORTABLE ELECTRONIC DEVICE DIRECTED AUDIO EMITTER ARRANGEMENT SYSTEM AND METHOD, naming Michael H. Baym, William David Duncan, Roderick A. Hyde, Edward K. Y. Jung, Richard T. Lord, Robert W. Lord, Nathan P. Myhrvold and Lowell L. Wood, Jr. as inventors, filed 18 Jun. 2013, which is currently co-pending or is an application of which a currently co-pending application is entitled to the benefit of the filing date.

Under the auspices of various alleged "rules" implementing the America Invents Act (AIA), the United States Patent and Trademark Office (USPTO) is purporting to require that an Attorney for a Client make various legal and/or factual statements/commentaries/admissions (e.g. Concerning any "Statement under 37 CFR 1.55 or 1.78 for AIA (First Inventor to File) Transition Application") related to written description/new matter, and/or advise his Client to make such legal and/or factual statements/commentaries/admissions. Attorney expressly points out that the burden of both alleging that an application contains new matter with respect to its parent(s) and establishing a prima facie case of lack of written description under 35 U.S.C. § 112, first paragraph lies firmly on the USPTO. Accordingly, and expressly in view of duties owed his client, Attorney further points out that the AIA legislation, while referencing the first to file, does not appear to constitute enabling legislation that would empower the USPTO to compel an Attorney to either make/advise such legal and/or factual statements/commentaries/admissions. Notwithstanding the foregoing, Attorney/Applicant understand that the USPTO's computer programs/personnel have certain data entry requirements, and hence Attorney/Applicant have provided a designation(s) of a relationship between the present application and its parent application(s) as set forth herein and in any ADS filed in this application, but expressly points out that such designation(s) is not to be construed in any way as any type of commentary and/or admission as to whether or not a claim in the present application is supported by a parent application, or whether or not the present application contains any new matter in addition to the matter of its parent application(s) in general and/or especially as such might relate to an effective filing date before, on, or after 16 Mar. 2013.

The fact that the Attorney/Applicant may have made certain statements in view of practical data entry requirements of the USPTO should NOT be taken as an admission of any sort. Attorney/Applicant hereby reserves any and all rights to contest/contradict/confirm such statements at a later time. Furthermore, no waiver (legal, factual, or otherwise), implicit or explicit, is hereby intended (e.g., with respect to any statements/admissions made by the Attorney/Applicant in response to the purported requirements of the USPTO related to the relationship between the present application and parent application[s], and/or regarding new matter or alleged new matter relative to the parent application[s]). For example, although not expressly stated and possibly despite a designation of the present application as a continuation-in-part of a parent application, Attorney/Applicant may later assert that the present application or one or more of its claims do not contain any new matter in addition to the matter of its parent application[s], or vice versa.

SUMMARY

In one aspect, a computationally-implemented method includes, but is not limited to electronically providing audio output information to one or more portions of a portable electronic device to be outputted from said portable electronic device via one or more acoustic ultrasonic signals; and electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements. In addition to the foregoing, other method aspects are described in the claims, drawings, and text forming a part of the disclosure set forth herein.

In one or more various aspects, related machines, compositions of matter, or manufactures of systems may include, but are not limited to, circuitry and/or programming for effecting the herein-referenced method aspects; the circuitry and/or programming can be virtually any combination of hardware, software, and/or firmware configured to effect the herein-referenced method aspects depending upon the design choices of the system designer (limited to patentable subject matter under 35 USC 101).

A computationally-implemented system includes, but is not limited to: means for electronically providing audio output information to one or more portions of a portable electronic device to be outputted from said portable electronic device via one or more acoustic ultrasonic signals; and means for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements. In addition to the foregoing, other system aspects are described in the claims, drawings, and text forming a part of the disclosure set forth herein.

A computationally-implemented system includes, but is not limited to a electronically providing electrical circuitry arrangement for electronically providing audio output information to one or more portions of a portable electronic device to be outputted from said portable electronic device via one or more acoustic ultrasonic signals; and an electronically outputting electrical circuitry arrangement for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements. In addition to the foregoing, other system aspects are described in the claims, drawings, and text forming a part of the disclosure set forth herein.

A system includes, but is not limited to a electronically providing module configured to operate in accordance with electronically providing audio output information to one or more portions of a portable electronic device to be outputted from said portable electronic device via one or more acoustic ultrasonic signals; and an electronically outputting module configured to operate in accordance with electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements. In addition to the foregoing, other system aspects are described in the claims, drawings, and text forming a part of the disclosure set forth herein.

An article of manufacture including one or more non-transitory signal-bearing storage medium bearing one or more instructions for electronically providing audio output information to one or more portions of a portable electronic device to be outputted from said portable electronic device via one or more acoustic ultrasonic signals; and one or more instructions for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements. In addition to the foregoing, other computer program product aspects are described in the claims, drawings, and text forming a part of the disclosure set forth herein.

A system including one or more computing devices; and one or more instructions when executed on the one or more computing devices cause the one or more computing devices to perform electronically providing audio output information to one or more portions of a portable electronic device to be outputted from said portable electronic device via one or more acoustic ultrasonic signals; and electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements. In addition to the foregoing, other computer program product aspects are described in the claims, drawings, and text forming a part of the disclosure set forth herein.

In addition to the foregoing, various other method and/or system and/or program product aspects are set forth and described in the teachings such as text (e.g., claims and/or detailed description) and/or drawings of the present disclosure.

The foregoing is a summary and thus may contain simplifications, generalizations, inclusions, and/or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of embodiments, reference now is made to the following descriptions taken in connection with the accompanying drawings. The use of the same symbols in different drawings typically indicates similar or identical items, unless context dictates otherwise.

With reference now to the figures, shown are one or more examples of portable electronic device directed audio that may provide context, for instance, in introducing one or more processes and/or devices described herein.

DETAILED DESCRIPTION

Figure 1:
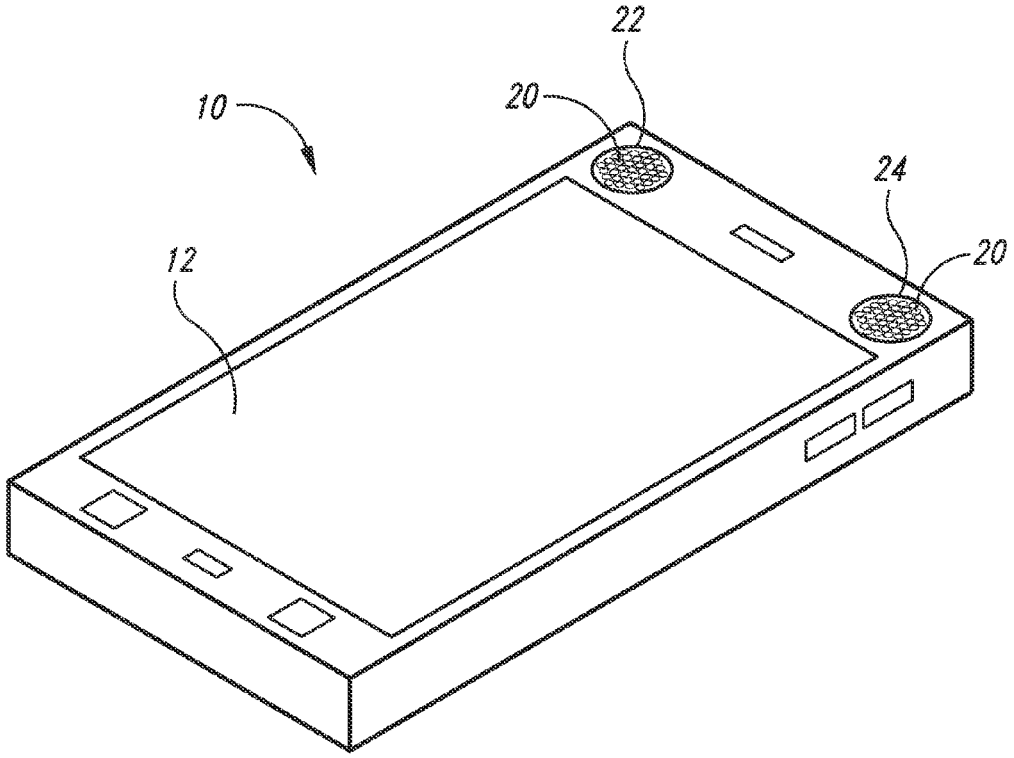
FIG. 1 is a perspective view depicting a smart phone implementation as related with a portable electronic device directed audio.
Figure 2:
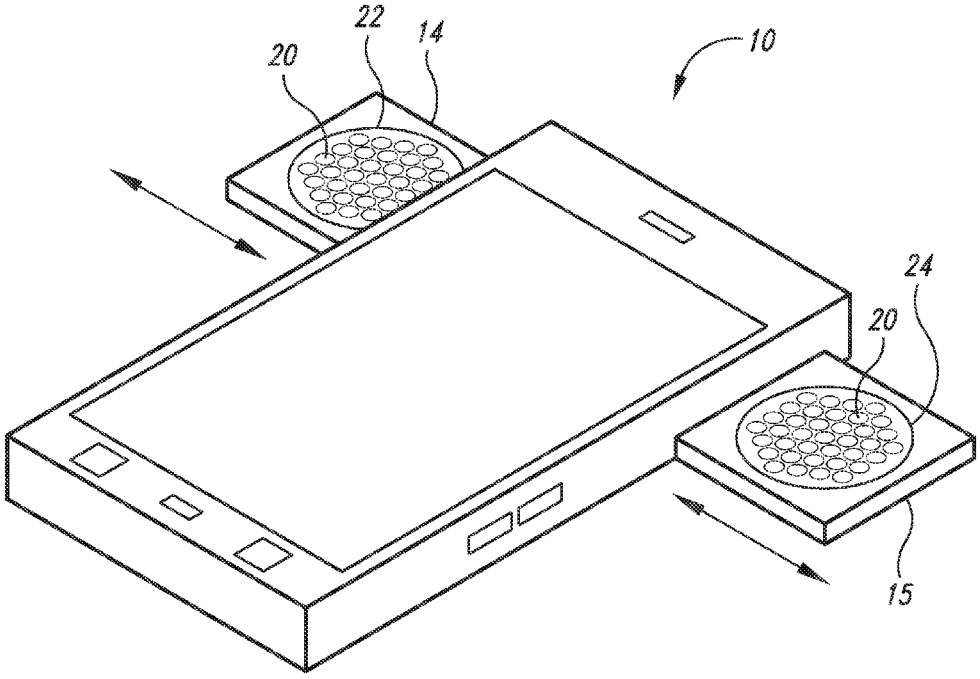
FIG. 2 is a perspective view depicting a smart phone implementation as related with a portable electronic device directed audio.
Figure 3:
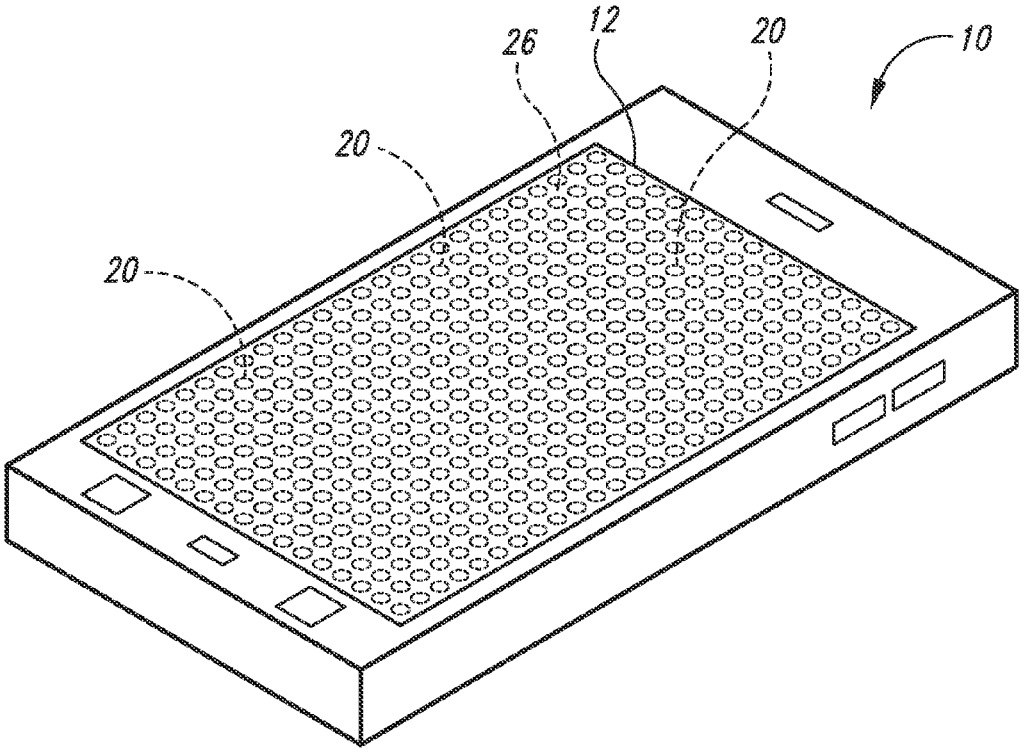
FIG. 3 is a perspective view depicting a smart phone implementation as related with a portable electronic device directed audio.
Figure 4:
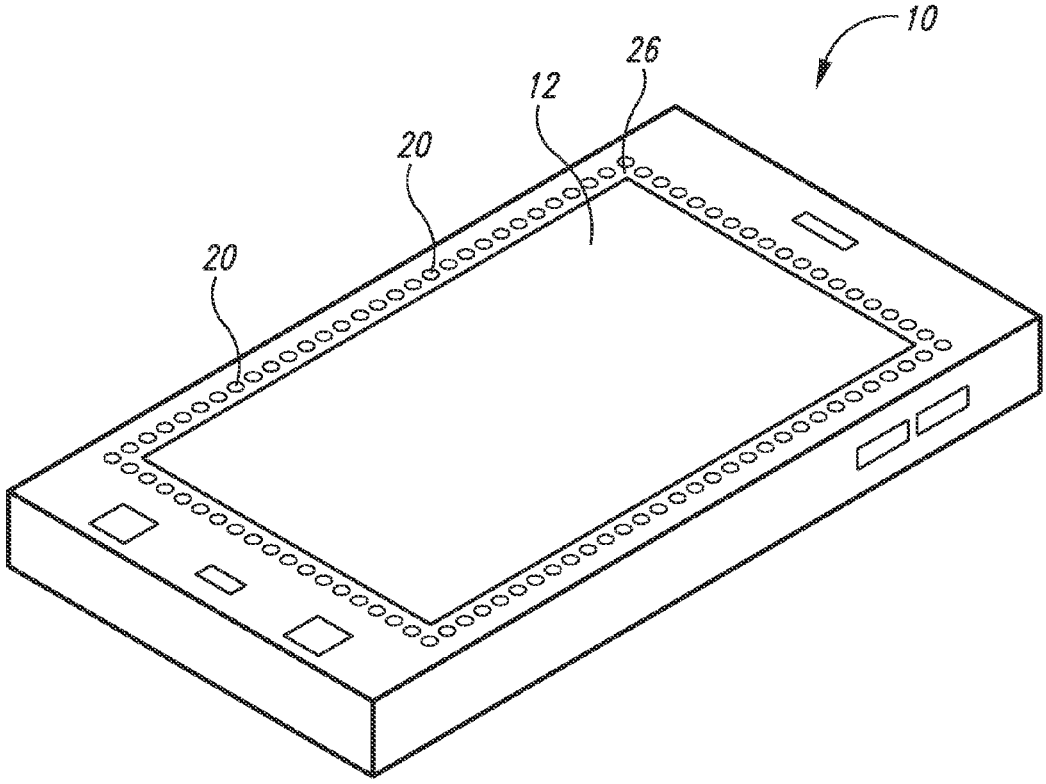
FIG. 4 is a perspective view depicting a smart phone implementation as related with a portable electronic device directed audio.
Figure 5:
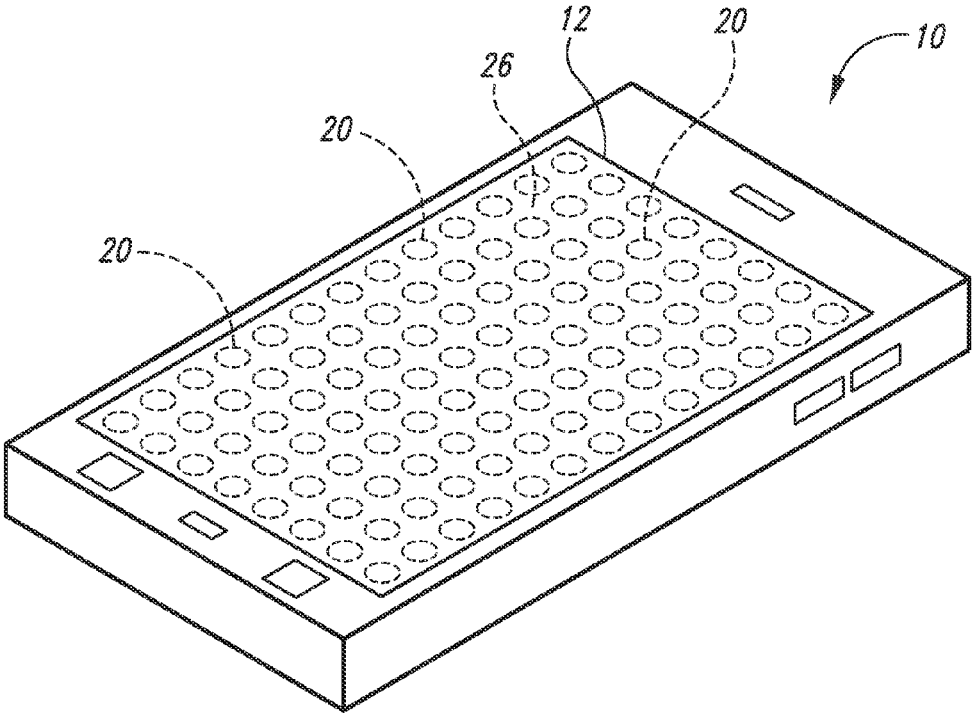
FIG. 5 is a perspective view depicting a smart phone implementation as related with a portable electronic device directed audio.
Figure 6:
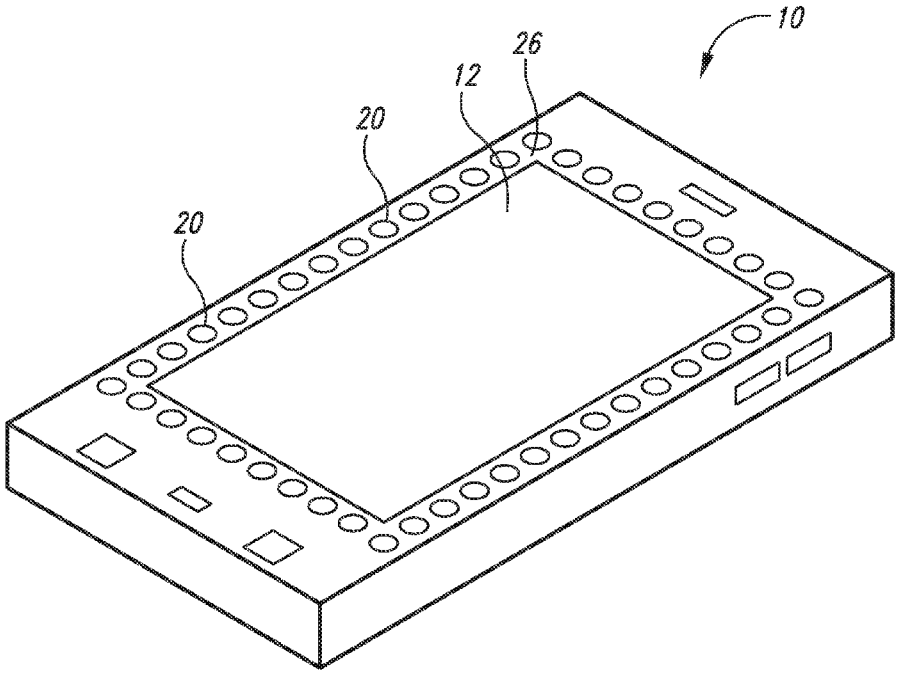
FIG. 6 is a perspective view depicting a smart phone implementation as related with a portable electronic device directed audio.
Figure 7:
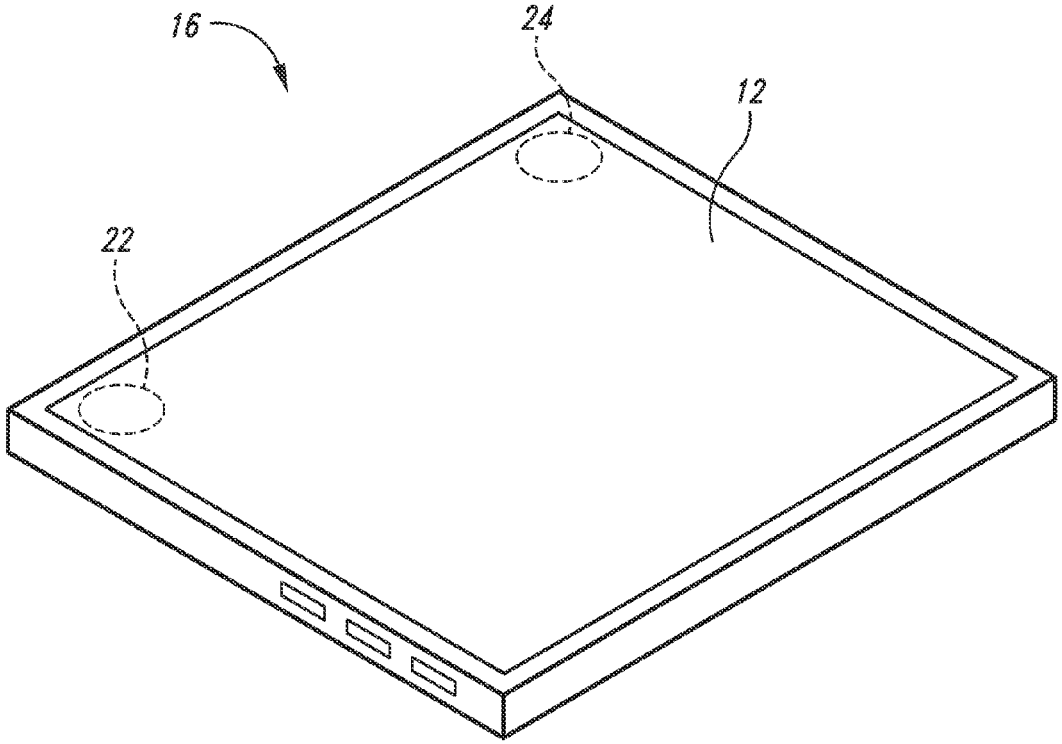
FIG. 7 is a perspective view depicting a tablet computer implementation as related with a portable electronic device directed audio.
Figure 8:
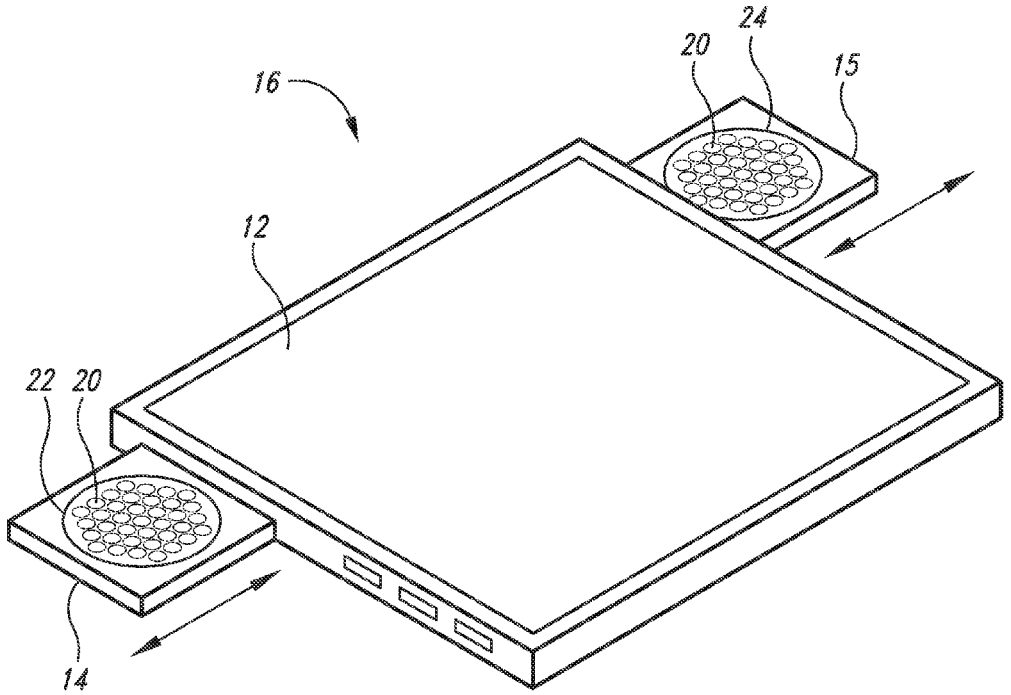
FIG. 8 is a perspective view depicting a tablet computer implementation as related with a portable electronic device directed audio.
Figure 9:
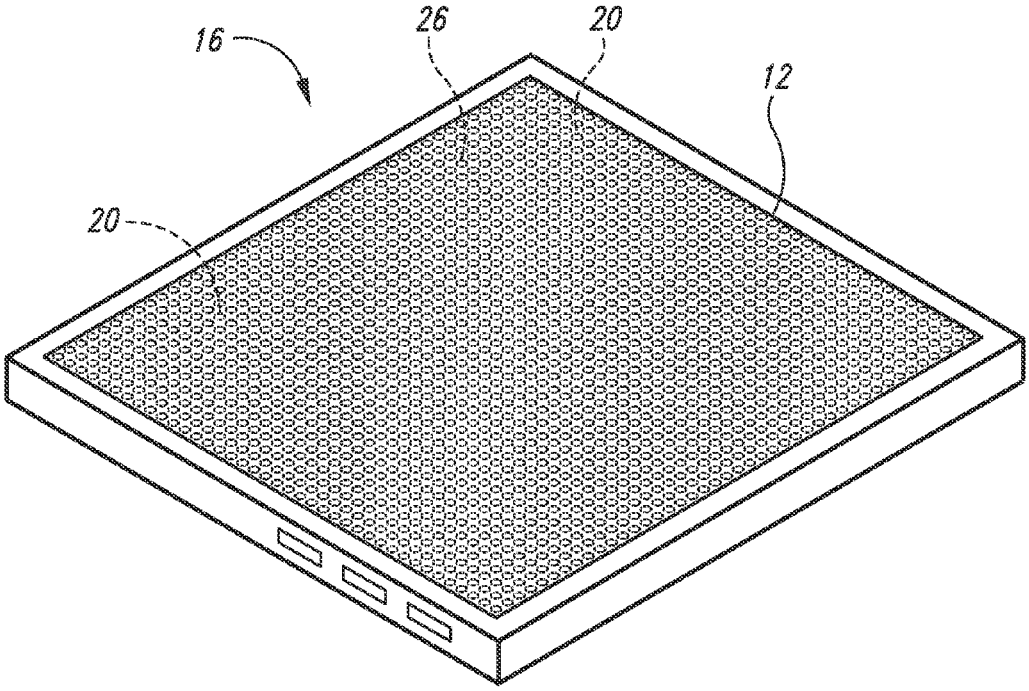
FIG. 9 is a perspective view depicting a tablet computer implementation as related with a portable electronic device directed audio.
Figure 10:
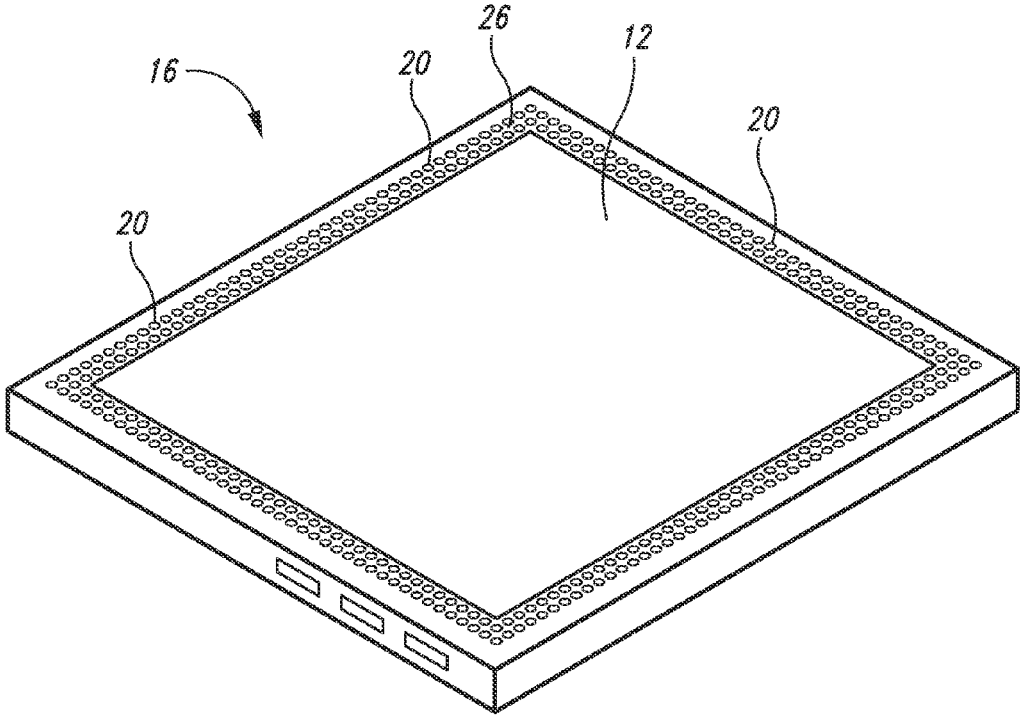
FIG. 10 is a perspective view depicting a tablet computer implementation as related with a portable electronic device directed audio.
Figure 11:
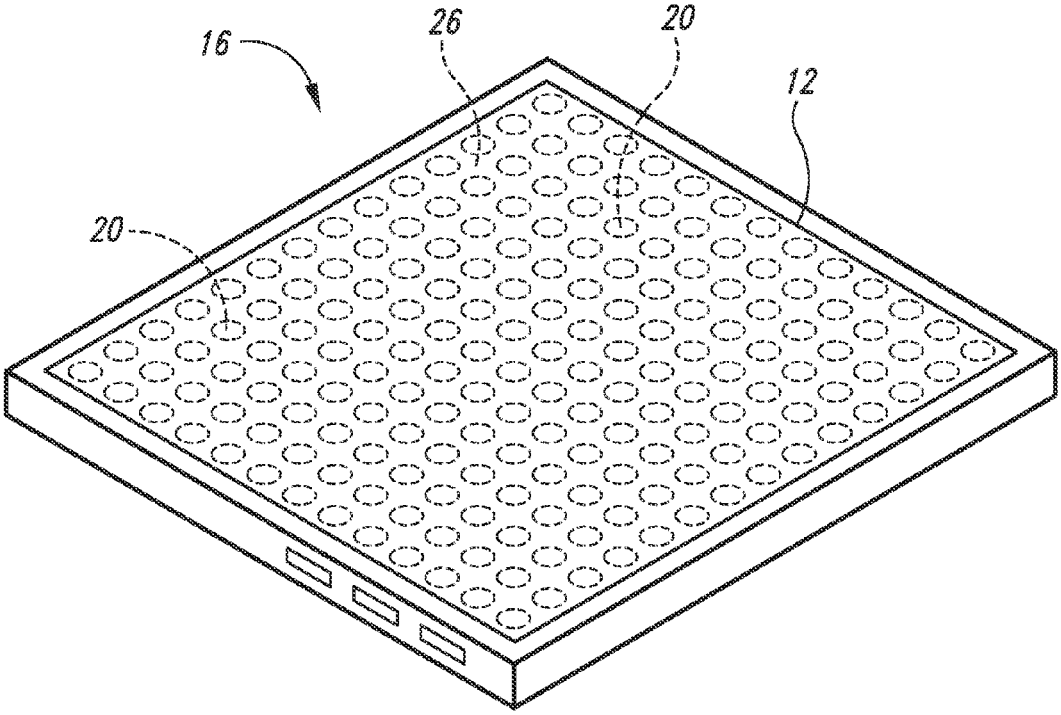
FIG. 11 is a perspective view depicting a tablet computer implementation as related with a portable electronic device directed audio.
Figure 12:
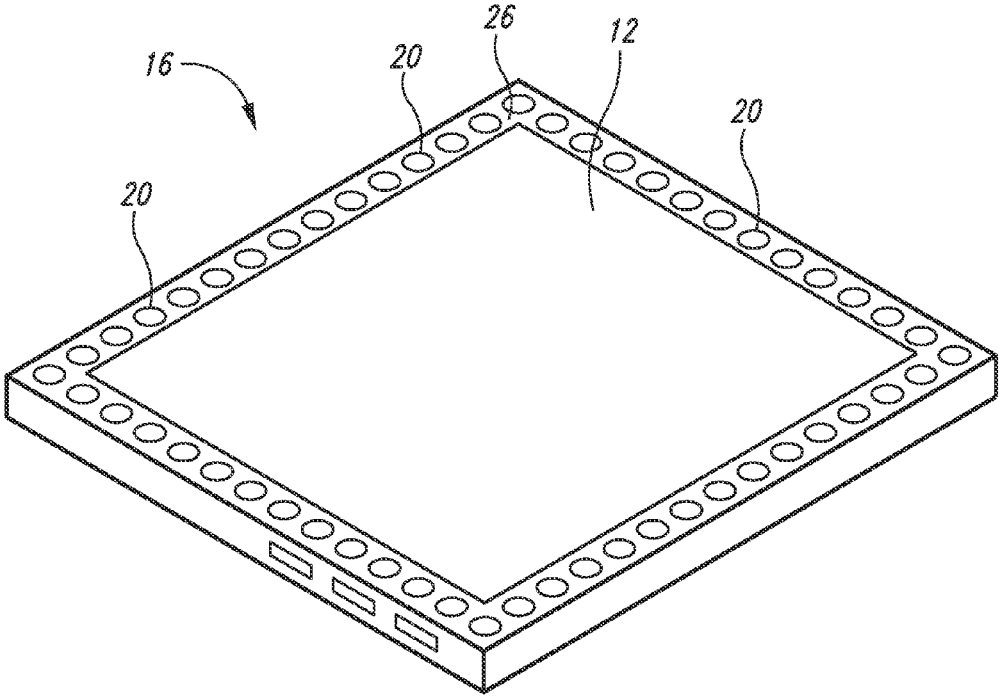
FIG. 12 is a perspective view depicting a tablet computer implementation as related with a portable electronic device directed audio.
Figure 13:
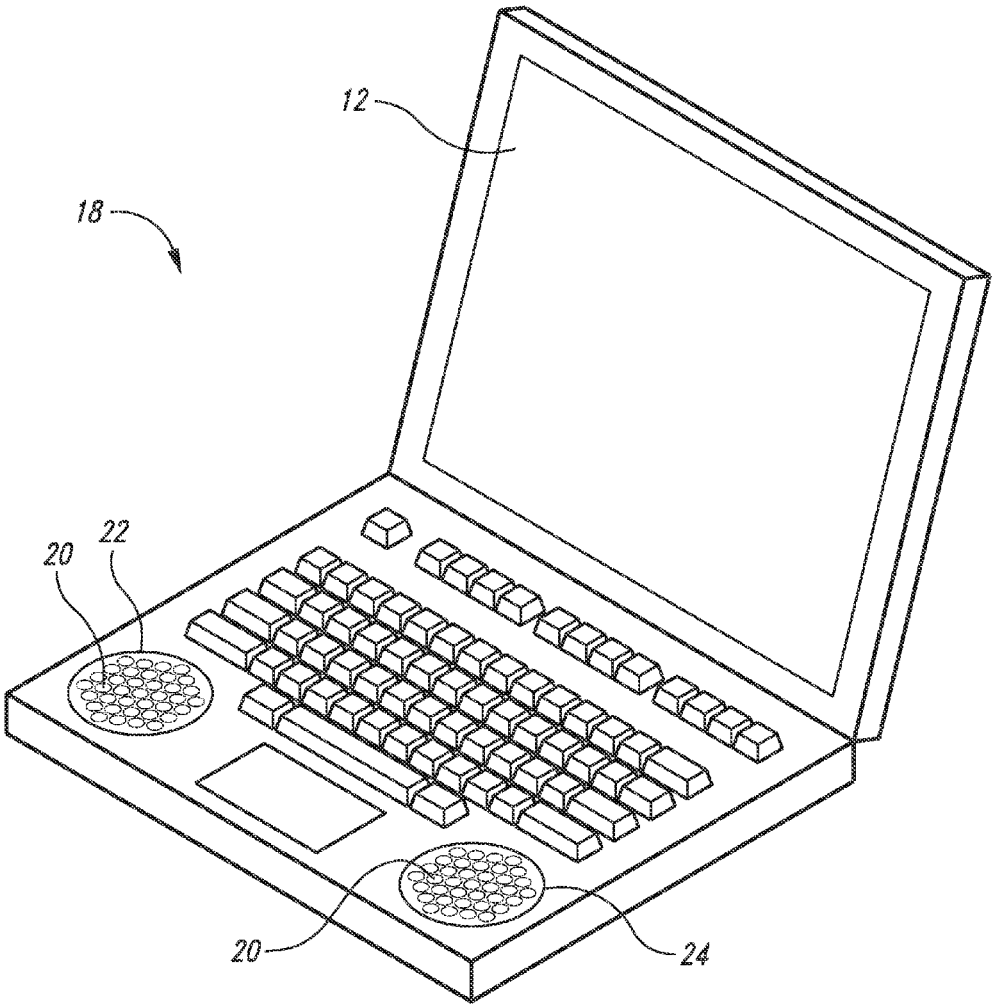
FIG. 13 is a perspective view depicting a laptop computer implementation as related with a portable electronic device directed audio.
Figure 14:
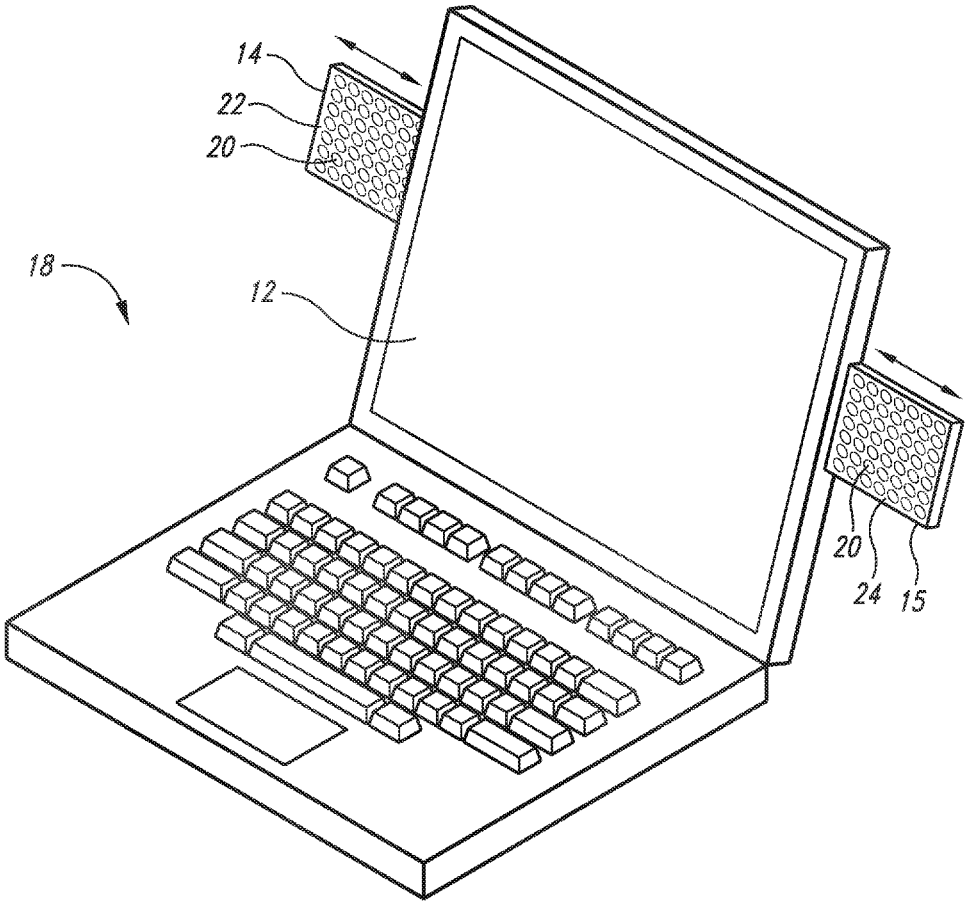
FIG. 14 is a perspective view depicting a laptop computer implementation as related with a portable electronic device directed audio.
Figure 15:
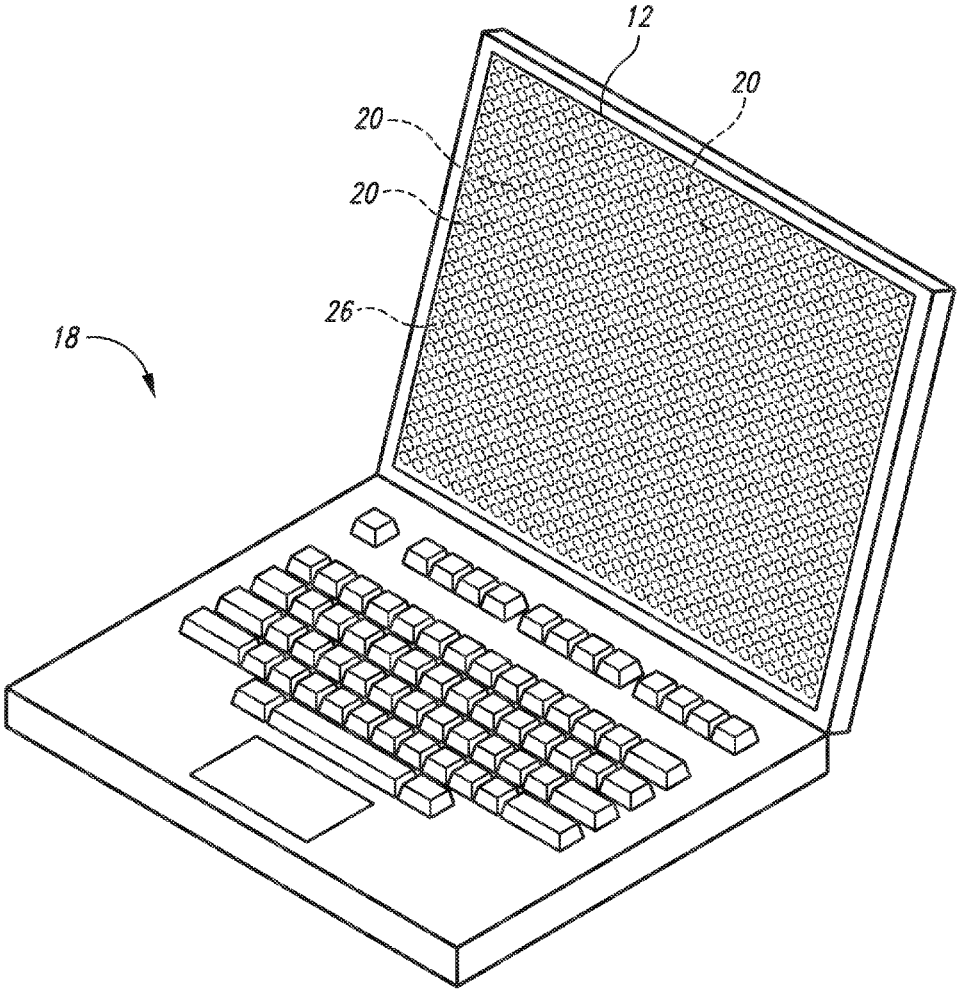
FIG. 15 is a perspective view depicting a laptop computer implementation as related with a portable electronic device directed audio.
Figure 16:
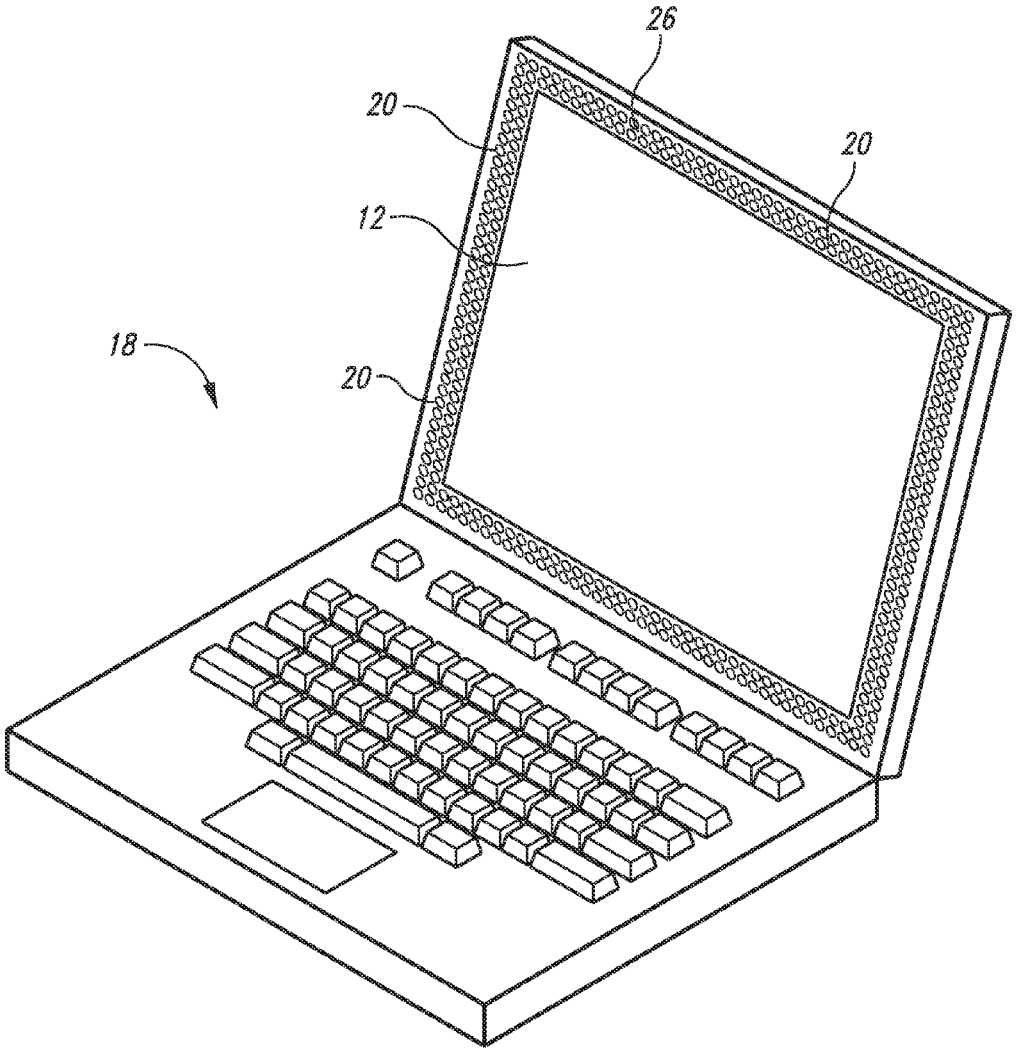
FIG. 16 is a perspective view depicting a laptop computer implementation as related with a portable electronic device directed audio.
Figure 17:
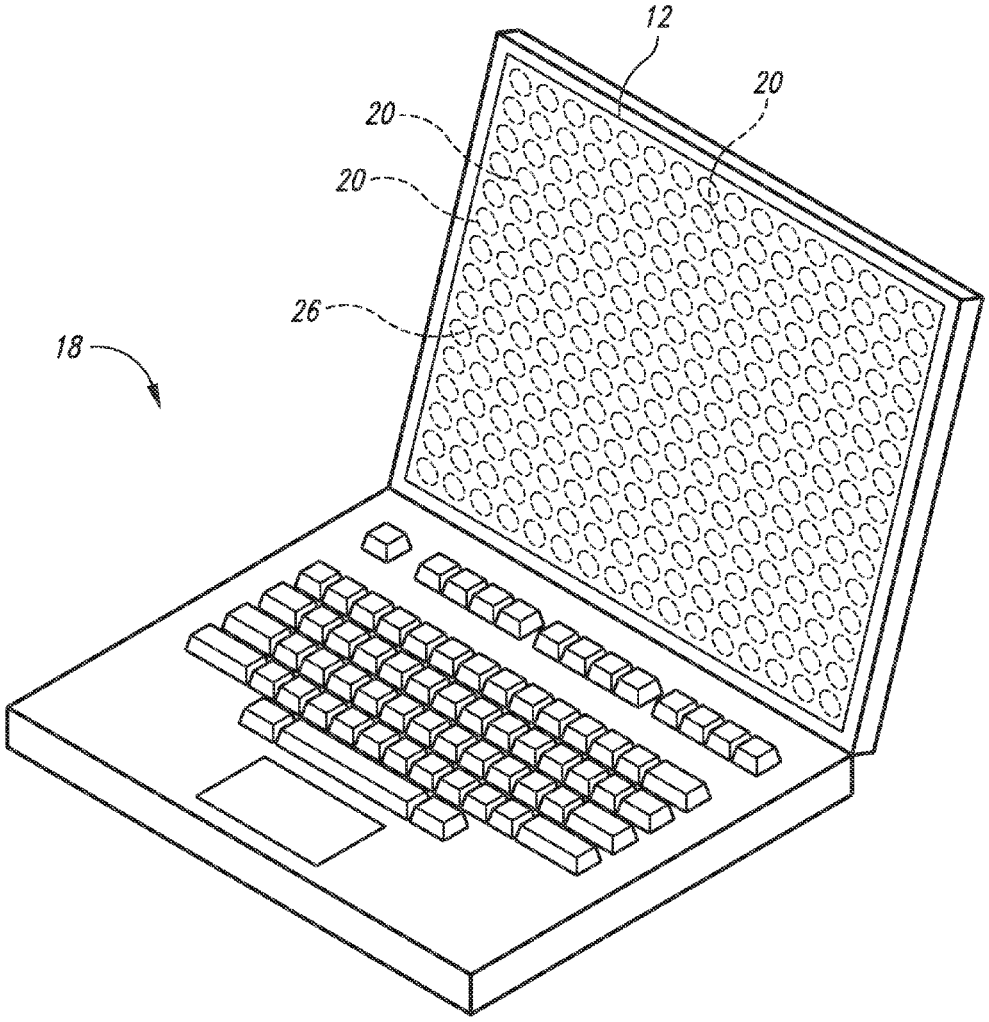
FIG. 17 is a perspective view depicting a laptop computer implementation as related with a portable electronic device directed audio.
Figure 18:
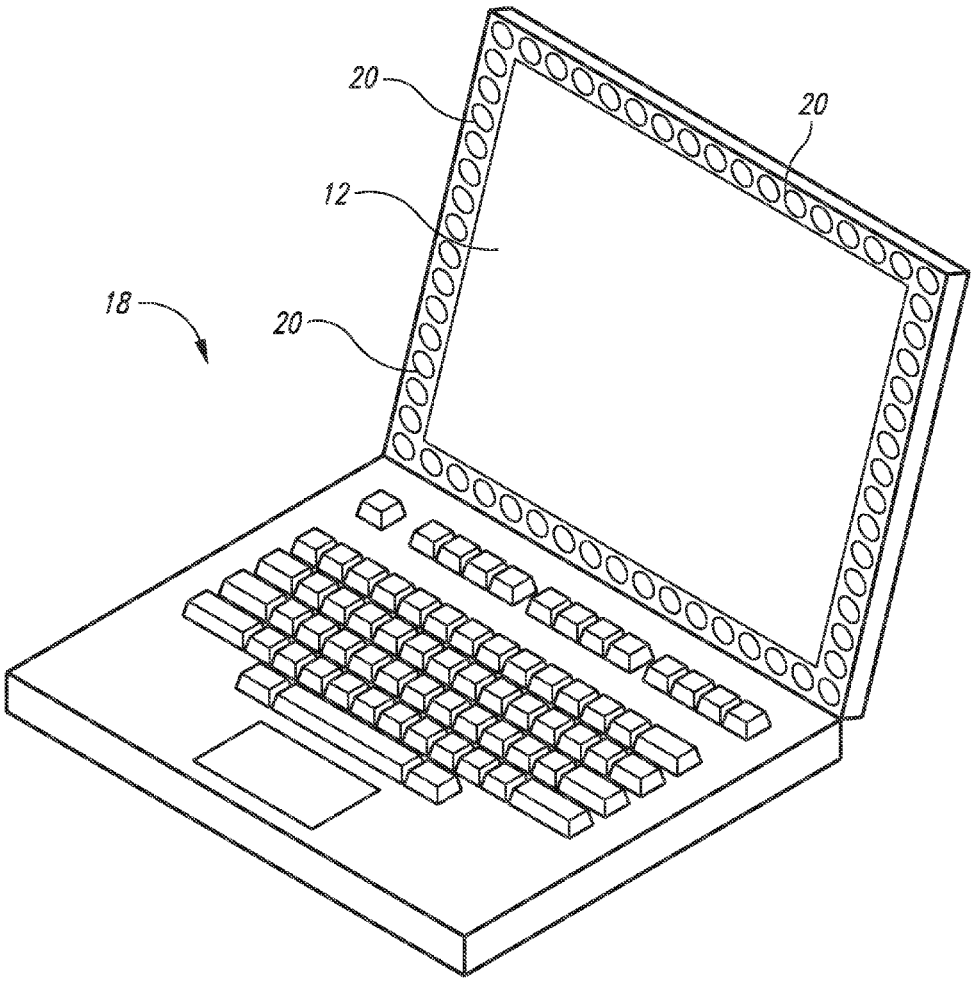
FIG. 18 is a perspective view depicting a laptop computer implementation as related with a portable electronic device directed audio.
Figure 19:
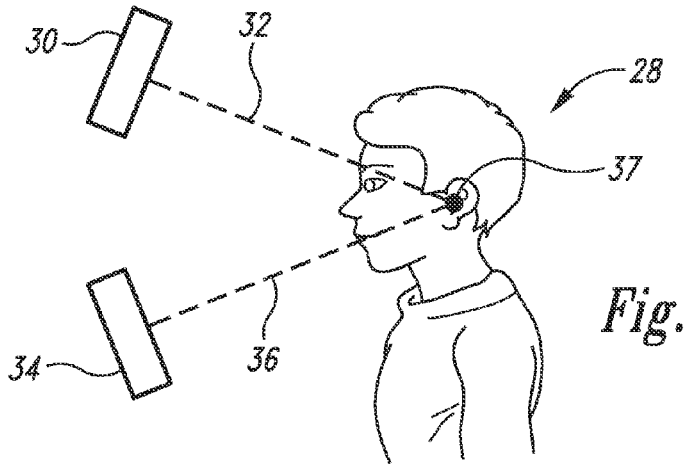
FIGS. 19-24 depict various schematic representations of down conversion of one or more acoustic ultrasonic signals into acoustic audio signals.
Figure 20:
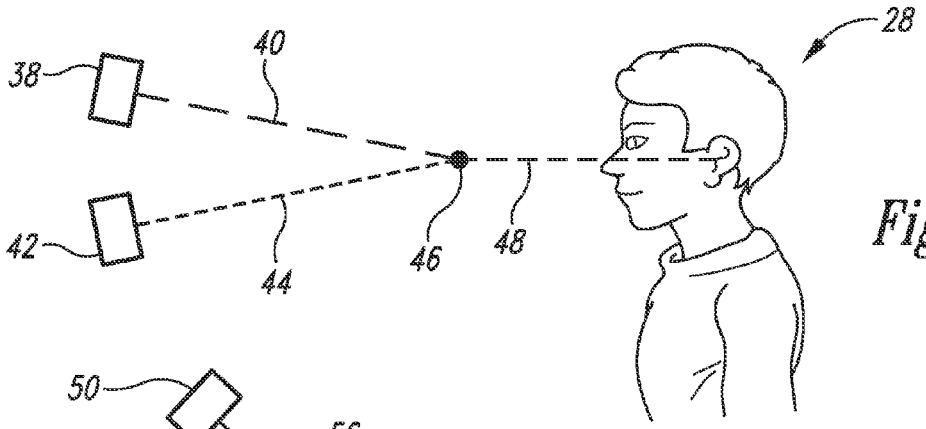
Figure 21:
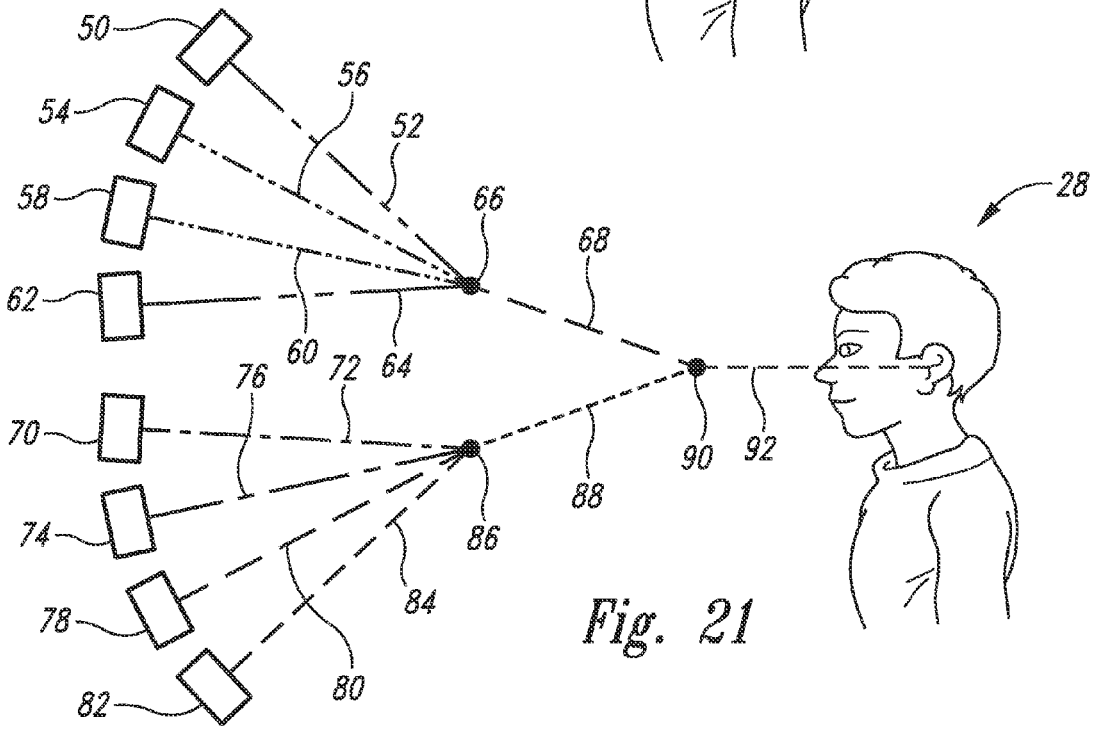
Figure 22:
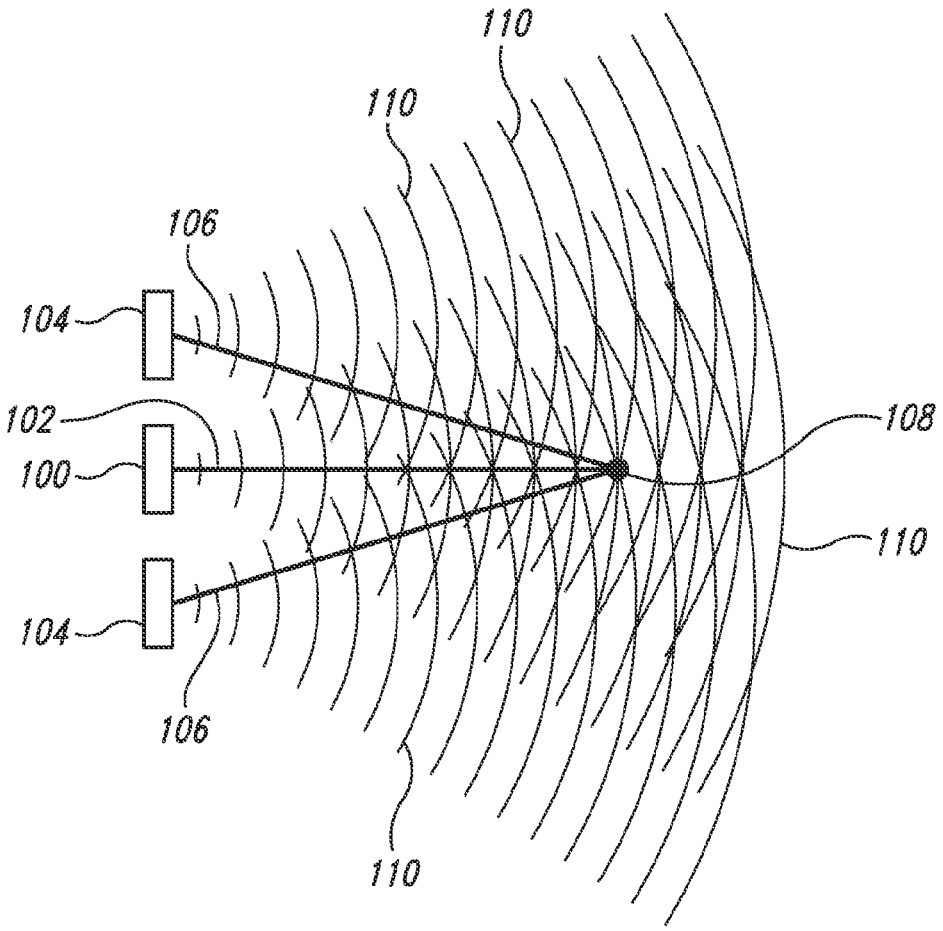
Figure 23:
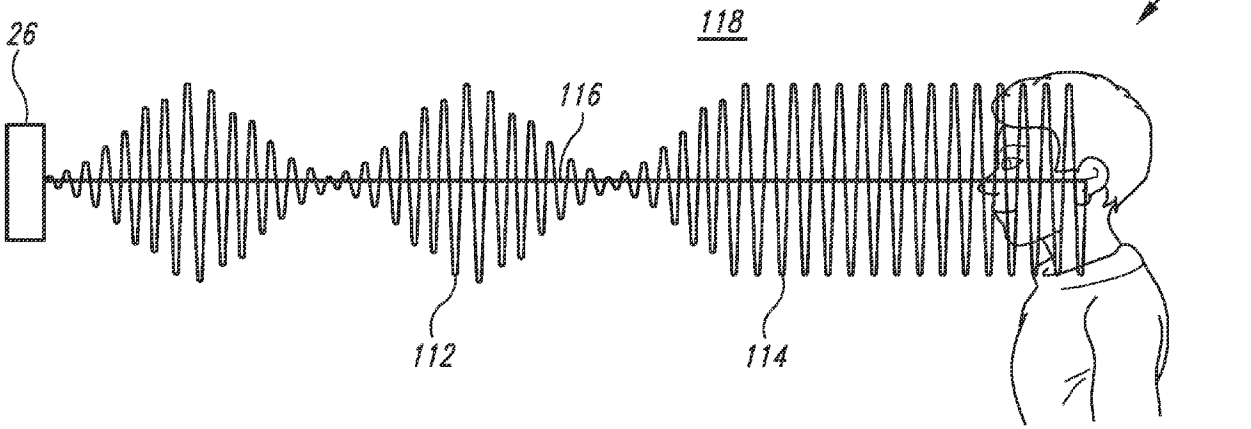
Figure 24:
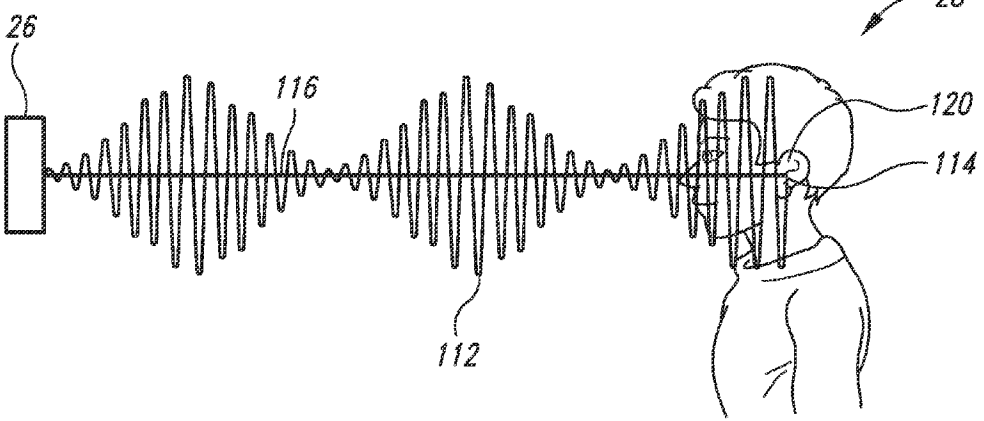

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

The present application may use formal outline headings for clarity of presentation. However, it is to be understood that the outline headings are for presentation purposes, and that different types of subject matter may be discussed throughout the application (e.g., device(s)/structure(s) may be described under process(es)/operations heading(s) and/or process(es)/operations may be discussed under structure(s)/process(es) headings; and/or descriptions of single topics may span two or more topic headings). Hence, the use of the formal outline headings is not intended to be in any way limiting.

With reference now to the Figures, FIGS. 1-24 depict environment(s) and/or an implementation(s) of technologies described herein. FIGS. 1-5 are perspective views depicting mobile device implementations 10, such as smart phone implementations, as related with a portable electronic device directed audio including display screens 12, arrays or other collections 22, 24, 26 of emitters 20 such as ultrasonic transducers. Various configurations are depicted for ultrasonic transducers or other emitters, including slide trays 14 and 15, such as configured in arrays to transmit acoustic ultrasonic signals modulated with one or more acoustic audio signals. Other depictions include locating the emitters 20 either integral with or around the periphery of the display screen 12. The acoustic audio signals can interact non-linearly with atmosphere, solid objects such as human tissue, or with each other to cause down conversion of part of the ultrasonic signals into acoustic audio signals directed at one or more desired locations such as near one or more target human ears.

FIGS. 7-12 are perspective views depicting tablet computer implementations as related with a portable electronic device directed audio including various configurations for ultrasonic transducers or other emitters such as configured in arrays to transmit acoustic ultrasonic signals modulated with one or more acoustic audio signals. The acoustic audio signals can interact non-linearly with atmosphere, solid objects such as human tissue, or with each other to cause down conversion of part of the ultrasonic signals into acoustic audio signals directed at one or more desired locations such as near one or more target human ears.

FIGS. 13-18 are perspective views depicting laptop computer implementations as related with a portable electronic device directed audio including various configurations for ultrasonic transducers or other emitters such as configured in arrays to transmit acoustic ultrasonic signals modulated with one or more acoustic audio signals. The acoustic audio signals can interact non-linearly with atmosphere, solid objects such as human tissue, or with each other to cause down conversion of part of the ultrasonic signals into acoustic audio signals directed at one or more desired locations such as near one or more target human ears.

Various approaches can be used in sizing emitter collections such as transducer arrays. For instance, approaches can consider an effective transducer size related to wavelengths of associated ultrasonic signals being emitted. Given an aperture area of emitters considered as antenna a dimension related to squaring of a wavelength involved would be related to a percentage of power contained by a beam being emitted. For instance, a given percentage of aperture area would have an equivalent percentage of original power being transmitted through an ultrasonic beam. For example, if a tablet was approximately forty square inches in aperture area with a perimeter of 25 linear inches a 60 GHz signal would have about a 0.2 inch wavelength with 25×0.2 square inches of effective aperture area. With transducers located along such a perimeter there could be about roughly a 10% transmission factor involved with an ultrasonic beam being emitted. In attempts to confine a beam, wavelength divided by aperture dimension could serve as a guide. For instance, 0.2 inches divided by 5 square inches could result in an approximate radius at a two foot range of approximately one or a few tenths of an inch. Such directionality of sound transmission could serve to isolate listener to only desired target listeners to down conversions into acoustic audio signals occurring at or near such listeners. For instance, FIGS. 19-24 depicted in schematic conceptual representations of various ultrasonic signals interacting with atmosphere, each other, or objects such as a target listener to produce a down-conversion of acoustic audio signals to be heard by one or more target listeners.

Figure 25:
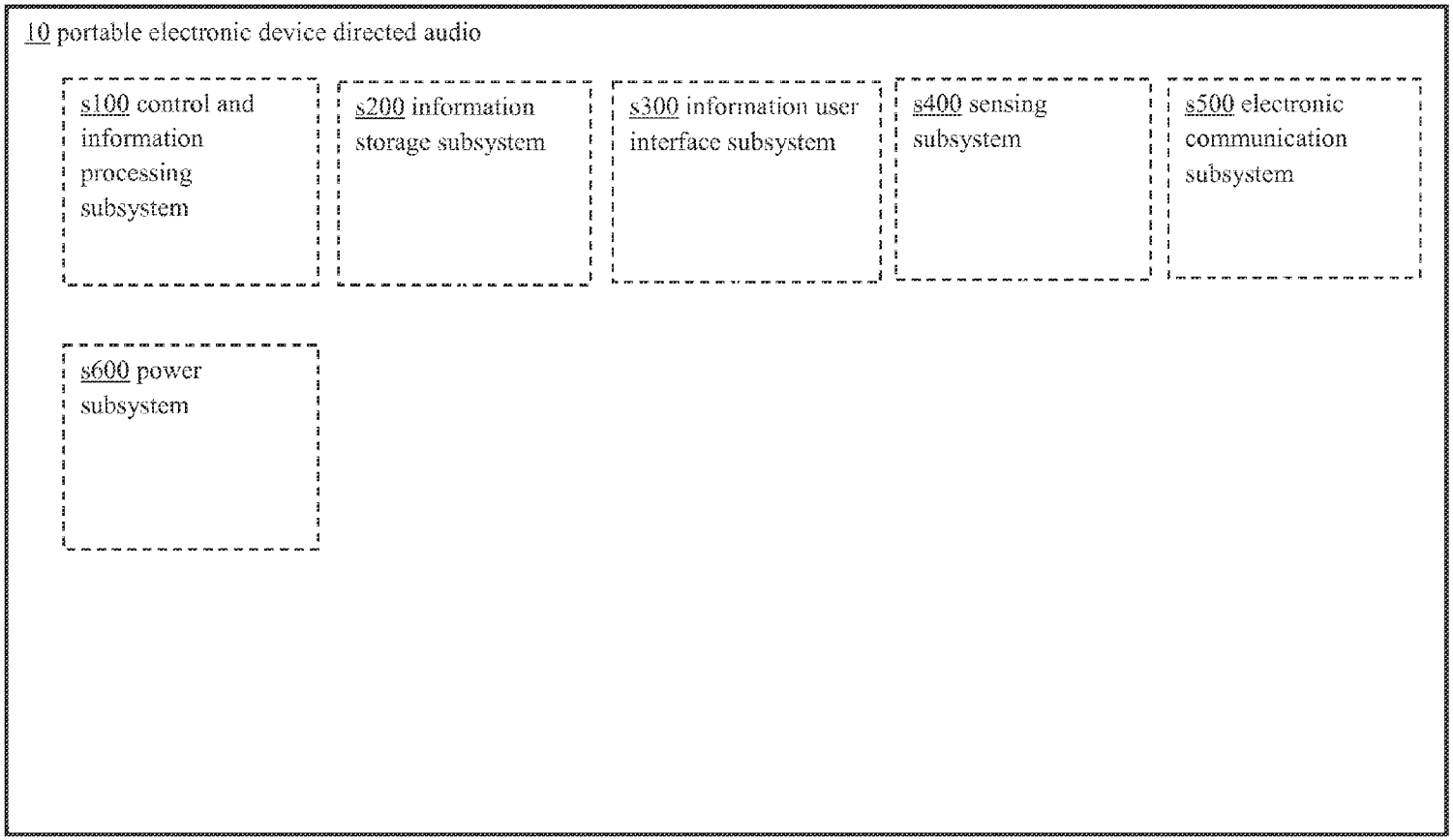
FIG. 25 is a block diagram depicting an exemplary implementation of the portable electronic device directed audio 10 of FIG. 1 including exemplary subsystems.

An exemplary version of the portable electronic device directed audio 10 is shown in FIG. 25 to optionally include various subsystems such as control and information processing subsystem s100, information storage subsystem s200, information user interface subsystem s300, sensing subsystem s400, electronic communication subsystem s500, and power subsystem s600.

Figure 26:
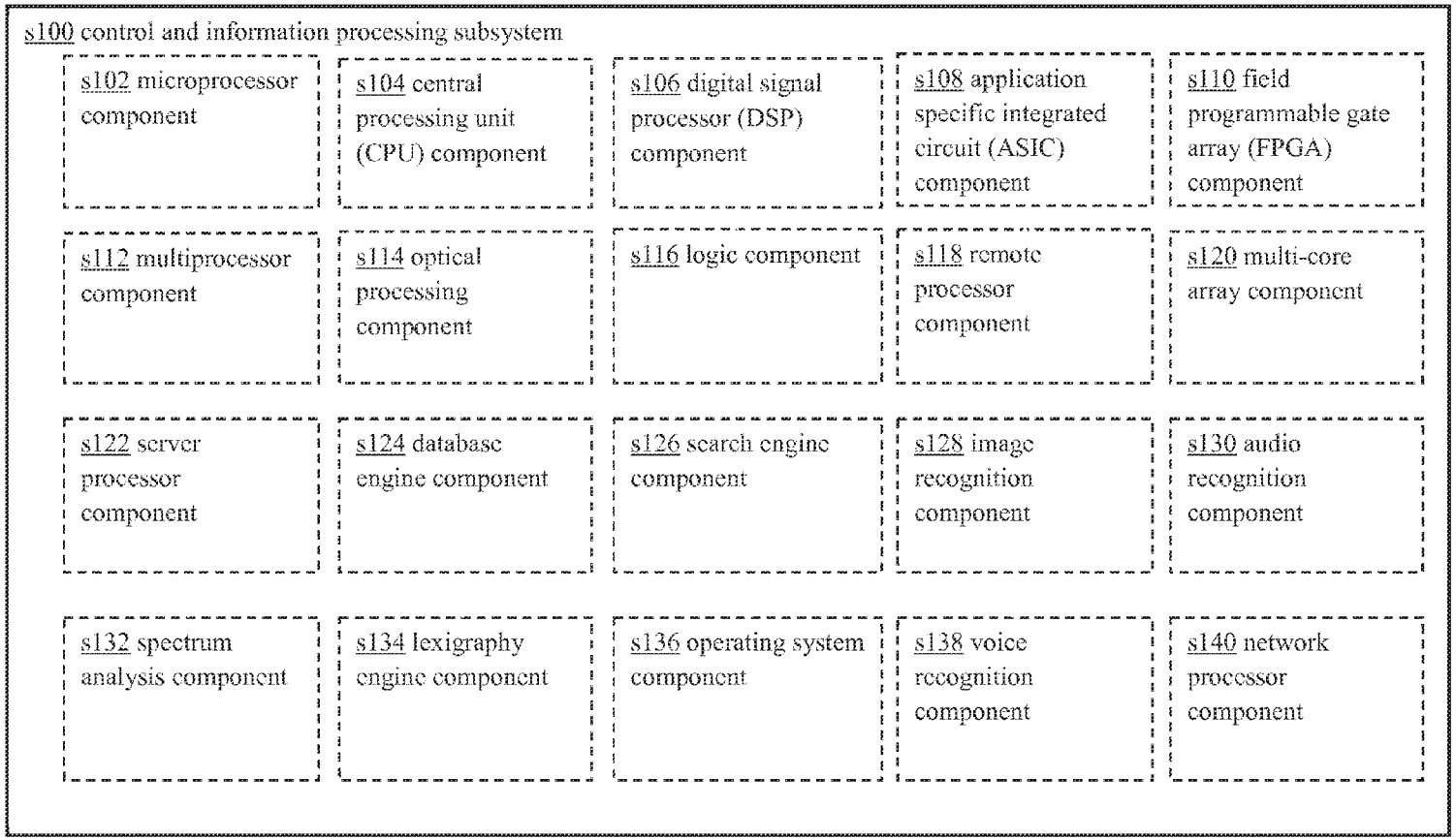
FIG. 26 is a block diagram depicting a control and information processing subsystem s100 of an exemplary implementation of the portable electronic device directed audio 10 of FIG. 1.

An exemplary implementation of the control and information processing subsystem s100 is shown in FIG. 26 to optionally include various components such as microprocessor component s102, central processing unit (CPU) component s104, digital signal processor (DSP) component s106, application specific integrated circuit (ASIC) component s108, field programmable gate array (FPGA) component s110, multiprocessor component s112, optical processing component s114, logic component s116, remote processor component s118, multi-core array component s120, server processor component s122, database engine component s124, search engine component s126, image recognition component s128, audio recognition component s130, spectrum analysis component s132, lexigraphy engine component s134, operating system component s136, voice recognition component s138, and network processor component s140.

Figure 27:
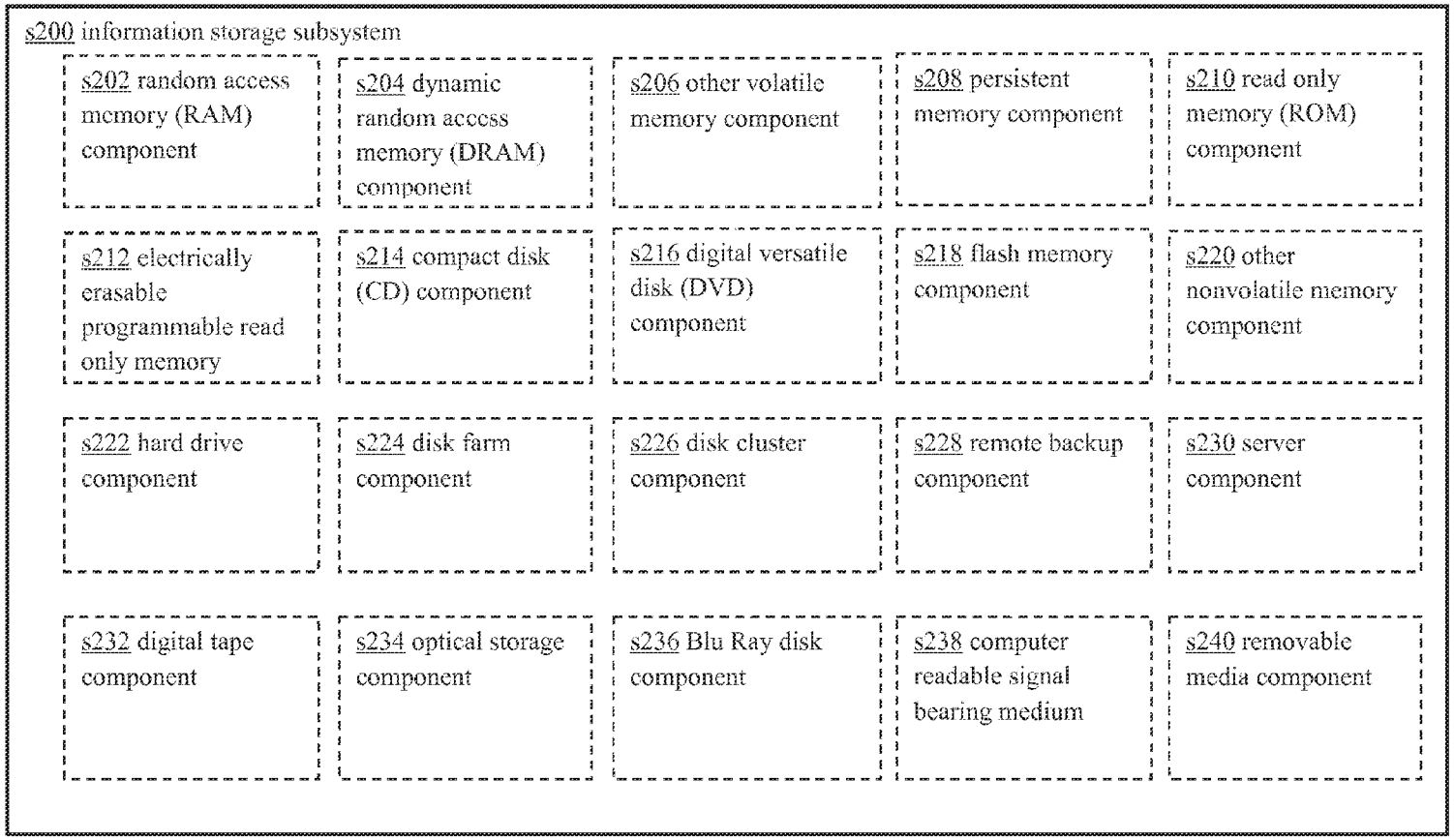
FIG. 27 is a block diagram depicting an information storage subsystem s200 of an exemplary implementation of the portable electronic device directed audio 10 of FIG. 1.

An exemplary implementation of the information storage subsystem s200 is shown in FIG. 27 to optionally include various components such as random access memory (RAM) component s202, dynamic random access memory (DRAM) component s204, other volatile memory component s206, persistent memory component s208, read only memory (ROM) component s210, electrically erasable programmable read only memory (EEPROM) component s212, compact disk (CD) component s214, digital versatile disk (DVD) component s216, flash memory component s218, other nonvolatile memory component s220, hard drive component s222, disk farm component s224, disk cluster component s226, remote backup component s228, server component s230, digital tape component s232, optical storage component s234, Blu Ray disk component s236, computer readable signal bearing medium s238, and removable media component s240.

Figure 28:
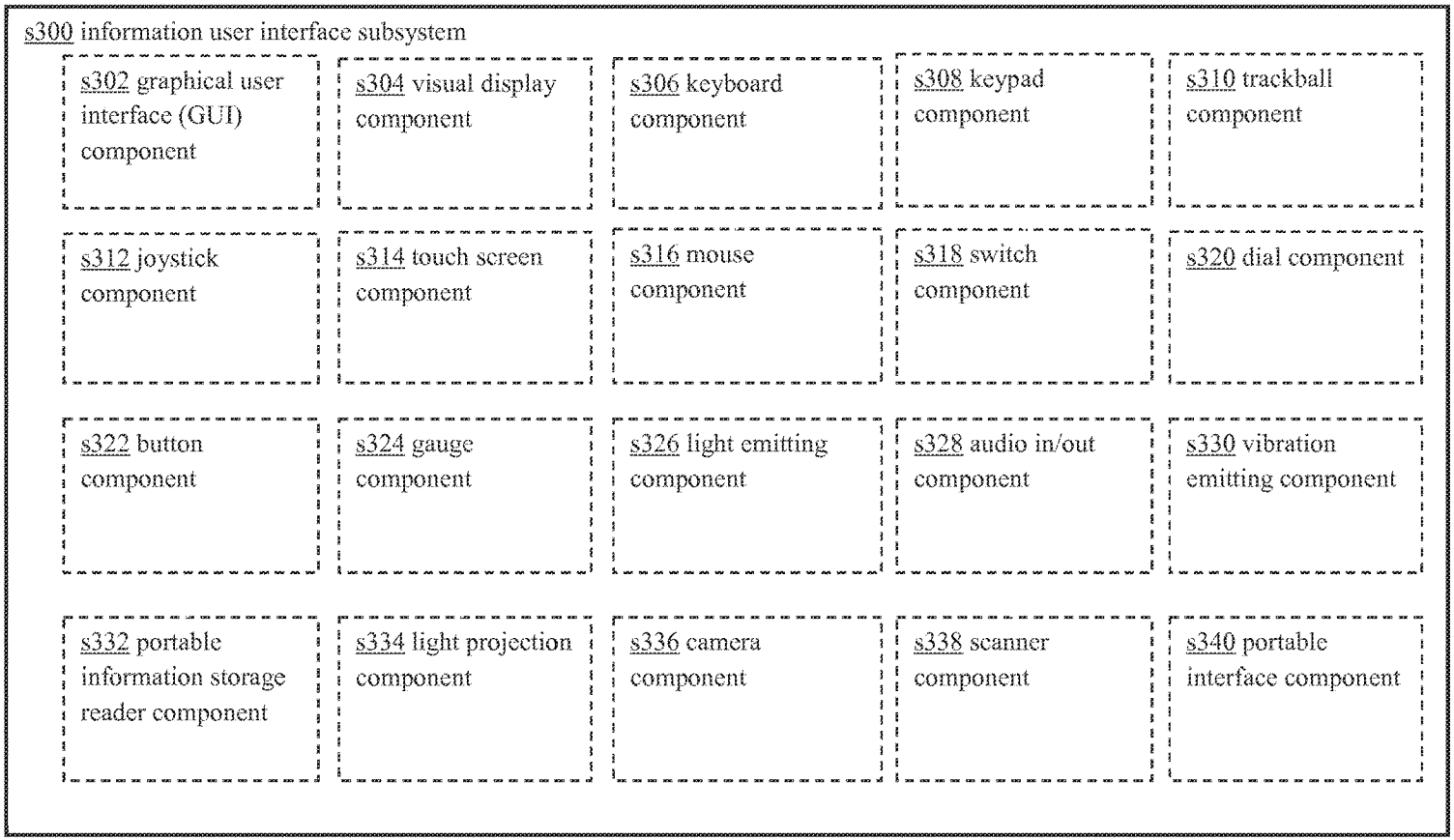
FIG. 28 is a block diagram depicting an information user interface subsystem s300 of an exemplary implementation of the portable electronic device directed audio 10 of FIG. 1.

An exemplary implementation of the information user interface subsystem s300 is shown in FIG. 28 to optionally include various components such as graphical user interface (GUI) component s302, visual display component s304, keyboard component s306, keypad component s308, trackball component s310, joystick component s312, touch screen component s314, mouse component s316, switch component s318, dial component s320, button component s322, gauge component s324, light emitting component s326, audio in/out component s328, vibration emitting component s330, portable information storage reader component s332, light projection component s334, camera component s336, scanner component s338, and portable interface component s340.

Figure 29:
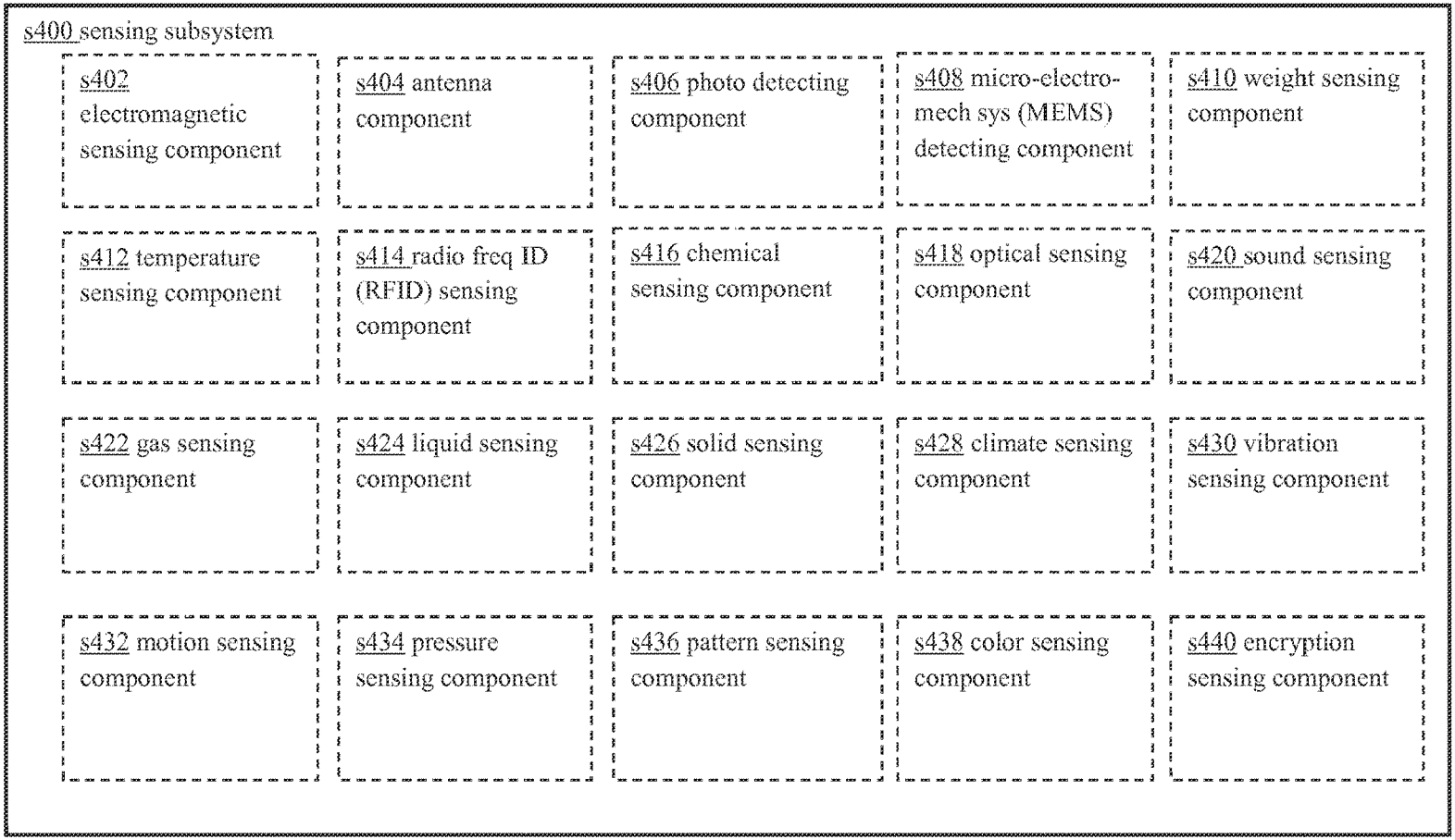
FIG. 29 is a block diagram depicting a sensing subsystem s400 of an exemplary implementation of the portable electronic device directed audio 10 of FIG. 1.

An exemplary implementation of the sensing subsystem s400 is shown in FIG. 29 to optionally include various components such as electromagnetic sensing component s402, antenna component s404, photo detecting component s406, micro-electro-mech sys (MEMS) detecting component s408, weight sensing component s410, temperature sensing component s412, radio freq ID (RFID) sensing component s414, chemical sensing component s416, optical sensing component s418, sound sensing component s420, gas sensing component s422, liquid sensing component s424, solid sensing component s426, climate sensing component s428, vibration sensing component s430, motion sensing component s432, pressure sensing component s434, pattern sensing component s436, color sensing component s438, and encryption sensing component s440.

Figure 30:
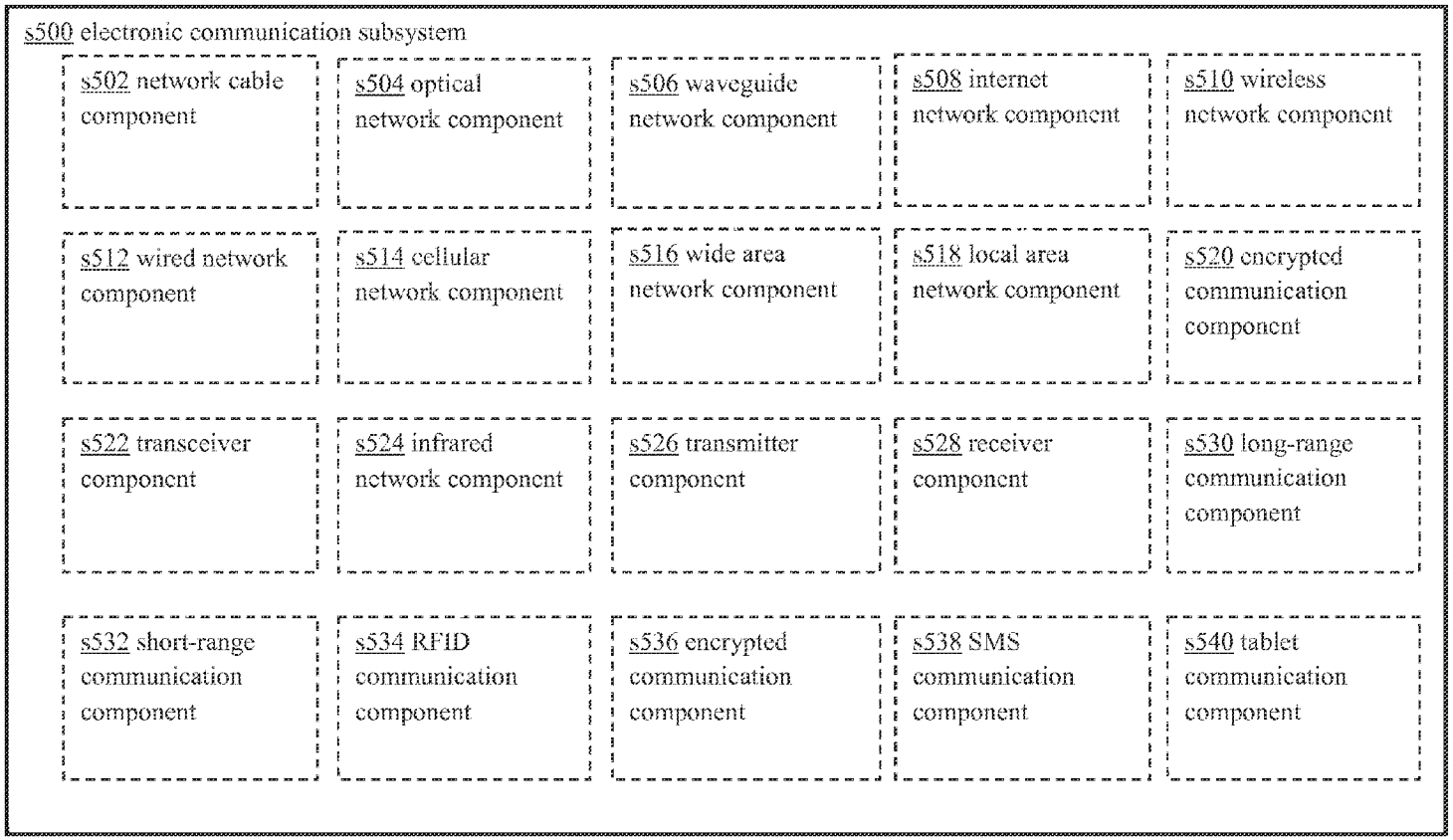
FIG. 30 is a block diagram depicting an electronic communication subsystem s500 of an exemplary implementation of the portable electronic device directed audio 10 of FIG. 1.

An exemplary implementation of the electronic communication subsystem s500 is shown in FIG. 30 to optionally include various components such as network cable component s502, optical network component s504, waveguide network component s506, internet network component s508, wireless network component s510, wired network component s512, cellular network component s514, wide area network component s516, local area network component s518, encrypted communication component s520, transceiver component s522, infrared network component s524, transmitter component s526, receiver component s528, receiver component s528, long-range communication component s530, short-range communication component s532, RFID communication component s534, encrypted communication component s536, SMS communication component s538, and tablet communication component s540.

Figure 31:
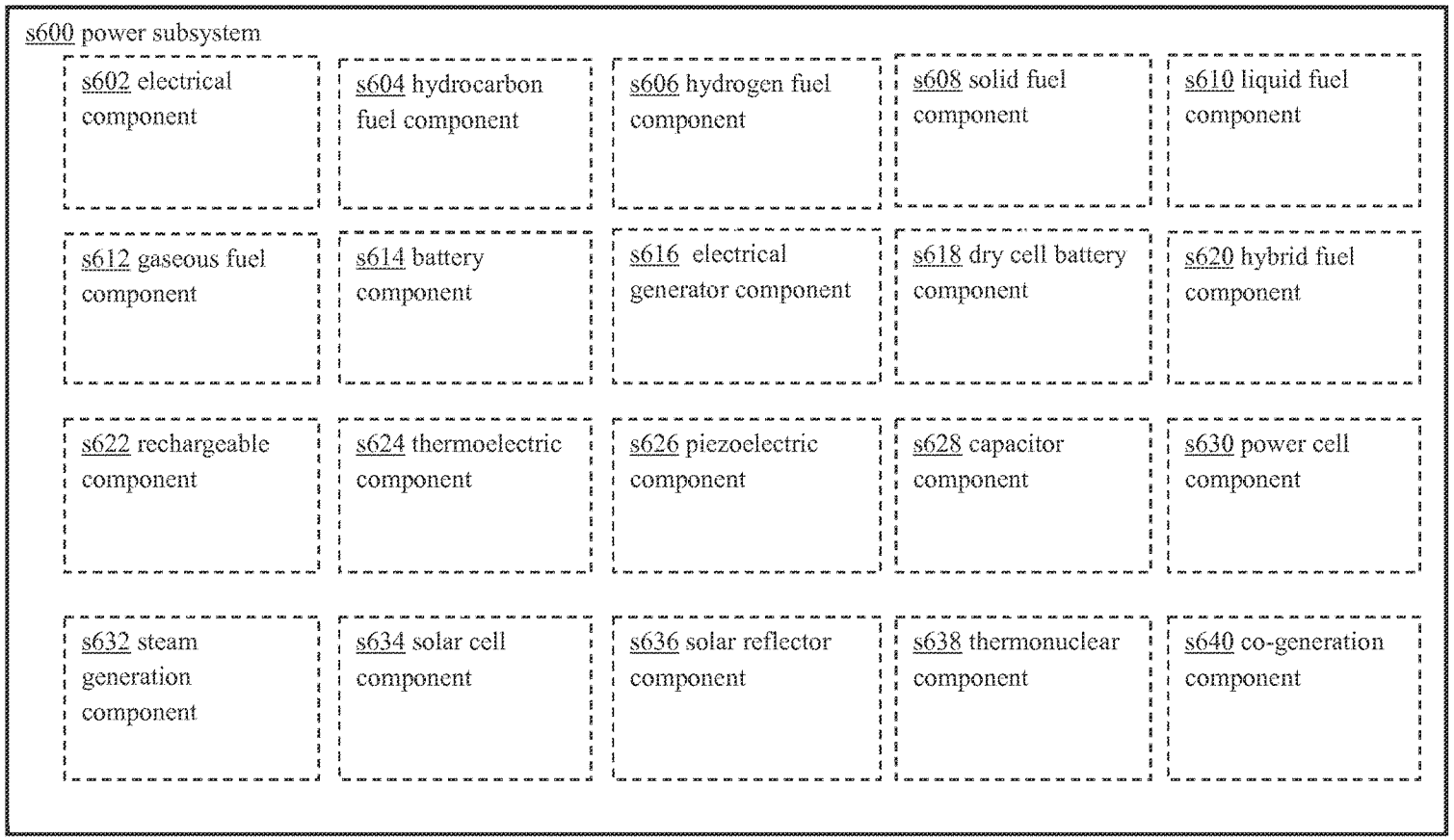
FIG. 31 is a block diagram depicting a power subsystem s600 of an exemplary implementation of the portable electronic device directed audio 10 of FIG. 1.

An exemplary implementation of the power subsystem s600 is shown in FIG. 31 to optionally include various components such as electrical component s602, hydrocarbon fuel component s604, hydrogen fuel component s606, solid fuel component s608, liquid fuel component s610, gaseous fuel component s612, battery component s614, battery component s622, battery component s624, battery component s626, battery component s628, power cell component s630, steam generation component s632, solar cell component s634, solar reflector component s636, thermonuclear component s638, and co-generation component s640.

Figure 32:
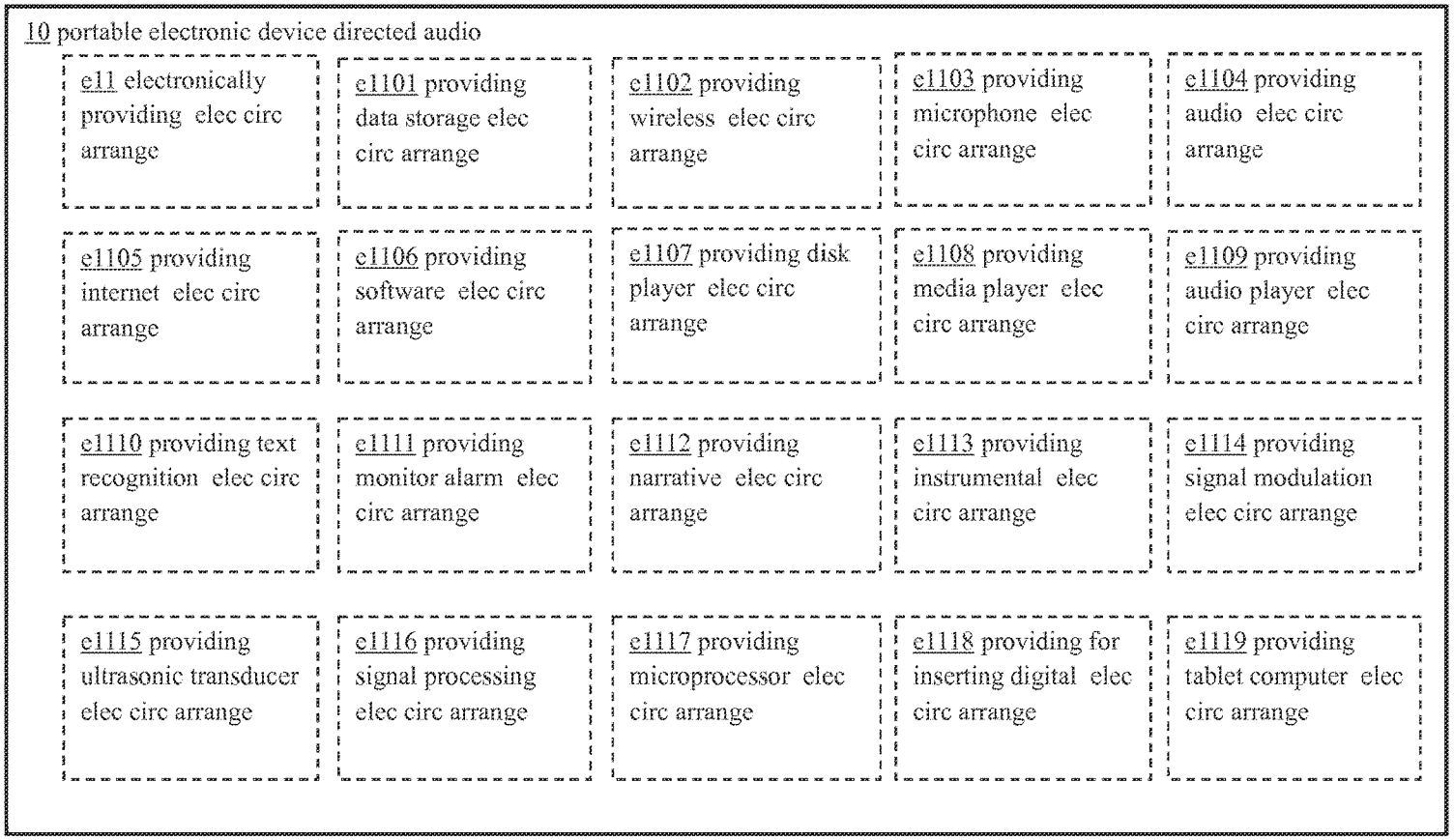
FIG. 32 is a block diagram depicting one or more exemplary electrical circuitry arrangements of the portable electronic device directed audio 10 of FIG. 1.

Implementations involve different combinations (otherwise known as "electrical circuitry arrangements") of components from the subsystems of the portable electronic device directed audio 10. Exemplary depictions of some of these electrical circuitry arrangements are shown in FIG. 32 to include electronically providing electrical circuitry arrangement e11, providing data storage electrical circuitry arrangement e1101, providing wireless electrical circuitry arrangement e1102, providing microphone electrical circuitry arrangement e1103, providing audio electrical circuitry arrangement e1104, providing internet electrical circuitry arrangement e1105, providing software electrical circuitry arrangement e1106, providing disk player electrical circuitry arrangement e1107, providing media player electrical circuitry arrangement e1108, providing audio player electrical circuitry arrangement e1109, providing text recognition electrical circuitry arrangement e1110, providing monitor alarm electrical circuitry arrangement e1111, providing narrative electrical circuitry arrangement e1112, providing instrumental electrical circuitry arrangement e1113, providing signal modulation electrical circuitry arrangement e1114, providing ultrasonic transducer electrical circuitry arrangement e1115, providing signal processing electrical circuitry arrangement e1116, providing microprocessor electrical circuitry arrangement e1117, providing for inserting digital electrical circuitry arrangement e1118, and providing tablet computer electrical circuitry arrangement e1119.

Figure 33:
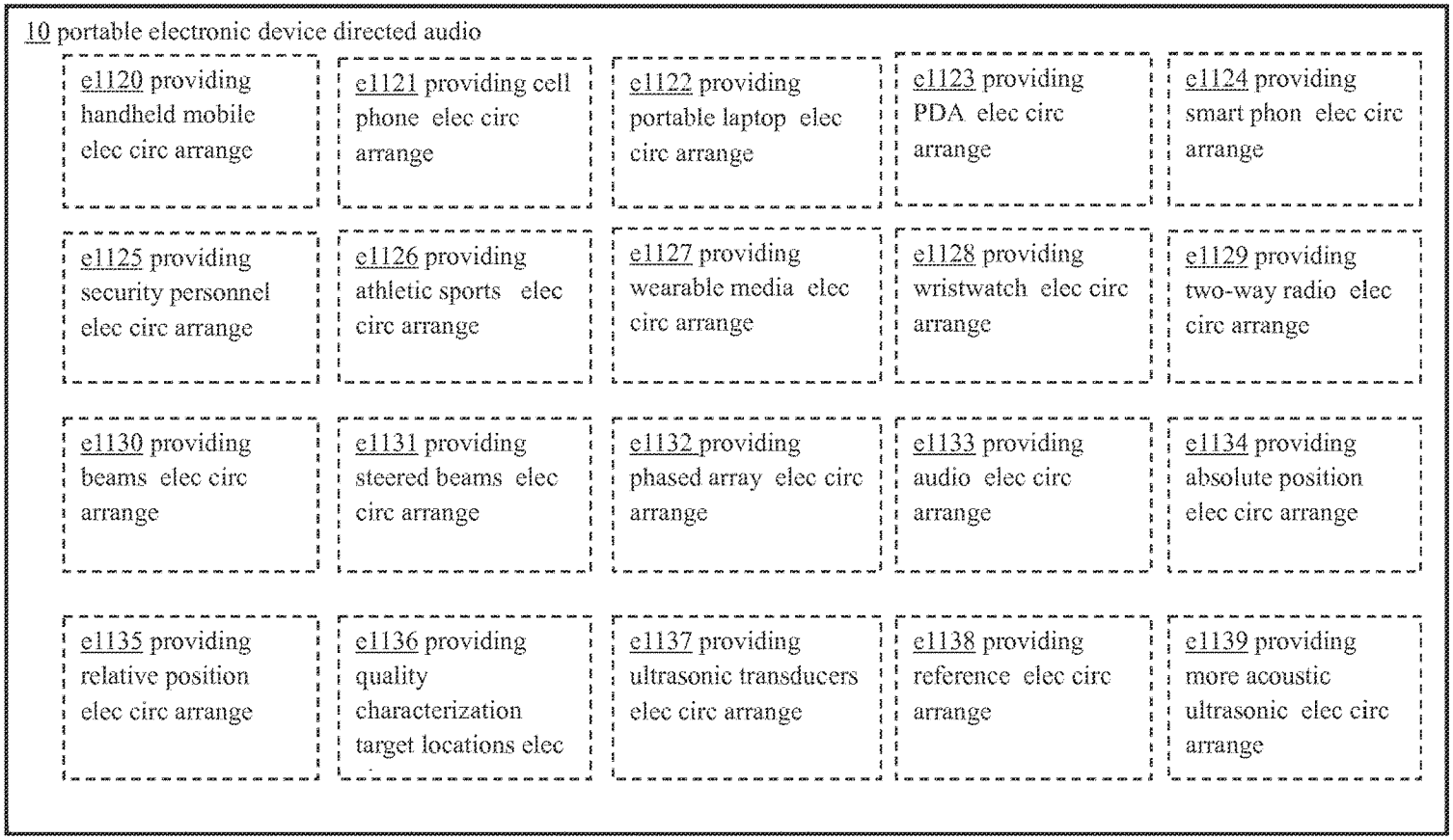
FIG. 33 is a block diagram depicting one or more exemplary electrical circuitry arrangements of the portable electronic device directed audio 10 of FIG. 1.

Some of these electrical circuitry arrangements are depicted in FIG. 33 to include providing handheld mobile electrical circuitry arrangement e1120, providing cell phone electrical circuitry arrangement e1121, providing portable laptop electrical circuitry arrangement e1122, providing PDA electrical circuitry arrangement e1123, providing smart phone electrical circuitry arrangement e1124, providing security personnel electrical circuitry arrangement e1125, providing athletic sports electrical circuitry arrangement e1126, providing wearable media electrical circuitry arrangement e1127, providing wristwatch electrical circuitry arrangement e1128, providing two-way radio electrical circuitry arrangement e1129, providing beams electrical circuitry arrangement e1130, providing steered beams electrical circuitry arrangement e113, providing phased array electrical circuitry arrangement e1132, providing audio electrical circuitry arrangement e1133, providing absolute position electrical circuitry arrangement e1134, providing relative position electrical circuitry arrangement e1135, providing quality characterization target locations electrical circuitry arrangement e1136, providing ultrasonic transducers electrical circuitry arrangement e1137, providing reference electrical circuitry arrangement e1138, and providing more acoustic ultrasonic electrical circuitry arrangement e1139.

Figure 34:
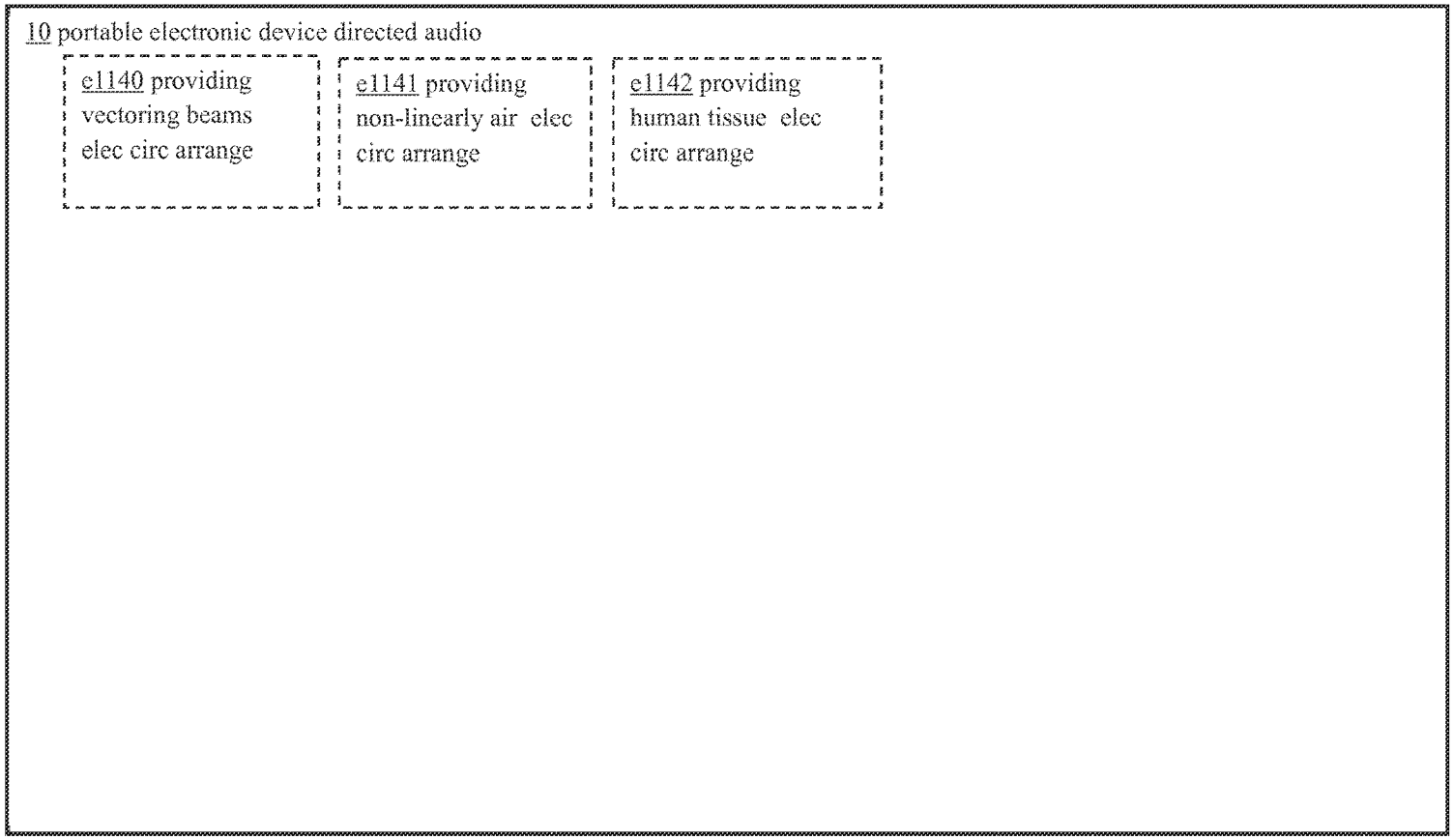
FIG. 34 is a block diagram depicting one or more exemplary electrical circuitry arrangements of the portable electronic device directed audio 10 of FIG. 1.

Some of these electrical circuitry arrangements are depicted in FIG. 34 to include providing vectoring beams electrical circuitry arrangement e1140, providing non-linearly air electrical circuitry arrangement e1141, and providing human tissue electrical circuitry arrangement e1142.

Figure 35:
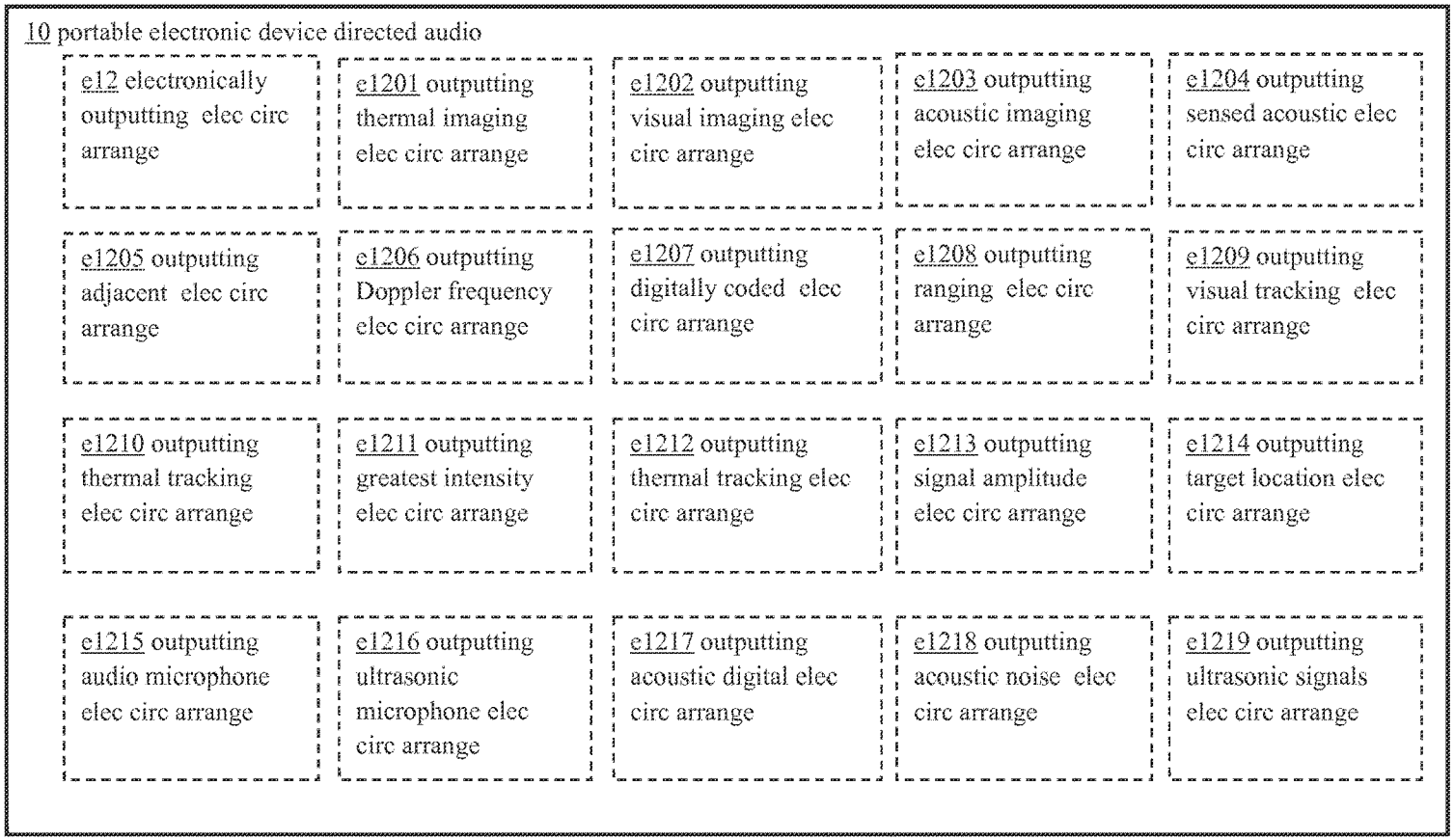
FIG. 35 is a block diagram depicting one or more exemplary electrical circuitry arrangements of the portable electronic device directed audio 10 of FIG. 1.

Some of these electrical circuitry arrangements are depicted in FIG. 35 to include electronically outputting electrical circuitry arrangement e12, outputting thermal imaging electrical circuitry arrangement e1201, outputting visual imaging electrical circuitry arrangement e1202, outputting acoustic imaging electrical circuitry arrangement e1203, outputting sensed acoustic electrical circuitry arrangement e1204, outputting adjacent electrical circuitry arrangement e1205, outputting Doppler frequency electrical circuitry arrangement e1206, outputting digitally coded electrical circuitry arrangement e1207, outputting ranging electrical circuitry arrangement e1208, outputting visual tracking electrical circuitry arrangement e1209, outputting thermal tracking electrical circuitry arrangement e1210, outputting greatest intensity electrical circuitry arrangement e1211, and outputting thermal tracking electrical circuitry arrangement e1212, outputting signal amplitude electrical circuitry arrangement e1213, outputting target location electrical circuitry arrangement e1214, outputting audio microphone electrical circuitry arrangement e1215, outputting ultrasonic microphone electrical circuitry arrangement e1216, outputting acoustic digital electrical circuitry arrangement e1217, outputting acoustic noise electrical circuitry arrangement e1218, and outputting ultrasonic signals electrical circuitry arrangement e1219.

Figure 36:
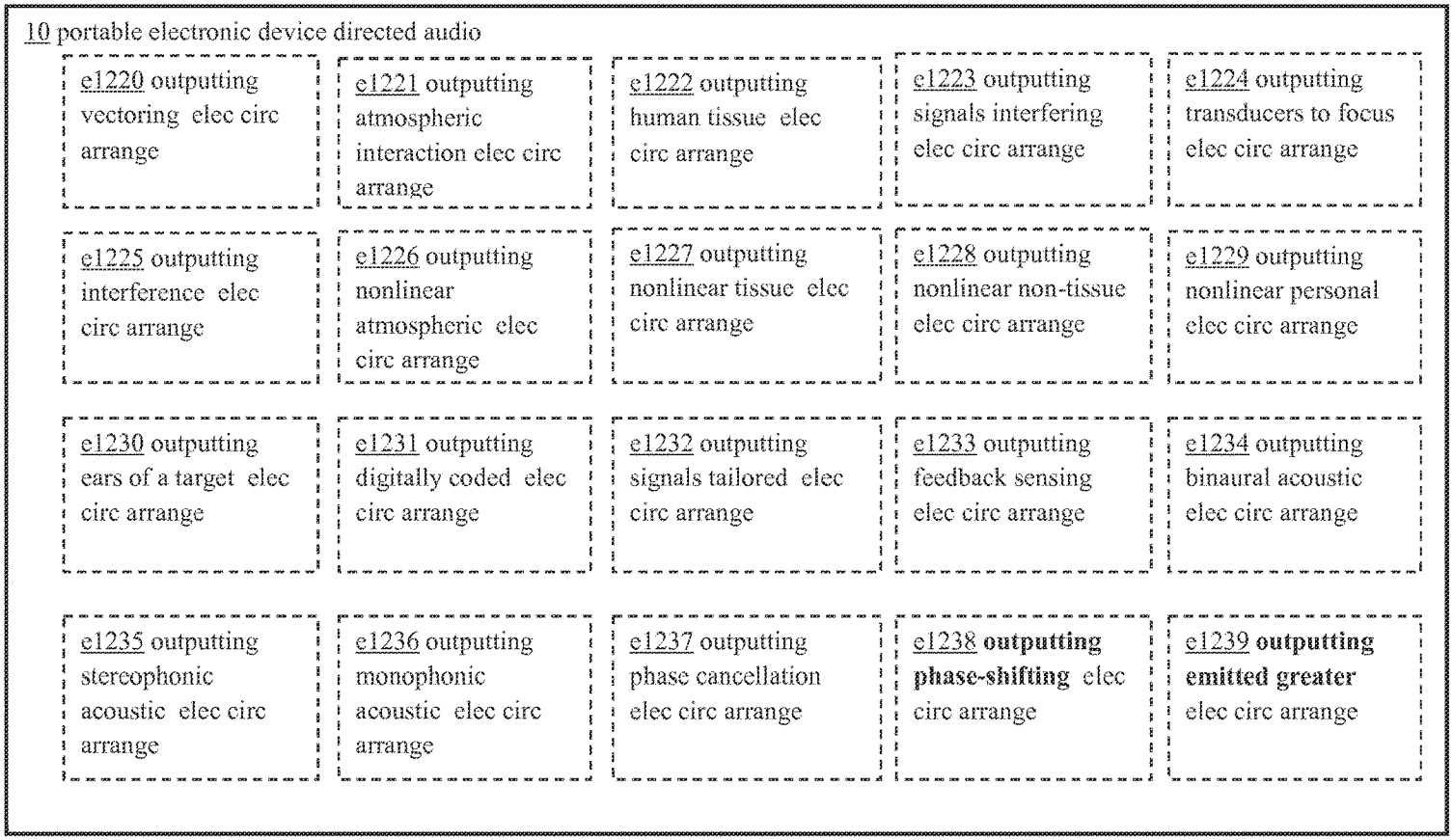
FIG. 36 is a block diagram depicting one or more exemplary electrical circuitry arrangements of the portable electronic device directed audio 10 of FIG. 1.

Some of these electrical circuitry arrangements are depicted in FIG. 36 to include outputting vectoring electrical circuitry arrangement e1220, outputting atmospheric interaction electrical circuitry arrangement e1221, outputting human tissue electrical circuitry arrangement e1222, outputting signals interfering electrical circuitry arrangement e1223, outputting transducers to focus electrical circuitry arrangement e1224, outputting interference electrical circuitry arrangement e1225, outputting nonlinear atmospheric electrical circuitry arrangement e1226, outputting nonlinear tissue electrical circuitry arrangement e1227, outputting nonlinear non-tissue electrical circuitry arrangement e1228, outputting nonlinear personal electrical circuitry arrangement e1229, outputting binaural acoustic electrical circuitry arrangement e1234, outputting digitally coded electrical circuitry arrangement e1231, outputting signals tailored electrical circuitry arrangement e1232, outputting feedback sensing electrical circuitry arrangement e1233, outputting binaural acoustic electrical circuitry arrangement e1234, outputting stereophonic acoustic electrical circuitry arrangement e1235, outputting monophonic acoustic electrical circuitry arrangement e1236, outputting phase cancellation electrical circuitry arrangement e1237, outputting phase-shifting electrical circuitry arrangement e1238 and outputting emitted greater electrical circuitry arrangement e1239.

Figure 37:
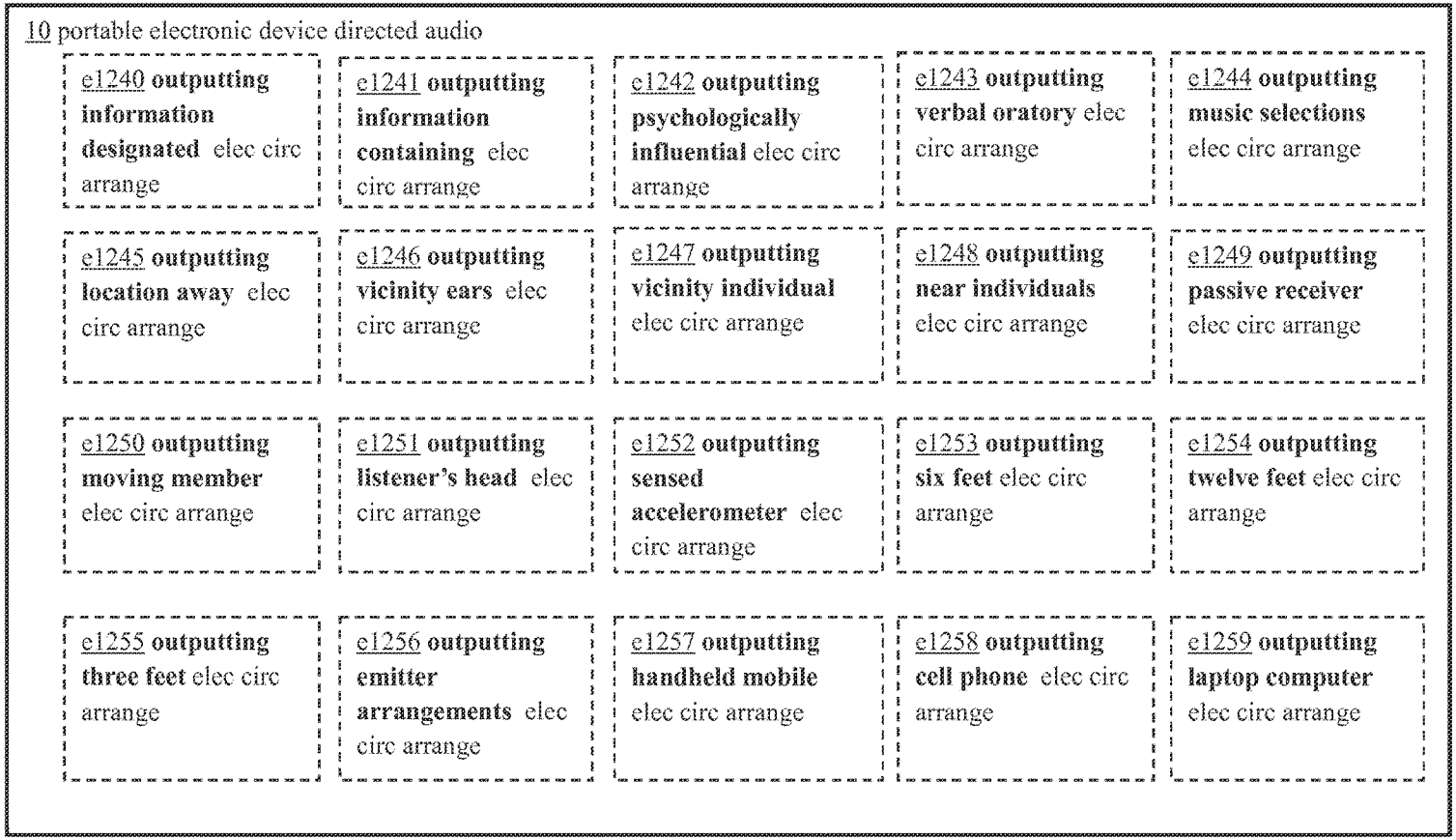
FIG. 37 is a block diagram depicting one or more exemplary electrical circuitry arrangements of the portable electronic device directed audio 10 of FIG. 1.

Some of these electrical circuitry arrangements are depicted in FIG. 37 to include outputting information designated electrical circuitry arrangement e1240, outputting information containing electrical circuitry arrangement e1241, outputting psychologically influential electrical circuitry arrangement e1242, outputting verbal oratory electrical circuitry arrangement e1243, outputting music selections electrical circuitry arrangement e1244, outputting location away electrical circuitry arrangement e1245, outputting vicinity ears electrical circuitry arrangement e1246, outputting vicinity individual electrical circuitry arrangement e1247, outputting near individuals electrical circuitry arrangement e1248, outputting passive receiver electrical circuitry arrangement e1249, outputting moving member electrical circuitry arrangement e1250, outputting listener's head electrical circuitry arrangement e1251, outputting sensed accelerometer electrical circuitry arrangement e1252, outputting six feet electrical circuitry arrangement e1253, outputting twelve feet electrical circuitry arrangement e1254, outputting three feet electrical circuitry arrangement e1255, outputting emitter arrangements electrical circuitry arrangement e1256, outputting handheld mobile electrical circuitry arrangement e1257, outputting cell phone electrical circuitry arrangement e1258 and outputting laptop computer electrical circuitry arrangement e1259.

Figure 38:
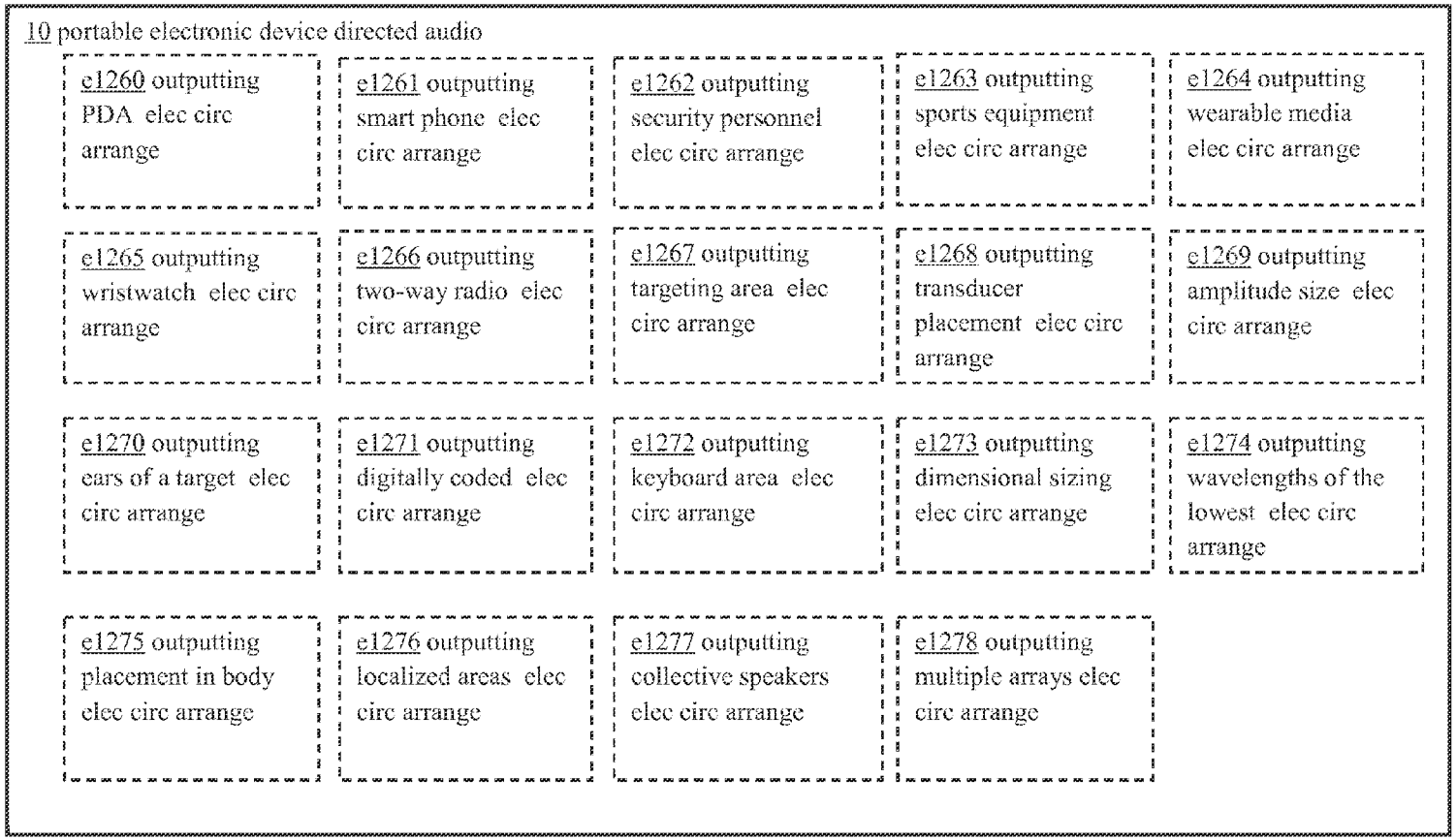
FIG. 38 is a block diagram depicting one or more exemplary electrical circuitry arrangements of the portable electronic device directed audio 10 of FIG. 1.

Some of these electrical circuitry arrangements are depicted in FIG. 38 to include outputting PDA electrical circuitry arrangement e1260, outputting smart phone electrical circuitry arrangement e1261, outputting security personnel electrical circuitry arrangement e1262, outputting sports equipment electrical circuitry arrangement e1263, outputting wearable media electrical circuitry arrangement e1264, outputting wristwatch electrical circuitry arrangement e1265, outputting two-way radio electrical circuitry arrangement e1266, outputting targeting area electrical circuitry arrangement e1267, outputting transducer placement electrical circuitry arrangement e1268, outputting amplitude size electrical circuitry arrangement e1269, outputting along vicinity electrical circuitry arrangement e1270, outputting display screen electrical circuitry arrangement e1271, outputting keyboard area electrical circuitry arrangement e1272, outputting dimensional sizing electrical circuitry arrangement e1273, outputting wavelengths of the lowest electrical circuitry arrangement e1274, outputting placement in body electrical circuitry arrangement e1275, outputting localized areas electrical circuitry arrangement e1276, outputting collective speakers electrical circuitry arrangement e1277, and outputting multiple arrays electrical circuitry arrangement e1278.

In implementations one or more instructions are stored and/or otherwise borne in various subsystems, components, and/or accessories of the portable electronic device directed audio 10 such as being borne in a non-transitory signal bearing medium of information storage subsystem s200. One or more exemplary instructions depicted in FIG. 39 as being borne in an exemplary version of a non-transitory signal bearing medium of information storage subsystem s200 include one or more electronically providing instructions i11, one or more providing data storage instructions i1101, one or more providing wireless instructions i1102, one or more providing microphone instructions i1103, one or more providing audio instructions i1104, one or more providing internet instructions i1105, one or more providing software instructions i1106, one or more providing disk player instructions i1107, one or more providing media player instructions i1108, one or more providing audio player instructions i1109, one or more providing text recognition instructions i1110, one or more providing monitor alarm instructions i1111, one or more providing narrative instructions i1112, one or more providing instrumental instructions i1113, one or more providing signal modulation instructions i1114, one or more providing ultrasonic transducer instructions i1115, one or more providing signal processing instructions i1116, one or more providing microprocessor instructions i1117, one or more providing for inserting digital instructions i1118, and one or more providing tablet computer instructions i1119.

Figure 40:
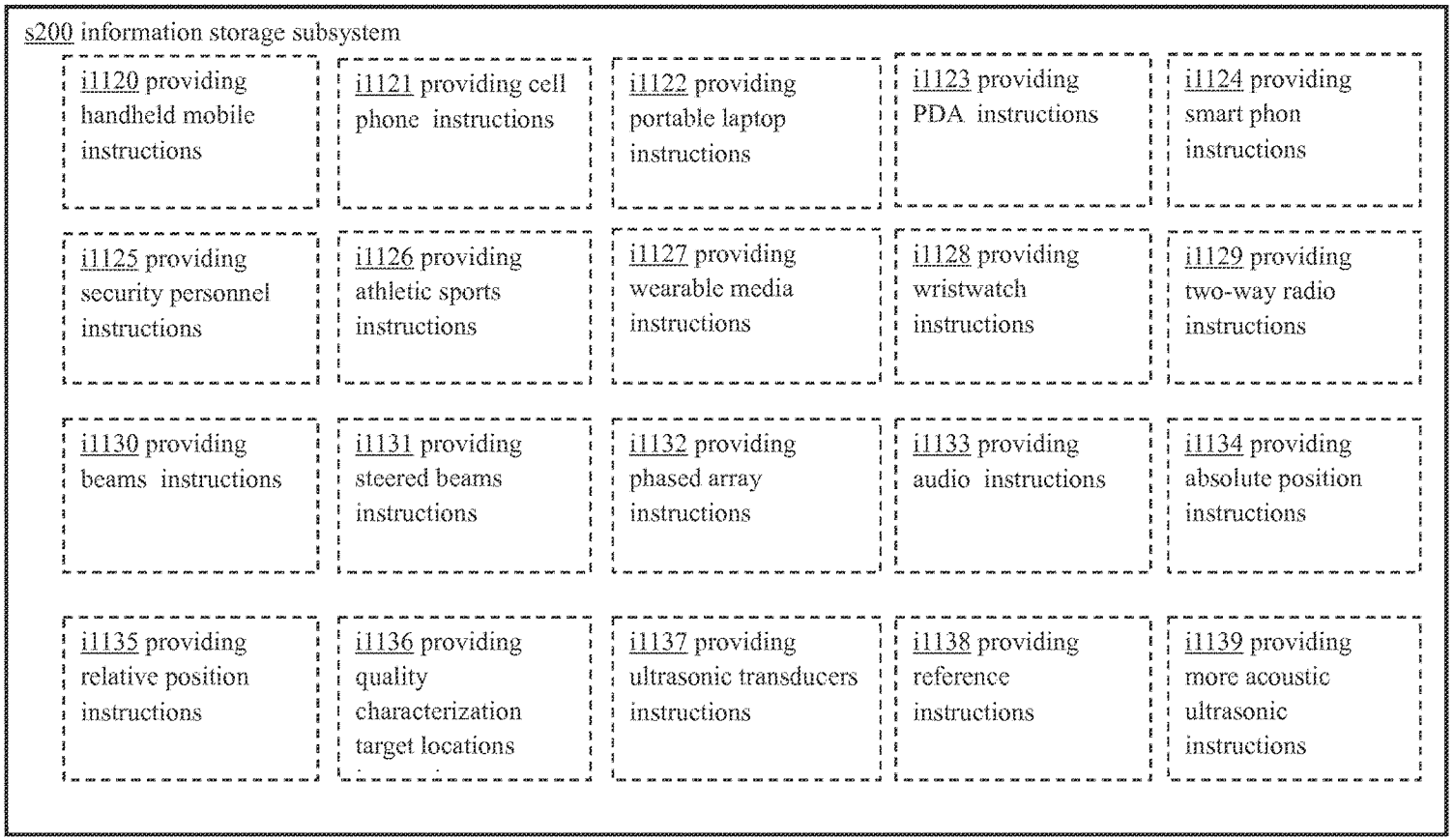
FIG. 40 is a block diagram depicting one or more exemplary instructions of the information storage subsystem s200 of the portable electronic device directed audio 10 of FIG. 1.

One or more exemplary instructions depicted in FIG. 40 as being borne in an exemplary version of a non-transitory signal bearing medium of information storage subsystem s200 include one or more providing handheld mobile instructions i1120, one or more providing cell phone instructions i1121, one or more providing portable laptop instructions i1122, one or more providing PDA instructions i1123, one or more providing smart phone instructions i1124, one or more providing security personnel instructions i1125, one or more providing athletic sports instructions i1126, one or more providing wearable media instructions i1127, one or more providing wristwatch instructions i1128, one or more providing two-way radio instructions i1129, one or more providing beams instructions i1130, one or more providing steered beams instructions i1131, one or more providing phased array instructions i1132, one or more providing audio instructions i1133, one or more providing absolute position instructions i1134, one or more providing relative position instructions i1135, one or more providing quality characterization target locations instructions i1136, one or more providing ultrasonic transducers instructions i1137, one or more providing reference instructions i1138, and one or more providing more acoustic ultrasonic instructions i1139.

Figure 41:
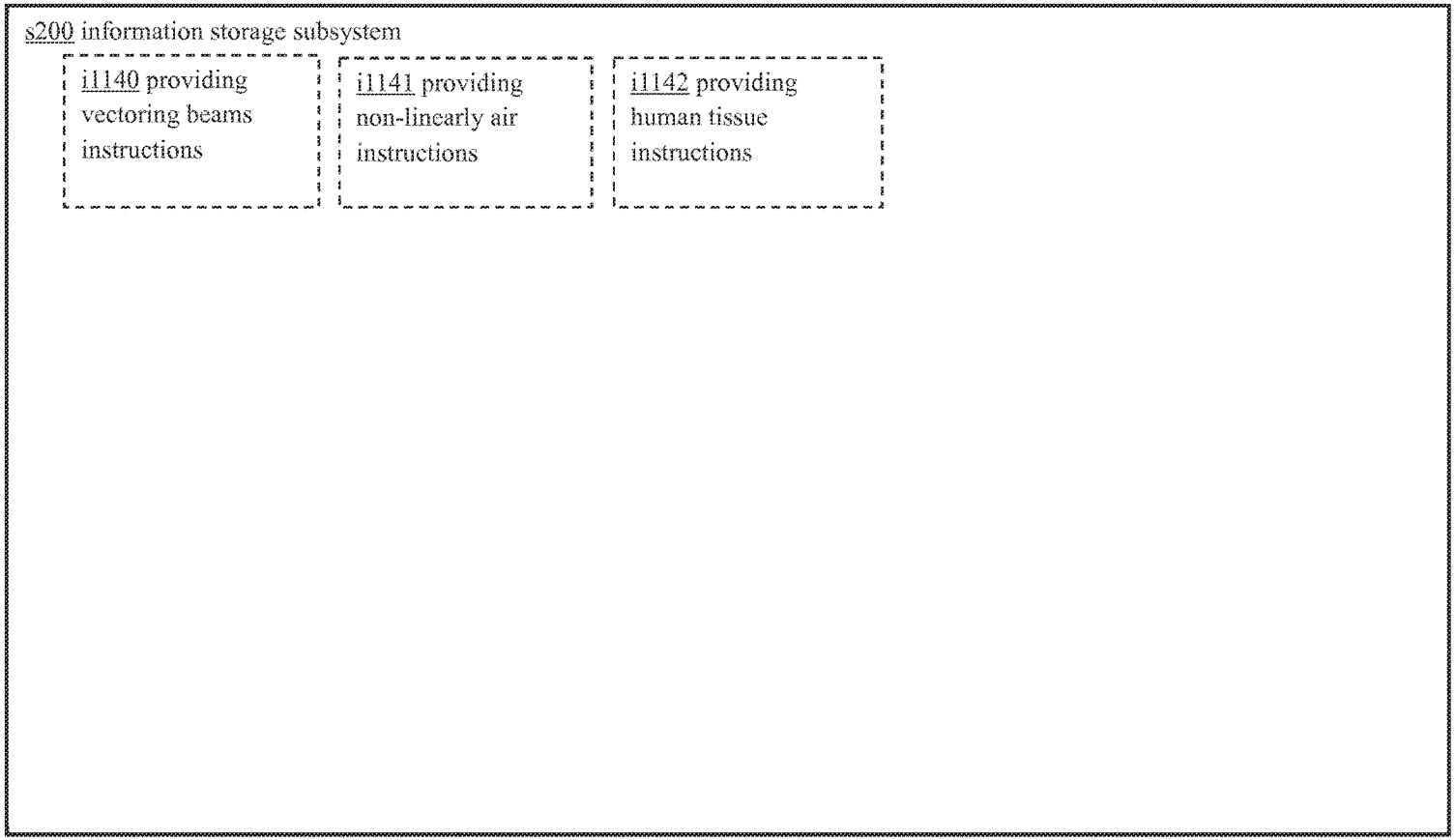
FIG. 41 is a block diagram depicting one or more exemplary instructions of the information storage subsystem s200 of the portable electronic device directed audio 10 of FIG. 1.

One or more exemplary instructions depicted in FIG. 41 as being borne in an exemplary version of a non-transitory signal bearing medium of information storage subsystem s200 include one or more providing vectoring beams instructions i1140, one or more providing non-linearly air instructions i1141, and one or more providing human tissue instructions i1142.

Figure 42:
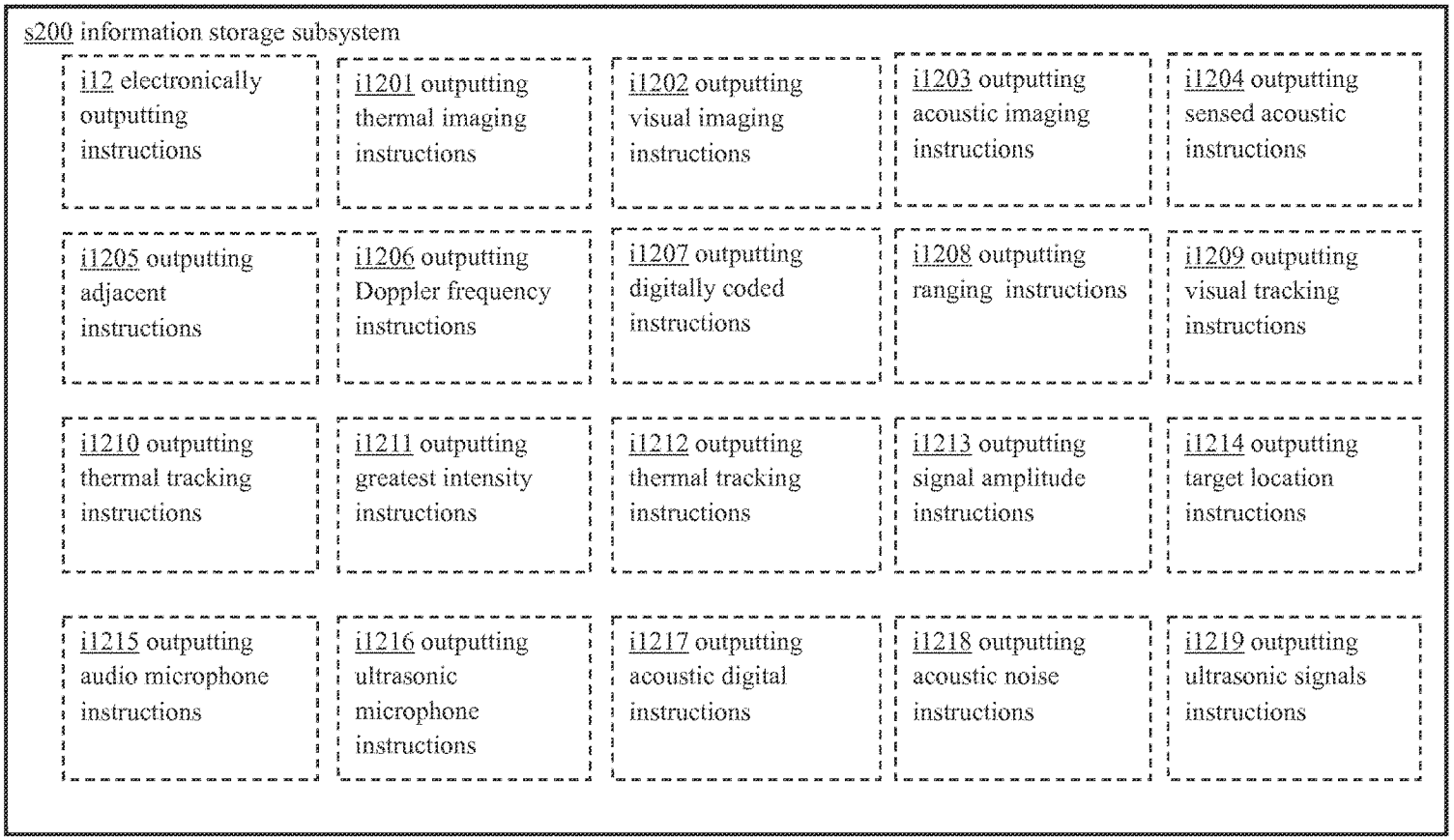
FIG. 42 is a block diagram depicting one or more exemplary instructions of the information storage subsystem s200 of the portable electronic device directed audio 10 of FIG. 1.

One or more exemplary instructions depicted in FIG. 42 as being borne in an exemplary version of a non-transitory signal bearing medium of information storage subsystem s200 include one or more electronically outputting instructions i12, one or more outputting thermal imaging instructions i1201, one or more outputting visual imaging instructions i1202, one or more outputting acoustic imaging instructions i1203, one or more outputting sensed acoustic instructions i1204, one or more outputting adjacent instructions i1205, one or more outputting Doppler frequency instructions i1206, one or more outputting digitally coded instructions i1207, one or more outputting ranging instructions i1208, one or more outputting visual tracking instructions i1209, one or more outputting thermal tracking instructions i1210, one or more outputting greatest intensity instructions i1211, one or more outputting thermal tracking instructions i1212, one or more outputting signal amplitude instructions i1213, one or more outputting target location instructions i1214, one or more outputting audio microphone instructions i1215, one or more outputting ultrasonic microphone instructions i1216, one or more outputting acoustic digital instructions i1217, one or more outputting acoustic noise instructions i1218, and one or more outputting ultrasonic signals instructions i1219.

Figure 43:
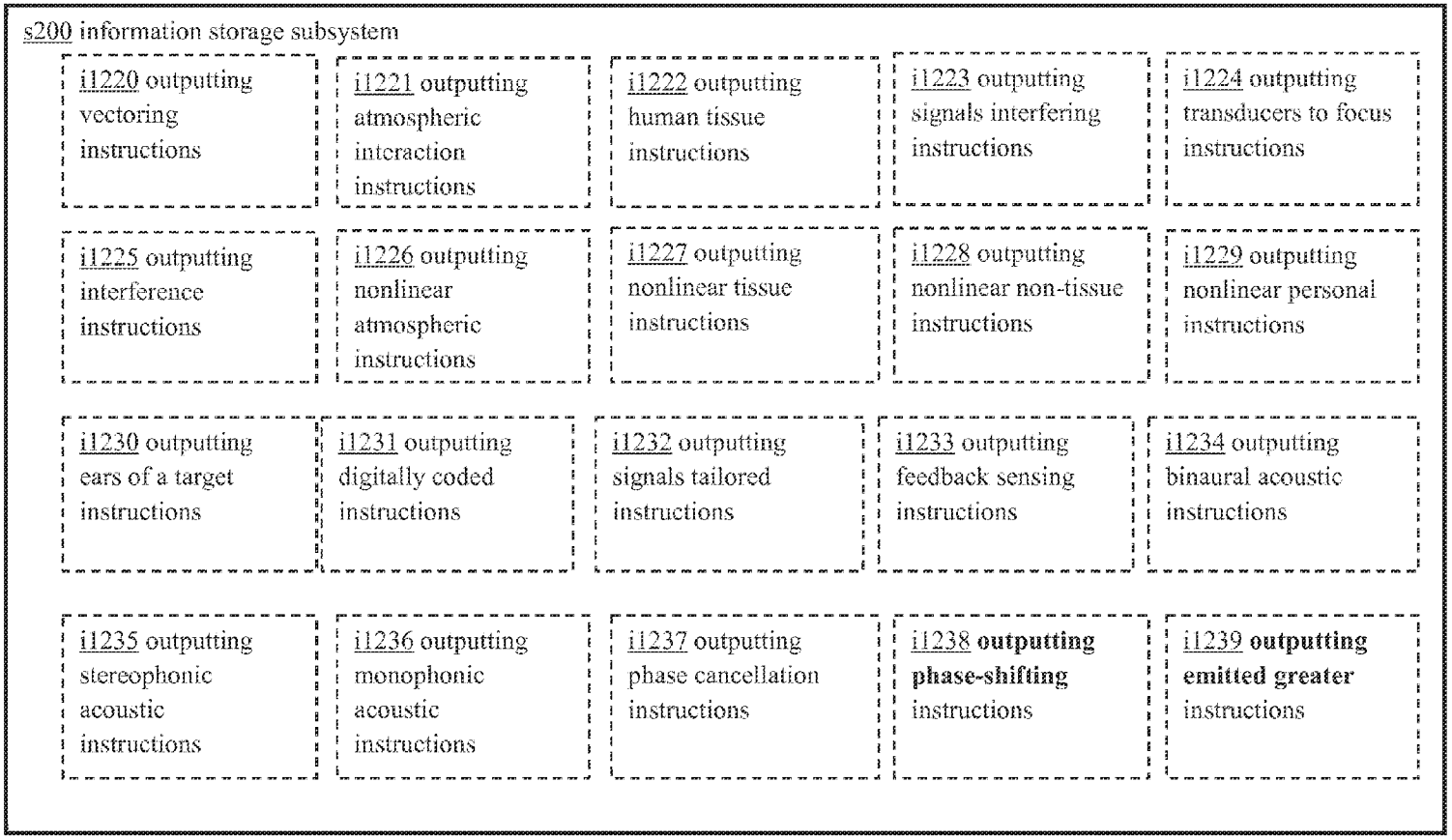
FIG. 43 is a block diagram depicting one or more exemplary instructions of the information storage subsystem s200 of the portable electronic device directed audio 10 of FIG. 1.

One or more exemplary instructions depicted in FIG. 43 as being borne in an exemplary version of a non-transitory signal bearing medium of information storage subsystem s200 include one or more outputting vectoring instructions i1220, one or more outputting atmospheric interaction instructions i1221, one or more outputting human tissue instructions i1222, one or more outputting signals interfering instructions i1223, one or more outputting transducers to focus instructions i1224, one or more outputting interference instructions i1225, one or more outputting nonlinear atmospheric instructions i1226, one or more outputting nonlinear tissue instructions i1227, one or more outputting nonlinear non-tissue instructions i1228, one or more outputting nonlinear personal instructions i1229, one or more outputting binaural acoustic instructions i1234, one or more outputting digitally coded instructions i1231, one or more outputting signals tailored instructions i1232, one or more outputting feedback sensing instructions i1233, one or more outputting binaural acoustic instructions i1234, one or more outputting stereophonic acoustic instructions i1235, one or more outputting monophonic acoustic instructions i1236, one or more outputting phase cancellation instructions i1237, one or more outputting phase-shifting instructions i1238 and one or more outputting emitted greater instructions i1239.

Figure 44:
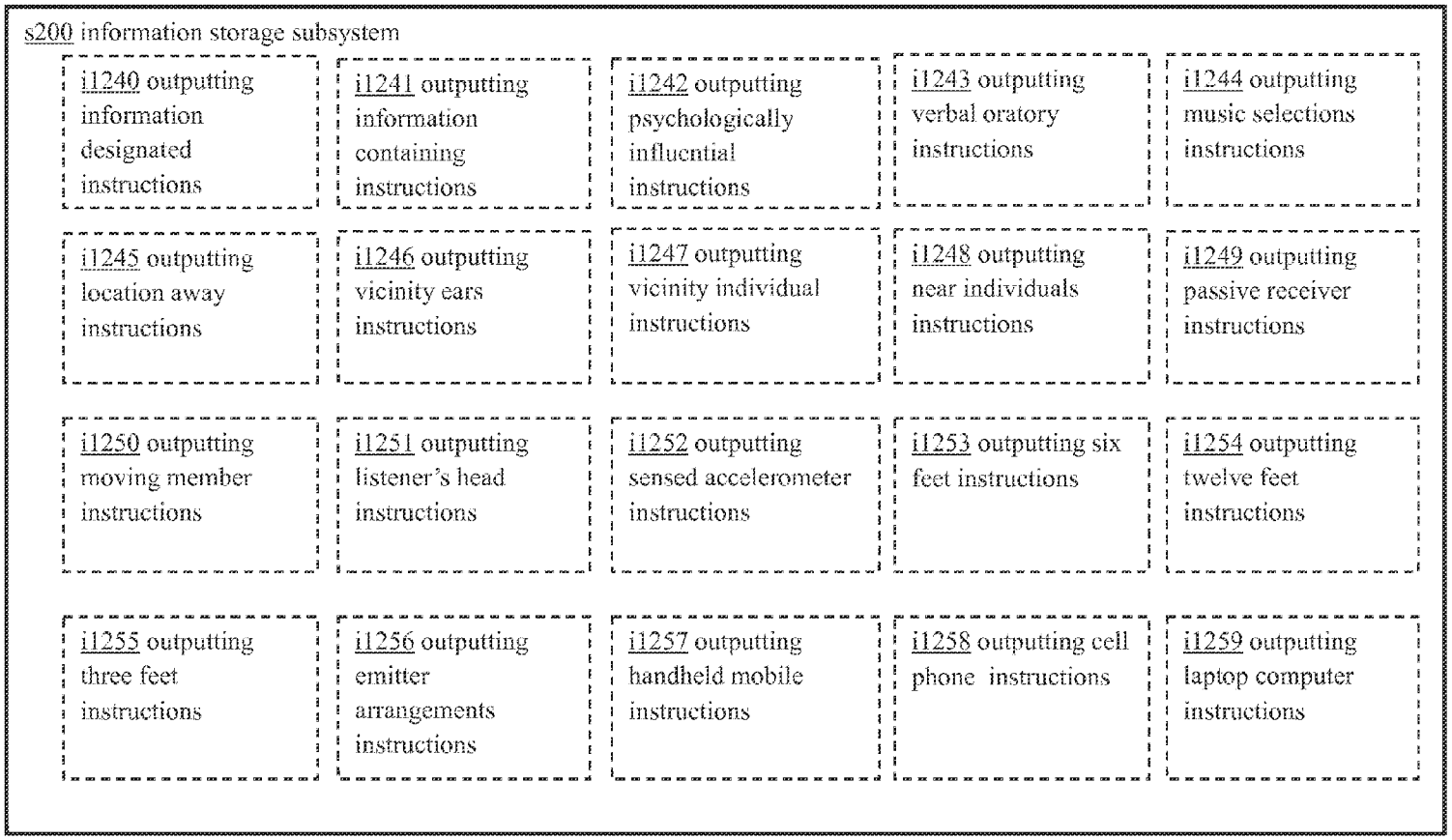
FIG. 44 is a block diagram depicting one or more exemplary instructions of the information storage subsystem s200 of the portable electronic device directed audio 10 of FIG. 1.

One or more exemplary instructions depicted in FIG. 44 as being borne in an exemplary version of a non-transitory signal bearing medium of information storage subsystem s200 include one or more outputting information designated instructions i1240, one or more outputting information containing instructions i1241, one or more outputting psychologically influential instructions i1242, one or more outputting verbal oratory instructions i1243, one or more outputting music selections instructions i1244, one or more outputting location away instructions i1245, one or more outputting vicinity ears instructions i1246, one or more outputting vicinity individual instructions i1247, one or more outputting near individuals instructions i1248, one or more outputting passive receiver instructions i1249, one or more outputting moving member instructions i1250, one or more outputting listener's head instructions i1251, one or more outputting sensed accelerometer instructions i1252, one or more outputting six feet instructions i1253, one or more outputting twelve feet instructions i1254, one or more outputting three feet instructions i1255, one or more outputting emitter arrangements instructions i1256, one or more outputting handheld mobile instructions i1257, one or more outputting cell phone instructions i1258 and one or more outputting laptop computer instructions i1259.

Figure 45:
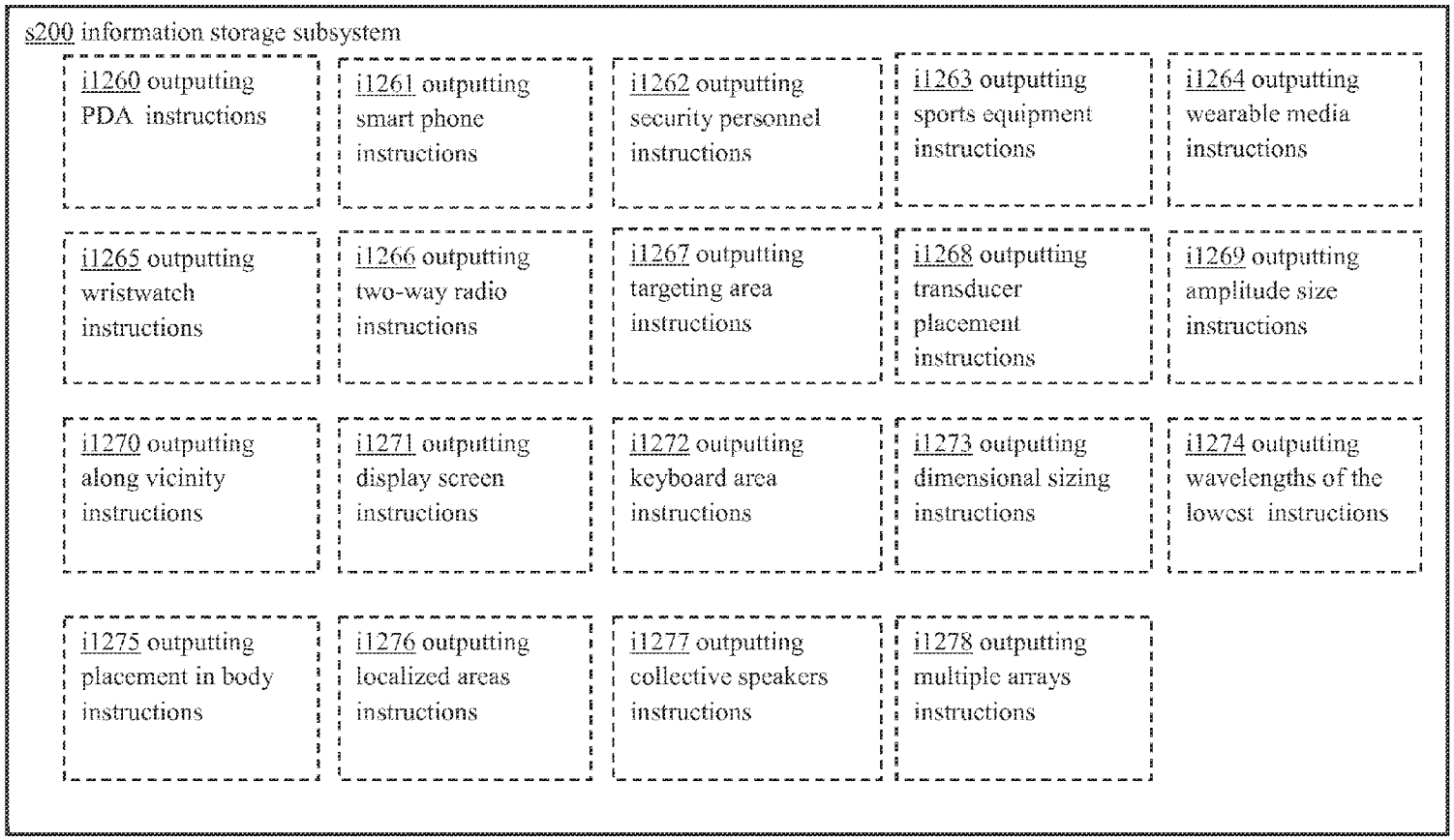
FIG. 45 is a block diagram depicting one or more exemplary instructions of the information storage subsystem s200 of the portable electronic device directed audio 10 of FIG. 1.

One or more exemplary instructions depicted in FIG. 45 as being borne in an exemplary version of a non-transitory signal bearing medium of information storage subsystem s200 include one or more outputting PDA instructions i1260, one or more outputting smart phone instructions i1261, one or more outputting security personnel instructions i1262, one or more outputting sports equipment instructions i1263, one or more outputting wearable media instructions i1264, one or more outputting wristwatch instructions i1265, one or more outputting two-way radio instructions i1266, one or more outputting targeting area instructions i1267, one or more outputting transducer placement instructions i1268, one or more outputting amplitude size instructions i1269, one or more outputting along vicinity instructions i1270, one or more outputting display screen instructions i1271, one or more outputting keyboard area instructions i1272, one or more outputting dimensional sizing instructions i1273, one or more outputting wavelengths of the lowest instructions i1274, one or more outputting placement in body instructions i1275, one or more outputting localized areas instructions i1276, one or more outputting collective speakers instructions i1277, and one or more outputting multiple arrays instructions i1278.

Figure 46:
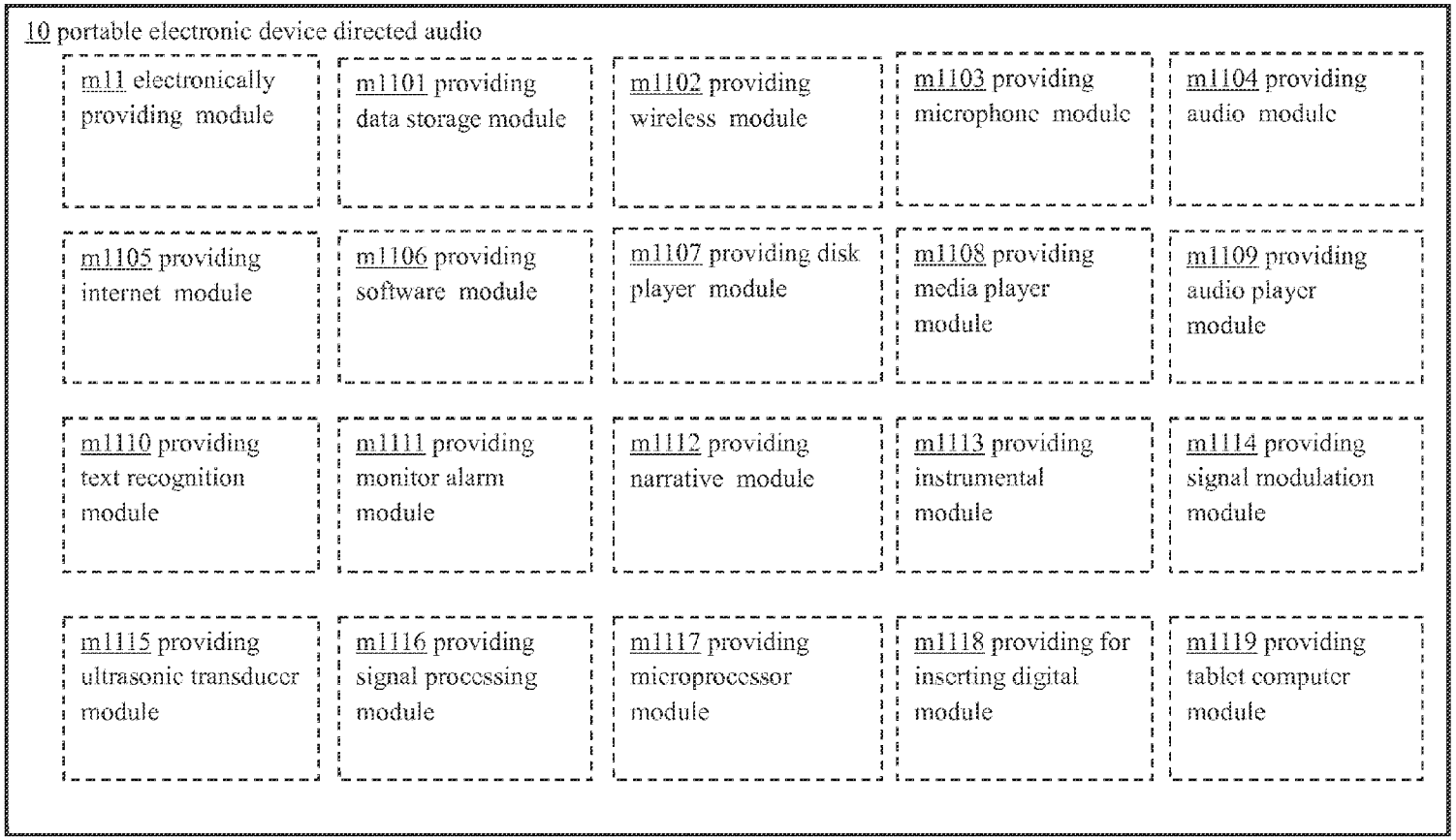
FIG. 46 is a block diagram depicting one or more exemplary modules of the portable electronic device directed audio 10 of FIG. 1.

Implementations of modules involve different combinations (limited to patentable subject matter under 35 U.S.C. 101) of one or more aspects from one or more of the electrical circuitry arrangements and/or one or more aspects from one or more of the instructions of the portable electronic device directed audio 10. Exemplary depictions of some of these modules are shown in FIG. 46 to include electronically providing module m11, providing data storage module m1101, providing wireless module m1102, providing microphone module m1103, providing audio module m1104, providing internet module m1105, providing software module m1106, providing disk player module m1107, providing media player module m1108, providing audio player module m1109, providing text recognition module m1110, providing monitor alarm module m1111, providing narrative module m1112, providing instrumental module m1113, providing signal modulation module m1114, providing ultrasonic transducer module m1115, providing signal processing module m1116, providing microprocessor module m1117, providing for inserting digital module m1118, and providing tablet computer module m1119.

Figure 47:
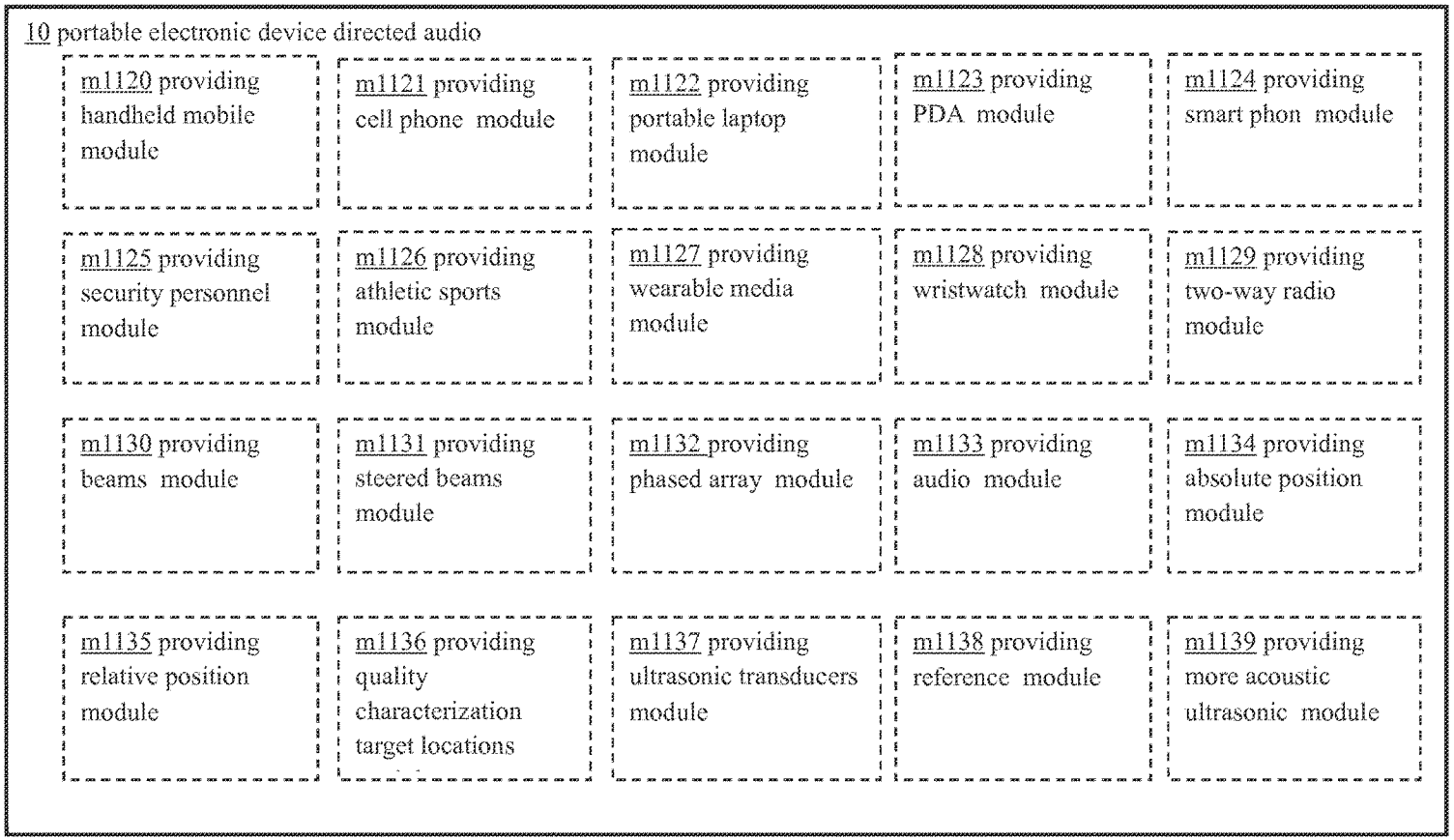
FIG. 47 is a block diagram depicting one or more exemplary modules of the portable electronic device directed audio 10 of FIG. 1.

Some of these modules are depicted in FIG. 47 to include providing handheld mobile module m1120, providing cell phone module m1121, providing portable laptop module m1122, providing PDA module m1123, providing smart phone module m1124, providing security personnel module m1125, providing athletic sports module m1126, providing wearable media module m1127, providing wristwatch module m1128, providing two-way radio module m1129, providing beams module m1130, providing steered beams module m113, providing phased array module m1132, providing audio module m1133, providing absolute position module m1134, providing relative position module m1135, providing quality characterization target locations module m1136, providing ultrasonic transducers module m1137, providing reference module m1138, and providing more acoustic ultrasonic module m1139.

Figure 48:
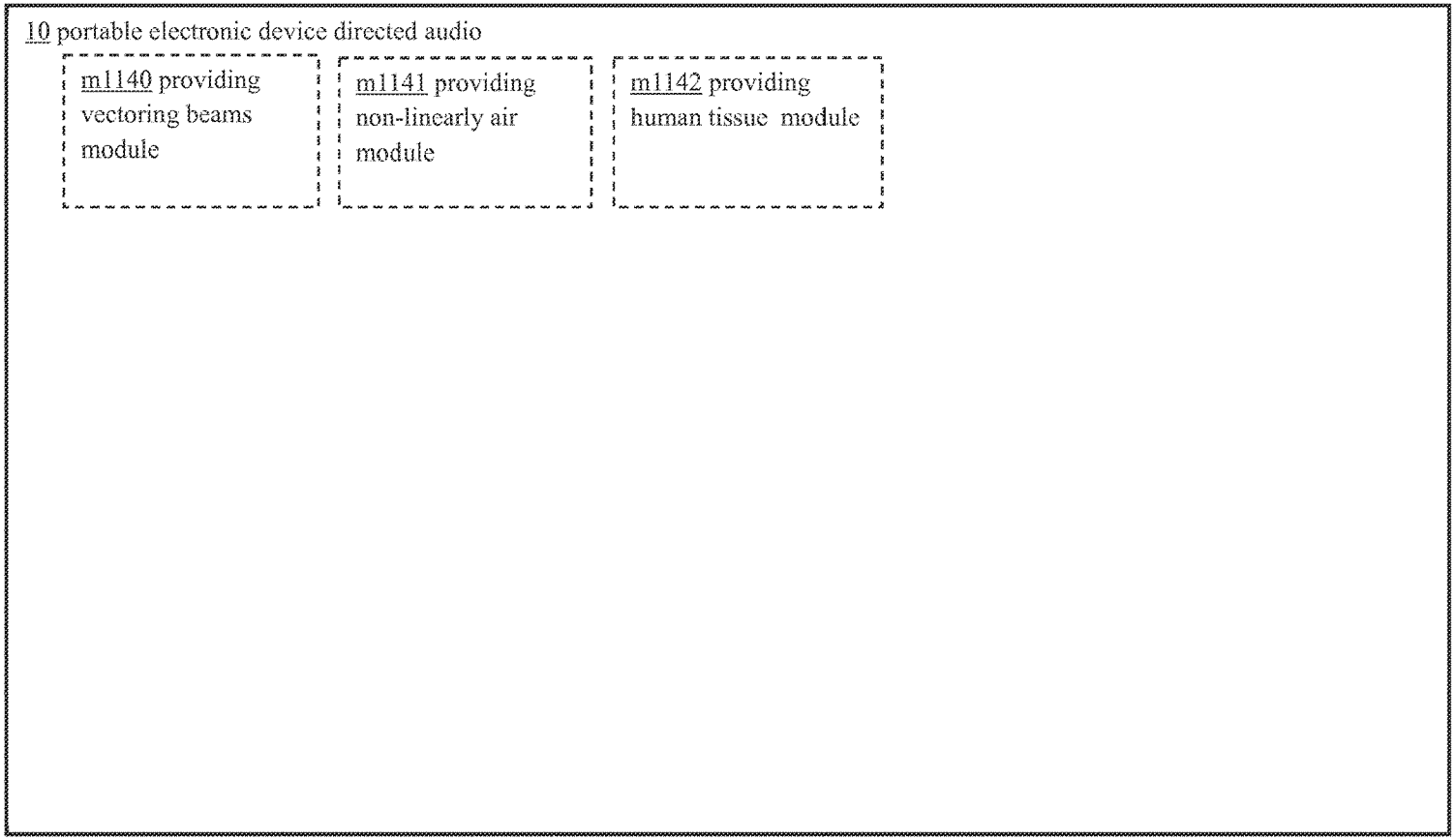
FIG. 48 is a block diagram depicting one or more exemplary modules of the portable electronic device directed audio 10 of FIG. 1.

Some of these modules are depicted in FIG. 48 to include providing vectoring beams module m1140, providing nonlinearly air module m1141, and providing human tissue module m1142.

Figure 49:
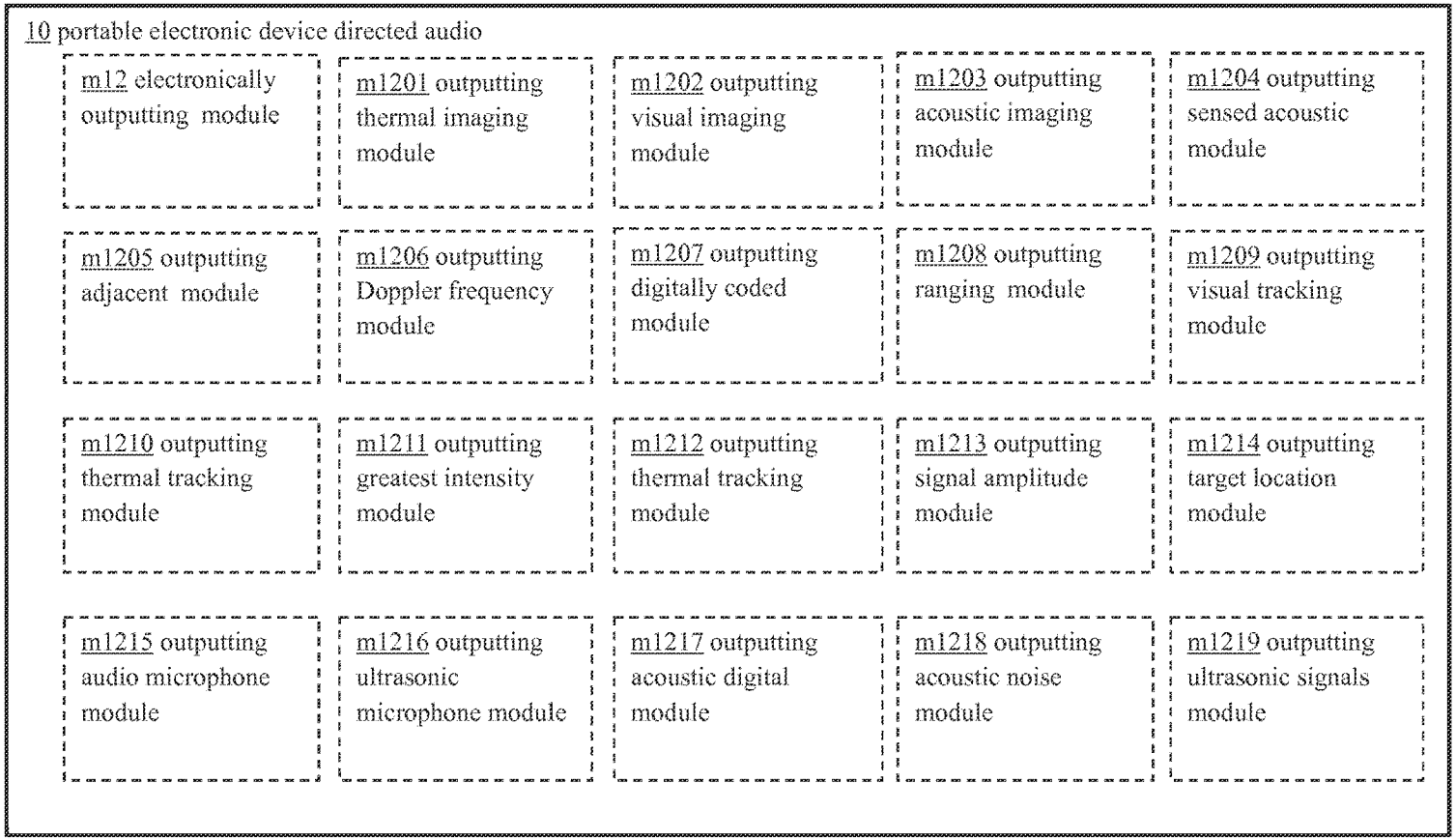
FIG. 49 is a block diagram depicting one or more exemplary modules of the portable electronic device directed audio 10 of FIG. 1.

Some of these modules are depicted in FIG. 49 to include electronically outputting module m12, outputting thermal imaging module m1201, outputting visual imaging module m1202, outputting acoustic imaging module m1203, outputting sensed acoustic module m1204, outputting adjacent module m1205, outputting Doppler frequency module m1206, outputting digitally coded module m1207, outputting ranging module m1208, outputting visual tracking module m1209, outputting thermal tracking module m1210, outputting greatest intensity module m1211, and outputting thermal tracking module m1212, outputting signal amplitude module m1213, outputting target location module m1214, outputting audio microphone module m1215, outputting ultrasonic microphone module m1216, outputting acoustic digital module m1217, outputting acoustic noise module m1218, and outputting ultrasonic signals module m1219.

Figure 50:
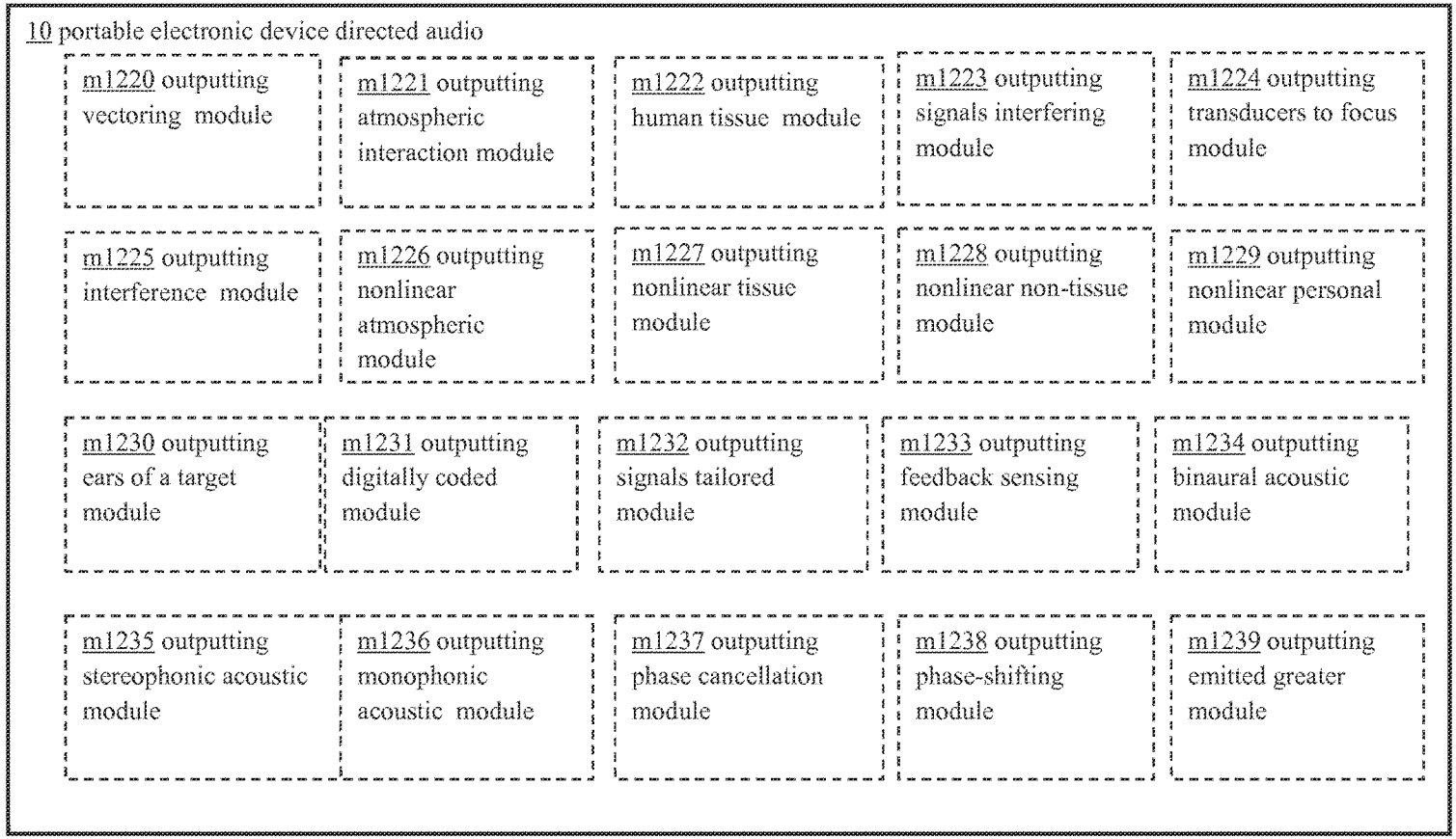
FIG. 50 is a block diagram depicting one or more exemplary modules of the portable electronic device directed audio 10 of FIG. 1.

Some of these modules are depicted in FIG. 50 to include outputting vectoring module m12, outputting atmospheric interaction module m1221, outputting human tissue module m1222, outputting signals interfering module m1223, outputting transducers to focus module m1224, outputting interference module m1225, outputting nonlinear atmospheric module m1226, outputting nonlinear tissue module m1227, outputting nonlinear non-tissue module m1228, outputting nonlinear personal module m1229, outputting binaural acoustic module m1234, outputting digitally coded module m1231, outputting signals tailored module m1232, outputting feedback sensing module m1233, outputting binaural acoustic module m1234, outputting stereophonic acoustic module m1235, outputting monophonic acoustic module m1236, outputting phase cancellation module m1237, outputting phase-shifting module m1238, and outputting emitted greater module m1239.

Figure 51:
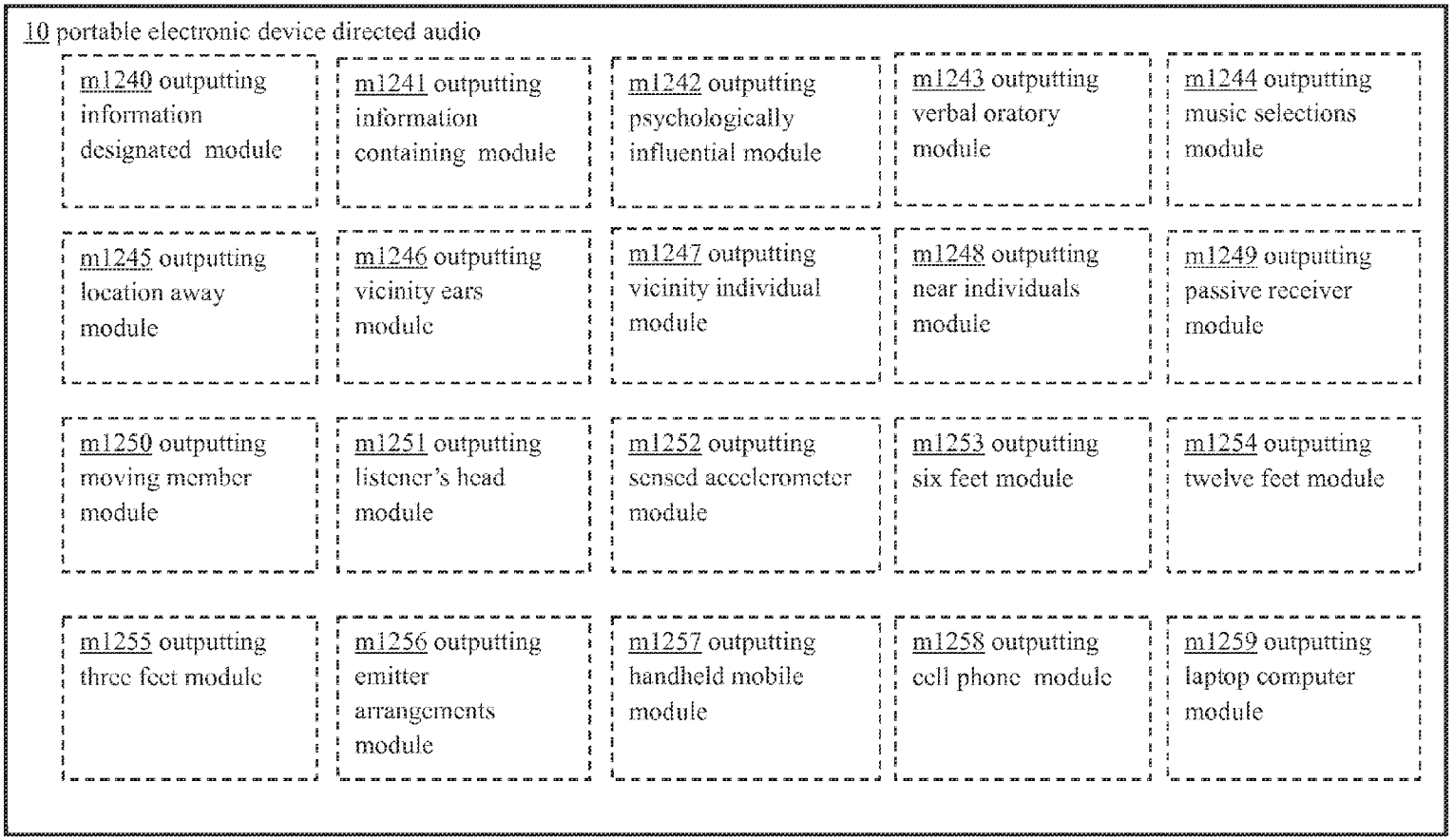
FIG. 51 is a block diagram depicting one or more exemplary modules of the portable electronic device directed audio 10 of FIG. 1.

Some of these modules are depicted in FIG. 51 to include outputting information designated module m12, outputting information containing module m1241, outputting psychologically influential module m1242, outputting verbal oratory module m1243, outputting music selections module m1244, outputting location away module m1245, outputting vicinity ears module m1246, outputting vicinity individual module m1247, outputting near individuals module m1248, outputting passive receiver module m1249, outputting moving member module m1250, outputting listener's head module m1251, outputting sensed accelerometer module m1252, outputting six feet module m1253, outputting twelve feet module m1254, outputting three feet module m1255, outputting emitter arrangements module m1256, outputting handheld mobile module m1257, outputting cell phone module m1258, and outputting laptop computer module m1259.

Figure 52:
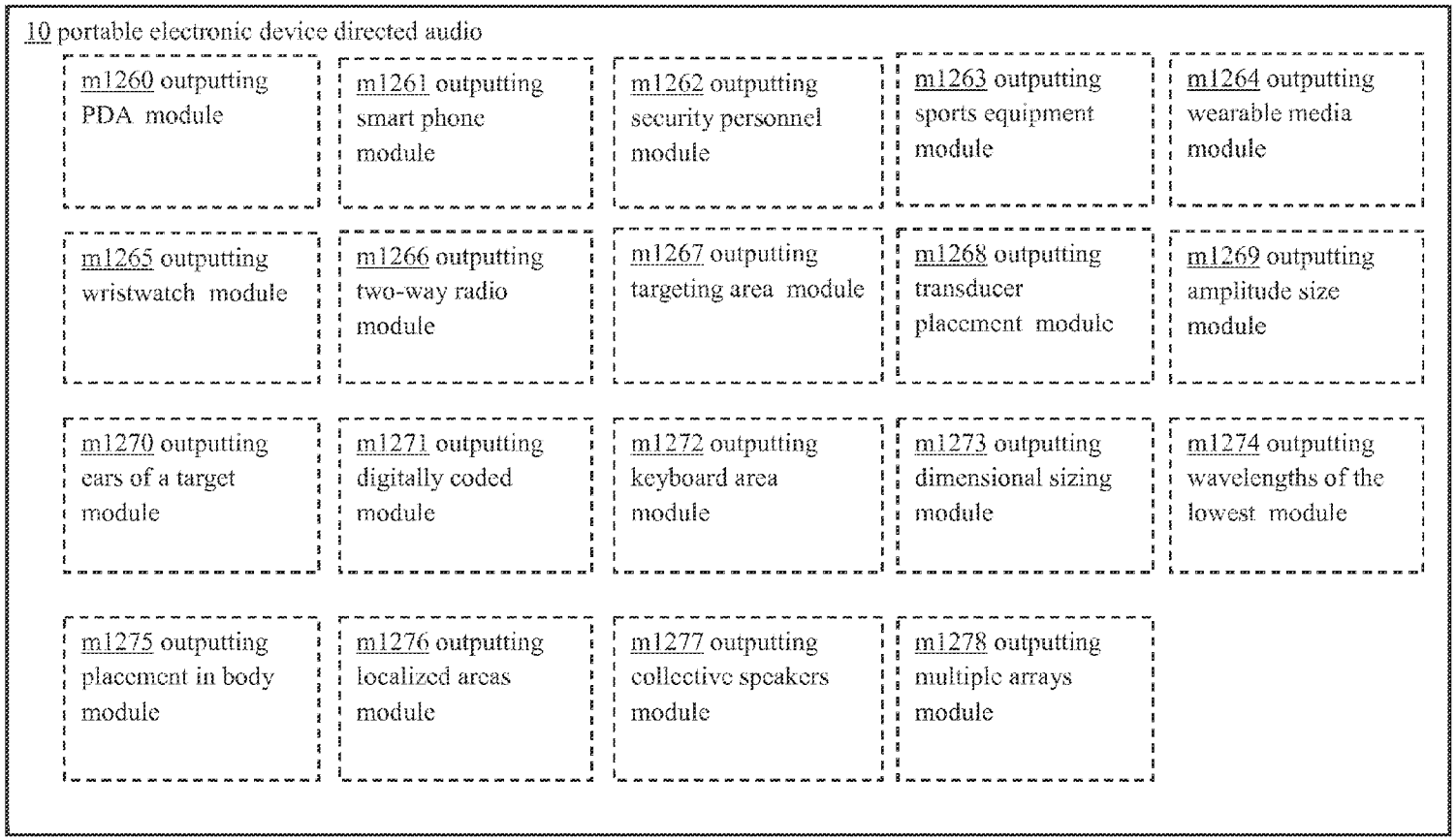
FIG. 52 is a block diagram depicting one or more exemplary modules of the portable electronic device directed audio 10 of FIG. 1.

Some of these modules are depicted in FIG. 52 to include outputting PDA module m12, outputting smart phone module m1261, outputting security personnel module m1262, outputting sports equipment module m1263, outputting wearable media module m1264, outputting wristwatch module m1265, outputting two-way radio module m1266, outputting targeting area module m1267, outputting transducer placement module m1268, outputting amplitude size module m1269, outputting along vicinity module m1270, outputting display screen module m1271, outputting keyboard area module m1272, outputting dimensional sizing module m1273, outputting wavelengths of the lowest module m1274, outputting placement in body module m1275, outputting localized areas module m1276, outputting collective speakers module m1277, and outputting multiple arrays module m1278.

In some implementations, non-transitory signal-bearing medium of information storage subsystem s200 as articles of manufacture may store the one or more exemplary instructions. In some implementations, the non-transitory signal bearing medium may include a computer-readable medium. In some implementations, the non-transitory signal-bearing medium may include a recordable medium. In some implementations, the signal-bearing medium may include a communication medium.

The various subsystems and components of the portable electronic device directed audio s10 such as the control and information processing subsystem s100, the information storage subsystem s200, the information user interface subsystems300, the sensing subsystem s400 and the electronic communication subsystem s500 and their sub-components and the other exemplary entities depicted may be embodied by hardware, software and/or firmware (limited to patentable subject matter under 35 USC 101). For example, in some implementations of the portable electronic device directed audio s10, aspects may be implemented with a processor (e.g., microprocessor, controller, and so forth) executing computer readable instructions (e.g., computer program product) stored in a storage medium (e.g., volatile or non-volatile memory) such as a signal-bearing medium. Alternatively, hardware such as application specific integrated circuit (ASIC) may be employed in order to implement such modules in some alternative implementations.

Figure 53:
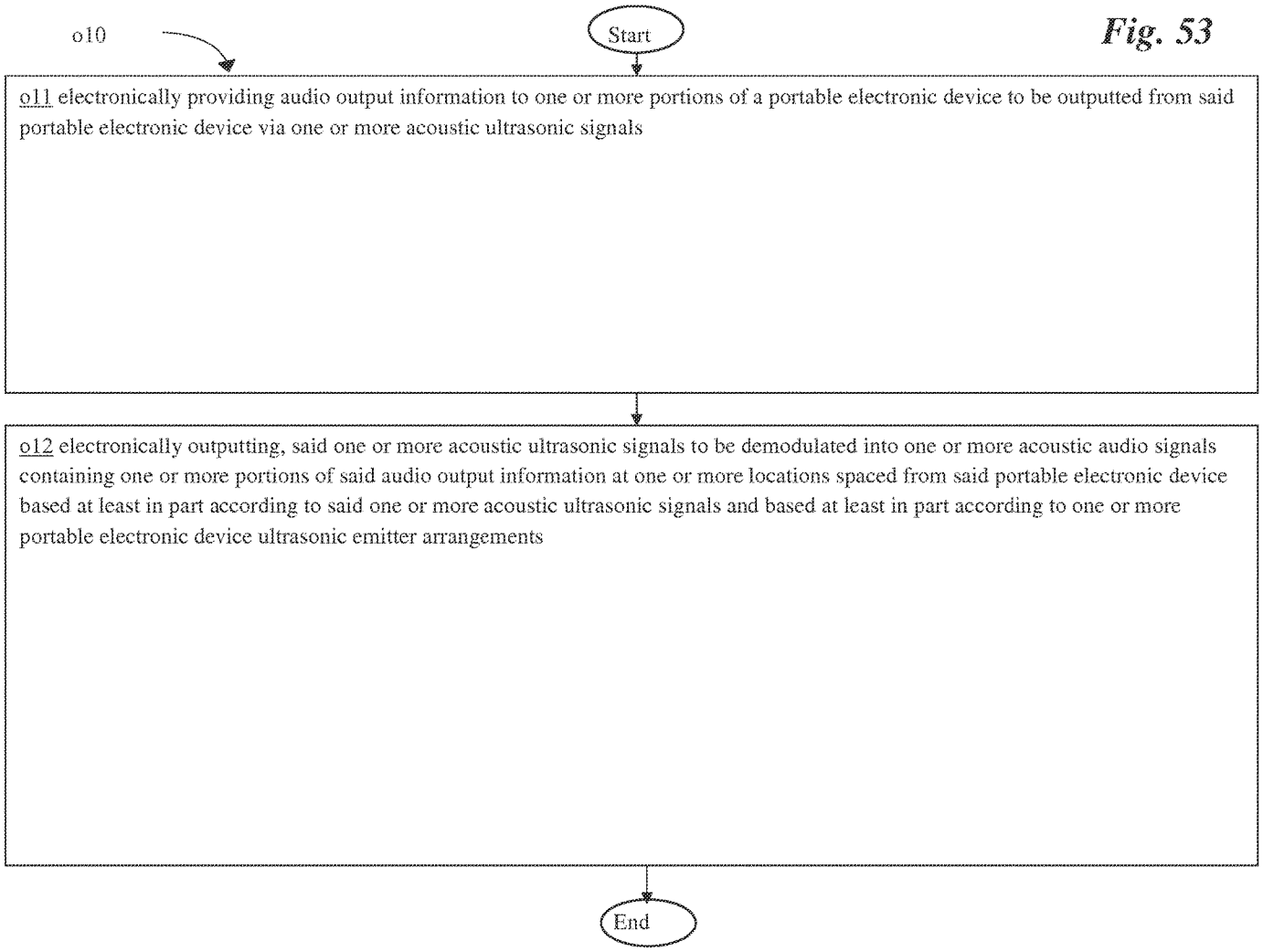
FIG. 53 is a high-level flowchart illustrating an operational flow ol0 representing exemplary operations related to electronically providing audio output information to one or more portions of a portable electronic device to be outputted from said portable electronic device via one or more acoustic ultrasonic signals, and electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements at least associated with the depicted exemplary implementations of the system.

An operational flow o10 as shown in FIG. 53 represents example operations related to electronically providing audio output information to one or more portions of a portable electronic device to be outputted from said portable electronic device via one or more acoustic ultrasonic signals and electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements.

FIG. 53 and those figures that follow may have various examples of operational flows, and explanation may be provided with respect to the above-described examples of FIGS. 1-12 and/or with respect to other examples and contexts. Nonetheless, it should be understood that the operational flows may be executed in a number of other environments and contexts, and/or in modified versions of FIGS. 1-12. Furthermore, although the various operational flows are presented in the sequence(s) illustrated, it should be understood that the various operations may be performed in other orders than those which are illustrated, or may be performed concurrently.

In FIG. 53 and those figures that follow, various operations may be depicted in a box-within-a-box manner. Such depictions may indicate that an operation in an internal box may comprise an optional exemplary implementation of the operational step illustrated in one or more external boxes. However, it should be understood that internal box operations may be viewed as independent operations separate from any associated external boxes and may be performed in any sequence with respect to all other illustrated operations, or may be performed concurrently.

For ease of understanding, the flowcharts are organized such that the initial flowcharts present implementations via an example implementation and thereafter the following flowcharts present alternate implementations and/or expansions of the initial flowchart(s) as either sub-component operations or additional component operations building on one or more earlier-presented flowcharts. Those having skill in the art will appreciate that the style of presentation utilized herein (e.g., beginning with a presentation of a flowchart(s) presenting an example implementation and thereafter providing additions to and/or further details in subsequent flowcharts) generally allows for a rapid and easy understanding of the various process implementations. In addition, those skilled in the art will further appreciate that the style of presentation used herein also lends itself well to modular and/or object-oriented program design paradigms.

As shown in FIG. 53, the operational flow o10 proceeds to operation o11 for electronically providing audio output information to one or more portions of a portable electronic device to be outputted from said portable electronic device via one or more acoustic ultrasonic signals. An exemplary version of a non-transitory signal bearing medium of information storage subsystem s200 is depicted as bearing one or more electronically providing instructions i11 that when executed will direct performance of the operation o11. In an implementation, the one or more electronically providing instructions i11 when executed direct electronically providing (e.g. through reception of cable communication packets, via Wi-Fi signal reception, by near-field infrared receiver, etc.) audio output information (e.g. including lecture formatted information, including foreign language speech information, including classical music selection information, etc.) to one or more portions (e.g. including one or more preamplifier portions, including one or more transceiver portions, including one or more digital amplifier portions, etc.) of a portable electronic device (e.g. including one or more 3G mobile components, including one or more cellular components, including one or more 4G components, etc.) to be outputted (e.g. through one or more cable interface portions, via one or more speaker portions, by one or more transducer portions, etc.) from said portable electronic device (e.g. including one or more media player components, including one or more clamshell phone components, including one or more time division multiplexing components, etc.) via one or more acoustic ultrasonic signals (e.g. via multiple acoustic ultrasonic signals configured to be demodulated through mutual interference therewith to at least in part result in one or more acoustic audio signals, via one or more acoustic ultrasonic signals configured to be demodulated through nonlinear atmospheric interaction to at least in part generate one or more acoustic audio signals, via one or more acoustic ultrasonic signals configured to be demodulated through nonlinear human tissue interaction to at least in part produce one or more acoustic audio signals, etc.). Furthermore, the electronically providing electrical circuitry arrangement ("elec circ arrange") e11 when activated will perform the operation o1101. Also, the providing data storage module m1101, when executed and/or activated, will direct performance of and/or performs the operation o11. In an implementation, the electronically providing electrical circuitry arrangement e11, when activated performs electronically providing (e.g. through reception of cable communication packets, via Wi-Fi signal reception, by near-field infrared receiver, etc.) audio output information (e.g. including lecture formatted information, including foreign language speech information, including classical music selection information, etc.) to one or more portions (e.g. including one or more preamplifier portions, including one or more transceiver portions, including one or more digital amplifier portions, etc.) of a portable electronic device (e.g. including one or more 3G mobile components, including one or more cellular components, including one or more 4G components, etc.) to be outputted (e.g. through one or more cable interface portions, via one or more speaker portions, by one or more transducer portions, etc.) from said portable electronic device (e.g. including one or more media player components, including one or more clamshell phone components, including one or more time division multiplexing components, etc.) via one or more acoustic ultrasonic signals (e.g. via multiple acoustic ultrasonic signals configured to be demodulated through mutual interference therewith to at least in part result in one or more acoustic audio signals, via one or more acoustic ultrasonic signals configured to be demodulated through nonlinear atmospheric interaction to at least in part generate one or more acoustic audio signals, via one or more acoustic ultrasonic signals configured to be demodulated through nonlinear human tissue interaction to at least in part produce one or more acoustic audio signals, etc.). Also, the electronically providing module m11, when executed and/or activated, will direct performance of and/or perform the operation o11. In an implementation, the electronically providing audio output information to one or more portions of a portable electronic device to be outputted from said portable electronic device via one or more acoustic ultrasonic signals is carried out by electronically providing (e.g. through reception of cable communication packets, via Wi-Fi signal reception, by near-field infrared receiver, etc.) audio output information (e.g. including lecture formatted information, including foreign language speech information, including classical music selection information, etc.) to one or more portions (e.g. including one or more preamplifier portions, including one or more transceiver portions, including one or more digital amplifier portions, etc.) of a portable electronic device (e.g. including one or more 3G mobile components, including one or more cellular components, including one or more 4G components, etc.) to be outputted (e.g. through one or more cable interface portions, via one or more speaker portions, by one or more transducer portions, etc.) from said portable electronic device (e.g. including one or more media player components, including one or more clamshell phone components, including one or more time division multiplexing components, etc.) via one or more acoustic ultrasonic signals (e.g. via multiple acoustic ultrasonic signals configured to be demodulated through mutual interference therewith to at least in part result in one or more acoustic audio signals, via one or more acoustic ultrasonic signals configured to be demodulated through nonlinear atmospheric interaction to at least in part generate one or more acoustic audio signals, via one or more acoustic ultrasonic signals configured to be demodulated through nonlinear human tissue interaction to at least in part produce one or more acoustic audio signals, etc.).

Figure 39:
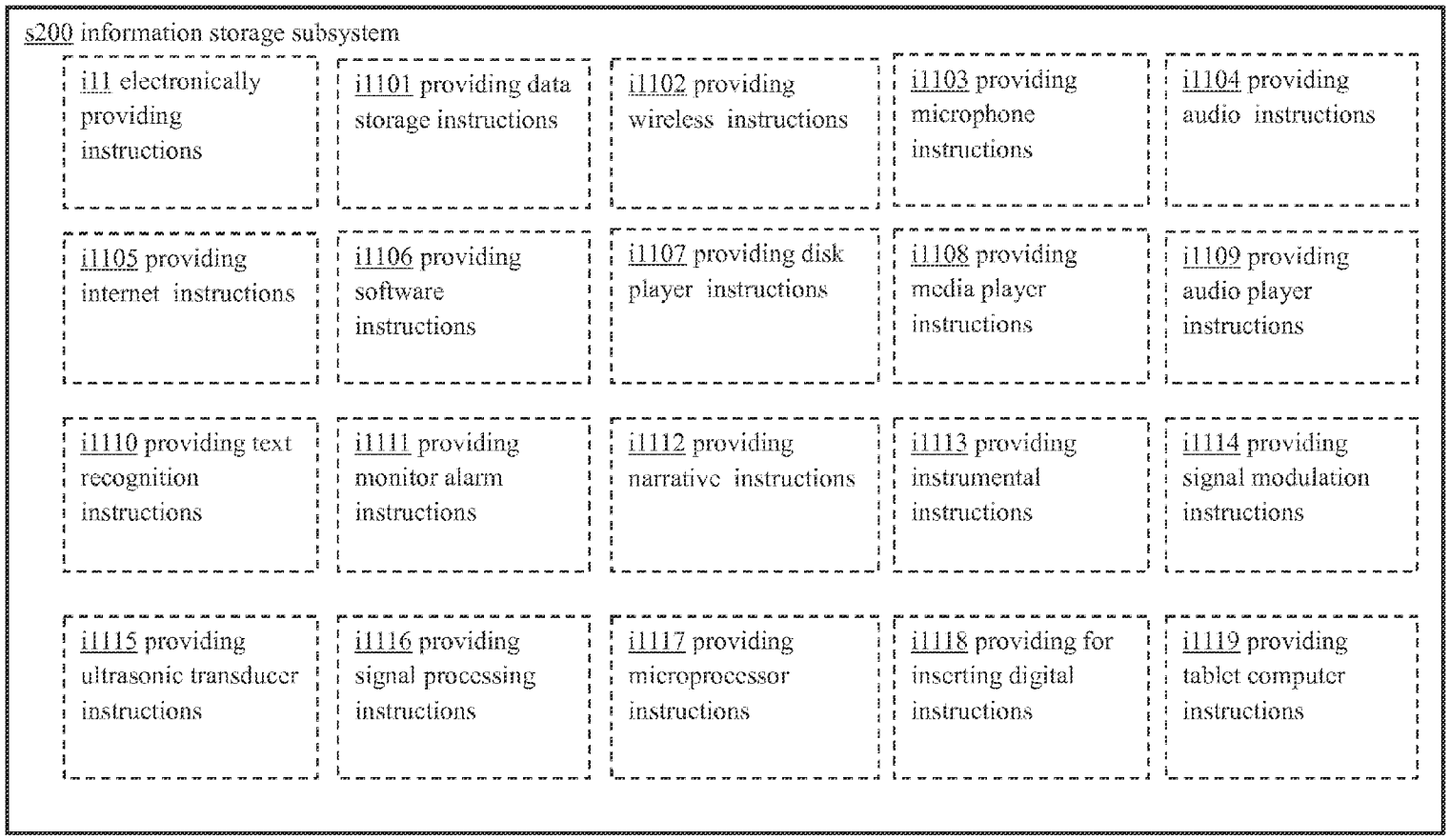
FIG. 39 is a block diagram depicting one or more exemplary instructions of the information storage subsystem s200 of the portable electronic device directed audio 10 of FIG. 1.
Figure 54:
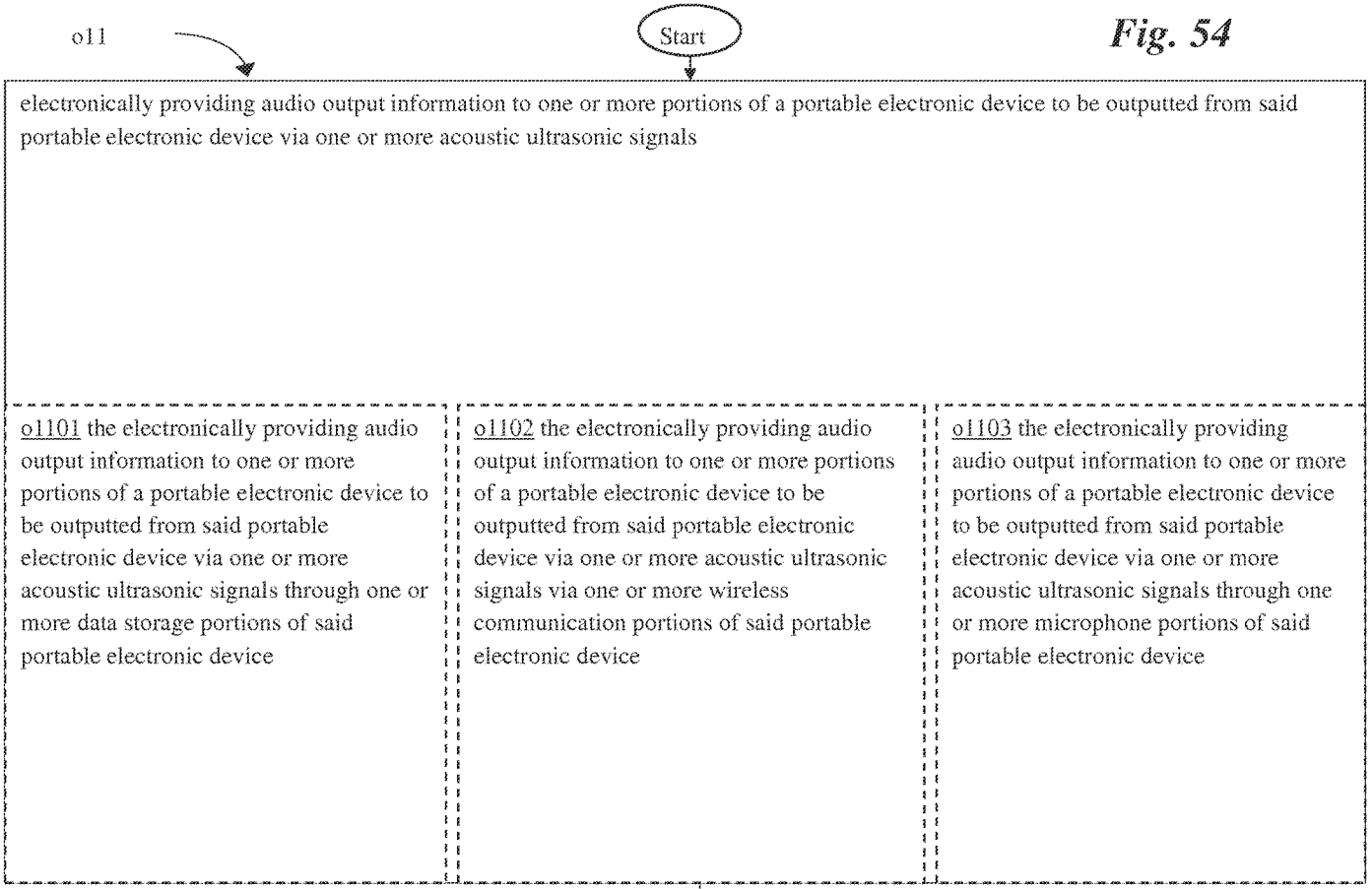
FIG. 54 is a high-level flowchart including exemplary implementations of operation o11 of FIG. 53.

In one or more implementations, as shown in FIG. 54, operation o11 includes an operation o1101 for the electronically providing audio output information to one or more portions of a portable electronic device to be outputted from said portable electronic device via one or more acoustic ultrasonic signals through one or more data storage portions of said portable electronic device. Origination of an illustratively derived providing data storage component group can be accomplished through skilled in the art design choice selection of one or more of the above depicted components from one or more of the above depicted subsystems shown in FIG. 25. Components from the providing data storage component group can be used in implementing execution of the one or more providing data storage instructions i1101 of FIG. 39, can be used in performance of the providing data storage electrical circuitry arrangement e1101 of FIG. 32, and/or can be used in otherwise fulfillment of the operation o1101. An exemplary non-transitory signal bearing medium version of the information storage subsystem s200 is depicted in FIG. 39 as bearing the one or more providing data storage instructions i1101 that when executed will direct performance of the operation o1101. Furthermore, the providing data storage electrical circuitry arrangement ("elec circ arrange") e1101, when activated, will perform the operation o1101. Also, the providing data storage module m1101, when executed and/or activated, will direct performance of and/or perform the operation o1101. For instance, in one or more exemplary implementations, the one or more providing data storage instructions i1101, when executed, direct performance of the operation o1101 in the illustrative depiction as follows, and/or the providing data storage electrical circuitry arrangement e1101, when activated, performs the operation o1101 in the illustrative depiction as follows, and/or the providing data storage module m1101, when executed and/or activated, directs performance of and/or performs the operation o1101 in the illustrative depiction as follows, and/or the operation o1101 is otherwise carried out in the illustrative depiction as follows: the electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) to be outputted (e.g. through one or more cable interface portions, etc.) from said portable electronic device (e.g. including one or more media player components, etc.) via one or more acoustic ultrasonic signals (e.g. via multiple acoustic ultrasonic signals configured to be demodulated through mutual interference therewith to at least in part result in one or more acoustic audio signals, etc.) through one or more data storage portions of said portable electronic device (e.g. including one or more tablet memory portions, etc.).

In one or more implementations, as shown in FIG. 54, operation o11 includes an operation o1102 for the electronically providing audio output information to one or more portions of a portable electronic device to be outputted from said portable electronic device via one or more acoustic ultrasonic signals via one or more wireless communication portions of said portable electronic device. Origination of an illustratively derived providing wireless component group can be accomplished through skilled in the art design choice selection of one or more of the above depicted components from one or more of the above depicted subsystems shown in FIG. 25. Components from the providing wireless component group can be used in implementing execution of the one or more providing wireless instructions i1102 of FIG. 39, can be used in performance of the providing wireless electrical circuitry arrangement e1102 of FIG. 32, and/or can be used in otherwise fulfillment of the operation o1102. An exemplary non-transitory signal bearing medium version of the information storage subsystem s200 is depicted in FIG. 39 as bearing the one or more providing wireless instructions i1102 that when executed will direct performance of the operation o1102. Furthermore, the providing wireless electrical circuitry arrangement ("elec circ arrange") e1102, when activated, will perform the operation o1102. Also, the providing wireless module m1102, when executed and/or activated, will direct performance of and/or perform the operation o1102. For instance, in one or more exemplary implementations, the one or more providing wireless instructions i1102, when executed, direct performance of the operation o1102 in the illustrative depiction as follows, and/or the providing wireless electrical circuitry arrangement e1102, when activated, performs the operation o1102 in the illustrative depiction as follows, and/or the providing wireless module m1102, when executed and/or activated, directs performance of and/or performs the operation o1102 in the illustrative depiction as follows, and/or the operation o1102 is otherwise carried out in the illustrative depiction as follows: the electronically providing (e.g. via Wi-Fi signal reception, etc.) audio output information (e.g. including foreign language speech information, etc.) to one or more portions (e.g. including one or more transceiver portions, etc.) of a portable electronic device (e.g. including one or more cellular components, etc.) to be outputted (e.g. via one or more speaker portions, etc.) from said portable electronic device (e.g. including one or more clamshell phone components, etc.) via one or more acoustic ultrasonic signals (e.g. via one or more acoustic ultrasonic signals configured to be demodulated through nonlinear atmospheric interaction to at least in part generate one or more acoustic audio signals, etc.) via one or more wireless communication portions of said portable electronic device (e.g. including one or more tablet WiFi, etc.).

In one or more implementations, as shown in FIG. 54, operation o11 includes an operation o1103 for the electronically providing audio output information to one or more portions of a portable electronic device to be outputted from said portable electronic device via one or more acoustic ultrasonic signals through one or more microphone portions of said portable electronic device. Origination of an illustratively derived providing microphone component group can be accomplished through skilled in the art design choice selection of one or more of the above depicted components from one or more of the above depicted subsystems shown in FIG. 25. Components from the providing microphone component group can be used in implementing execution of the one or more providing microphone instructions i1103 of FIG. 39, can be used in performance of the providing microphone electrical circuitry arrangement e1103 of FIG. 32, and/or can be used in otherwise fulfillment of the operation o1103. An exemplary non-transitory signal bearing medium version of the information storage subsystem s200 is depicted in FIG. 39 as bearing the one or more providing microphone instructions i1103 that when executed will direct performance of the operation o1103. Furthermore, the providing microphone electrical circuitry arrangement ("elec circ arrange") e1103, when activated, will perform the operation o1103. Also, the providing microphone module m1103, when executed and/or activated, will direct performance of and/or perform the operation o1103. For instance, in one or more exemplary implementations, the one or more providing microphone instructions i1103, when executed, direct performance of the operation o1103 in the illustrative depiction as follows, and/or the providing microphone electrical circuitry arrangement e1103, when activated, performs the operation o1103 in the illustrative depiction as follows, and/or the providing microphone module m1103, when executed and/or activated, directs performance of and/or performs the operation o1103 in the illustrative depiction as follows, and/or the operation o1103 is otherwise carried out in the illustrative depiction as follows: the electronically providing (e.g. by near-field infrared receiver, etc.) audio output information (e.g. including classical music selection information, etc.) to one or more portions (e.g. including one or more digital amplifier portions, etc.) of a portable electronic device (e.g. including one or more 4G components, etc.) to be outputted (e.g. by one or more transducer portions, etc.) from said portable electronic device (e.g. including one or more time division multiplexing components, etc.) via one or more acoustic ultrasonic signals (e.g. via one or more acoustic ultrasonic signals configured to be demodulated through nonlinear human tissue interaction to at least in part produce one or more acoustic audio signals, etc.) through one or more microphone portions of said portable electronic device (e.g. including one or more smart phone directional microphone portions, etc.).

Figure 55:
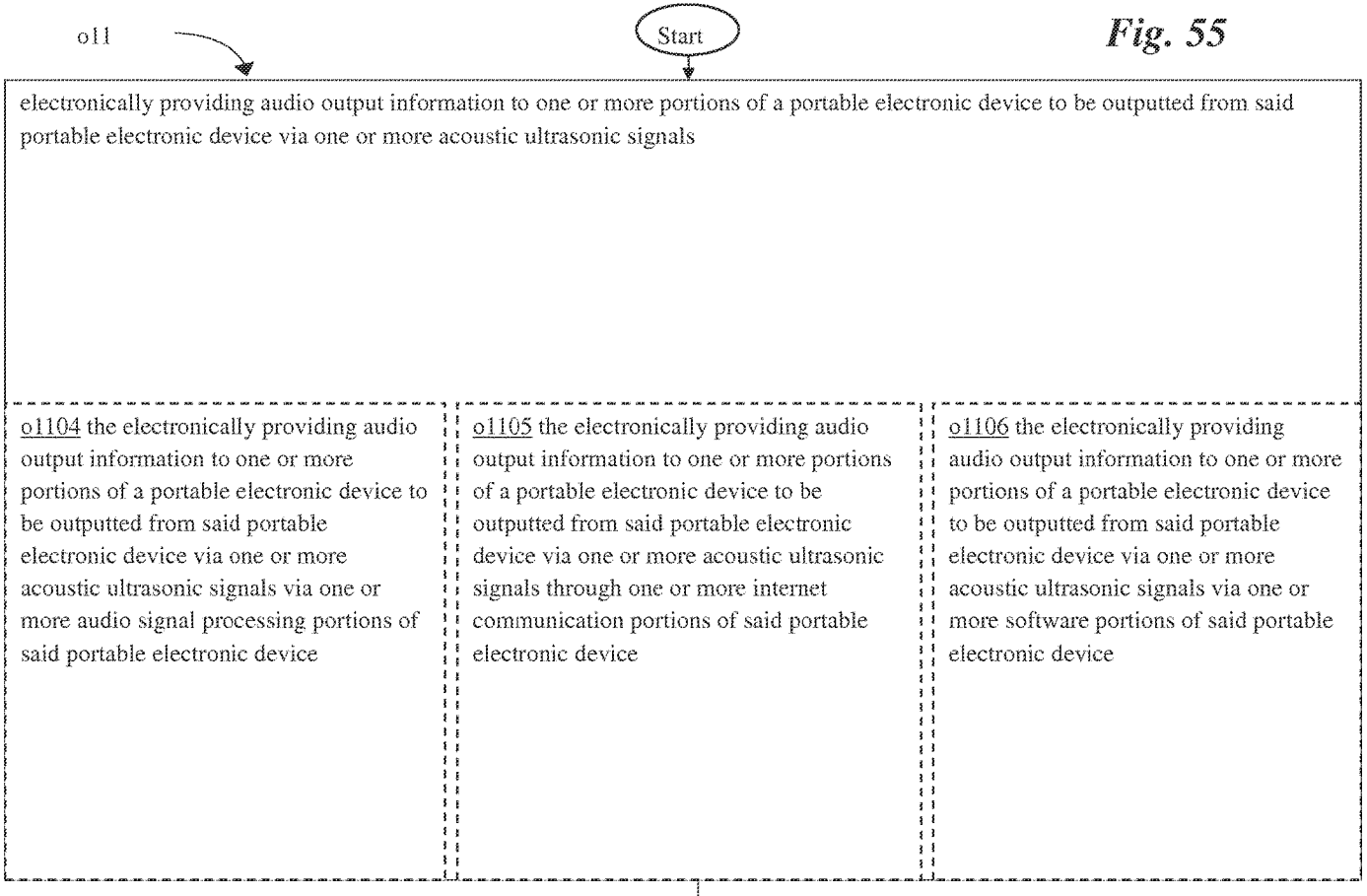
FIG. 55 is a high-level flowchart including exemplary implementations of operation o11 of FIG. 53.

In one or more implementations, as shown in FIG. 55, operation o11 includes an operation o1104 for the electronically providing audio output information to one or more portions of a portable electronic device to be outputted from said portable electronic device via one or more acoustic ultrasonic signals via one or more audio signal processing portions of said portable electronic device. Origination of an illustratively derived providing audio component group can be accomplished through skilled in the art design choice selection of one or more of the above depicted components from one or more of the above depicted subsystems shown in FIG. 25. Components from the providing audio component group can be used in implementing execution of the one or more providing audio instructions i1104 of FIG. 39, can be used in performance of the providing audio electrical circuitry arrangement e1104 of FIG. 32, and/or can be used in otherwise fulfillment of the operation o1104. An exemplary non-transitory signal bearing medium version of the information storage subsystem s200 is depicted in FIG. 39 as bearing the one or more providing audio instructions i1104 that when executed will direct performance of the operation o1104. Furthermore, the providing audio electrical circuitry arrangement ("elec circ arrange") e1104, when activated, will perform the operation o1104. Also, the providing audio module m1104, when executed and/or activated, will direct performance of and/or perform the operation o1104. For instance, in one or more exemplary implementations, the one or more providing audio instructions i1104, when executed, direct performance of the operation o1104 in the illustrative depiction as follows, and/or the providing audio electrical circuitry arrangement e1104, when activated, performs the operation o1104 in the illustrative depiction as follows, and/or the providing audio module m1104, when executed and/or activated, directs performance of and/or performs the operation o1104 in the illustrative depiction as follows, and/or the operation o1104 is otherwise carried out in the illustrative depiction as follows: the electronically providing (e.g. from hard drive access, etc.) audio output information (e.g. including instructional lesson material information, etc.) to one or more portions (e.g. including one or more digital compression portions, etc.) of a portable electronic device (e.g. including one or more WiFi components, etc.) to be outputted (e.g. from one or more aperture portions, etc.) from said portable electronic device (e.g. including one or more frequency division multiplexing components, etc.) via one or more acoustic ultrasonic signals (e.g. via one or more acoustic ultrasonic signals configured to be demodulated through nonlinear polymeric interaction to at least in part result in one or more acoustic audio signals, etc.) via one or more audio signal processing portions of said portable electronic device (e.g. including one or more smart phone fast fourier transform signal processing portions, etc.).

In one or more implementations, as shown in FIG. 55, operation o11 includes an operation o1105 for the electronically providing audio output information to one or more portions of a portable electronic device to be outputted from said portable electronic device via one or more acoustic ultrasonic signals through one or more internet communication portions of said portable electronic device. Origination of an illustratively derived providing internet component group can be accomplished through skilled in the art design choice selection of one or more of the above depicted components from one or more of the above depicted subsystems shown in FIG. 25. Components from the providing internet component group can be used in implementing execution of the one or more providing internet instructions i1105 of FIG. 39, can be used in performance of the providing internet electrical circuitry arrangement e1105 of FIG. 32, and/or can be used in otherwise fulfillment of the operation o1105. An exemplary non-transitory signal bearing medium version of the information storage subsystem s200 is depicted in FIG. 39 as bearing the one or more providing internet instructions i1105 that when executed will direct performance of the operation o1105. Furthermore, the providing internet electrical circuitry arrangement ("elec circ arrange") e1105, when activated, will perform the operation o1105. Also, the providing internet module m1105, when executed and/or activated, will direct performance of and/or perform the operation o1105. For instance, in one or more exemplary implementations, the one or more providing internet instructions i1105, when executed, direct performance of the operation o1105 in the illustrative depiction as follows, and/or the providing internet electrical circuitry arrangement e1105, when activated, performs the operation o1105 in the illustrative depiction as follows, and/or the providing internet module m1105, when executed and/or activated, directs performance of and/or performs the operation o1105 in the illustrative depiction as follows, and/or the operation o1105 is otherwise carried out in the illustrative depiction as follows: the electronically providing (e.g. using fiber optic communication, etc.) audio output information (e.g. including warning tone information, etc.) to one or more portions (e.g. including one or more signal limiter portions, etc.) of a portable electronic device (e.g. including one or more infrared components, etc.) to be outputted (e.g. using one or more transmitter portions, etc.) from said portable electronic device (e.g. including one or more wireless components, etc.) via one or more acoustic ultrasonic signals (e.g. via one or more acoustic ultrasonic signals configured to be demodulated through nonlinear apparel interaction to at least in part produce one or more acoustic audio signals, etc.) through one or more internet communication portions of said portable electronic device (e.g. including one or more laptop TCP/IP internet protocol portions, etc.).

In one or more implementations, as shown in FIG. 55, operation o11 includes an operation o1106 for the electronically providing audio output information to one or more portions of a portable electronic device to be outputted from said portable electronic device via one or more acoustic ultrasonic signals via one or more software portions of said portable electronic device. Origination of an illustratively derived providing software component group can be accomplished through skilled in the art design choice selection of one or more of the above depicted components from one or more of the above depicted subsystems shown in FIG. 25. Components from the providing software component group can be used in implementing execution of the one or more providing software instructions i1106 of FIG. 39, can be used in performance of the providing software electrical circuitry arrangement e1106 of FIG. 32, and/or can be used in otherwise fulfillment of the operation o1106. An exemplary non-transitory signal bearing medium version of the information storage subsystem s200 is depicted in FIG. 39 as bearing the one or more providing software instructions i1106 that when executed will direct performance of the operation o1106. Furthermore, the providing software electrical circuitry arrangement ("elec circ arrange") e1106, when activated, will perform the operation o1106. Also, the providing software module m1106, when executed and/or activated, will direct performance of and/or perform the operation o1106. For instance, in one or more exemplary implementations, the one or more providing software instructions i1106, when executed, direct performance of the operation o1106 in the illustrative depiction as follows, and/or the providing software electrical circuitry arrangement e1106, when activated, performs the operation o1106 in the illustrative depiction as follows, and/or the providing software module m1106, when executed and/or activated, directs performance of and/or performs the operation o1106 in the illustrative depiction as follows, and/or the operation o1106 is otherwise carried out in the illustrative depiction as follows: the electronically providing (e.g. through sound wave reception, etc.) audio output information (e.g. including white noise information, etc.) to one or more portions (e.g. including one or more signal limiter portions, etc.) of a portable electronic device (e.g. including one or more personal digital assistant components, etc.) to be outputted (e.g. through one or more air-coupled transducer portions, etc.) from said portable electronic device (e.g. including one or more spread spectrum components, etc.) via one or more acoustic ultrasonic signals (e.g. via one or more acoustic ultrasonic signals configured to be demodulated through nonlinear interaction with one or more solids to at least in part generate one or more acoustic audio signals, etc.) via one or more software portions of said portable electronic device (e.g. including one or more internet browser tablet software portions, etc.).

Figure 56:
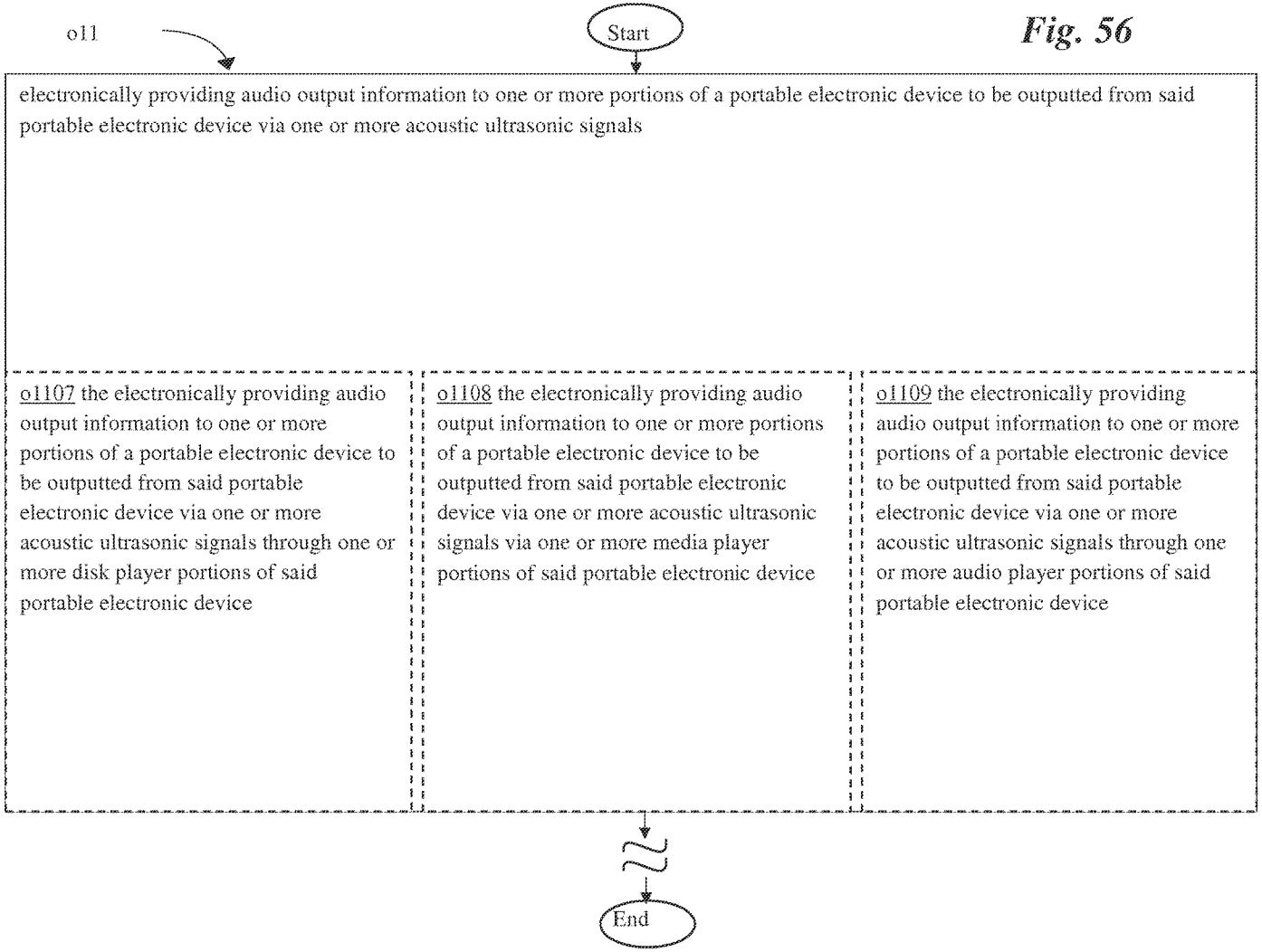
FIG. 56 is a high-level flowchart including exemplary implementations of operation o11 of FIG. 53.

In one or more implementations, as shown in FIG. 56, operation o11 includes an operation o1107 for the electronically providing audio output information to one or more portions of a portable electronic device to be outputted from said portable electronic device via one or more acoustic ultrasonic signals through one or more disk player portions of said portable electronic device. Origination of an illustratively derived providing disk player component group can be accomplished through skilled in the art design choice selection of one or more of the above depicted components from one or more of the above depicted subsystems shown in FIG. 25. Components from the providing disk player component group can be used in implementing execution of the one or more providing disk player instructions i1107 of FIG. 39, can be used in performance of the providing disk player electrical circuitry arrangement e1107 of FIG. 32, and/or can be used in otherwise fulfillment of the operation o1107. An exemplary non-transitory signal bearing medium version of the information storage subsystem s200 is depicted in FIG. 39 as bearing the one or more providing disk player instructions i1107 that when executed will direct performance of the operation o1107. Furthermore, the providing disk player electrical circuitry arrangement ("elec circ arrange") e1107, when activated, will perform the operation o1107. Also, the providing disk player module m1107, when executed and/or activated, will direct performance of and/or perform the operation o1107. For instance, in one or more exemplary implementations, the one or more providing disk player instructions i1107, when executed, direct performance of the operation o1107 in the illustrative depiction as follows, and/or the providing disk player electrical circuitry arrangement e1107, when activated, performs the operation o1107 in the illustrative depiction as follows, and/or the providing disk player module m1107, when executed and/or activated, directs performance of and/or performs the operation o1107 in the illustrative depiction as follows, and/or the operation o1107 is otherwise carried out in the illustrative depiction as follows: the electronically providing (e.g. via radio frequency antenna, etc.) audio output information (e.g. including varying pitch information, etc.) to one or more portions (e.g. including one or more auxiliary signal input portions, etc.) of a portable electronic device (e.g. including one or more smart phone components, etc.) to be outputted (e.g. via one or more thin-film membrane portions, etc.) from said portable electronic device (e.g. including one or more handheld radio components, etc.) via one or more acoustic ultrasonic signals (e.g. via one or more acoustic ultrasonic signals including signals having one or more frequencies above 60 kHz, etc.) through one or more disk player portions of said portable electronic device (e.g. including one or more laptop Blu-Ray player portions, etc.).

In one or more implementations, as shown in FIG. 56, operation o11 includes an operation o1108 for the electronically providing audio output information to one or more portions of a portable electronic device to be outputted from said portable electronic device via one or more acoustic ultrasonic signals via one or more media player portions of said portable electronic device. Origination of an illustratively derived providing media player component group can be accomplished through skilled in the art design choice selection of one or more of the above depicted components from one or more of the above depicted subsystems shown in FIG. 25. Components from the providing media player component group can be used in implementing execution of the one or more providing media player instructions i1108 of FIG. 39, can be used in performance of the providing media player electrical circuitry arrangement e1108 of FIG. 32, and/or can be used in otherwise fulfillment of the operation o1108. An exemplary non-transitory signal bearing medium version of the information storage subsystem s200 is depicted in FIG. 39 as bearing the one or more providing media player instructions i1108 that when executed will direct performance of the operation o1108. Furthermore, the providing media player electrical circuitry arrangement ("elec circ arrange") e1108, when activated, will perform the operation o1108. Also, the providing media player module m1108, when executed and/or activated, will direct performance of and/or perform the operation o1108. For instance, in one or more exemplary implementations, the one or more providing media player instructions i1108, when executed, direct performance of the operation o1108 in the illustrative depiction as follows, and/or the providing media player electrical circuitry arrangement e1108, when activated, performs the operation o1108 in the illustrative depiction as follows, and/or the providing media player module m1108, when executed and/or activated, directs performance of and/or performs the operation o1108 in the illustrative depiction as follows, and/or the operation o1108 is otherwise carried out in the illustrative depiction as follows: the electronically providing (e.g. by reception of wireless transmission, etc.) audio output information (e.g. including note sequence information, etc.) to one or more portions (e.g. including one or more equalizer portions, etc.) of a portable electronic device (e.g. including one or more cell phone components, etc.) to be outputted (e.g. by one or more resonant surface portions, etc.) from said portable electronic device (e.g. including one or more digital music player components, etc.) via one or more acoustic ultrasonic signals (e.g. via one or more acoustic ultrasonic signals including signals having one or more frequencies above 80 kHz, etc.) via one or more media player portions of said portable electronic device (e.g. including one or more tablet mp4 player portions, etc.).

In one or more implementations, as shown in FIG. 56, operation o11 includes an operation o1109 for the electronically providing audio output information to one or more portions of a portable electronic device to be outputted from said portable electronic device via one or more acoustic ultrasonic signals through one or more audio player portions of said portable electronic device. Origination of an illustratively derived providing audio player component group can be accomplished through skilled in the art design choice selection of one or more of the above depicted components from one or more of the above depicted subsystems shown in FIG. 25. Components from the providing audio player component group can be used in implementing execution of the one or more providing audio player instructions i1109 of FIG. 39, can be used in performance of the providing audio player electrical circuitry arrangement e1109 of FIG. 32, and/or can be used in otherwise fulfillment of the operation o1109. An exemplary non-transitory signal bearing medium version of the information storage subsystem s200 is depicted in FIG. 39 as bearing the one or more providing audio player instructions i1109 that when executed will direct performance of the operation o1109. Furthermore, the providing audio player electrical circuitry arrangement ("elec circ arrange") e1109, when activated, will perform the operation o1109. Also, the providing audio player module m1109, when executed and/or activated, will direct performance of and/or perform the operation o1109. For instance, in one or more exemplary implementations, the one or more providing audio player instructions i1109, when executed, direct performance of the operation o1109 in the illustrative depiction as follows, and/or the providing audio player electrical circuitry arrangement e1109, when activated, performs the operation o1109 in the illustrative depiction as follows, and/or the providing audio player module m1109, when executed and/or activated, directs performance of and/or performs the operation o1109 in the illustrative depiction as follows, and/or the operation o1109 is otherwise carried out in the illustrative depiction as follows: the electronically providing (e.g. from memory stick access, etc.) audio output information (e.g. including two-way conversation information, etc.) to one or more portions (e.g. including one or more modulation portions, etc.) of a portable electronic device (e.g. including one or more laptop components, etc.) to be outputted (e.g. from one or more signal processor portions, etc.) from said portable electronic device (e.g. including one or more CD player components, etc.) via one or more acoustic ultrasonic signals (e.g. via one or more acoustic ultrasonic signals including signals having one or more frequencies above 100 kHz, etc.) through one or more audio player portions of said portable electronic device (e.g. including one or more mp3 player portions, etc.).

Figure 57:
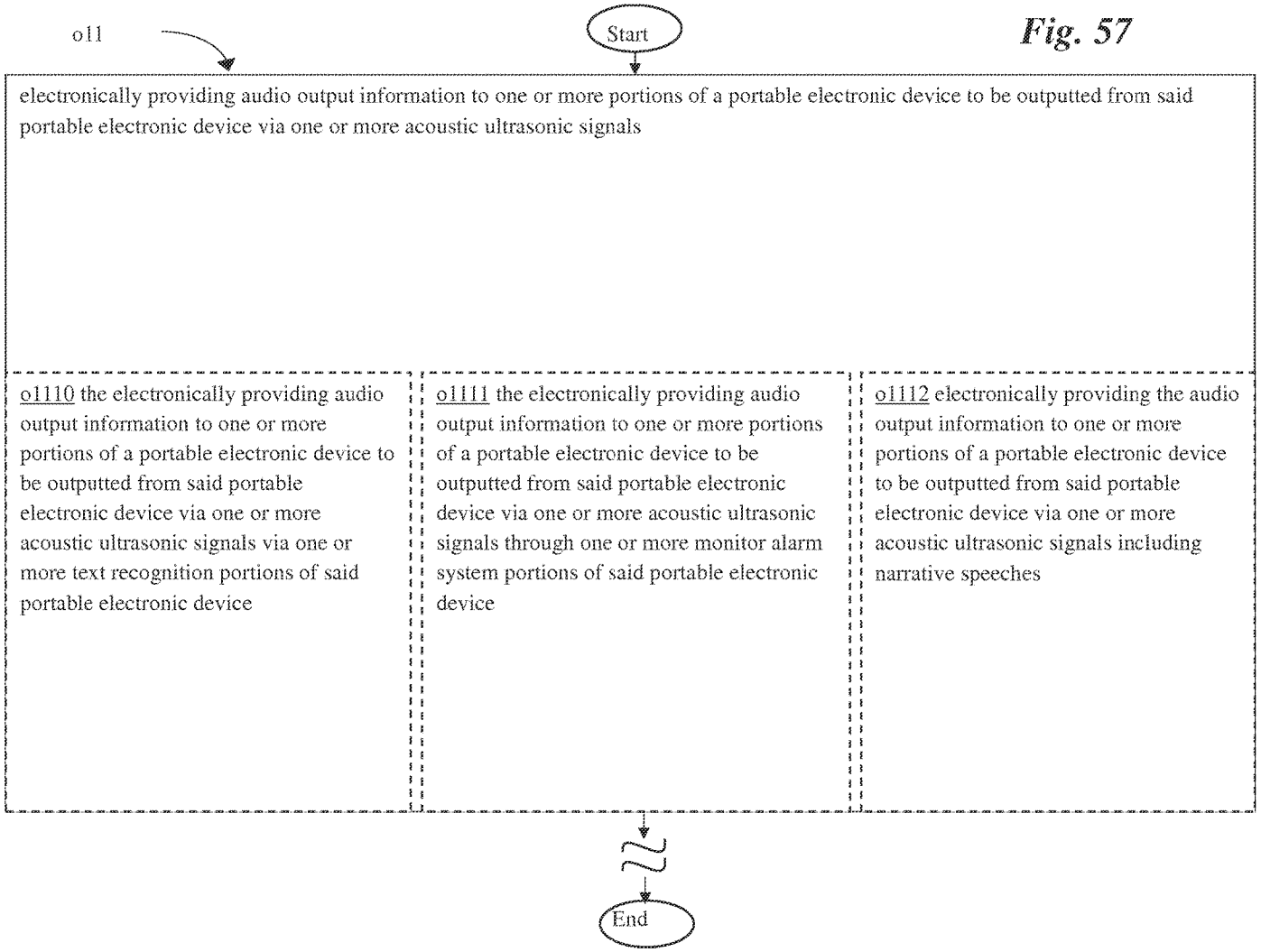
FIG. 57 is a high-level flowchart including exemplary implementations of operation o11 of FIG. 53.

In one or more implementations, as shown in FIG. 57, operation o11 includes an operation o1110 for the electronically providing audio output information to one or more portions of a portable electronic device to be outputted from said portable electronic device via one or more acoustic ultrasonic signals via one or more text recognition portions of said portable electronic device. Origination of an illustratively derived providing text recognition component group can be accomplished through skilled in the art design choice selection of one or more of the above depicted components from one or more of the above depicted subsystems shown in FIG. 25. Components from the providing text recognition component group can be used in implementing execution of the one or more providing text recognition instructions i1110 of FIG. 39, can be used in performance of the providing text recognition electrical circuitry arrangement e1110 of FIG. 32, and/or can be used in otherwise fulfillment of the operation o1110. An exemplary non-transitory signal bearing medium version of the information storage subsystem s200 is depicted in FIG. 39 as bearing the one or more providing text recognition instructions i1110 that when executed will direct performance of the operation o1110. Furthermore, the providing text recognition electrical circuitry arrangement ("elec circ arrange") e1110, when activated, will perform the operation o1110. Also, the providing text recognition module m1110, when executed and/or activated, will direct performance of and/or perform the operation o1110. For instance, in one or more exemplary implementations, the one or more providing text recognition instructions i1110, when executed, direct performance of the operation o1110 in the illustrative depiction as follows, and/or the providing text recognition electrical circuitry arrangement e1110, when activated, performs the operation o1110 in the illustrative depiction as follows, and/or the providing text recognition module m1110, when executed and/or activated, directs performance of and/or performs the operation o1110 in the illustrative depiction as follows, and/or the operation o1110 is otherwise carried out in the illustrative depiction as follows: the electronically providing (e.g. using flash drive stored data, etc.) audio output information (e.g. including confidential information, etc.) to one or more portions (e.g. including one or more signal mixing portions, etc.) of a portable electronic device (e.g. including one or more tablet computer components, etc.) to be outputted (e.g. using one or more transmitter portions, etc.) from said portable electronic device (e.g. including one or more digital audio output components, etc.) via one or more acoustic ultrasonic signals (e.g. via one or more acoustic ultrasonic signals including signals having one or more frequencies above 120 kHz, etc.) via one or more text recognition portions of said portable electronic device (e.g. including one or more laptop based text reading software portions, etc.).

In one or more implementations, as shown in FIG. 57, operation o11 includes an operation o1111 for the electronically providing audio output information to one or more portions of a portable electronic device to be outputted from said portable electronic device via one or more acoustic ultrasonic signals through one or more monitor alarm system portions of said portable electronic device. Origination of an illustratively derived providing monitor alarm component group can be accomplished through skilled in the art design choice selection of one or more of the above depicted components from one or more of the above depicted subsystems shown in FIG. 25. Components from the providing monitor alarm component group can be used in implementing execution of the one or more providing monitor alarm instructions i1111 of FIG. 39, can be used in performance of the providing monitor alarm electrical circuitry arrangement e1111 of FIG. 32, and/or can be used in otherwise fulfillment of the operation o1111. An exemplary non-transitory signal bearing medium version of the information storage subsystem s200 is depicted in FIG. 39 as bearing the one or more providing monitor alarm instructions i1111 that when executed will direct performance of the operation o1111. Furthermore, the providing monitor alarm electrical circuitry arrangement ("elec circ arrange") e1111, when activated, will perform the operation o1111. Also, the providing monitor alarm module m1111, when executed and/or activated, will direct performance of and/or perform the operation o1111. For instance, in one or more exemplary implementations, the one or more providing monitor alarm instructions i1111, when executed, direct performance of the operation o1111 in the illustrative depiction as follows, and/or the providing monitor alarm electrical circuitry arrangement e1111, when activated, performs the operation o1111 in the illustrative depiction as follows, and/or the providing monitor alarm module m1111, when executed and/or activated, directs performance of and/or performs the operation o1111 in the illustrative depiction as follows, and/or the operation o1111 is otherwise carried out in the illustrative depiction as follows: the electronically providing (e.g. through processor synthesized information, etc.) audio output information (e.g. including eavesdropping information, etc.) to one or more portions (e.g. including one or more ultrasonic generator portions, etc.) of a portable electronic device (e.g. including one or more mp3 player components, etc.) to be outputted (e.g. through one or more transducer membrane portions, etc.) from said portable electronic device (e.g. including one or more boombox components, etc.) via one or more acoustic ultrasonic signals (e.g. via one or more acoustic ultrasonic signals including signals having one or more frequencies above 140 kHz, etc.) through one or more monitor alarm system portions of said portable electronic device (e.g. including one or more alarm based motion sensor portions, etc.).

In one or more implementations, as shown in FIG. 57, operation o11 includes an operation o1112 for electronically providing the audio output information to one or more portions of a portable electronic device to be outputted from said portable electronic device via one or more acoustic ultrasonic signals including narrative speeches. Origination of an illustratively derived providing narrative component group can be accomplished through skilled in the art design choice selection of one or more of the above depicted components from one or more of the above depicted subsystems shown in FIG. 25. Components from the providing narrative component group can be used in implementing execution of the one or more providing narrative instructions i1112 of FIG. 39, can be used in performance of the providing narrative electrical circuitry arrangement e1112 of FIG. 32, and/or can be used in otherwise fulfillment of the operation o1112. An exemplary non-transitory signal bearing medium version of the information storage subsystem s200 is depicted in FIG. 39 as bearing the one or more providing narrative instructions i1112 that when executed will direct performance of the operation o1112. Furthermore, the providing narrative electrical circuitry arrangement ("elec circ arrange") e1112, when activated, will perform the operation o1112. Also, the providing narrative module m1112, when executed and/or activated, will direct performance of and/or perform the operation o1112. For instance, in one or more exemplary implementations, the one or more providing narrative instructions i1112, when executed, direct performance of the operation o1112 in the illustrative depiction as follows, and/or the providing narrative electrical circuitry arrangement e1112, when activated, performs the operation o1112 in the illustrative depiction as follows, and/or the providing narrative module m1112, when executed and/or activated, directs performance of and/or performs the operation o1112 in the illustrative depiction as follows, and/or the operation o1112 is otherwise carried out in the illustrative depiction as follows: electronically providing (e.g. via ROM drive reads, etc.) the audio output information (e.g. including pre-recorded information, etc.) to one or more portions (e.g. including one or more parametric modulation portions, etc.) of a portable electronic device (e.g. including one or more mobile phone components, etc.) to be outputted (e.g. via one or more transducer array portions, etc.) from said portable electronic device (e.g. including one or more portable computer components, etc.) via one or more acoustic ultrasonic signals (e.g. via one or more acoustic ultrasonic signals including signals having one or more frequencies above 160 kHz, etc.) including narrative speeches (e.g. including one or more online school classroom lectures, etc.).

Figure 58:
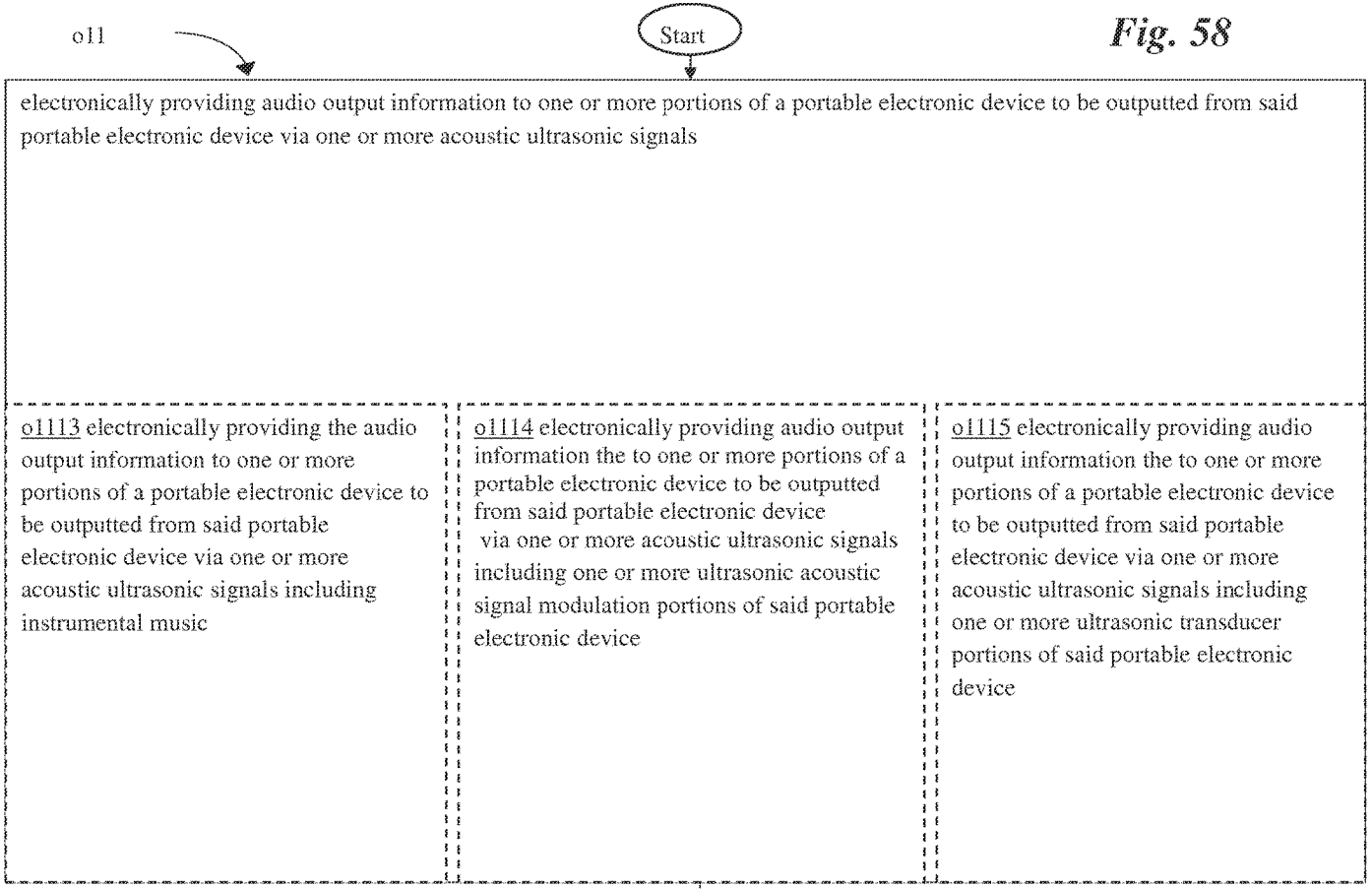
FIG. 58 is a high-level flowchart including exemplary implementations of operation o11 of FIG. 53.

In one or more implementations, as shown in FIG. 58, operation o11 includes an operation o1113 for electronically providing the audio output information to one or more portions of a portable electronic device to be outputted from said portable electronic device via one or more acoustic ultrasonic signals including instrumental music. Origination of an illustratively derived providing instrumental component group can be accomplished through skilled in the art design choice selection of one or more of the above depicted components from one or more of the above depicted subsystems shown in FIG. 25. Components from the providing instrumental component group can be used in implementing execution of the one or more providing instrumental instructions i1113 of FIG. 39, can be used in performance of the providing instrumental electrical circuitry arrangement e1113 of FIG. 32, and/or can be used in otherwise fulfillment of the operation o1113. An exemplary non-transitory signal bearing medium version of the information storage subsystem s200 is depicted in FIG. 39 as bearing the one or more providing instrumental instructions i1113 that when executed will direct performance of the operation o1113. Furthermore, the providing instrumental electrical circuitry arrangement ("elec circ arrange") e1113, when activated, will perform the operation o1113. Also, the providing instrumental module m1113, when executed and/or activated, will direct performance of and/or perform the operation o1113. For instance, in one or more exemplary implementations, the one or more providing instrumental instructions i1113, when executed, direct performance of the operation o1113 in the illustrative depiction as follows, and/or the providing instrumental electrical circuitry arrangement e1113, when activated, performs the operation o1113 in the illustrative depiction as follows, and/or the providing instrumental module m1113, when executed and/or activated, directs performance of and/or performs the operation o1113 in the illustrative depiction as follows, and/or the operation o1113 is otherwise carried out in the illustrative depiction as follows: electronically providing (e.g. by CD-ROM playback, etc.) the audio output information (e.g. including processor generated information, etc.) to one or more portions (e.g. including one or more nonlinear modulation portions, etc.) of a portable electronic device (e.g. including one or more two-way radio components, etc.) to be outputted (e.g. by one or more membrane speaker portions, etc.) from said portable electronic device (e.g. including one or more flip-phone components, etc.) via one or more acoustic ultrasonic signals (e.g. via one or more acoustic ultrasonic signals including signals having one or more frequencies above 180 kHz, etc.) including instrumental music (e.g. including one or more WAV file formatted music, etc.).

In one or more implementations, as shown in FIG. 58, operation o11 includes an operation o1114 for electronically providing audio output information the to one or more portions of a portable electronic device to be outputted from said portable electronic device via one or more acoustic ultrasonic signals including one or more ultrasonic acoustic signal modulation portions of said portable electronic device. Origination of an illustratively derived providing signal modulation component group can be accomplished through skilled in the art design choice selection of one or more of the above depicted components from one or more of the above depicted subsystems shown in FIG. 25. Components from the providing signal modulation component group can be used in implementing execution of the one or more providing signal modulation instructions i1114 of FIG. 39, can be used in performance of the providing signal modulation electrical circuitry arrangement e1114 of FIG. 32, and/or can be used in otherwise fulfillment of the operation o1114. An exemplary non-transitory signal bearing medium version of the information storage subsystem s200 is depicted in FIG. 39 as bearing the one or more providing signal modulation instructions i1114 that when executed will direct performance of the operation o1114. Furthermore, the providing signal modulation electrical circuitry arrangement ("elec circ arrange") e1114, when activated, will perform the operation o1114. Also, the providing signal modulation module m1114, when executed and/or activated, will direct performance of and/or perform the operation o1114. For instance, in one or more exemplary implementations, the one or more providing signal modulation instructions i1114, when executed, direct performance of the operation o1114 in the illustrative depiction as follows, and/or the providing signal modulation electrical circuitry arrangement e1114, when activated, performs the operation o1114 in the illustrative depiction as follows, and/or the providing signal modulation module m1114, when executed and/or activated, directs performance of and/or performs the operation o1114 in the illustrative depiction as follows, and/or the operation o1114 is otherwise carried out in the illustrative depiction as follows: electronically providing (e.g. from DVD player, etc.) audio output information (e.g. including internet based information, etc.) the to one or more portions (e.g. including one or more digital signal processing portions, etc.) of a portable electronic device (e.g. including one or more security network components, etc.) to be outputted (e.g. from one or more ultrasonic transducer portions, etc.) from said portable electronic device (e.g. including one or more ultrabook components, etc.) via one or more acoustic ultrasonic signals (e.g. via one or more acoustic ultrasonic signals including signals having one or more frequencies above 200 kHz, etc.) including one or more ultrasonic acoustic signal modulation portions of said portable electronic device (e.g. including one or more 120 kHz acoustic ultrasonic signals modulated with audio music signals of a tablet device, etc.).

In one or more implementations, as shown in FIG. 58, operation o11 includes an operation o1115 for electronically providing audio output information the to one or more portions of a portable electronic device to be outputted from said portable electronic device via one or more acoustic ultrasonic signals including one or more ultrasonic transducer portions of said portable electronic device. Origination of an illustratively derived providing ultrasonic transducer component group can be accomplished through skilled in the art design choice selection of one or more of the above depicted components from one or more of the above depicted subsystems shown in FIG. 25. Components from the providing ultrasonic transducer component group can be used in implementing execution of the one or more providing ultrasonic transducer instructions i1115 of FIG. 39, can be used in performance of the providing ultrasonic transducer electrical circuitry arrangement e1115 of FIG. 32, and/or can be used in otherwise fulfillment of the operation o1115. An exemplary non-transitory signal bearing medium version of the information storage subsystem s200 is depicted in FIG. 39 as bearing the one or more providing ultrasonic transducer instructions i1115 that when executed will direct performance of the operation o1115. Furthermore, the providing ultrasonic transducer electrical circuitry arrangement ("elec circ arrange") e1115, when activated, will perform the operation o1115. Also, the providing ultrasonic transducer module m1115, when executed and/or activated, will direct performance of and/or perform the operation o1115. For instance, in one or more exemplary implementations, the one or more providing ultrasonic transducer instructions i1115, when executed, direct performance of the operation o1115 in the illustrative depiction as follows, and/or the providing ultrasonic transducer electrical circuitry arrangement e1115, when activated, performs the operation o1115 in the illustrative depiction as follows, and/or the providing ultrasonic transducer module m1115, when executed and/or activated, directs performance of and/or performs the operation o1115 in the illustrative depiction as follows, and/or the operation o1115 is otherwise carried out in the illustrative depiction as follows: electronically providing (e.g. using mp3 media player, etc.) audio output information (e.g. including digital audio information, etc.) the to one or more portions (e.g. including one or more central processing unit portions, etc.) of a portable electronic device (e.g. including one or more netbook components, etc.) to be outputted (e.g. using one or more electrostatic transducer portions, etc.) from said portable electronic device (e.g. including one or more netbook components, etc.) via one or more acoustic ultrasonic signals (e.g. via multiple acoustic ultrasonic signals configured to be demodulated through mutual interference therewith to at least in part result in one or more acoustic audio signals, etc.) including one or more ultrasonic transducer portions of said portable electronic device (e.g. including one or more thin film transducer portions of a tablet computer, etc.).

Figure 59:
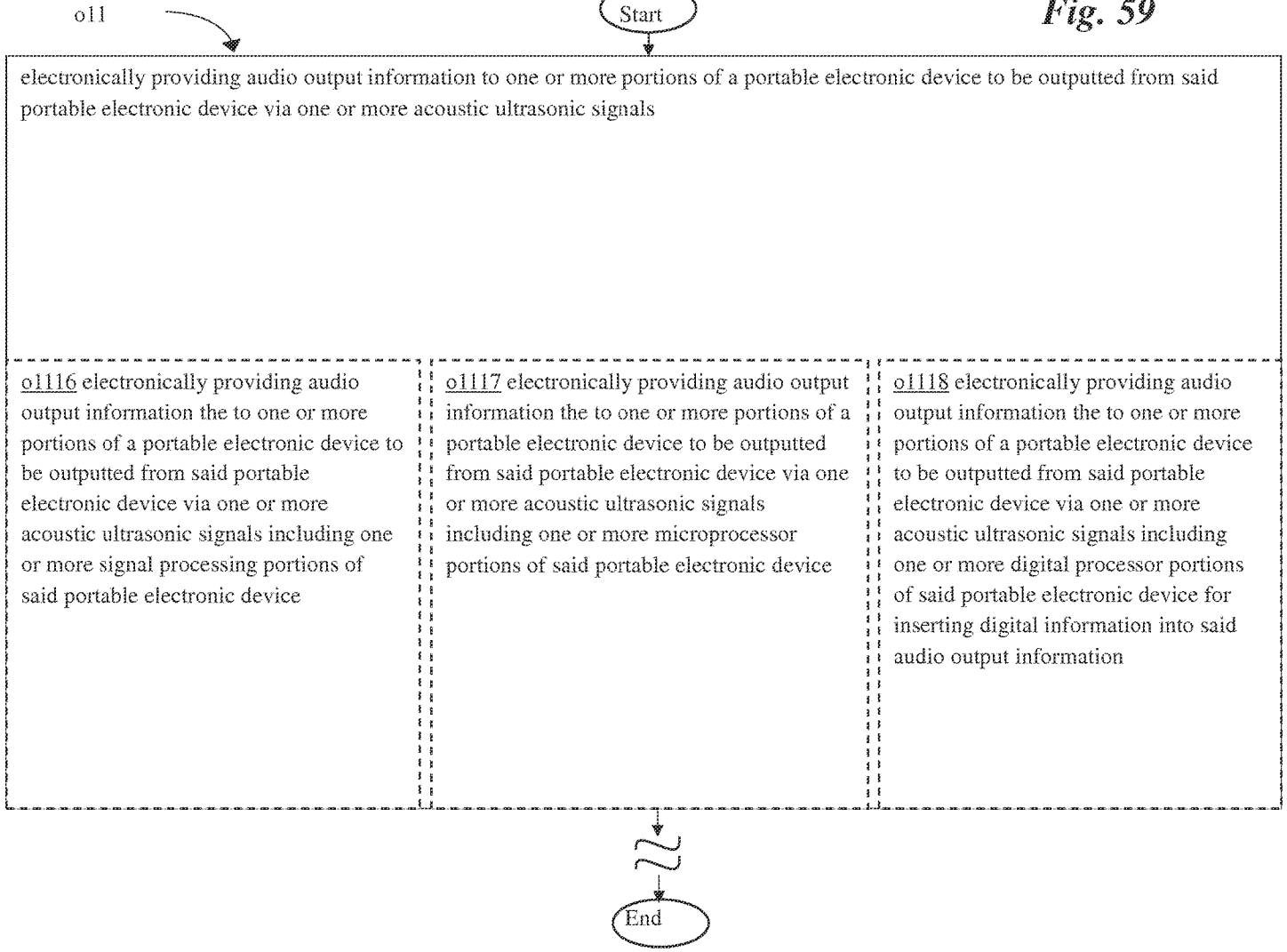
FIG. 59 is a high-level flowchart including exemplary implementations of operation o11 of FIG. 53.

In one or more implementations, as shown in FIG. 59, operation o11 includes an operation o1116 for electronically providing audio output information the to one or more portions of a portable electronic device to be outputted from said portable electronic device via one or more acoustic ultrasonic signals including one or more signal processing portions of said portable electronic device. Origination of an illustratively derived providing signal processing component group can be accomplished through skilled in the art design choice selection of one or more of the above depicted components from one or more of the above depicted subsystems shown in FIG. 25. Components from the providing signal processing component group can be used in implementing execution of the one or more providing signal processing instructions i1116 of FIG. 39, can be used in performance of the providing signal processing electrical circuitry arrangement e1116 of FIG. 32, and/or can be used in otherwise fulfillment of the operation o1116. An exemplary non-transitory signal bearing medium version of the information storage subsystem s200 is depicted in FIG. 39 as bearing the one or more providing signal processing instructions i1116 that when executed will direct performance of the operation o1116. Furthermore, the providing signal processing electrical circuitry arrangement ("elec circ arrange") e1116, when activated, will perform the operation o1116. Also, the providing signal processing module m1116, when executed and/or activated, will direct performance of and/or perform the operation o1116. For instance, in one or more exemplary implementations, the one or more providing signal processing instructions i1116, when executed, direct performance of the operation o1116 in the illustrative depiction as follows, and/or the providing signal processing electrical circuitry arrangement e1116, when activated, performs the operation o1116 in the illustrative depiction as follows, and/or the providing signal processing module m1116, when executed and/or activated, directs performance of and/or performs the operation o1116 in the illustrative depiction as follows, and/or the operation o1116 is otherwise carried out in the illustrative depiction as follows: electronically providing (e.g. through internet communication protocols, etc.) audio output information (e.g. including analog audio information, etc.) the to one or more portions (e.g. including one or more analog processor portions, etc.) of a portable electronic device (e.g. including one or more ultrabook components, etc.) to be outputted (e.g. through one or more piezoelectric transducer portions, etc.) from said portable electronic device (e.g. including one or more security network components, etc.) via one or more acoustic ultrasonic signals (e.g. via multiple acoustic ultrasonic signals configured to be demodulated through mutual interference therewith to at least in part result in one or more acoustic audio signals, etc.) including one or more signal processing portions of said portable electronic device (e.g. including one or more tablet signal compression processor portions, etc.).

In one or more implementations, as shown in FIG. 59, operation o11 includes an operation o1117 for electronically providing audio output information the to one or more portions of a portable electronic device to be outputted from said portable electronic device via one or more acoustic ultrasonic signals including one or more microprocessor portions of said portable electronic device. Origination of an illustratively derived providing microprocessor component group can be accomplished through skilled in the art design choice selection of one or more of the above depicted components from one or more of the above depicted subsystems shown in FIG. 25. Components from the providing microprocessor component group can be used in implementing execution of the one or more providing microprocessor instructions i1117 of FIG. 39, can be used in performance of the providing microprocessor electrical circuitry arrangement e1117 of FIG. 32, and/or can be used in otherwise fulfillment of the operation o1117. An exemplary non-transitory signal bearing medium version of the information storage subsystem s200 is depicted in FIG. 39 as bearing the one or more providing microprocessor instructions i1117 that when executed will direct performance of the operation o1117. Furthermore, the providing microprocessor electrical circuitry arrangement ("elec circ arrange") e1117, when activated, will perform the operation o1117. Also, the providing microprocessor module m1117, when executed and/or activated, will direct performance of and/or perform the operation o1117. For instance, in one or more exemplary implementations, the one or more providing microprocessor instructions i1117, when executed, direct performance of the operation o1117 in the illustrative depiction as follows, and/or the providing microprocessor electrical circuitry arrangement e1117, when activated, performs the operation o1117 in the illustrative depiction as follows, and/or the providing microprocessor module m1117, when executed and/or activated, directs performance of and/or performs the operation o1117 in the illustrative depiction as follows, and/or the operation o1117 is otherwise carried out in the illustrative depiction as follows: electronically providing (e.g. through reception of cable communication packets, etc.) audio output information (e.g. including high frequency audio information, etc.) the to one or more portions (e.g. including one or more digital decompression portions, etc.) of a portable electronic device (e.g. including one or more flip-phone components, etc.) to be outputted (e.g. via one or more electrostrictive transducer portions, etc.) from said portable electronic device (e.g. including one or more two-way radio components, etc.) via one or more acoustic ultrasonic signals (e.g. via multiple acoustic ultrasonic signals configured to be demodulated through mutual interference therewith to at least in part result in one or more acoustic audio signals, etc.) including one or more microprocessor portions of said portable electronic device (e.g. including one or more smart phone microprocessor portions, etc.).

In one or more implementations, as shown in FIG. 59, operation o11 includes an operation o1118 for electronically providing audio output information the to one or more portions of a portable electronic device to be outputted from said portable electronic device via one or more acoustic ultrasonic signals including one or more digital processor portions of said portable electronic device for inserting digital information into said audio output information. Origination of an illustratively derived providing for inserting digital component group can be accomplished through skilled in the art design choice selection of one or more of the above depicted components from one or more of the above depicted subsystems shown in FIG. 25. Components from the providing for inserting digital component group can be used in implementing execution of the one or more providing for inserting digital instructions i1118 of FIG. 39, can be used in performance of the providing for inserting digital electrical circuitry arrangement e1118 of FIG. 32, and/or can be used in otherwise fulfillment of the operation o1118. An exemplary non-transitory signal bearing medium version of the information storage subsystem s200 is depicted in FIG. 39 as bearing the one or more providing for inserting digital instructions i1118 that when executed will direct performance of the operation o1118. Furthermore, the providing for inserting digital electrical circuitry arrangement ("elec circ arrange") e1118, when activated, will perform the operation o1118. Also, the providing for inserting digital module m1118, when executed and/or activated, will direct performance of and/or perform the operation o1118. For instance, in one or more exemplary implementations, the one or more providing for inserting digital instructions i1118, when executed, direct performance of the operation o1118 in the illustrative depiction as follows, and/or the providing for inserting digital electrical circuitry arrangement e1118, when activated, performs the operation o1118 in the illustrative depiction as follows, and/or the providing for inserting digital module m1118, when executed and/or activated, directs performance of and/or performs the operation o1118 in the illustrative depiction as follows, and/or the operation o1118 is otherwise carried out in the illustrative depiction as follows: electronically providing (e.g. through reception of cable communication packets, etc.) audio output information (e.g. including low frequency audio information, etc.) the to one or more portions (e.g. including one or more ultrasonic signal modulation portions, etc.) of a portable electronic device (e.g. including one or more portable computer components, etc.) to be outputted (e.g. by one or more electro-thermo-mechanical film transducer portions, etc.) from said portable electronic device (e.g. including one or more mobile phone components, etc.) via one or more acoustic ultrasonic signals (e.g. via multiple acoustic ultrasonic signals configured to be demodulated through mutual interference therewith to at least in part result in one or more acoustic audio signals, etc.) including one or more digital processor portions of said portable electronic device for inserting digital information into said audio output information (e.g. including one or more tablet processor portions to insert one or more digital signatures to track acoustic audio reception quality from a notebook computer, etc.).

Figure 60:
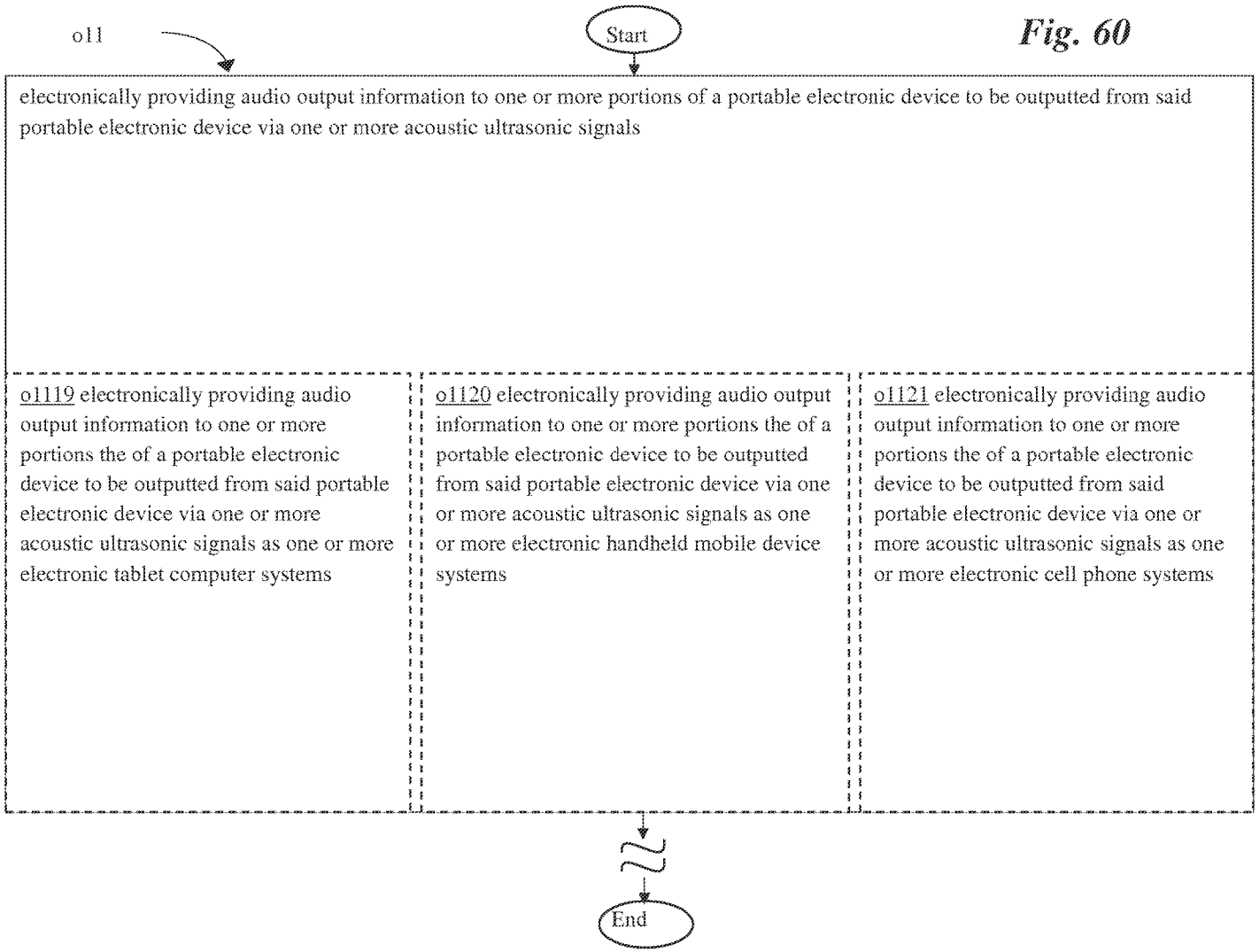
FIG. 60 is a high-level flowchart including exemplary implementations of operation o11 of FIG. 53.

In one or more implementations, as shown in FIG. 60, operation o11 includes an operation o1119 for electronically providing audio output information to one or more portions the of a portable electronic device to be outputted from said portable electronic device via one or more acoustic ultrasonic signals as one or more electronic tablet computer systems. Origination of an illustratively derived providing tablet computer component group can be accomplished through skilled in the art design choice selection of one or more of the above depicted components from one or more of the above depicted subsystems shown in FIG. 25. Components from the providing tablet computer component group can be used in implementing execution of the one or more providing tablet computer instructions i1119 of FIG. 39, can be used in performance of the providing tablet computer electrical circuitry arrangement e1119 of FIG. 32, and/or can be used in otherwise fulfillment of the operation o1119. An exemplary non-transitory signal bearing medium version of the information storage subsystem s200 is depicted in FIG.

39 as bearing the one or more providing tablet computer instructions i1119 that when executed will direct performance of the operation o1119. Furthermore, the providing tablet computer electrical circuitry arrangement ("elec circ arrange") e1119, when activated, will perform the operation o1119. Also, the providing tablet computer module m1119, when executed and/or activated, will direct performance of and/or perform the operation o1119. For instance, in one or more exemplary implementations, the one or more providing tablet computer instructions i1119, when executed, direct performance of the operation o1119 in the illustrative depiction as follows, and/or the providing tablet computer electrical circuitry arrangement e1119, when activated, performs the operation o1119 in the illustrative depiction as follows, and/or the providing tablet computer module m1119, when executed and/or activated, directs performance of and/or performs the operation o1119 in the illustrative depiction as follows, and/or the operation o1119 is otherwise carried out in the illustrative depiction as follows: electronically providing (e.g. through reception of cable communication packets, etc.) audio output information (e.g. including lecture formatted information, etc.) to one or more portions (e.g. including one or more electronic storage portions, etc.) the of a portable electronic device (e.g. including one or more boombox components, etc.) to be outputted (e.g. from one or more polyvinylidene fluoride film transducer portions, etc.) from said portable electronic device (e.g. including one or more mp3 player components, etc.) via one or more acoustic ultrasonic signals (e.g. via multiple acoustic ultrasonic signals configured to be demodulated through mutual interference therewith to at least in part result in one or more acoustic audio signals, etc.) as one or more electronic tablet computer systems (e.g. including one or more 4G capable tablet computer portions, etc.).

In one or more implementations, as shown in FIG. 60, operation o11 includes an operation o1120 for electronically providing audio output information to one or more portions the of a portable electronic device to be outputted from said portable electronic device via one or more acoustic ultrasonic signals as one or more electronic handheld mobile device systems. Origination of an illustratively derived providing handheld mobile component group can be accomplished through skilled in the art design choice selection of one or more of the above depicted components from one or more of the above depicted subsystems shown in FIG. 25. Components from the providing handheld mobile component group can be used in implementing execution of the one or more providing handheld mobile instructions i1120 of FIG. 40, can be used in performance of the providing handheld mobile electrical circuitry arrangement e1120 of FIG. 33, and/or can be used in otherwise fulfillment of the operation o1120. An exemplary non-transitory signal bearing medium version of the information storage subsystem s200 is depicted in FIG. 40 as bearing the one or more providing handheld mobile instructions i1120 that when executed will direct performance of the operation o1120. Furthermore, the providing handheld mobile electrical circuitry arrangement ("elec circ arrange") e1120, when activated, will perform the operation o1120. Also, the providing handheld mobile module m1120, when executed and/or activated, will direct performance of and/or perform the operation o1120. For instance, in one or more exemplary implementations, the one or more providing handheld mobile instructions i1120, when executed, direct performance of the operation o1120 in the illustrative depiction as follows, and/or the providing handheld mobile electrical circuitry arrangement e1120, when activated, performs the operation o1120 in the illustrative depiction as follows, and/or the providing handheld mobile module m1120, when executed and/or activated, directs performance of and/or performs the operation o1120 in the illustrative depiction as follows, and/or the operation o1120 is otherwise carried out in the illustrative depiction as follows: electronically providing (e.g. through reception of cable communication packets, etc.) audio output information (e.g. including lecture formatted information, etc.) to one or more portions (e.g. including one or more random access memory portions, etc.) the of a portable electronic device (e.g. including one or more digital audio output components, etc.) to be outputted (e.g. using one or more deposition transducer portions, etc.) from said portable electronic device (e.g. including one or more tablet computer components, etc.) via one or more acoustic ultrasonic signals (e.g. via multiple acoustic ultrasonic signals configured to be demodulated through mutual interference therewith to at least in part result in one or more acoustic audio signals, etc.) as one or more electronic handheld mobile device systems (e.g. including one or more smart phone portions, etc.).

In one or more implementations, as shown in FIG. 60, operation o11 includes an operation o1121 for electronically providing audio output information to one or more portions the of a portable electronic device to be outputted from said portable electronic device via one or more acoustic ultrasonic signals as one or more electronic cell phone systems. Origination of an illustratively derived providing cell phone component group can be accomplished through skilled in the art design choice selection of one or more of the above depicted components from one or more of the above depicted subsystems shown in FIG. 25. Components from the providing cell phone component group can be used in implementing execution of the one or more providing cell phone instructions i1121 of FIG. 40, can be used in performance of the providing cell phone electrical circuitry arrangement e1121 of FIG. 33, and/or can be used in otherwise fulfillment of the operation o1121. An exemplary non-transitory signal bearing medium version of the information storage subsystem s200 is depicted in FIG. 40 as bearing the one or more providing cell phone instructions i1121 that when executed will direct performance of the operation o1121. Furthermore, the providing cell phone electrical circuitry arrangement ("elec circ arrange") e1121, when activated, will perform the operation o1121. Also, the providing cell phone module m1121, when executed and/or activated, will direct performance of and/or perform the operation o1121. For instance, in one or more exemplary implementations, the one or more providing cell phone instructions i1121, when executed, direct performance of the operation o1121 in the illustrative depiction as follows, and/or the providing cell phone electrical circuitry arrangement e1121, when activated, performs the operation o1121 in the illustrative depiction as follows, and/or the providing cell phone module m1121, when executed and/or activated, directs performance of and/or performs the operation o1121 in the illustrative depiction as follows, and/or the operation o1121 is otherwise carried out in the illustrative depiction as follows: electronically providing (e.g. through reception of cable communication packets, etc.) audio output information (e.g. including lecture formatted information, etc.) to one or more portions (e.g. including one or more flash drive portions, etc.) the of a portable electronic device (e.g. including one or more CD player components, etc.) to be outputted (e.g. through one or more emitter array portions, etc.) from said portable electronic device (e.g. including one or more laptop components, etc.) via one or more acoustic ultrasonic signals (e.g. via multiple acoustic ultrasonic signals configured to be demodulated through mutual interference therewith to at least in part result in one or more acoustic audio signals, etc.) as one or more electronic cell phone systems (e.g. including one or more cellular flip-phone portions, etc.).

Figure 61:
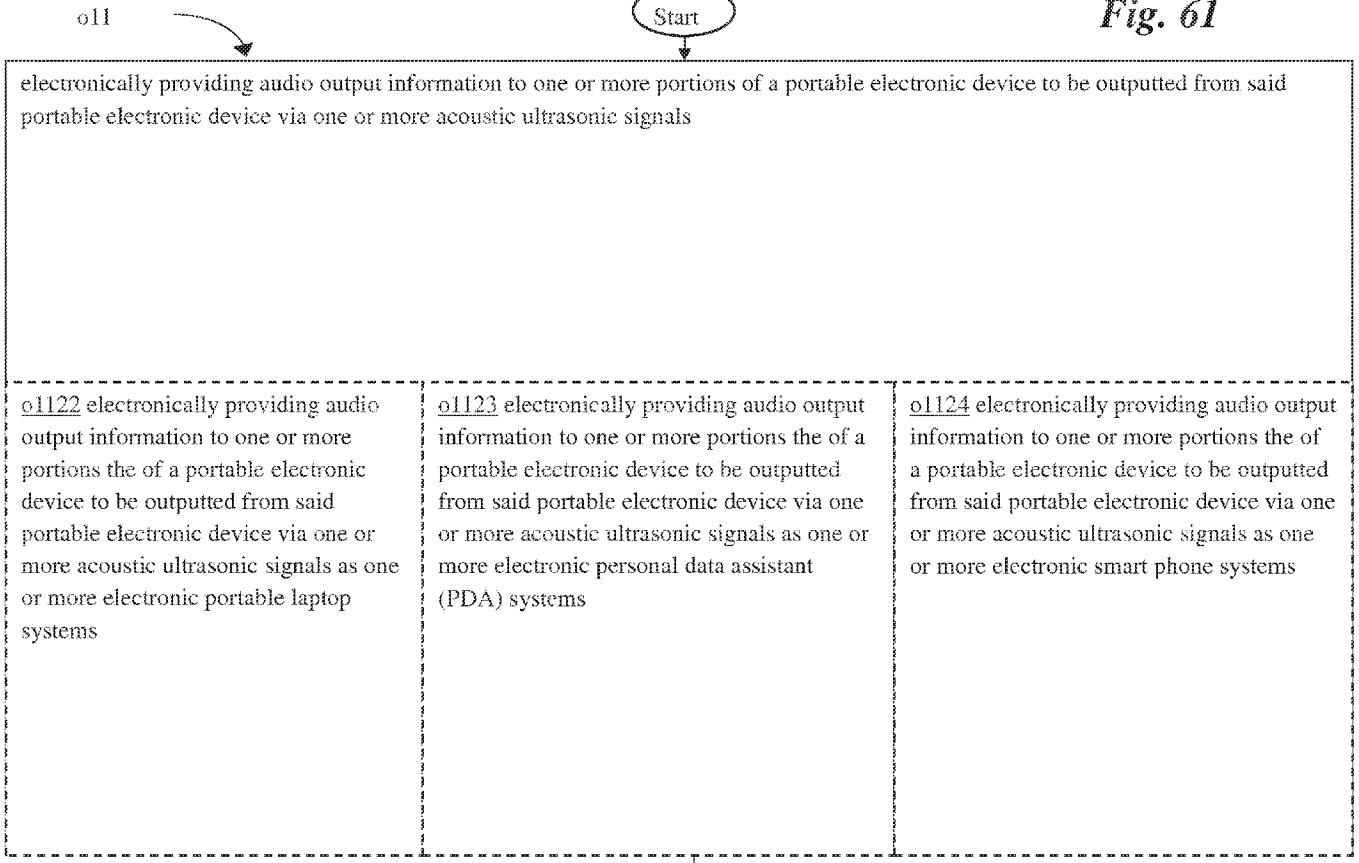
FIG. 61 is a high-level flowchart including exemplary implementations of operation o11 of FIG. 53.

In one or more implementations, as shown in FIG. 61, operation o11 includes an operation o1122 for electronically providing audio output information to one or more portions the of a portable electronic device to be outputted from said portable electronic device via one or more acoustic ultrasonic signals as one or more electronic portable laptop systems. Origination of an illustratively derived providing portable laptop component group can be accomplished through skilled in the art design choice selection of one or more of the above depicted components from one or more of the above depicted subsystems shown in FIG. 25. Components from the providing portable laptop component group can be used in implementing execution of the one or more providing portable laptop instructions i1122 of FIG. 40, can be used in performance of the providing portable laptop electrical circuitry arrangement e1122 of FIG. 33, and/or can be used in otherwise fulfillment of the operation o1122. An exemplary non-transitory signal bearing medium version of the information storage subsystem s200 is depicted in FIG. 40 as bearing the one or more providing portable laptop instructions i1122 that when executed will direct performance of the operation o1122. Furthermore, the providing portable laptop electrical circuitry arrangement ("elec circ arrange") e1122, when activated, will perform the operation o1122. Also, the providing portable laptop module m1122, when executed and/or activated, will direct performance of and/or perform the operation o1122. For instance, in one or more exemplary implementations, the one or more providing portable laptop instructions i1122, when executed, direct performance of the operation o1122 in the illustrative depiction as follows, and/or the providing portable laptop electrical circuitry arrangement e1122, when activated, performs the operation o1122 in the illustrative depiction as follows, and/or the providing portable laptop module m1122, when executed and/or activated, directs performance of and/or performs the operation o1122 in the illustrative depiction as follows, and/or the operation o1122 is otherwise carried out in the illustrative depiction as follows: electronically providing (e.g. through reception of cable communication packets, etc.) audio output information (e.g. including lecture formatted information, etc.) to one or more portions (e.g. including one or more portable memory portions, etc.) the of a portable electronic device (e.g. including one or more digital music player components, etc.) to be outputted (e.g. via one or more dispersed transducer portions, etc.) from said portable electronic device (e.g. including one or more cell phone components, etc.) via one or more acoustic ultrasonic signals (e.g. via multiple acoustic ultrasonic signals configured to be demodulated through mutual interference therewith to at least in part result in one or more acoustic audio signals, etc.) as one or more electronic portable laptop systems (e.g. including one or more business laptop portions, etc.).

In one or more implementations, as shown in FIG. 61, operation o11 includes an operation o1123 for electronically providing audio output information to one or more portions the of a portable electronic device to be outputted from said portable electronic device via one or more acoustic ultrasonic signals as one or more electronic personal data assistant (PDA) systems. Origination of an illustratively derived providing PDA component group can be accomplished through skilled in the art design choice selection of one or more of the above depicted components from one or more of the above depicted subsystems shown in FIG. 25. Components from the providing PDA component group can be used in implementing execution of the one or more providing PDA instructions i1123 of FIG. 40, can be used in performance of the providing PDA electrical circuitry arrangement e1123 of FIG. 33, and/or can be used in otherwise fulfillment of the operation o1123. An exemplary non-transitory signal bearing medium version of the information storage subsystem s200 is depicted in FIG. 40 as bearing the one or more providing PDA instructions i1123 that when executed will direct performance of the operation o1123. Furthermore, the providing PDA electrical circuitry arrangement ("elec circ arrange") e1123, when activated, will perform the operation o1123. Also, the providing PDA module m1123, when executed and/or activated, will direct performance of and/or perform the operation o1123. For instance, in one or more exemplary implementations, the one or more providing PDA instructions i1123, when executed, direct performance of the operation o1123 in the illustrative depiction as follows, and/or the providing PDA electrical circuitry arrangement e1123, when activated, performs the operation o1123 in the illustrative depiction as follows, and/or the providing PDA module m1123, when executed and/or activated, directs performance of and/or performs the operation o1123 in the illustrative depiction as follows, and/or the operation o1123 is otherwise carried out in the illustrative depiction as follows: electronically providing (e.g. through reception of cable communication packets, etc.) audio output information (e.g. including lecture formatted information, etc.) to one or more portions (e.g. including one or more backup storage portions, etc.) the of a portable electronic device (e.g. including one or more handheld radio components, etc.) to be outputted (e.g. by one or more monitor embedded transducer portions, etc.) from said portable electronic device (e.g. including one or more smart phone components, etc.) via one or more acoustic ultrasonic signals (e.g. via multiple acoustic ultrasonic signals configured to be demodulated through mutual interference therewith to at least in part result in one or more acoustic audio signals, etc.) as one or more electronic personal data assistant (PDA) systems (e.g. including one or more credit card sized electronic managers, etc.).

In one or more implementations, as shown in FIG. 61, operation o11 includes an operation o1124 for electronically providing audio output information to one or more portions the of a portable electronic device to be outputted from said portable electronic device via one or more acoustic ultrasonic signals as one or more electronic smart phone systems. Origination of an illustratively derived providing smart phone component group can be accomplished through skilled in the art design choice selection of one or more of the above depicted components from one or more of the above depicted subsystems shown in FIG. 25. Components from the providing smart phone component group can be used in implementing execution of the one or more providing smart phone instructions i1124 of FIG. 40, can be used in performance of the providing smart phone electrical circuitry arrangement e1124 of FIG. 33, and/or can be used in otherwise fulfillment of the operation o1124. An exemplary non-transitory signal bearing medium version of the information storage subsystem s200 is depicted in FIG. 40 as bearing the one or more providing smart phone instructions i1124 that when executed will direct performance of the operation o1124. Furthermore, the providing smart phone electrical circuitry arrangement ("elec circ arrange")

e1124, when activated, will perform the operation o1124. Also, the providing smart phone module m1124, when executed and/or activated, will direct performance of and/or perform the operation o1124. For instance, in one or more exemplary implementations, the one or more providing smart phone instructions i1124, when executed, direct performance of the operation o1124 in the illustrative depiction as follows, and/or the providing smart phone electrical circuitry arrangement e1124, when activated, performs the operation o1124 in the illustrative depiction as follows, and/or the providing smart phone module m1124, when executed and/or activated, directs performance of and/or performs the operation o1124 in the illustrative depiction as follows, and/or the operation o1124 is otherwise carried out in the illustrative depiction as follows: electronically providing (e.g. through reception of cable communication packets, etc.) audio output information (e.g. including lecture formatted information, etc.) to one or more portions (e.g. including one or more network interface portions, etc.) the of a portable electronic device (e.g. including one or more spread spectrum components, etc.) to be outputted (e.g. from one or more keyboard embedded transducer portions, etc.) from said portable electronic device (e.g. including one or more personal digital assistant components, etc.) via one or more acoustic ultrasonic signals (e.g. via multiple acoustic ultrasonic signals configured to be demodulated through mutual interference therewith to at least in part result in one or more acoustic audio signals, etc.) as one or more electronic smart phone systems (e.g. including one or more 4G smart phone systems, etc.).

Figure 62:
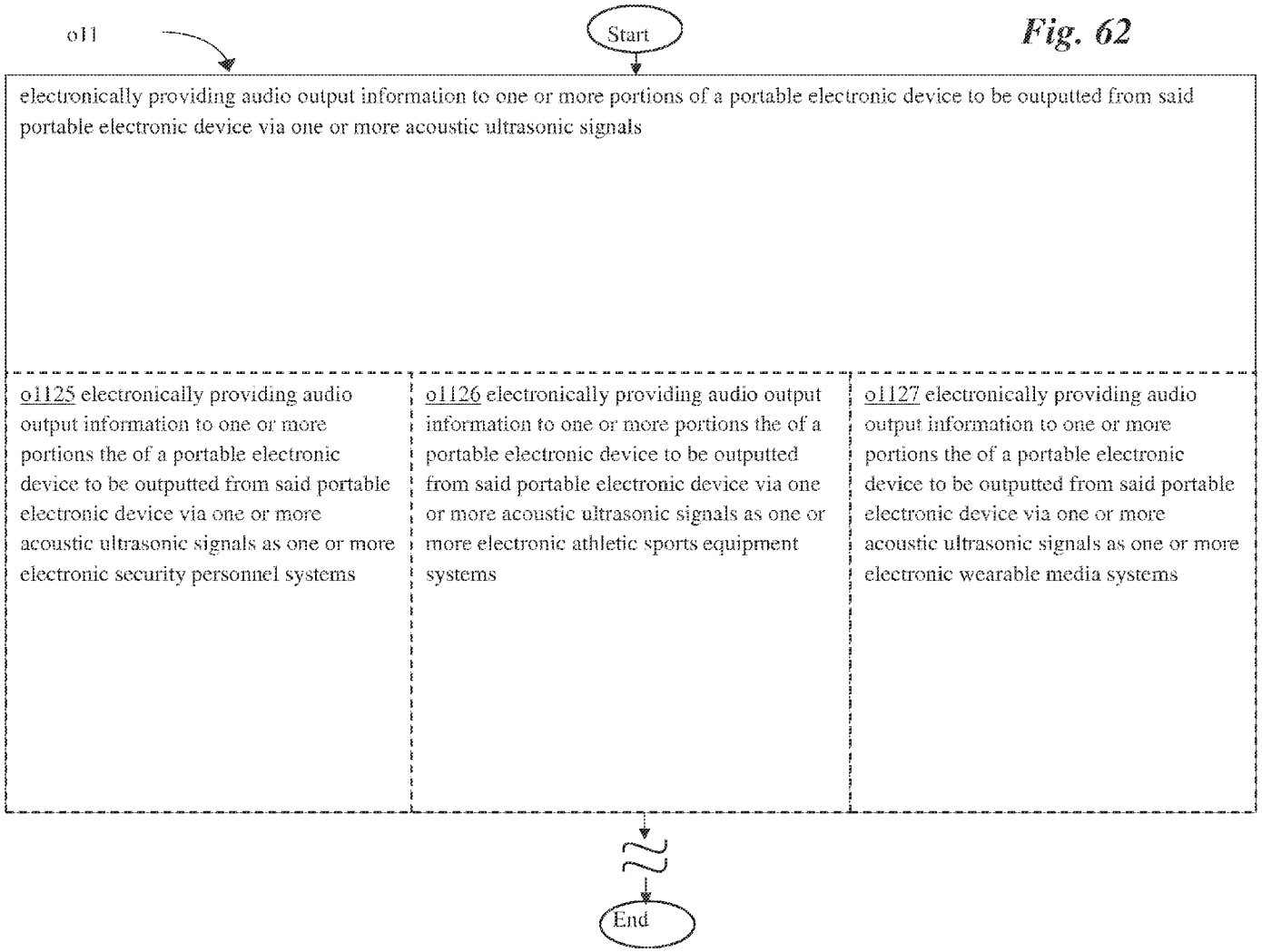
FIG. 62 is a high-level flowchart including exemplary implementations of operation o11 of FIG. 53.

In one or more implementations, as shown in FIG. 62, operation o11 includes an operation o1125 for electronically providing audio output information to one or more portions the of a portable electronic device to be outputted from said portable electronic device via one or more acoustic ultrasonic signals as one or more electronic security personnel systems. Origination of an illustratively derived providing security personnel component group can be accomplished through skilled in the art design choice selection of one or more of the above depicted components from one or more of the above depicted subsystems shown in FIG. 25. Components from the providing security personnel component group can be used in implementing execution of the one or more providing security personnel instructions i1125 of FIG. 40, can be used in performance of the providing security personnel electrical circuitry arrangement e1125 of FIG. 33, and/or can be used in otherwise fulfillment of the operation o1125. An exemplary non-transitory signal bearing medium version of the information storage subsystem s200 is depicted in FIG. 40 as bearing the one or more providing security personnel instructions i1125 that when executed will direct performance of the operation o1125. Furthermore, the providing security personnel electrical circuitry arrangement ("elec circ arrange") e1125, when activated, will perform the operation o1125. Also, the providing security personnel module m1125, when executed and/or activated, will direct performance of and/or perform the operation o1125. For instance, in one or more exemplary implementations, the one or more providing security personnel instructions i1125, when executed, direct performance of the operation o1125 in the illustrative depiction as follows, and/or the providing security personnel electrical circuitry arrangement e1125, when activated, performs the operation o1125 in the illustrative depiction as follows, and/or the providing security personnel module m1125, when executed and/or activated, directs performance of and/or performs the operation o1125 in the illustrative depiction as follows, and/or the operation o1125 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) the of a portable electronic device (e.g. including one or more wireless components, etc.) to be outputted (e.g. using one or more device body embedded transducer portions, etc.) from said portable electronic device (e.g. including one or more infrared components, etc.) via one or more acoustic ultrasonic signals (e.g. via multiple acoustic ultrasonic signals configured to be demodulated through mutual interference therewith to at least in part result in one or more acoustic audio signals, etc.) as one or more electronic security personnel systems (e.g. including one or more two-way radio portions, etc.).

In one or more implementations, as shown in FIG. 62, operation o11 includes an operation o1126 for electronically providing audio output information to one or more portions the of a portable electronic device to be outputted from said portable electronic device via one or more acoustic ultrasonic signals as one or more electronic athletic sports equipment systems. Origination of an illustratively derived providing athletic sports component group can be accomplished through skilled in the art design choice selection of one or more of the above depicted components from one or more of the above depicted subsystems shown in FIG. 25. Components from the providing athletic sports component group can be used in implementing execution of the one or more providing athletic sports instructions i1126 of FIG. 40, can be used in performance of the providing athletic sports electrical circuitry arrangement e1126 of FIG. 33, and/or can be used in otherwise fulfillment of the operation o1126. An exemplary non-transitory signal bearing medium version of the information storage subsystem s200 is depicted in FIG. 40 as bearing the one or more providing athletic sports instructions i1126 that when executed will direct performance of the operation o1126. Furthermore, the providing athletic sports electrical circuitry arrangement ("elec circ arrange") e1126, when activated, will perform the operation o1126. Also, the providing athletic sports module m1126, when executed and/or activated, will direct performance of and/or perform the operation o1126. For instance, in one or more exemplary implementations, the one or more providing athletic sports instructions i1126, when executed, direct performance of the operation o1126 in the illustrative depiction as follows, and/or the providing athletic sports electrical circuitry arrangement e1126, when activated, performs the operation o1126 in the illustrative depiction as follows, and/or the providing athletic sports module m1126, when executed and/or activated, directs performance of and/or performs the operation o1126 in the illustrative depiction as follows, and/or the operation o1126 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) the of a portable electronic device (e.g. including one or more frequency division multiplexing components, etc.) to be outputted (e.g. through one or more device perimeter embedded transducer portions, etc.) from said portable electronic device (e.g. including one or more WiFi components, etc.) via one or more acoustic ultrasonic signals (e.g. via multiple acoustic ultrasonic signals configured to be demodulated through mutual interference therewith to at least in part result in one or more acoustic audio signals, etc.) as one or more electronic athletic sports equipment systems (e.g. including one or more integrated sports helmet communication portions, etc.).

In one or more implementations, as shown in FIG. 62, operation o11 includes an operation o1127 for electronically providing audio output information to one or more portions the of a portable electronic device to be outputted from said portable electronic device via one or more acoustic ultrasonic signals as one or more electronic wearable media systems. Origination of an illustratively derived providing wearable media component group can be accomplished through skilled in the art design choice selection of one or more of the above depicted components from one or more of the above depicted subsystems shown in FIG. 25. Components from the providing wearable media component group can be used in implementing execution of the one or more providing wearable media instructions i1127 of FIG. 40, can be used in performance of the providing wearable media electrical circuitry arrangement e1127 of FIG. 33, and/or can be used in otherwise fulfillment of the operation o1127. An exemplary non-transitory signal bearing medium version of the information storage subsystem s200 is depicted in FIG. 40 as bearing the one or more providing wearable media instructions i1127 that when executed will direct performance of the operation o1127. Furthermore, the providing wearable media electrical circuitry arrangement ("elec circ arrange") e1127, when activated, will perform the operation o1127. Also, the providing wearable media module m1127, when executed and/or activated, will direct performance of and/or perform the operation o1127. For instance, in one or more exemplary implementations, the one or more providing wearable media instructions i1127, when executed, direct performance of the operation o1127 in the illustrative depiction as follows, and/or the providing wearable media electrical circuitry arrangement e1127, when activated, performs the operation o1127 in the illustrative depiction as follows, and/or the providing wearable media module m1127, when executed and/or activated, directs performance of and/or performs the operation o1127 in the illustrative depiction as follows, and/or the operation o1127 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions 1, etc.) the of a portable electronic device (e.g. including one or more time division multiplexing components, etc.) to be outputted (e.g. via one or more multiple emitter array portions, etc.) from said portable electronic device (e.g. including one or more 4G components, etc.) via one or more acoustic ultrasonic signals (e.g. via multiple acoustic ultrasonic signals configured to be demodulated through mutual interference therewith to at least in part result in one or more acoustic audio signals, etc.) as one or more electronic wearable media systems (e.g. including one or more coat based computer based portions, etc.).

Figure 63:
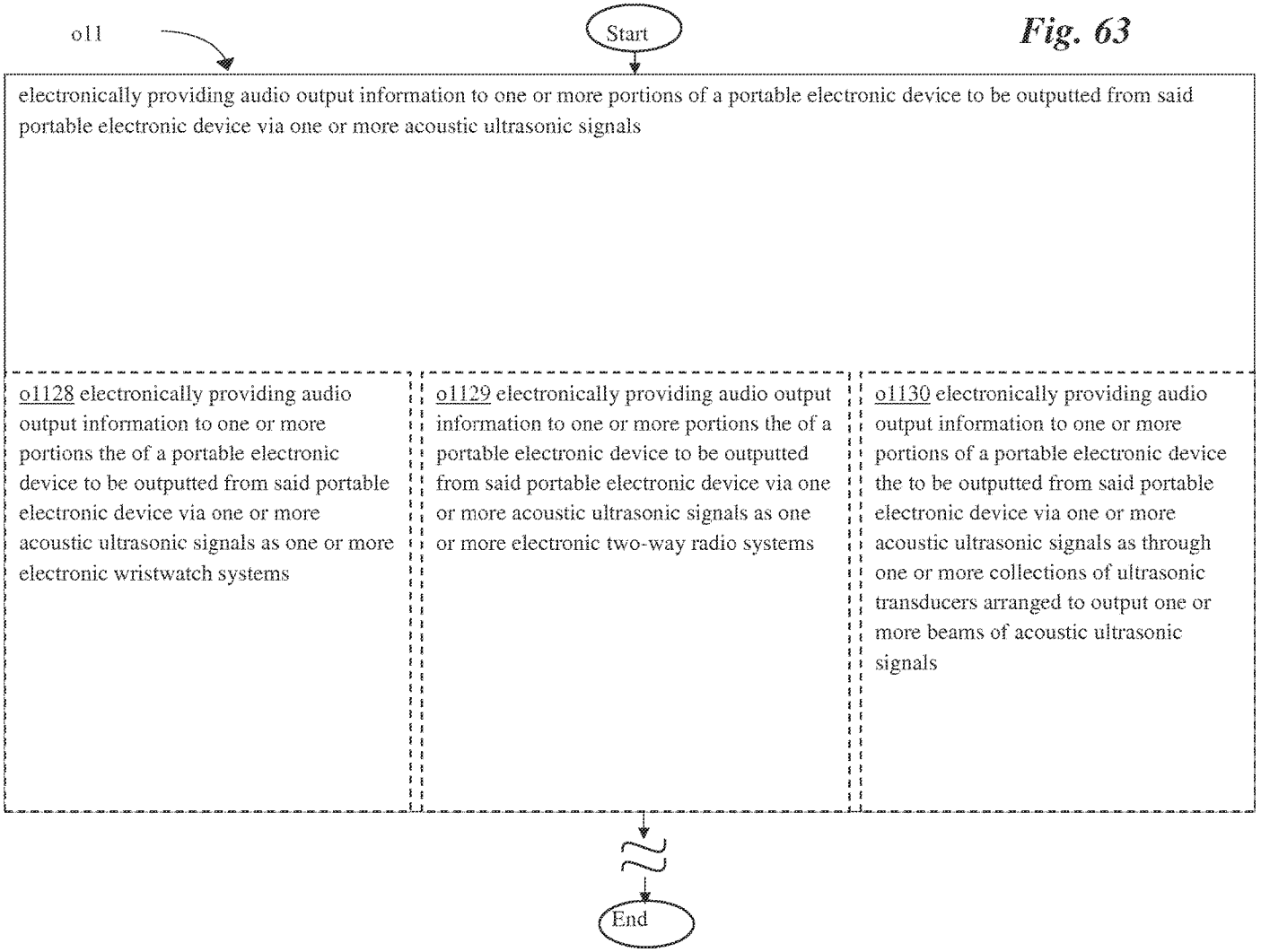
FIG. 63 is a high-level flowchart including exemplary implementations of operation o11 of FIG. 53.

In one or more implementations, as shown in FIG. 63, operation o11 includes an operation o1128 for electronically providing audio output information to one or more portions the of a portable electronic device to be outputted from said portable electronic device via one or more acoustic ultrasonic signals as one or more electronic wristwatch systems. Origination of an illustratively derived providing wristwatch component group can be accomplished through skilled in the art design choice selection of one or more of the above depicted components from one or more of the above depicted subsystems shown in FIG. 25. Components from the providing wristwatch component group can be used in implementing execution of the one or more providing wristwatch instructions i1128 of FIG. 40, can be used in performance of the providing wristwatch electrical circuitry arrangement e1128 of FIG. 33, and/or can be used in otherwise fulfillment of the operation o1128. An exemplary non-transitory signal bearing medium version of the information storage subsystem s200 is depicted in FIG. 40 as bearing the one or more providing wristwatch instructions i1128 that when executed will direct performance of the operation o1128. Furthermore, the providing wristwatch electrical circuitry arrangement ("elec circ arrange") e1128, when activated, will perform the operation o1128. Also, the providing wristwatch module m1128, when executed and/or activated, will direct performance of and/or perform the operation o1128. For instance, in one or more exemplary implementations, the one or more providing wristwatch instructions i1128, when executed, direct performance of the operation o1128 in the illustrative depiction as follows, and/or the providing wristwatch electrical circuitry arrangement e1128, when activated, performs the operation o1128 in the illustrative depiction as follows, and/or the providing wristwatch module m1128, when executed and/or activated, directs performance of and/or performs the operation o1128 in the illustrative depiction as follows, and/or the operation o1128 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) the of a portable electronic device (e.g. including one or more clamshell phone components, etc.) to be outputted (e.g. through one or more cable interface portions, etc.) from said portable electronic device (e.g. including one or more cellular components, etc.) via one or more acoustic ultrasonic signals (e.g. via multiple acoustic ultrasonic signals configured to be demodulated through mutual interference therewith to at least in part result in one or more acoustic audio signals, etc.) as one or more electronic wristwatch systems (e.g. including one or more phone watch portions, etc.).

In one or more implementations, as shown in FIG. 63, operation o11 includes an operation o1129 for electronically providing audio output information to one or more portions the of a portable electronic device to be outputted from said portable electronic device via one or more acoustic ultrasonic signals as one or more electronic two-way radio systems. Origination of an illustratively derived providing two-way radio component group can be accomplished through skilled in the art design choice selection of one or more of the above depicted components from one or more of the above depicted subsystems shown in FIG. 25. Components from the providing two-way radio component group can be used in implementing execution of the one or more providing two-way radio instructions i1129 of FIG. 40, can be used in performance of the providing two-way radio electrical circuitry arrangement e1129 of FIG. 33, and/or can be used in otherwise fulfillment of the operation o1129. An exemplary non-transitory signal bearing medium version of the information storage subsystem s200 is depicted in FIG. 40 as bearing the one or more providing two-way radio instructions i1129 that when executed will direct performance of the operation o1129. Furthermore, the providing two-way radio electrical circuitry arrangement ("elec circ arrange") e1129, when activated, will perform the operation o1129. Also, the providing two-way radio module m1129, when executed and/or activated, will direct performance of and/or perform the operation o1129. For instance, in one or more exemplary implementations, the one or more providing two-way radio instructions i1129, when executed, direct performance of the operation o1129 in the illustrative depiction as follows, and/or the providing two-way radio electrical circuitry arrangement e1129, when activated, performs the operation o1129 in the illustrative depiction as follows, and/or the providing two-way radio module m1129, when executed and/or activated, directs performance of and/or performs the operation o1129 in the illustrative depiction as follows, and/or the operation o1129 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) the of a portable electronic device (e.g. including one or more media player components, etc.) to be outputted (e.g. through one or more cable interface portions, etc.) from said portable electronic device (e.g. including one or more 3G mobile components, etc.) via one or more acoustic ultrasonic signals (e.g. via multiple acoustic ultrasonic signals configured to be demodulated through mutual interference therewith to at least in part result in one or more acoustic audio signals, etc.) as one or more electronic two-way radio systems (e.g. including one or more walkie-talkie portions, etc.).

In one or more implementations, as shown in FIG. 63, operation o11 includes an operation o1130 for electronically providing audio output information to one or more portions of a portable electronic device the to be outputted from said portable electronic device via one or more acoustic ultrasonic signals as through one or more collections of ultrasonic transducers arranged to output one or more beams of acoustic ultrasonic signals. Origination of an illustratively derived providing beams component group can be accomplished through skilled in the art design choice selection of one or more of the above depicted components from one or more of the above depicted subsystems shown in FIG. 25. Components from the providing beams component group can be used in implementing execution of the one or more providing beams instructions i1130 of FIG. 40, can be used in performance of the providing beams electrical circuitry arrangement e1130 of FIG. 33, and/or can be used in otherwise fulfillment of the operation o1130. An exemplary non-transitory signal bearing medium version of the information storage subsystem s200 is depicted in FIG. 40 as bearing the one or more providing beams instructions i1130 that when executed will direct performance of the operation o1130. Furthermore, the providing beams electrical circuitry arrangement ("elec circ arrange") e1130, when activated, will perform the operation o1130. Also, the providing beams module m1130, when executed and/or activated, will direct performance of and/or perform the operation o1130. For instance, in one or more exemplary implementations, the one or more providing beams instructions i1130, when executed, direct performance of the operation o1130 in the illustrative depiction as follows, and/or the providing beams electrical circuitry arrangement e1130, when activated, performs the operation o1130 in the illustrative depiction as follows, and/or the providing beams module m1130, when executed and/or activated, directs performance of and/or performs the operation o1130 in the illustrative depiction as follows, and/or the operation o1130 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) the to be outputted (e.g. through one or more cable interface portions, etc.) from said portable electronic device (e.g. including one or more media player components, etc.) via one or more acoustic ultrasonic signals (e.g. via multiple acoustic ultrasonic signals configured to be demodulated through mutual interference therewith to at least in part result in one or more acoustic audio signals, etc.) as through one or more collections of ultrasonic transducers arranged to output one or more beams of acoustic ultrasonic signals (e.g. including one or more transducer arrays configured to output two interfering ultrasonic beams, etc.).

Figure 64:
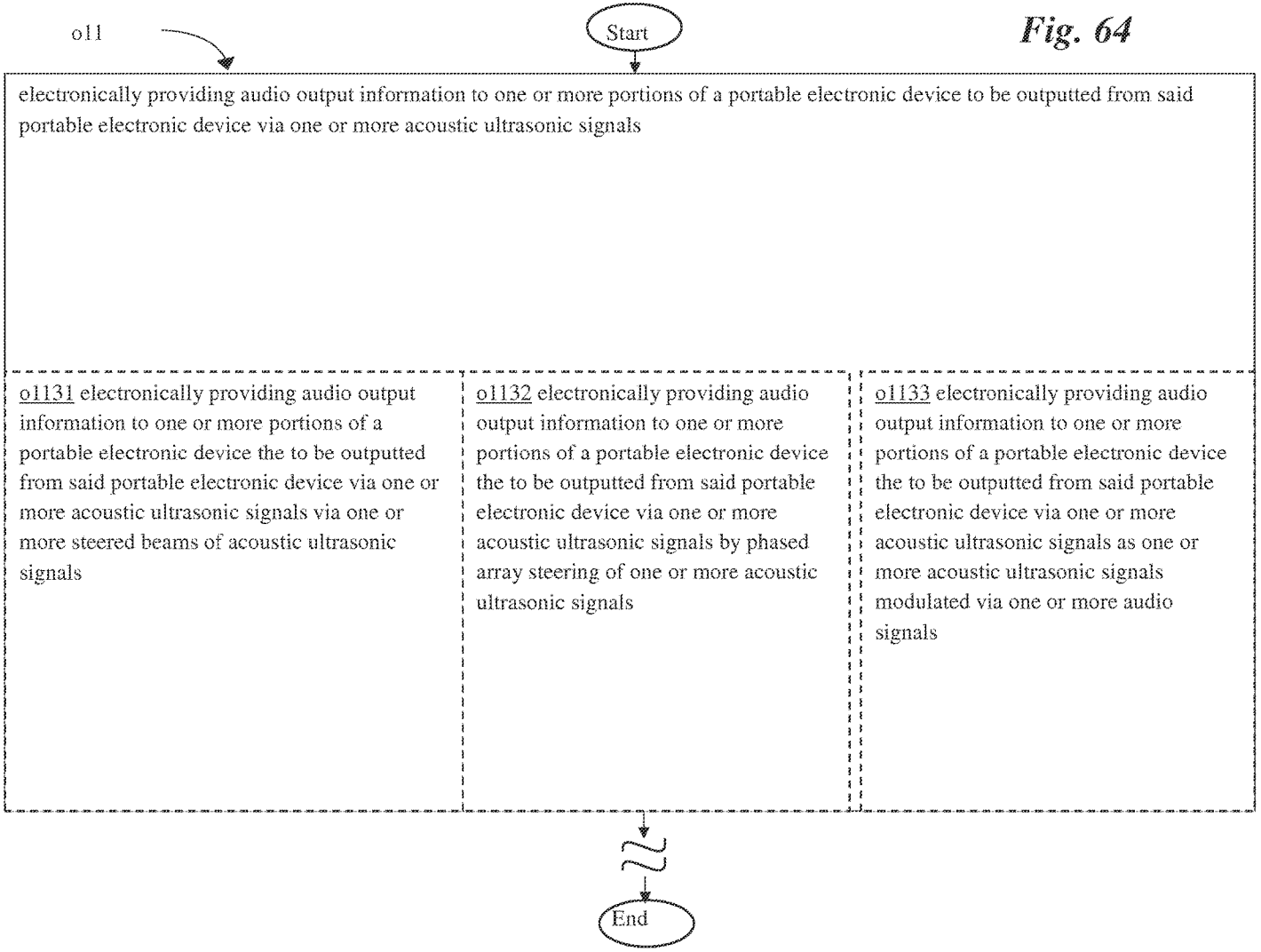
FIG. 64 is a high-level flowchart including exemplary implementations of operation o11 of FIG. 53.

In one or more implementations, as shown in FIG. 64, operation o11 includes an operation o1131 for electronically providing audio output information to one or more portions of a portable electronic device the to be outputted from said portable electronic device via one or more acoustic ultrasonic signals via one or more steered beams of acoustic ultrasonic signals. Origination of an illustratively derived providing steered beams component group can be accomplished through skilled in the art design choice selection of one or more of the above depicted components from one or more of the above depicted subsystems shown in FIG. 25. Components from the providing steered beams component group can be used in implementing execution of the one or more providing steered beams instructions i1131 of FIG. 40, can be used in performance of the providing steered beams electrical circuitry arrangement e1131 of FIG. 33, and/or can be used in otherwise fulfillment of the operation o1131. An exemplary non-transitory signal bearing medium version of the information storage subsystem s200 is depicted in FIG. 40 as bearing the one or more providing steered beams instructions i1131 that when executed will direct performance of the operation o1131. Furthermore, the providing steered beams electrical circuitry arrangement ("elec circ arrange") e1131, when activated, will perform the operation o1131. Also, the providing steered beams module m1131, when executed and/or activated, will direct performance of and/or perform the operation o1131. For instance, in one or more exemplary implementations, the one or more providing steered beams instructions i1131, when executed, direct performance of the operation o1131 in the illustrative depiction as follows, and/or the providing steered beams electrical circuitry arrangement e1131, when activated, performs the operation o1131 in the illustrative depiction as follows, and/or the providing steered beams module m1131, when executed and/or activated, directs performance of and/or performs the operation o1131 in the illustrative depiction as follows, and/or the operation o1131 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) the to be outputted (e.g. through one or more cable interface portions, etc.) from said portable electronic device (e.g. including one or more media player components, etc.) via one or more acoustic ultrasonic signals (e.g. via multiple acoustic ultrasonic signals configured to be demodulated through mutual interference therewith to at least in part result in one or more acoustic audio signals, etc.) via one or more steered beams of acoustic ultrasonic signals (e.g. including one or more phased based beam steering portions, etc.).

In one or more implementations, as shown in FIG. 64, operation o11 includes an operation o1132 for electronically providing audio output information to one or more portions of a portable electronic device the to be outputted from said portable electronic device via one or more acoustic ultrasonic signals by phased array steering of one or more acoustic ultrasonic signals. Origination of an illustratively derived providing phased array component group can be accomplished through skilled in the art design choice selection of one or more of the above depicted components from one or more of the above depicted subsystems shown in FIG. 25. Components from the providing phased array component group can be used in implementing execution of the one or more providing phased array instructions i1132 of FIG. 40, can be used in performance of the providing phased array electrical circuitry arrangement e1132 of FIG. 33, and/or can be used in otherwise fulfillment of the operation o1132. An exemplary non-transitory signal bearing medium version of the information storage subsystem s200 is depicted in FIG. 40 as bearing the one or more providing phased array instructions i1132 that when executed will direct performance of the operation o1132. Furthermore, the providing phased array electrical circuitry arrangement ("elec circ arrange") e1132, when activated, will perform the operation o1132. Also, the providing phased array module m1132, when executed and/or activated, will direct performance of and/or perform the operation o1132. For instance, in one or more exemplary implementations, the one or more providing phased array instructions i1132, when executed, direct performance of the operation o1132 in the illustrative depiction as follows, and/or the providing phased array electrical circuitry arrangement e1132, when activated, performs the operation o1132 in the illustrative depiction as follows, and/or the providing phased array module m1132, when executed and/or activated, directs performance of and/or performs the operation o1132 in the illustrative depiction as follows, and/or the operation o1132 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) the to be outputted (e.g. through one or more cable interface portions, etc.) from said portable electronic device (e.g. including one or more media player components, etc.) via one or more acoustic ultrasonic signals (e.g. via multiple acoustic ultrasonic signals configured to be demodulated through mutual interference therewith to at least in part result in one or more acoustic audio signals, etc.) by phased array steering of one or more acoustic ultrasonic signals (e.g. including steering to a designated location, etc.).

In one or more implementations, as shown in FIG. 64, operation o11 includes an operation o1133 for electronically providing audio output information to one or more portions of a portable electronic device the to be outputted from said portable electronic device via one or more acoustic ultrasonic signals as one or more acoustic ultrasonic signals modulated via one or more audio signals. Origination of an illustratively derived providing audio component group can be accomplished through skilled in the art design choice selection of one or more of the above depicted components from one or more of the above depicted subsystems shown in FIG. 25. Components from the providing audio component group can be used in implementing execution of the one or more providing audio instructions i1133 of FIG. 40, can be used in performance of the providing audio electrical circuitry arrangement e1133 of FIG. 33, and/or can be used in otherwise fulfillment of the operation o1133. An exemplary non-transitory signal bearing medium version of the information storage subsystem s200 is depicted in FIG. 40 as bearing the one or more providing audio instructions i1133 that when executed will direct performance of the operation o1133. Furthermore, the providing audio electrical circuitry arrangement ("elec circ arrange") e1133, when activated, will perform the operation o1133. Also, the providing audio module m1133, when executed and/or activated, will direct performance of and/or perform the operation o1133. For instance, in one or more exemplary implementations, the one or more providing audio instructions i1133, when executed, direct performance of the operation o1133 in the illustrative depiction as follows, and/or the providing audio electrical circuitry arrangement e1133, when activated, performs the operation o1133 in the illustrative depiction as follows, and/or the providing audio module m1133, when executed and/or activated, directs performance of and/or performs the operation o1133 in the illustrative depiction as follows, and/or the operation o1133 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) the to be outputted (e.g. through one or more cable interface portions, etc.) from said portable electronic device (e.g. including one or more media player components, etc.) via one or more acoustic ultrasonic signals (e.g. via multiple acoustic ultrasonic signals configured to be demodulated through mutual interference therewith to at least in part result in one or more acoustic audio signals, etc.) as one or more acoustic ultrasonic signals modulated via one or more audio signals (e.g. including one or more 120 kHz signals being modulated by human speech based signals, etc.).

Figure 65:
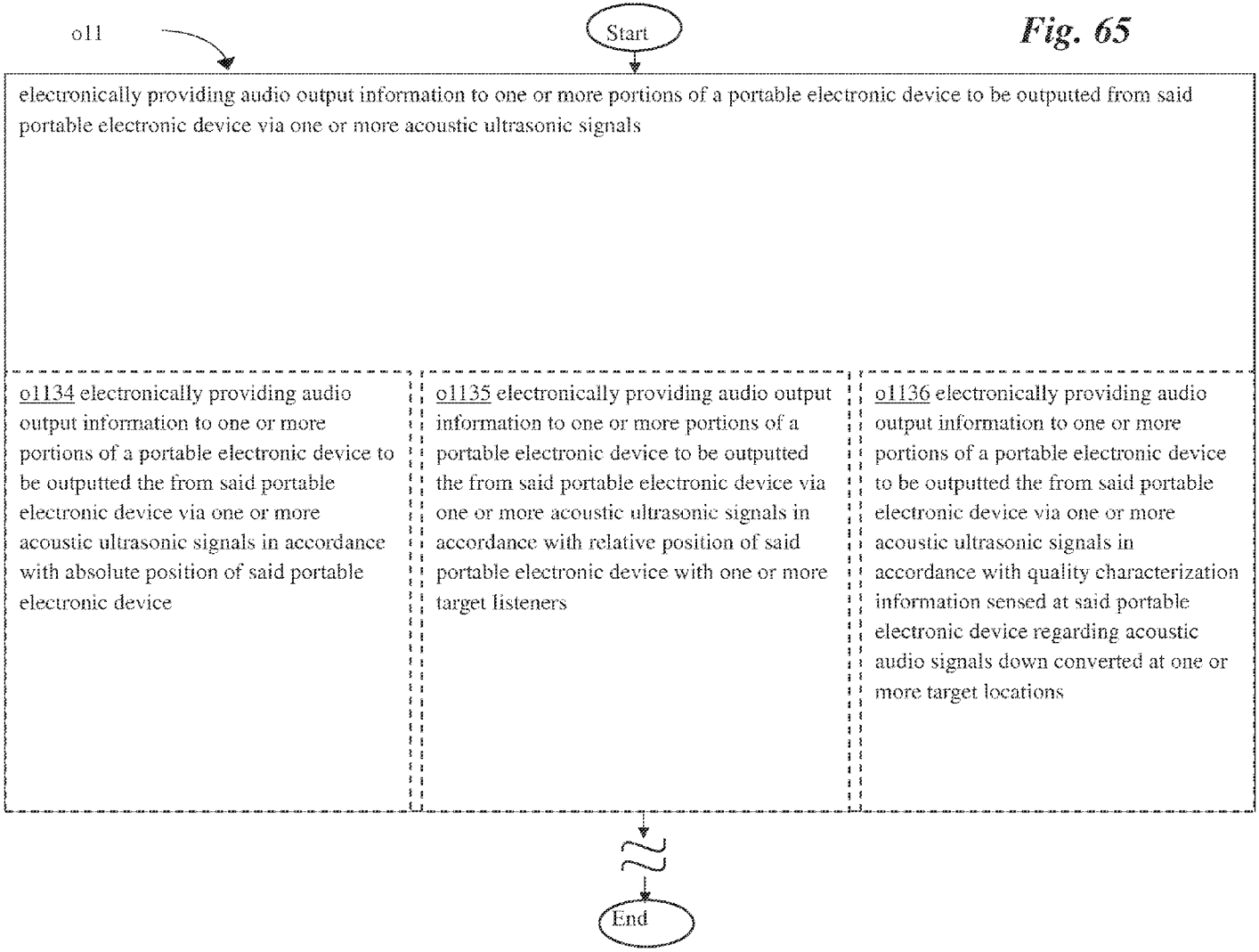
FIG. 65 is a high-level flowchart including exemplary implementations of operation o11 of FIG. 53.

In one or more implementations, as shown in FIG. 65, operation o11 includes an operation o1134 for electronically providing audio output information to one or more portions of a portable electronic device to be outputted the from said portable electronic device via one or more acoustic ultrasonic signals in accordance with absolute position of said portable electronic device. Origination of an illustratively derived providing absolute position component group can be accomplished through skilled in the art design choice selection of one or more of the above depicted components from one or more of the above depicted subsystems shown in FIG. 25. Components from the providing absolute position component group can be used in implementing execution of the one or more providing absolute position instructions i1134 of FIG. 40, can be used in performance of the providing absolute position electrical circuitry arrangement e1134 of FIG. 33, and/or can be used in otherwise fulfillment of the operation o1134. An exemplary non-transitory signal bearing medium version of the information storage subsystem s200 is depicted in FIG. 40 as bearing the one or more providing absolute position instructions i1134 that when executed will direct performance of the operation o1134. Furthermore, the providing absolute position electrical circuitry arrangement ("elec circ arrange") e1134, when activated, will perform the operation o1134. Also, the providing absolute position module m1134, when executed and/or activated, will direct performance of and/or perform the operation o1134. For instance, in one or more exemplary implementations, the one or more providing absolute position instructions i1134, when executed, direct performance of the operation o1134 in the illustrative depiction as follows, and/or the providing absolute position electrical circuitry arrangement e1134, when activated, performs the operation o1134 in the illustrative depiction as follows, and/or the providing absolute position module m1134, when executed and/or activated, directs performance of and/or performs the operation o1134 in the illustrative depiction as follows, and/or the operation o1134 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) to be outputted (e.g. through one or more cable interface portions, etc.) the from said portable electronic device (e.g. including one or more media player components, etc.) via one or more acoustic ultrasonic signals (e.g. via multiple acoustic ultrasonic signals configured to be demodulated through mutual interference therewith to at least in part result in one or more acoustic audio signals, etc.) in accordance with absolute position of said portable electronic device (e.g. based on GPS coordinates, etc.).

In one or more implementations, as shown in FIG. 65, operation o11 includes an operation o1135 for electronically providing audio output information to one or more portions of a portable electronic device to be outputted the from said portable electronic device via one or more acoustic ultrasonic signals in accordance with relative position of said portable electronic device with one or more target listeners. Origination of an illustratively derived providing relative position component group can be accomplished through skilled in the art design choice selection of one or more of the above depicted components from one or more of the above depicted subsystems shown in FIG. 25. Components from the providing relative position component group can be used in implementing execution of the one or more providing relative position instructions i1135 of FIG. 40, can be used in performance of the providing relative position electrical circuitry arrangement e1135 of FIG. 33, and/or can be used in otherwise fulfillment of the operation o1135. An exemplary non-transitory signal bearing medium version of the information storage subsystem s200 is depicted in FIG. 40 as bearing the one or more providing relative position instructions i1135 that when executed will direct performance of the operation o1135. Furthermore, the providing relative position electrical circuitry arrangement ("elec circ arrange") e1135, when activated, will perform the operation o1135. Also, the providing relative position module m1135, when executed and/or activated, will direct performance of and/or perform the operation o1135. For instance, in one or more exemplary implementations, the one or more providing relative position instructions i1135, when executed, direct performance of the operation o1135 in the illustrative depiction as follows, and/or the providing relative position electrical circuitry arrangement e1135, when activated, performs the operation o1135 in the illustrative depiction as follows, and/or the providing relative position module m1135, when executed and/or activated, directs performance of and/or performs the operation o1135 in the illustrative depiction as follows, and/or the operation o1135 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) to be outputted (e.g. through one or more cable interface portions, etc.) the from said portable electronic device (e.g. including one or more media player components, etc.) via one or more acoustic ultrasonic signals (e.g. via multiple acoustic ultrasonic signals configured to be demodulated through mutual interference therewith to at least in part result in one or more acoustic audio signals, etc.) in accordance with relative position of said portable electronic device with one or more target listeners (e.g. based on distance from a tablet to a group of listeners ranged through ultrasonic signals, etc.).

In one or more implementations, as shown in FIG. 65, operation o11 includes an operation o1136 for electronically providing audio output information to one or more portions of a portable electronic device to be outputted the from said portable electronic device via one or more acoustic ultrasonic signals in accordance with quality characterization formation sensed at said portable electronic device regarding acoustic audio signals down converted at one or more target locations. Origination of an illustratively derived providing quality characterization target locations component group can be accomplished through skilled in the art design choice selection of one or more of the above depicted components from one or more of the above depicted subsystems shown in FIG. 25. Components from the providing quality characterization target locations component group can be used in implementing execution of the one or more providing quality characterization target locations instructions i1136 of FIG. 40, can be used in performance of the providing quality characterization target locations electrical circuitry arrangement e1136 of FIG. 33, and/or can be used in otherwise fulfillment of the operation o1136. An exemplary non-transitory signal bearing medium version of the information storage subsystem s200 is depicted in FIG. 40 as bearing the one or more providing quality characterization target locations instructions i1136 that when executed will direct performance of the operation o1136. Furthermore, the providing quality characterization target locations electrical circuitry arrangement ("elec circ arrange") e1136, when activated, will perform the operation o1136. Also, the providing quality characterization target locations module m1136, when executed and/or activated, will direct performance of and/or perform the operation o1136. For instance, in one or more exemplary implementations, the one or more providing quality characterization target locations instructions i1136, when executed, direct performance of the operation o1136 in the illustrative depiction as follows, and/or the providing quality characterization target locations electrical circuitry arrangement e1136, when activated, performs the operation o1136 in the illustrative depiction as follows, and/or the providing quality characterization target locations module m1136, when executed and/or activated, directs performance of and/or performs the operation o1136 in the illustrative depiction as follows, and/or the operation o1136 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) to be outputted (e.g. through one or more cable interface portions, etc.) the from said portable electronic device (e.g. including one or more media player components, etc.) via one or more acoustic ultrasonic signals (e.g. via multiple acoustic ultrasonic signals configured to be demodulated through mutual interference therewith to at least in part result in one or more acoustic audio signals, etc.) in accordance with quality characterization information sensed at said portable electronic device regarding acoustic audio signals down converted at one or more target locations (e.g. based on sensing down-converted audio quality through one or more microphone sensing portions of a tablet computer, etc.).

Figure 66:
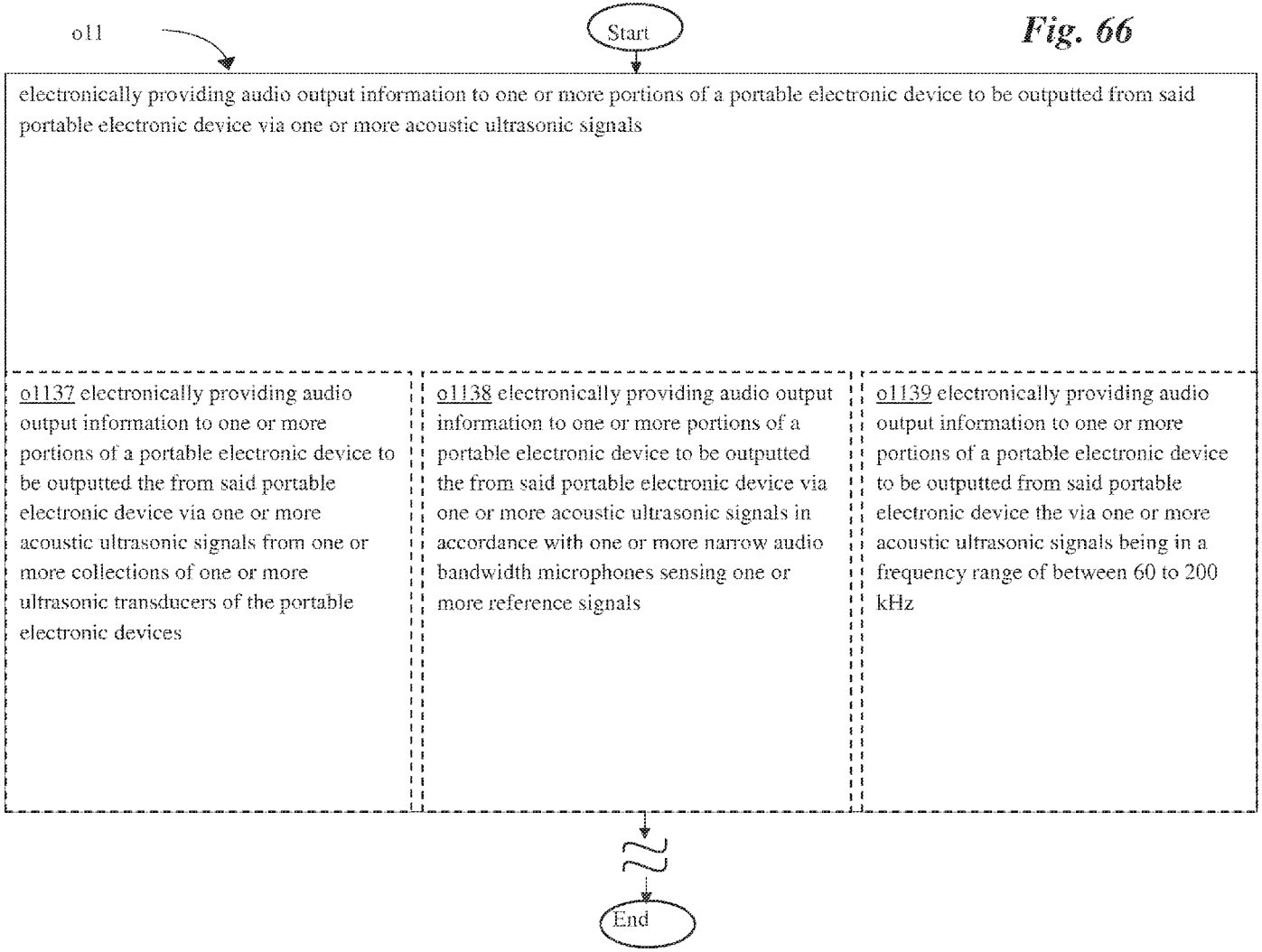
FIG. 66 is a high-level flowchart including exemplary implementations of operation o11 of FIG. 53.

In one or more implementations, as shown in FIG. 66, operation o11 includes an operation o1137 for electronically providing audio output information to one or more portions of a portable electronic device to be outputted the from said portable electronic device via one or more acoustic ultrasonic signals from one or more collections of one or more ultrasonic transducers of the portable electronic devices. Origination of an illustratively derived providing ultrasonic transducers component group can be accomplished through skilled in the art design choice selection of one or more of the above depicted components from one or more of the above depicted subsystems shown in FIG. 25. Components from the providing ultrasonic transducers component group can be used in implementing execution of the one or more providing ultrasonic transducers instructions i1137 of FIG. 40, can be used in performance of the providing ultrasonic transducers electrical circuitry arrangement e1137 of FIG. 33, and/or can be used in otherwise fulfillment of the operation o1137. An exemplary non-transitory signal bearing medium version of the information storage subsystem s200 is depicted in FIG. 40 as bearing the one or more providing ultrasonic transducers instructions i1137 that when executed will direct performance of the operation o1137. Furthermore, the providing ultrasonic transducers electrical circuitry arrangement ("elec circ arrange") e1137, when activated, will perform the operation o1137. Also, the providing ultrasonic transducers module m1137, when executed and/or activated, will direct performance of and/or perform the operation o1137. For instance, in one or more exemplary implementations, the one or more providing ultrasonic transducers instructions i1137, when executed, direct performance of the operation o1137 in the illustrative depiction as follows, and/or the providing ultrasonic transducers electrical circuitry arrangement e1137, when activated, performs the operation o1137 in the illustrative depiction as follows, and/or the providing ultrasonic transducers module m1137, when executed and/or activated, directs performance of and/or performs the operation o1137 in the illustrative depiction as follows, and/or the operation o1137 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) to be outputted (e.g. through one or more cable interface portions, etc.) the from said portable electronic device (e.g. including one or more media player components, etc.) via one or more acoustic ultrasonic signals (e.g. via multiple acoustic ultrasonic signals configured to be demodulated through mutual interference therewith to at least in part result in one or more acoustic audio signals, etc.) from one or more collections of one or more ultrasonic transducers of the portable electronic devices (e.g. including one or more arrays of transducers located around a perimeter of a tablet computer, etc.).

In one or more implementations, as shown in FIG. 66, operation o11 includes an operation o1138 for electronically providing audio output information to one or more portions of a portable electronic device to be outputted the from said portable electronic device via one or more acoustic ultrasonic signals in accordance with one or more narrow audio bandwidth microphones sensing one or more reference signals. Origination of an illustratively derived providing reference component group can be accomplished through skilled in the art design choice selection of one or more of the above depicted components from one or more of the above depicted subsystems shown in FIG. 25. Components from the providing reference component group can be used in implementing execution of the one or more providing reference instructions i1138 of FIG. 40, can be used in performance of the providing reference electrical circuitry arrangement e1138 of FIG. 33, and/or can be used in otherwise fulfillment of the operation o1138. An exemplary non-transitory signal bearing medium version of the information storage subsystem s200 is depicted in FIG. 40 as bearing the one or more providing reference instructions i1138 that when executed will direct performance of the operation o1138. Furthermore, the providing reference electrical circuitry arrangement ("elec circ arrange") e1138, when activated, will perform the operation o1138. Also, the providing reference module m1138, when executed and/or activated, will direct performance of and/or perform the operation o1138. For instance, in one or more exemplary implementations, the one or more providing reference instructions i1138, when executed, direct performance of the operation o1138 in the illustrative depiction as follows, and/or the providing reference electrical circuitry arrangement e1138, when activated, performs the operation o1138 in the illustrative depiction as follows, and/or the providing reference module m1138, when executed and/or activated, directs performance of and/or performs the operation o1138 in the illustrative depiction as follows, and/or the operation o1138 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) to be outputted (e.g. through one or more cable interface portions, etc.) the from said portable electronic device (e.g. including one or more media player components, etc.) via one or more acoustic ultrasonic signals (e.g. via multiple acoustic ultrasonic signals configured to be demodulated through mutual interference therewith to at least in part result in one or more acoustic audio signals, etc.) in accordance with one or more narrow audio bandwidth microphones sensing one or more reference signals (e.g. including one or more microphones located in a smart phone to sense digitally coded audio signals modulated into an ultrasonic carrier signal, etc.).

In one or more implementations, as shown in FIG. 66, operation o11 includes an operation o1139 for electronically providing audio output information to one or more portions of a portable electronic device to be outputted from said portable electronic device the via one or more acoustic ultrasonic signals being in a frequency range of between 60 to 200 kHz. Origination of an illustratively derived providing more acoustic ultrasonic component group can be accomplished through skilled in the art design choice selection of one or more of the above depicted components from one or more of the above depicted subsystems shown in FIG. 25. Components from the providing more acoustic ultrasonic component group can be used in implementing execution of the one or more providing more acoustic ultrasonic instructions i1139 of FIG. 40, can be used in performance of the providing more acoustic ultrasonic electrical circuitry arrangement e1139 of FIG. 33, and/or can be used in otherwise fulfillment of the operation o1139. An exemplary non-transitory signal bearing medium version of the information storage subsystem s200 is depicted in FIG. 40 as bearing the one or more providing more acoustic ultrasonic instructions i1139 that when executed will direct performance of the operation o1139. Furthermore, the providing more acoustic ultrasonic electrical circuitry arrangement ("elec circ arrange") e1139, when activated, will perform the operation o1139. Also, the providing more acoustic ultrasonic module m1139, when executed and/or activated, will direct performance of and/or perform the operation o1139. For instance, in one or more exemplary implementations, the one or more providing more acoustic ultrasonic instructions i1139, when executed, direct performance of the operation o1139 in the illustrative depiction as follows, and/or the providing more acoustic ultrasonic electrical circuitry arrangement e1139, when activated, performs the operation o1139 in the illustrative depiction as follows, and/or the providing more acoustic ultrasonic module m1139, when executed and/or activated, directs performance of and/or performs the operation o1139 in the illustrative depiction as follows, and/or the operation o1139 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) to be outputted (e.g. through one or more cable interface portions, etc.) from said portable electronic device (e.g. including one or more media player components, etc.) the via one or more acoustic ultrasonic signals (e.g. via multiple acoustic ultrasonic signals configured to be demodulated through mutual interference therewith to at least in part result in one or more acoustic audio signals, etc.) being in a frequency range of between 60 to 200 kHz (e.g. including an acoustic ultrasonic based carrier signal of 120 kHz, etc.).

Figure 67:
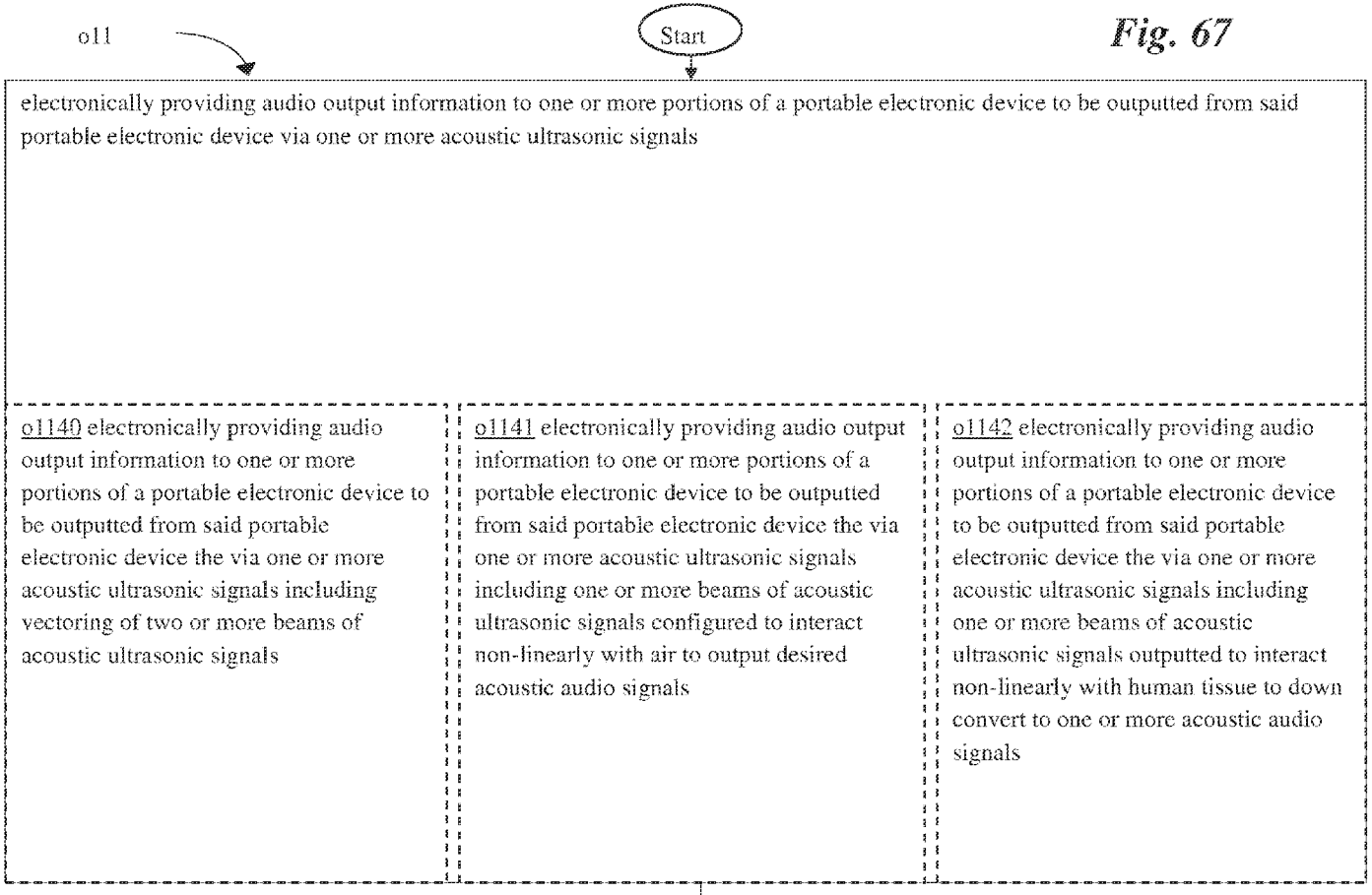
FIG. 67 is a high-level flowchart including exemplary implementations of operation o11 of FIG. 53.

In one or more implementations, as shown in FIG. 67, operation o11 includes an operation o1140 for electronically providing audio output information to one or more portions of a portable electronic device to be outputted from said portable electronic device the via one or more acoustic ultrasonic signals including vectoring of two or more beams of acoustic ultrasonic signals. Origination of an illustratively derived providing vectoring beams component group can be accomplished through skilled in the art design choice selection of one or more of the above depicted components from one or more of the above depicted subsystems shown in FIG. 25. Components from the providing vectoring beams component group can be used in implementing execution of the one or more providing vectoring beams instructions i1140 of FIG. 41, can be used in performance of the providing vectoring beams electrical circuitry arrangement e1140 of FIG. 34, and/or can be used in otherwise fulfillment of the operation o1140. An exemplary non-transitory signal bearing medium version of the information storage subsystem s200 is depicted in FIG. 41 as bearing the one or more providing vectoring beams instructions i1140 that when executed will direct performance of the operation o1140. Furthermore, the providing vectoring beams electrical circuitry arrangement ("elec circ arrange") e1140, when activated, will perform the operation o1140. Also, the providing vectoring beams module m1140, when executed and/or activated, will direct performance of and/or perform the operation o1140. For instance, in one or more exemplary implementations, the one or more providing vectoring beams instructions i1140, when executed, direct performance of the operation o1140 in the illustrative depiction as follows, and/or the providing vectoring beams electrical circuitry arrangement e1140, when activated, performs the operation o1140 in the illustrative depiction as follows, and/or the providing vectoring beams module m1140, when executed and/or activated, directs performance of and/or performs the operation o1140 in the illustrative depiction as follows, and/or the operation o1140 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) to be outputted (e.g. through one or more cable interface portions, etc.) from said portable electronic device (e.g. including one or more media player components, etc.) the via one or more acoustic ultrasonic signals (e.g. via multiple acoustic ultrasonic signals configured to be demodulated through mutual interference therewith to at least in part result in one or more acoustic audio signals, etc.) including vectoring of two or more beams of acoustic ultrasonic signals (e.g. including transmitting two ultrasonic beams from transducer arrays of a smart phone, etc.).

In one or more implementations, as shown in FIG. 67, operation o11 includes an operation o1141 for electronically providing audio output information to one or more portions of a portable electronic device to be outputted from said portable electronic device the via one or more acoustic ultrasonic signals including one or more beams of acoustic ultrasonic signals configured to interact non-linearly with air to output desired acoustic audio signals. Origination of an illustratively derived providing non-linearly air component group can be accomplished through skilled in the art design choice selection of one or more of the above depicted components from one or more of the above depicted subsystems shown in FIG. 25. Components from the providing non-linearly air component group can be used in implementing execution of the one or more providing non-linearly air instructions i1141 of FIG. 41, can be used in performance of the providing non-linearly air electrical circuitry arrangement e1141 of FIG. 34, and/or can be used in otherwise fulfillment of the operation o1141. An exemplary non-transitory signal bearing medium version of the information storage subsystem s200 is depicted in FIG. 41 as bearing the one or more providing non-linearly air instructions i1141 that when executed will direct performance of the operation o1141. Furthermore, the providing non-linearly air electrical circuitry arrangement ("elec circ arrange") e1141, when activated, will perform the operation o1141. Also, the providing non-linearly air module m1141, when executed and/or activated, will direct performance of and/or perform the operation o1141. For instance, in one or more exemplary implementations, the one or more providing non-linearly air instructions i1141, when executed, direct performance of the operation o1141 in the illustrative depiction as follows, and/or the providing non-linearly air electrical circuitry arrangement e1141, when activated, performs the operation o1141 in the illustrative depiction as follows, and/or the providing non-linearly air module m1141, when executed and/or activated, directs performance of and/or performs the operation o1141 in the illustrative depiction as follows, and/or the operation o1141 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) to be outputted (e.g. through one or more cable interface portions, etc.) from said portable electronic device (e.g. including one or more media player components, etc.) the via one or more acoustic ultrasonic signals (e.g. via multiple acoustic ultrasonic signals configured to be demodulated through mutual interference therewith to at least in part result in one or more acoustic audio signals, etc.) including one or more beams of acoustic ultrasonic signals configured to interact non-linearly with air to output desired acoustic audio signals (e.g. including a beam of acoustic ultrasonic signals transmitted from a tablet to interact with air to produce audio near an ear of a target listener, etc.).

In one or more implementations, as shown in FIG. 67, operation o11 includes an operation o1142 for electronically providing audio output information to one or more portions of a portable electronic device to be outputted from said portable electronic device the via one or more acoustic ultrasonic signals including one or more beams of acoustic ultrasonic signals outputted to interact non-linearly with human tissue to down convert to one or more acoustic audio signals. Origination of an illustratively derived providing human tissue component group can be accomplished through skilled in the art design choice selection of one or more of the above depicted components from one or more of the above depicted subsystems shown in FIG. 25. Components from the providing human tissue component group can be used in implementing execution of the one or more providing human tissue instructions i1142 of FIG. 41, can be used in performance of the providing human tissue electrical circuitry arrangement e1142 of FIG. 34, and/or can be used in otherwise fulfillment of the operation o1142. An exemplary non-transitory signal bearing medium version of the information storage subsystem s200 is depicted in FIG. 41 as bearing the one or more providing human tissue instructions i1142 that when executed will direct performance of the operation o1142. Furthermore, the providing human tissue electrical circuitry arrangement ("elec circ arrange") e1142, when activated, will perform the operation o1142. Also, the providing human tissue module m1142, when executed and/or activated, will direct performance of and/or perform the operation o1142. For instance, in one or more exemplary implementations, the one or more providing human tissue instructions i1142, when executed, direct performance of the operation o1142 in the illustrative depiction as follows, and/or the providing human tissue electrical circuitry arrangement e1142, when activated, performs the operation o1142 in the illustrative depiction as follows, and/or the providing human tissue module m1142, when executed and/or activated, directs performance of and/or performs the operation o1142 in the illustrative depiction as follows, and/or the operation o1142 is otherwise carried out in the illustrative depiction as follows: electronically providing (e.g. through reception of cable communication packets, etc.) audio output information (e.g. including lecture formatted information, etc.) to one or more portions (e.g. including one or more preamplifier portions, etc.) of a portable electronic device (e.g. including one or more 3G mobile components, etc.) to be outputted (e.g. through one or more cable interface portions, etc.) from said portable electronic device (e.g. including one or more media player components, etc.) the via one or more acoustic ultrasonic signals (e.g. via multiple acoustic ultrasonic signals configured to be demodulated through mutual interference therewith to at least in part result in one or more acoustic audio signals, etc.) including one or more beams of acoustic ultrasonic signals outputted to interact non-linearly with human tissue to down convert to one or more acoustic audio signals (e.g. including a beam of acoustic ultrasonic signals transmitted from a laptop to interact with human tissue near an ear of a target listener, etc.).

As shown in FIG. 53, the operational flow o10 proceeds to operation o12 for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements. An exemplary version of a non-transitory signal bearing medium of information storage subsystem s200 is depicted as bearing one or more electronically outputting instructions i12 that when executed will direct performance of the operation o12. In an implementation, the one or more electronically outputting instructions i12 when executed direct electronically outputting, (e.g. via one or more multiple emitter array portions, through one or more device perimeter embedded transducer portions, using one or more device body embedded transducer portions, etc.) said one or more acoustic ultrasonic signals (e.g. via one or more acoustic ultrasonic signals including signals having one or more frequencies above 200 kHz, via one or more acoustic ultrasonic signals including signals having one or more frequencies above 180 kHz, via one or more acoustic ultrasonic signals including signals having one or more frequencies above 160 kHz, etc.) to be demodulated (e.g. including at least in part demodulation by signal down conversion, including at least in part demodulation through signal amplitude demodulation, including at least in part demodulation via signal frequency demodulation portions, etc.) into one or more acoustic audio signals (e.g. including one or more low frequency acoustic audio signals, including one or more high frequency acoustic audio signals, including one or more full spectrum acoustic audio signals, etc.) containing one or more portions (e.g. including containing beginning portions, including containing middle portions, including containing end portions, etc.) of said audio output information (e.g. including low frequency audio information, including high frequency audio information, including analog audio information, etc.) at one or more locations (e.g. exclusive to one or more designated ears, exclusive to one or more identified persons, exclusive to one or more predetermined ears, etc.) spaced (e.g. within a confines of a room, within an arm's length, within a three foot radius, etc.) from said portable electronic device (e.g. including one or more 3G mobile components, including one or more cellular components, through reception of cable communication packets, etc.) based at least in part according to (e.g. based in part according to all, based in part according to some, based in part according to an entirety, etc.) said one or more acoustic ultrasonic signals (e.g. via multiple acoustic ultrasonic signals configured to be demodulated through mutual interference therewith to at least in part result in one or more acoustic audio signals, via one or more acoustic ultrasonic signals configured to be demodulated through nonlinear atmospheric interaction to at least in part generate one or more acoustic audio signals, via one or more acoustic ultrasonic signals configured to be demodulated through nonlinear human tissue interaction to at least in part produce one or more acoustic audio signals, etc.) and based at least in part according to (e.g. based in part according to all, based in part according to some, based in part according to an entirety, etc.) one or more portable electronic device ultrasonic emitter arrangements (e.g. including one or more perimeter arrays, including one or more polar arrays, including one or more orthographic arrays, etc.). Furthermore, the electronically outputting electrical circuitry arrangement e12 when activated will perform the operation o12. Also, the electronically outputting module m12, when executed and/or activated, will direct performance of and/or perform the operation o12. In an implementation, the electronically outputting electrical circuitry arrangement e12, when activated performs the operation o12 in the illustrative depiction as follows, and/or the electronically outputting module m12, when executed and/or activated, directs performance of and/or performs electronically outputting, (e.g. via one or more multiple emitter array portions, through one or more device perimeter embedded transducer portions, using one or more device body embedded transducer portions, etc.) said one or more acoustic ultrasonic signals (e.g. via one or more acoustic ultrasonic signals including signals having one or more frequencies above 200 kHz, via one or more acoustic ultrasonic signals including signals having one or more frequencies above 180 kHz, via one or more acoustic ultrasonic signals including signals having one or more frequencies above 160 kHz, etc.) to be demodulated (e.g. including at least in part demodulation by signal down conversion, including at least in part demodulation through signal amplitude demodulation, including at least in part demodulation via signal frequency demodulation portions, etc.) into one or more acoustic audio signals (e.g. including one or more low frequency acoustic audio signals, including one or more high frequency acoustic audio signals, including one or more full spectrum acoustic audio signals, etc.) containing one or more portions (e.g. including containing beginning portions, including containing middle portions, including containing end portions, etc.) of said audio output information (e.g. including low frequency audio information, including high frequency audio information, including analog audio information, etc.) at one or more locations (e.g. exclusive to one or more designated ears, exclusive to one or more identified persons, exclusive to one or more predetermined ears, etc.) spaced (e.g. within a confines of a room, within an arm's length, within a three foot radius, etc.) from said portable electronic device (e.g. including one or more 3G mobile components, including one or more cellular components, through reception of cable communication packets, etc.) based at least in part according to (e.g. based in part according to all, based in part according to some, based in part according to an entirety, etc.) said one or more acoustic ultrasonic signals (e.g. via multiple acoustic ultrasonic signals configured to be demodulated through mutual interference therewith to at least in part result in one or more acoustic audio signals, via one or more acoustic ultrasonic signals configured to be demodulated through nonlinear atmospheric interaction to at least in part generate one or more acoustic audio signals, via one or more acoustic ultrasonic signals configured to be demodulated through nonlinear human tissue interaction to at least in part produce one or more acoustic audio signals, etc.) and based at least in part according to (e.g. based in part according to all, based in part according to some, based in part according to an entirety, etc.) one or more portable electronic device ultrasonic emitter arrangements (e.g. including one or more perimeter arrays, including one or more polar arrays, including one or more orthographic arrays, etc.). In an implementation, the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements is carried out by electronically outputting, (e.g. via one or more multiple emitter array portions, through one or more device perimeter embedded transducer portions, using one or more device body embedded transducer portions, etc.) said one or more acoustic ultrasonic signals (e.g. via one or more acoustic ultrasonic signals including signals having one or more frequencies above 200 kHz, via one or more acoustic ultrasonic signals including signals having one or more frequencies above 180 kHz, via one or more acoustic ultrasonic signals including signals having one or more frequencies above 160 kHz, etc.) to be demodulated (e.g. including at least in part demodulation by signal down conversion, including at least in part demodulation through signal amplitude demodulation, including at least in part demodulation via signal frequency demodulation portions, etc.) into one or more acoustic audio signals (e.g. including one or more low frequency acoustic audio signals, including one or more high frequency acoustic audio signals, including one or more full spectrum acoustic audio signals, etc.) containing one or more portions (e.g. including containing beginning portions, including containing middle portions, including containing end portions, etc.) of said audio output information (e.g. including low frequency audio information, including high frequency audio information, including analog audio information, etc.) at one or more locations (e.g. exclusive to one or more designated ears, exclusive to one or more identified persons, exclusive to one or more predetermined ears, etc.) spaced (e.g. within a confines of a room, within an arm's length, within a three foot radius, etc.) from said portable electronic device (e.g. including one or more 3G mobile components, including one or more cellular components, through reception of cable communication packets, etc.) based at least in part according to (e.g. based in part according to all, based in part according to some, based in part according to an entirety, etc.) said one or more acoustic ultrasonic signals (e.g. via multiple acoustic ultrasonic signals configured to be demodulated through mutual interference therewith to at least in part result in one or more acoustic audio signals, via one or more acoustic ultrasonic signals configured to be demodulated through nonlinear atmospheric interaction to at least in part generate one or more acoustic audio signals, via one or more acoustic ultrasonic signals configured to be demodulated through nonlinear human tissue interaction to at least in part produce one or more acoustic audio signals, etc.) and based at least in part according to (e.g. based in part according to all, based in part according to some, based in part according to an entirety, etc.) one or more portable electronic device ultrasonic emitter arrangements (e.g. including one or more perimeter arrays, including one or more polar arrays, including one or more orthographic arrays, etc.).

Figure 68:
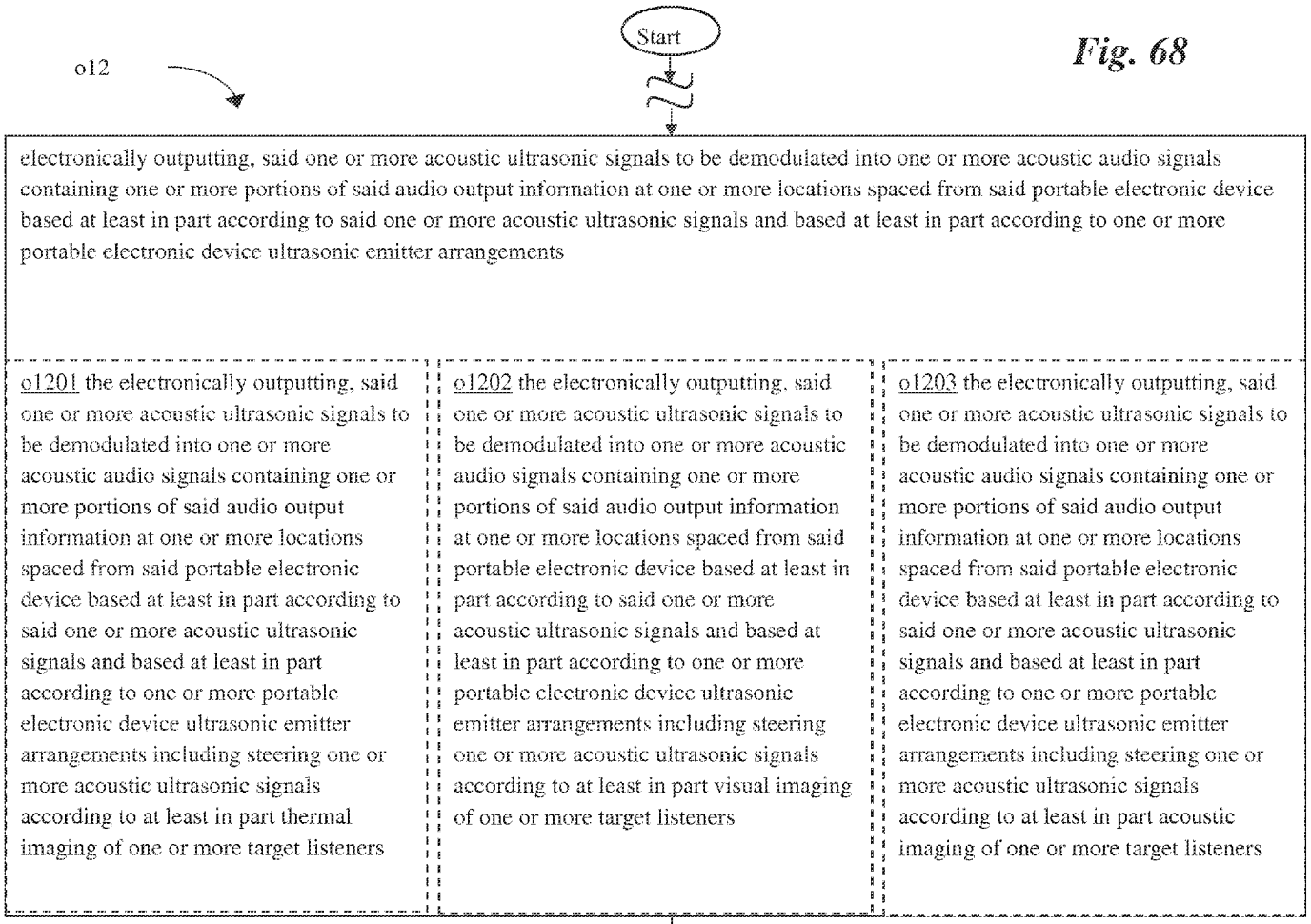
FIG. 68 is a high-level flowchart including exemplary implementations of operation o12 of FIG. 53.

In one or more implementations, as shown in FIG. 68, operation o12 includes an operation o1201 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including steering one or more acoustic ultrasonic signals according to at least in part thermal imaging of one or more target listeners. Origination of an illustratively derived outputting thermal imaging component group can be accomplished through skilled in the art design choice selection of one or more of the above depicted components from one or more of the above depicted subsystems shown in FIG. 25. Components from the outputting thermal imaging component group can be used in implementing execution of the one or more outputting thermal imaging instructions i1201 of FIG. 42, can be used in performance of the outputting thermal imaging electrical circuitry arrangement e1201 of FIG. 35, and/or can be used in otherwise fulfillment of the operation o1201. An exemplary non-transitory signal bearing medium version of the information storage subsystem s200 is depicted in FIG. 42 as bearing the one or more outputting thermal imaging instructions i1201 that when executed will direct performance of the operation o1201. Furthermore, the outputting thermal imaging electrical circuitry arrangement ("elec circ arrange") e1201, when activated, will perform the operation o1201. Also, the outputting thermal imaging module m1201, when executed and/or activated, will direct performance of and/or perform the operation o1201. For instance, in one or more exemplary implementations, the one or more outputting thermal imaging instructions i1201, when executed, direct performance of the operation o1201 in the illustrative depiction as follows, and/or the outputting thermal imaging electrical circuitry arrangement e1201, when activated, performs the operation o1201 in the illustrative depiction as follows, and/or the outputting thermal imaging module m1201, when executed and/or activated, directs performance of and/or performs the operation o1201 in the illustrative depiction as follows, and/or the operation o1201 is otherwise carried out in the illustrative depiction as follows: the electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including low frequency audio information, etc.) at one or more locations (e.g. exclusive to one or more designated ears, etc.) spaced (e.g. within a confines of a room, etc.) from said portable electronic device (e.g. including one or more 3G mobile components, etc.) based at least in part according to (e.g. based in part according to all, etc.) said one or more acoustic ultrasonic signals (e.g. via multiple acoustic ultrasonic signals configured to be demodulated through mutual interference therewith to at least in part result in one or more acoustic audio signals, etc.) and based at least in part according to (e.g. based in part according to all, etc.) one or more portable electronic device ultrasonic emitter arrangements (e.g. including one or more perimeter arrays, etc.) including steering one or more acoustic ultrasonic signals according to at least in part thermal imaging of one or more target listeners (e.g. including infrared sensing from a tablet to determine ear position of a target listener to steer ultrasonic beam portions through phase control, etc.).

In one or more implementations, as shown in FIG. 68, operation o12 includes an operation o1202 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including steering one or more acoustic ultrasonic signals according to at least in part visual imaging of one or more target listeners. Origination of an illustratively derived outputting visual imaging component group can be accomplished through skilled in the art design choice selection of one or more of the above depicted components from one or more of the above depicted subsystems shown in FIG. 25. Components from the outputting visual imaging component group can be used in implementing execution of the one or more outputting visual imaging instructions i1202 of FIG. 42, can be used in performance of the outputting visual imaging electrical circuitry arrangement e1202 of FIG. 35, and/or can be used in otherwise fulfillment of the operation o1202. An exemplary non-transitory signal bearing medium version of the information storage subsystem s200 is depicted in FIG. 42 as bearing the one or more outputting visual imaging instructions i1202 that when executed will direct performance of the operation o1202. Furthermore, the outputting visual imaging electrical circuitry arrangement ("elec circ arrange") e1202, when activated, will perform the operation o1202. Also, the outputting visual imaging module m1202, when executed and/or activated, will direct performance of and/or perform the operation o1202. For instance, in one or more exemplary implementations, the one or more outputting visual imaging instructions i1202, when executed, direct performance of the operation o1202 in the illustrative depiction as follows, and/or the outputting visual imaging electrical circuitry arrangement e1202, when activated, performs the operation o1202 in the illustrative depiction as follows, and/or the outputting visual imaging module m1202, when executed and/or activated, directs performance of and/or performs the operation o1202 in the illustrative depiction as follows, and/or the operation o1202 is otherwise carried out in the illustrative depiction as follows: the electronically outputting, (e.g. through one or more device perimeter embedded transducer portions, etc.) said one or more acoustic ultrasonic signals (e.g. via one or more acoustic ultrasonic signals including signals having one or more frequencies above 180 kHz, etc.) to be demodulated (e.g. including at least in part demodulation through signal amplitude demodulation, etc.) into one or more acoustic audio signals (e.g. including one or more high frequency acoustic audio signals, etc.) containing one or more portions (e.g. including containing middle portions, etc.) of said audio output information (e.g. including high frequency audio information, etc.) at one or more locations (e.g. exclusive to one or more identified persons, etc.) spaced (e.g. within an arm's length, etc.) from said portable electronic device (e.g. including one or more cellular components, etc.) based at least in part according to (e.g. based in part according to some, etc.) said one or more acoustic ultrasonic signals (e.g. via one or more acoustic ultrasonic signals configured to be demodulated through nonlinear atmospheric interaction to at least in part generate one or more acoustic audio signals, etc.) and based at least in part according to (e.g. based in part according to some, etc.) one or more portable electronic device ultrasonic emitter arrangements (e.g. including one or more polar arrays, etc.) including steering one or more acoustic ultrasonic signals according to at least in part visual imaging of one or more target listeners (e.g. including camera based visual recognition from a laptop to determine target listener location to steer one or more ultrasonic beams through phase array control, etc.).

In one or more implementations, as shown in FIG. 68, operation o12 includes an operation o1203 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including steering one or more acoustic ultrasonic signals according to at least in part acoustic imaging of one or more target listeners. Origination of an illustratively derived outputting acoustic imaging component group can be accomplished through skilled in the art design choice selection of one or more of the above depicted components from one or more of the above depicted subsystems shown in FIG. 25. Components from the outputting acoustic imaging component group can be used in implementing execution of the one or more outputting acoustic imaging instructions i1203 of FIG. 42, can be used in performance of the outputting acoustic imaging electrical circuitry arrangement e1203 of FIG. 35, and/or can be used in otherwise fulfillment of the operation o1203. An exemplary non-transitory signal bearing medium version of the information storage subsystem s200 is depicted in FIG. 42 as bearing the one or more outputting acoustic imaging instructions i1203 that when executed will direct performance of the operation o1203. Furthermore, the outputting acoustic imaging electrical circuitry arrangement ("elec circ arrange") e1203, when activated, will perform the operation o1203. Also, the outputting acoustic imaging module m1203, when executed and/or activated, will direct performance of and/or perform the operation o1203. For instance, in one or more exemplary implementations, the one or more outputting acoustic imaging instructions i1203, when executed, direct performance of the operation o1203 in the illustrative depiction as follows, and/or the outputting acoustic imaging electrical circuitry arrangement e1203, when activated, performs the operation o1203 in the illustrative depiction as follows, and/or the outputting acoustic imaging module m1203, when executed and/or activated, directs performance of and/or performs the operation o1203 in the illustrative depiction as follows, and/or the operation o1203 is otherwise carried out in the illustrative depiction as follows: the electronically outputting, (e.g. using one or more device body embedded transducer portions, etc.) said one or more acoustic ultrasonic signals (e.g. via one or more acoustic ultrasonic signals including signals having one or more frequencies above 160 kHz, etc.) to be demodulated (e.g. including at least in part demodulation via signal frequency demodulation portions, etc.) into one or more acoustic audio signals (e.g. including one or more full spectrum acoustic audio signals, etc.) containing one or more portions (e.g. including containing end portions, etc.) of said audio output information (e.g. including analog audio information, etc.) at one or more locations (e.g. exclusive to one or more predetermined ears, etc.) spaced (e.g. within a three foot radius, etc.) from said portable electronic device (e.g. through reception of cable communication packets, etc.) based at least in part according to (e.g. based in part according to an entirety, etc.) said one or more acoustic ultrasonic signals (e.g. via one or more acoustic ultrasonic signals configured to be demodulated through nonlinear human tissue interaction to at least in part produce one or more acoustic audio signals, etc.) and based at least in part according to (e.g. based in part according to an entirety, etc.) one or more portable electronic device ultrasonic emitter arrangements (e.g. including one or more orthographic arrays, etc.) including steering one or more acoustic ultrasonic signals according to at least in part acoustic imaging of one or more target listeners (e.g. including acoustic imaging from a smart phone to determine target listener location to steer one or more ultrasonic beams through phase array control, etc.).

Figure 69:
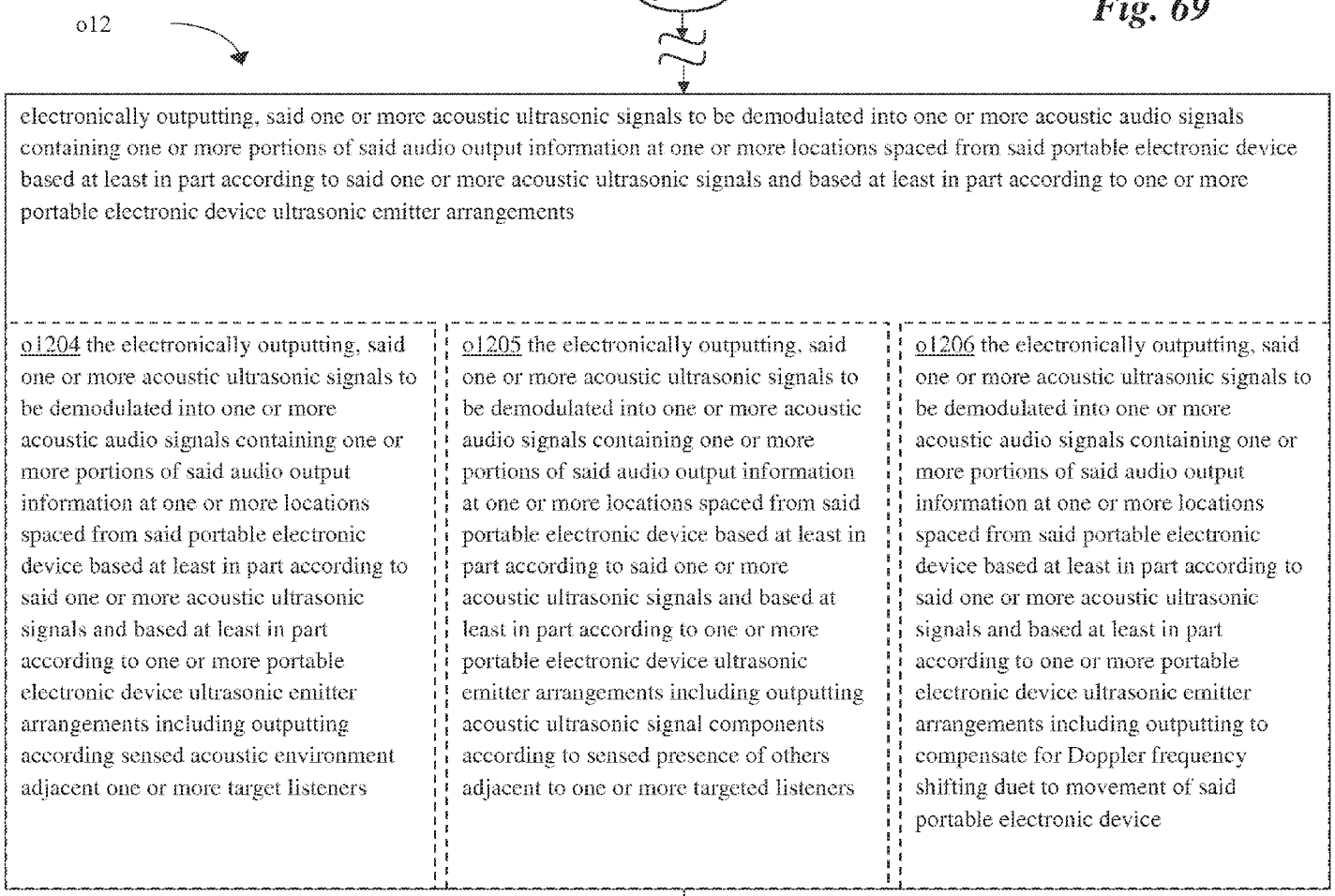
FIG. 69 is a high-level flowchart including exemplary implementations of operation o12 of FIG. 53.

In one or more implementations, as shown in FIG. 69, operation o12 includes an operation o1204 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including outputting according sensed acoustic environment adjacent one or more target listeners. Origination of an illustratively derived outputting sensed acoustic component group can be accomplished through skilled in the art design choice selection of one or more of the above depicted components from one or more of the above depicted subsystems shown in FIG. 25. Components from the outputting sensed acoustic component group can be used in implementing execution of the one or more outputting sensed acoustic instructions i1204 of FIG. 42, can be used in performance of the outputting sensed acoustic electrical circuitry arrangement e1204 of FIG. 35, and/or can be used in otherwise fulfillment of the operation o1204. An exemplary non-transitory signal bearing medium version of the information storage subsystem s200 is depicted in FIG. 42 as bearing the one or more outputting sensed acoustic instructions i1204 that when executed will direct performance of the operation o1204. Furthermore, the outputting sensed acoustic electrical circuitry arrangement ("elec circ arrange") e1204, when activated, will perform the operation o1204. Also, the outputting sensed acoustic module m1204, when executed and/or activated, will direct performance of and/or perform the operation o1204. For instance, in one or more exemplary implementations, the one or more outputting sensed acoustic instructions i1204, when executed, direct performance of the operation o1204 in the illustrative depiction as follows, and/or the outputting sensed acoustic electrical circuitry arrangement e1204, when activated, performs the operation o1204 in the illustrative depiction as follows, and/or the outputting sensed acoustic module m1204, when executed and/or activated, directs performance of and/or performs the operation o1204 in the illustrative depiction as follows, and/or the operation o1204 is otherwise carried out in the illustrative depiction as follows: the electronically outputting, (e.g. from one or more keyboard embedded transducer portions, etc.) said one or more acoustic ultrasonic signals (e.g. via one or more acoustic ultrasonic signals including signals having one or more frequencies above 140 kHz, etc.) to be demodulated (e.g. including at least in part demodulation with signal phase demodulation portions, etc.) into one or more acoustic audio signals (e.g. including one or more partial spectrum acoustic audio signals, etc.) containing one or more portions (e.g. including containing some portions, etc.) of said audio output information (e.g. including digital audio information, etc.) at one or more locations (e.g. exclusive to one or more desired groups of people, etc.) spaced (e.g. within a distance from a portable device to a person, etc.) from said portable electronic device (e.g. including one or more WiFi components, etc.) based at least in part according to (e.g. based in part according to one or more portions, etc.) said one or more acoustic ultrasonic signals (e.g. via one or more acoustic ultrasonic signals configured to be demodulated through nonlinear polymeric interaction to at least in part result in one or more acoustic audio signals, etc.) and based at least in part according to (e.g. based in part according to one or more portions, etc.) one or more portable electronic device ultrasonic emitter arrangements (e.g. including one or more three-dimensional arrays, etc.) including outputting according sensed acoustic environment adjacent one or more target listeners (e.g. including sensing quality of down-converting audio at a target listener through use of a sensitive audio microphone of a tablet, etc.).

In one or more implementations, as shown in FIG. 69, operation o12 includes an operation o1205 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including outputting acoustic ultrasonic signal components according to sensed presence of others adjacent to one or more targeted listeners. Origination of an illustratively derived outputting adjacent component group can be accomplished through skilled in the art design choice selection of one or more of the above depicted components from one or more of the above depicted subsystems shown in FIG. 25. Components from the outputting adjacent component group can be used in implementing execution of the one or more outputting adjacent instructions i1205 of FIG. 42, can be used in performance of the outputting adjacent electrical circuitry arrangement e1205 of FIG. 35, and/or can be used in otherwise fulfillment of the operation o1205. An exemplary non-transitory signal bearing medium version of the information storage subsystem s200 is depicted in FIG. 42 as bearing the one or more outputting adjacent instructions i1205 that when executed will direct performance of the operation o1205. Furthermore, the outputting adjacent electrical circuitry arrangement ("elec circ arrange") e1205, when activated, will perform the operation o1205. Also, the outputting adjacent module m1205, when executed and/or activated, will direct performance of and/or perform the operation o1205. For instance, in one or more exemplary implementations, the one or more outputting adjacent instructions i1205, when executed, direct performance of the operation o1205 in the illustrative depiction as follows, and/or the outputting adjacent electrical circuitry arrangement e1205, when activated, performs the operation o1205 in the illustrative depiction as follows, and/or the outputting adjacent module m1205, when executed and/or activated, directs performance of and/or performs the operation o1205 in the illustrative depiction as follows, and/or the operation o1205 is otherwise carried out in the illustrative depiction as follows: the electronically outputting, (e.g. by one or more monitor embedded transducer portions, etc.) said one or more acoustic ultrasonic signals (e.g. via one or more acoustic ultrasonic signals including signals having one or more frequencies above 120 kHz, etc.) to be demodulated (e.g. including at least in part demodulation using signal rectification, etc.) into one or more acoustic audio signals (e.g. including one or more low amplitude acoustic audio signals, etc.) containing one or more portions (e.g. including containing all portions, etc.) of said audio output information (e.g. including internet based information, etc.) at one or more locations (e.g. exclusive to one or more chosen audio receivers, etc.) spaced (e.g. within a distance from a display screen to a person, etc.) from said portable electronic device (e.g. including one or more infrared components, etc.) based at least in part according to (e.g. based in part according to one or more sections, etc.) said one or more acoustic ultrasonic signals (e.g. via one or more acoustic ultrasonic signals configured to be demodulated through nonlinear apparel interaction to at least in part produce one or more acoustic audio signals, etc.) and based at least in part according to (e.g. based in part according to one or more sections, etc.) one or more portable electronic device ultrasonic emitter arrangements (e.g. including one or more scattered arrangements, etc.) including outputting acoustic ultrasonic signal components according to sensed presence of others adjacent to one or more targeted listeners (e.g. including using ultrasonic imaging of a vicinity of target listener to determine if others without security clearances are near the target listener, etc.).

In one or more implementations, as shown in FIG. 69, operation o12 includes an operation o1206 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including outputting to compensate for Doppler frequency shifting duet to movement of said portable electronic device. Origination of an illustratively derived outputting Doppler frequency component group can be accomplished through skilled in the art design choice selection of one or more of the above depicted components from one or more of the above depicted subsystems shown in FIG. 25. Components from the outputting Doppler frequency component group can be used in implementing execution of the one or more outputting Doppler frequency instructions i1206 of FIG. 42, can be used in performance of the outputting Doppler frequency electrical circuitry arrangement e1206 of FIG. 35, and/or can be used in otherwise fulfillment of the operation o1206. An exemplary non-transitory signal bearing medium version of the information storage subsystem s200 is depicted in FIG. 42 as bearing the one or more outputting Doppler frequency instructions i1206 that when executed will direct performance of the operation o1206. Furthermore, the outputting Doppler frequency electrical circuitry arrangement ("elec circ arrange") e1206, when activated, will perform the operation o1206. Also, the outputting Doppler frequency module m1206, when executed and/or activated, will direct performance of and/or perform the operation o1206. For instance, in one or more exemplary implementations, the one or more outputting Doppler frequency instructions i1206, when executed, direct performance of the operation o1206 in the illustrative depiction as follows, and/or the outputting Doppler frequency electrical circuitry arrangement e1206, when activated, performs the operation o1206 in the illustrative depiction as follows, and/or the outputting Doppler frequency module m1206, when executed and/or activated, directs performance of and/or performs the operation o1206 in the illustrative depiction as follows, and/or the operation o1206 is otherwise carried out in the illustrative depiction as follows: the electronically outputting, (e.g. via one or more dispersed transducer portions, etc.) said one or more acoustic ultrasonic signals (e.g. via one or more acoustic ultrasonic signals including signals having one or more frequencies above 100 kHz, etc.) to be demodulated (e.g. including at least in part demodulation by signal filtering, etc.) into one or more acoustic audio signals (e.g. including one or more high amplitude acoustic audio signals, etc.) containing one or more portions (e.g. including containing measure portions, etc.) of said audio output information (e.g. including processor generated information, etc.) at one or more locations (e.g. exclusive to one or more selected microphones, etc.) spaced (e.g. within a distance from a portable device to an ear, etc.) from said portable electronic device (e.g. including one or more personal digital assistant components, etc.) based at least in part according to (e.g. based in part according to one or more assemblies, etc.) said one or more acoustic ultrasonic signals (e.g. via one or more acoustic ultrasonic signals configured to be demodulated through nonlinear interaction with one or more solids to at least in part generate one or more acoustic audio signals, etc.) and based at least in part according to (e.g. based in part according to one or more assemblies, etc.) one or more portable electronic device ultrasonic emitter arrangements (e.g. including one or more staggered arrays, etc.) including outputting to compensate for Doppler frequency shifting duet to movement of said portable electronic device (e.g. including frequency shifting audio components to account for quick arm movements having a smart watch attached thereto, etc.).

Figure 70:
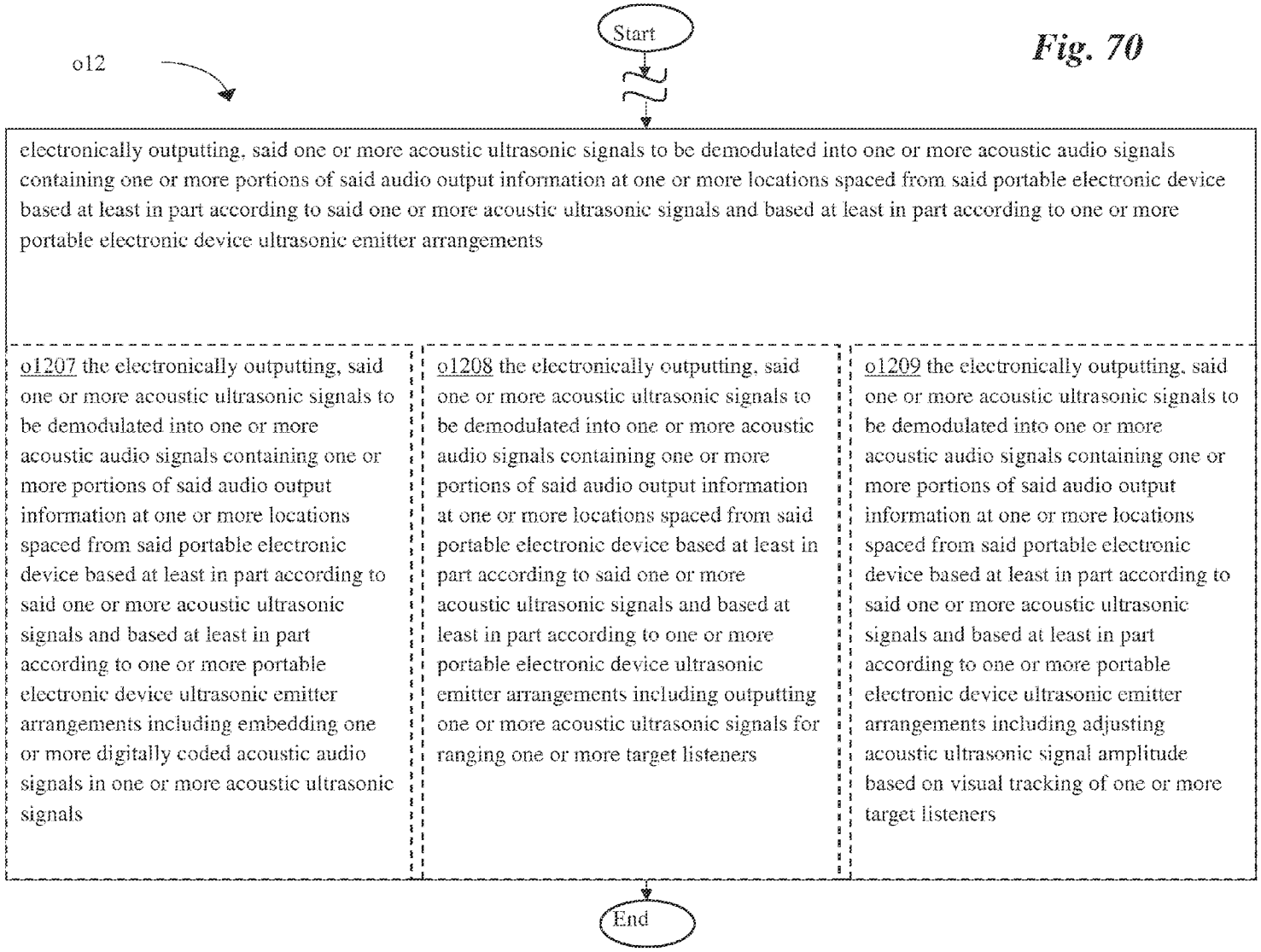
FIG. 70 is a high-level flowchart including exemplary implementations of operation o12 of FIG. 53.

In one or more implementations, as shown in FIG. 70, operation o12 includes an operation o1207 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including embedding one or more digitally coded acoustic audio signals in one or more acoustic ultrasonic signals. Origination of an illustratively derived outputting digitally coded component group can be accomplished through skilled in the art design choice selection of one or more of the above depicted components from one or more of the above depicted subsystems shown in FIG. 25. Components from the outputting digitally coded component group can be used in implementing execution of the one or more outputting digitally coded instructions i1207 of FIG. 42, can be used in performance of the outputting digitally coded electrical circuitry arrangement e1207 of FIG. 35, and/or can be used in otherwise fulfillment of the operation o1207. An exemplary non-transitory signal bearing medium version of the information storage subsystem s200 is depicted in FIG. 42 as bearing the one or more outputting digitally coded instructions i1207 that when executed will direct performance of the operation o1207. Furthermore, the outputting digitally coded electrical circuitry arrangement ("elec circ arrange") e1207, when activated, will perform the operation o1207. Also, the outputting digitally coded module m1207, when executed and/or activated, will direct performance of and/or perform the operation o1207. For instance, in one or more exemplary implementations, the one or more outputting digitally coded instructions i1207, when executed, direct performance of the operation o1207 in the illustrative depiction as follows, and/or the outputting digitally coded electrical circuitry arrangement e1207, when activated, performs the operation o1207 in the illustrative depiction as follows, and/or the outputting digitally coded module m1207, when executed and/or activated, directs performance of and/or performs the operation o1207 in the illustrative depiction as follows, and/or the operation o1207 is otherwise carried out in the illustrative depiction as follows: the electronically outputting, (e.g. through one or more emitter array portions, etc.) said one or more acoustic ultrasonic signals (e.g. via one or more acoustic ultrasonic signals including signals having one or more frequencies above 80 kHz, etc.) to be demodulated (e.g. including at least in part demodulation through signal intelligence recovery, etc.) into one or more acoustic audio signals (e.g. including one or more high frequency acoustic audio signals, etc.) containing one or more portions (e.g. including containing phrase portions, etc.) of said audio output information (e.g. including pre-recorded information, etc.) at one or more locations (e.g. exclusive to one or more designated surfaces, etc.) spaced (e.g. within a distance from a display screen to an ear, etc.) from said portable electronic device (e.g. including one or more smart phone components, etc.) based at least in part according to (e.g. based in part according to one or more partials, etc.) said one or more acoustic ultrasonic signals (e.g. via one or more acoustic ultrasonic signals including signals having one or more frequencies above 60 kHz, etc.) and based at least in part according to (e.g. based in part according to one or more partials, etc.) one or more portable electronic device ultrasonic emitter arrangements (e.g. including one or more linear arrangements, etc.) including embedding one or more digitally coded acoustic audio signals in one or more acoustic ultrasonic signals (e.g. including digitally coded acoustic signals to sense level of quality of acoustic audio signals down-converted from an ultrasonic carrier signal, etc.).

In one or more implementations, as shown in FIG. 70, operation o12 includes an operation o1208 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including outputting one or more acoustic ultrasonic signals for ranging one or more target listeners. Origination of an illustratively derived outputting ranging component group can be accomplished through skilled in the art design choice selection of one or more of the above depicted components from one or more of the above depicted subsystems shown in FIG. 25. Components from the outputting ranging component group can be used in implementing execution of the one or more outputting ranging instructions i1208 of FIG. 42, can be used in performance of the outputting ranging electrical circuitry arrangement e1208 of FIG. 35, and/or can be used in otherwise fulfillment of the operation o1208. An exemplary non-transitory signal bearing medium version of the information storage subsystem s200 is depicted in FIG. 42 as bearing the one or more outputting ranging instructions i1208 that when executed will direct performance of the operation o1208. Furthermore, the outputting ranging electrical circuitry arrangement ("elec circ arrange") e1208, when activated, will perform the operation o1208. Also, the outputting ranging module m1208, when executed and/or activated, will direct performance of and/or perform the operation o1208. For instance, in one or more exemplary implementations, the one or more outputting ranging instructions i1208, when executed, direct performance of the operation o1208 in the illustrative depiction as follows, and/or the outputting ranging electrical circuitry arrangement e1208, when activated, performs the operation o1208 in the illustrative depiction as follows, and/or the outputting ranging module m1208, when executed and/or activated, directs performance of and/or performs the operation o1208 in the illustrative depiction as follows, and/or the operation o1208 is otherwise carried out in the illustrative depiction as follows: the electronically outputting, (e.g. using one or more deposition transducer portions, etc.) said one or more acoustic ultrasonic signals (e.g. via one or more acoustic ultrasonic signals including signals having one or more frequencies above 60 kHz, etc.) to be demodulated (e.g. including demodulation via mutual interference therewith multiple acoustic ultrasonic signals configured to be demodulated through to at least in part result in one or more acoustic audio signals, etc.) into one or more acoustic audio signals (e.g. including one or more lecture information containing acoustic audio signals, etc.) containing one or more portions (e.g. including containing chapter portions, etc.) of said audio output information (e.g. including eavesdropping information, etc.) at one or more locations (e.g. exclusive to one or more identified objects, etc.) spaced (e.g. within a distance from a portable device to a center of a group, etc.) from said portable electronic device (e.g. including one or more cell phone components, etc.) based at least in part according to (e.g. based in part according to one or more pieces, etc.) said one or more acoustic ultrasonic signals (e.g. via one or more acoustic ultrasonic signals including signals having one or more frequencies above 80 kHz, etc.) and based at least in part according to (e.g. based in part according to one or more pieces, etc.) one or more portable electronic device ultrasonic emitter arrangements (e.g. including one or more parabolic arrangements, etc.) including outputting one or more acoustic ultrasonic signals for ranging one or more target listeners (e.g. including using portions of ultrasonic signals sent from a tablet computer to a target listener to determine positioning of the target listener relative to the tablet computer, etc.).

In one or more implementations, as shown in FIG. 70, operation o12 includes an operation o1209 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including adjusting acoustic ultrasonic signal amplitude based on visual tracking of one or more target listeners. Origination of an illustratively derived outputting visual tracking component group can be accomplished through skilled in the art design choice selection of one or more of the above depicted components from one or more of the above depicted subsystems shown in FIG. 25. Components from the outputting visual tracking component group can be used in implementing execution of the one or more outputting visual tracking instructions i1209 of FIG. 42, can be used in performance of the outputting visual tracking electrical circuitry arrangement e1209 of FIG. 35, and/or can be used in otherwise fulfillment of the operation o1209. An exemplary non-transitory signal bearing medium version of the information storage subsystem s200 is depicted in FIG. 42 as bearing the one or more outputting visual tracking instructions i1209 that when executed will direct performance of the operation o1209. Furthermore, the outputting visual tracking electrical circuitry arrangement ("elec circ arrange") e1209, when activated, will perform the operation o1209. Also, the outputting visual tracking module m1209, when executed and/or activated, will direct performance of and/or perform the operation o1209. For instance, in one or more exemplary implementations, the one or more outputting visual tracking instructions i1209, when executed, direct performance of the operation o1209 in the illustrative depiction as follows, and/or the outputting visual tracking electrical circuitry arrangement e1209, when activated, performs the operation o1209 in the illustrative depiction as follows, and/or the outputting visual tracking module m1209, when executed and/or activated, directs performance of and/or performs the operation o1209 in the illustrative depiction as follows, and/or the operation o1209 is otherwise carried out in the illustrative depiction as follows: the electronically outputting, (e.g. from one or more polyvinylidene fluoride film transducer portions, etc.) said one or more acoustic ultrasonic signals (e.g. via one or more acoustic ultrasonic signals configured to be demodulated through nonlinear interaction with one or more solids to at least in part generate one or more acoustic audio signals, etc.) to be demodulated (e.g. including demodulation using one or more acoustic ultrasonic signals configured to be demodulated through nonlinear atmospheric interaction to at least in part generate one or more acoustic audio signals, etc.) into one or more acoustic audio signals (e.g. including one or more foreign language speech information containing acoustic audio signals, etc.) containing one or more portions (e.g. including containing sectional portions, etc.) of said audio output information (e.g. including confidential information, etc.) at one or more locations (e.g. exclusive to one or more predetermined locations, etc.) spaced (e.g. within a distance from a display screen to a center of a group, etc.) from said portable electronic device (e.g. including one or more laptop components, etc.) based at least in part according to (e.g. based in part according to one or more completions, etc.) said one or more acoustic ultrasonic signals (e.g. via one or more acoustic ultrasonic signals including signals having one or more frequencies above 100 kHz, etc.) and based at least in part according to (e.g. based in part according to one or more completions, etc.) one or more portable electronic device ultrasonic emitter arrangements (e.g. including one or more hyperbolic arrangements, etc.) including adjusting acoustic ultrasonic signal amplitude based on visual tracking of one or more target listeners (e.g. including adjustment of amplitude of ultrasonic signals transmitted from a laptop based upon visual recognition of one or more target listeners by algorithms being run on the laptop, etc.).

Figure 71:
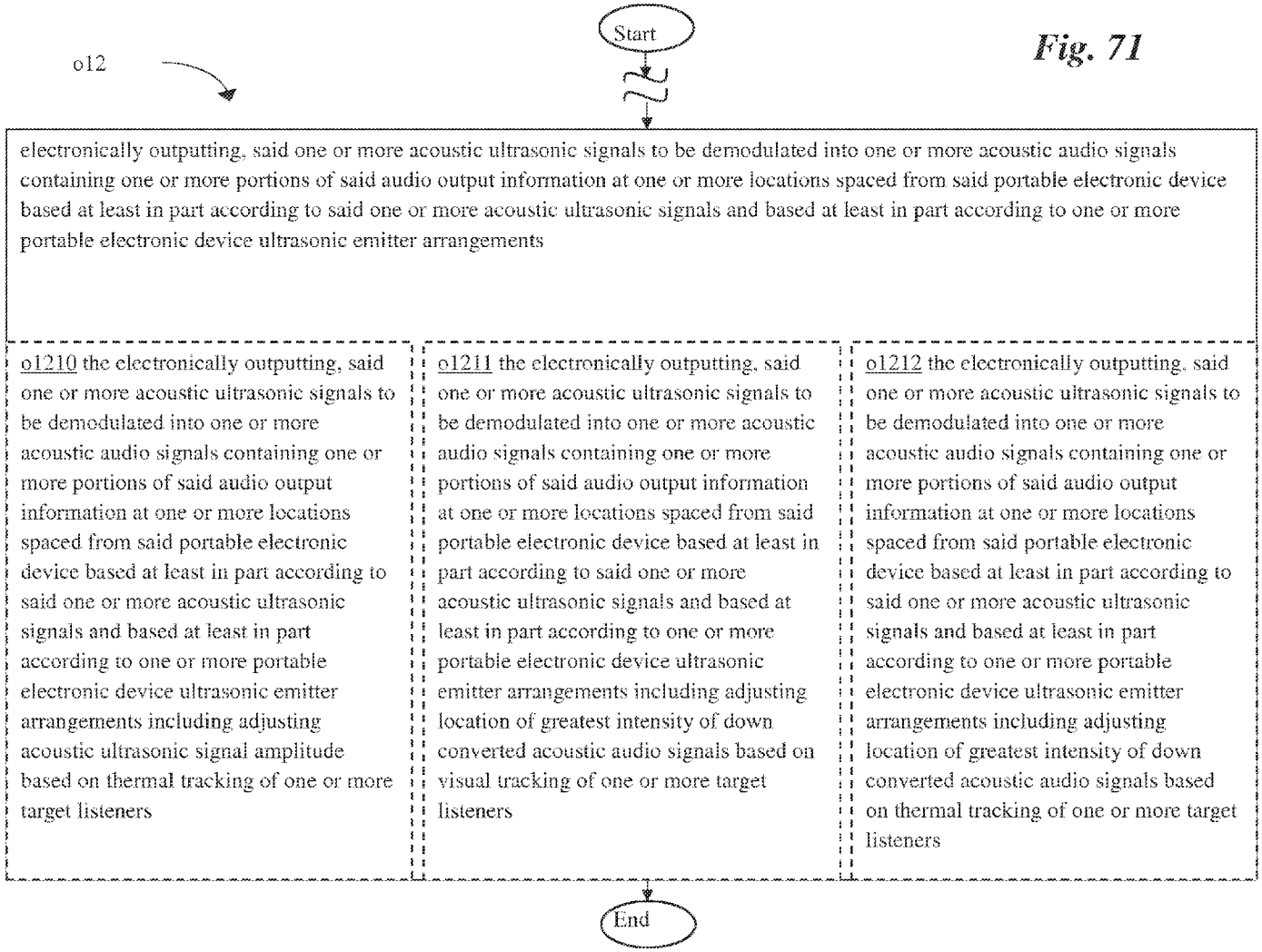
FIG. 71 is a high-level flowchart including exemplary implementations of operation o12 of FIG. 53.

In one or more implementations, as shown in FIG. 71, operation o12 includes an operation o1210 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including adjusting acoustic ultrasonic signal amplitude based on thermal tracking of one or more target listeners. Origination of an illustratively derived outputting thermal tracking component group can be accomplished through skilled in the art design choice selection of one or more of the above depicted components from one or more of the above depicted subsystems shown in FIG.

25. Components from the outputting thermal tracking component group can be used in implementing execution of the one or more outputting thermal tracking instructions i1210 of FIG. 42, can be used in performance of the outputting thermal tracking electrical circuitry arrangement e1210 of FIG. 35, and/or can be used in otherwise fulfillment of the operation o1210. An exemplary non-transitory signal bearing medium version of the information storage subsystem s200 is depicted in FIG. 42 as bearing the one or more outputting thermal tracking instructions i1210 that when executed will direct performance of the operation o1210. Furthermore, the outputting thermal tracking electrical circuitry arrangement ("elec circ arrange") e1210, when activated, will perform the operation o1210. Also, the outputting thermal tracking module m1210, when executed and/or activated, will direct performance of and/or perform the operation o1210. For instance, in one or more exemplary implementations, the one or more outputting thermal tracking instructions i1210, when executed, direct performance of the operation o1210 in the illustrative depiction as follows, and/or the outputting thermal tracking electrical circuitry arrangement e1210, when activated, performs the operation o1210 in the illustrative depiction as follows, and/or the outputting thermal tracking module m1210, when executed and/or activated, directs performance of and/or performs the operation o1210 in the illustrative depiction as follows, and/or the operation o1210 is otherwise carried out in the illustrative depiction as follows: the electronically outputting, (e.g. by one or more electro-thermo-mechanical film transducer portions, etc.) said one or more acoustic ultrasonic signals (e.g. via one or more acoustic ultrasonic signals configured to be demodulated through nonlinear apparel interaction to at least in part produce one or more acoustic audio signals, etc.) to be demodulated (e.g. including demodulation via mutual interference therewith multiple acoustic ultrasonic signals configured to be demodulated through to at least in part result in one or more acoustic audio signals, etc.) into one or more acoustic audio signals (e.g. including one or more classical music selection information containing acoustic audio signals, etc.) containing one or more portions (e.g. including containing whole portions, etc.) of said audio output information (e.g. including two-way conversation information, etc.) at one or more locations (e.g. exclusive to one or more desired environments, etc.) spaced (e.g. within a distance from a transmitter to a receiver, etc.) from said portable electronic device (e.g. including one or more tablet computer components, etc.) based at least in part according to (e.g. based in part according to full coverage, etc.) said one or more acoustic ultrasonic signals (e.g. via one or more acoustic ultrasonic signals including signals having one or more frequencies above 120 kHz, etc.) and based at least in part according to (e.g. based in part according to full coverage, etc.) one or more portable electronic device ultrasonic emitter arrangements (e.g. including one or more enclosed arrangements, etc.) including adjusting acoustic ultrasonic signal amplitude based on thermal tracking of one or more target listeners (e.g. including adjustment of amplitude of ultrasonic signals transmitted from a laptop based upon infrared recognition of one or more target listeners by algorithms being run on the laptop, etc.).

In one or more implementations, as shown in FIG. 71, operation o12 includes an operation o1211 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including adjusting location of greatest intensity of down converted acoustic audio signals based on visual tracking of one or more target listeners. Origination of an illustratively derived outputting greatest intensity component group can be accomplished through skilled in the art design choice selection of one or more of the above depicted components from one or more of the above depicted subsystems shown in FIG. 25. Components from the outputting greatest intensity component group can be used in implementing execution of the one or more outputting greatest intensity instructions i1211 of FIG. 42, can be used in performance of the outputting greatest intensity electrical circuitry arrangement e1211 of FIG. 35, and/or can be used in otherwise fulfillment of the operation o1211. An exemplary non-transitory signal bearing medium version of the information storage subsystem s200 is depicted in FIG. 42 as bearing the one or more outputting greatest intensity instructions i1211 that when executed will direct performance of the operation o1211. Furthermore, the outputting greatest intensity electrical circuitry arrangement ("elec circ arrange") e1211, when activated, will perform the operation o1211. Also, the outputting greatest intensity module m1211, when executed and/or activated, will direct performance of and/or perform the operation o1211. For instance, in one or more exemplary implementations, the one or more outputting greatest intensity instructions i1211, when executed, direct performance of the operation o1211 in the illustrative depiction as follows, and/or the outputting greatest intensity electrical circuitry arrangement e1211, when activated, performs the operation o1211 in the illustrative depiction as follows, and/or the outputting greatest intensity module m1211, when executed and/or activated, directs performance of and/or performs the operation o1211 in the illustrative depiction as follows, and/or the operation o1211 is otherwise carried out in the illustrative depiction as follows: the electronically outputting, (e.g. via one or more electrostrictive transducer portions, etc.) said one or more acoustic ultrasonic signals (e.g. via one or more acoustic ultrasonic signals configured to be demodulated through nonlinear polymeric interaction to at least in part result in one or more acoustic audio signals, etc.) to be demodulated (e.g. including demodulation by one or more acoustic ultrasonic signals configured to be demodulated through nonlinear polymeric interaction to at least in part result in one or more acoustic audio signals, etc.) into one or more acoustic audio signals (e.g. including one or more instructional lesson material information containing acoustic audio signals, etc.) containing one or more portions (e.g. including containing partial portions, etc.) of said audio output information (e.g. including note sequence information, etc.) at one or more locations (e.g. exclusive to one or more chosen distances, etc.) spaced (e.g. within a distance from a first seat back to a second seat back, etc.) from said portable electronic device (e.g. including one or more mp3 player components, etc.) based at least in part according to (e.g. based according to all, etc.) said one or more acoustic ultrasonic signals (e.g. via one or more acoustic ultrasonic signals including signals having one or more frequencies above 140 kHz, etc.) and based at least in part according to (e.g. based according to all, etc.) one or more portable electronic device ultrasonic emitter arrangements (e.g. including one or more transducer arrangements, etc.) including adjusting location of greatest intensity of down converted acoustic audio signals based on visual tracking of one or more target listeners (e.g. including adjustment of location of intensity of ultrasonic signals transmitted from a tablet computer based upon visual recognition of one or more target listeners by algorithms being run on the tablet, etc.).

In one or more implementations, as shown in FIG. 71, operation o12 includes an operation o1212 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including adjusting location of greatest intensity of down converted acoustic audio signals based on thermal tracking of one or more target listeners. Origination of an illustratively derived outputting thermal tracking component group can be accomplished through skilled in the art design choice selection of one or more of the above depicted components from one or more of the above depicted subsystems shown in FIG. 25. Components from the outputting thermal tracking component group can be used in implementing execution of the one or more outputting thermal tracking instructions i1212 of FIG. 42, can be used in performance of the outputting thermal tracking electrical circuitry arrangement e1212 of FIG. 35, and/or can be used in otherwise fulfillment of the operation o1212. An exemplary non-transitory signal bearing medium version of the information storage subsystem s200 is depicted in FIG. 42 as bearing the one or more outputting thermal tracking instructions i1212 that when executed will direct performance of the operation o1212. Furthermore, the outputting thermal tracking electrical circuitry arrangement ("elec circ arrange") e1212, when activated, will perform the operation o1212. Also, the outputting thermal tracking module m1212, when executed and/or activated, will direct performance of and/or perform the operation o1212. For instance, in one or more exemplary implementations, the one or more outputting thermal tracking instructions i1212, when executed, direct performance of the operation o1212 in the illustrative depiction as follows, and/or the outputting thermal tracking electrical circuitry arrangement e1212, when activated, performs the operation o1212 in the illustrative depiction as follows, and/or the outputting thermal tracking module m1212, when executed and/or activated, directs performance of and/or performs the operation o1212 in the illustrative depiction as follows, and/or the operation o1212 is otherwise carried out in the illustrative depiction as follows: the electronically outputting, (e.g. through one or more piezoelectric transducer portions, etc.) said one or more acoustic ultrasonic signals (e.g. via one or more acoustic ultrasonic signals configured to be demodulated through nonlinear human tissue interaction to at least in part produce one or more acoustic audio signals, etc.) to be demodulated (e.g. including demodulation through one or more acoustic ultrasonic signals configured to be demodulated through nonlinear apparel interaction to at least in part produce one or more acoustic audio signals, etc.) into one or more acoustic audio signals (e.g. including one or more warning tone information containing acoustic audio signals, etc.) containing one or more portions (e.g. including containing transitionary portions, etc.) of said audio output information (e.g. including varying pitch information, etc.) at one or more locations (e.g. exclusive to one or more selected ranges, etc.) spaced (e.g. within a distance from a seat back to a tray table, etc.) from said portable electronic device (e.g. including one or more mobile phone components, etc.) based at least in part according to (e.g. based according to some, etc.) said one or more acoustic ultrasonic signals (e.g. via one or more acoustic ultrasonic signals including signals having one or more frequencies above 160 kHz, etc.) and based at least in part according to (e.g. based according to some, etc.) one or more portable electronic device ultrasonic emitter arrangements (e.g. including one or more aperture arrangements, etc.) including adjusting location of greatest intensity of down converted acoustic audio signals based on thermal tracking of one or more target listeners (e.g. including adjustment of location of intensity of ultrasonic signals transmitted from a tablet computer based upon infrared tracking of one or more target listeners by algorithms being run on the tablet, etc.).

Figure 72:
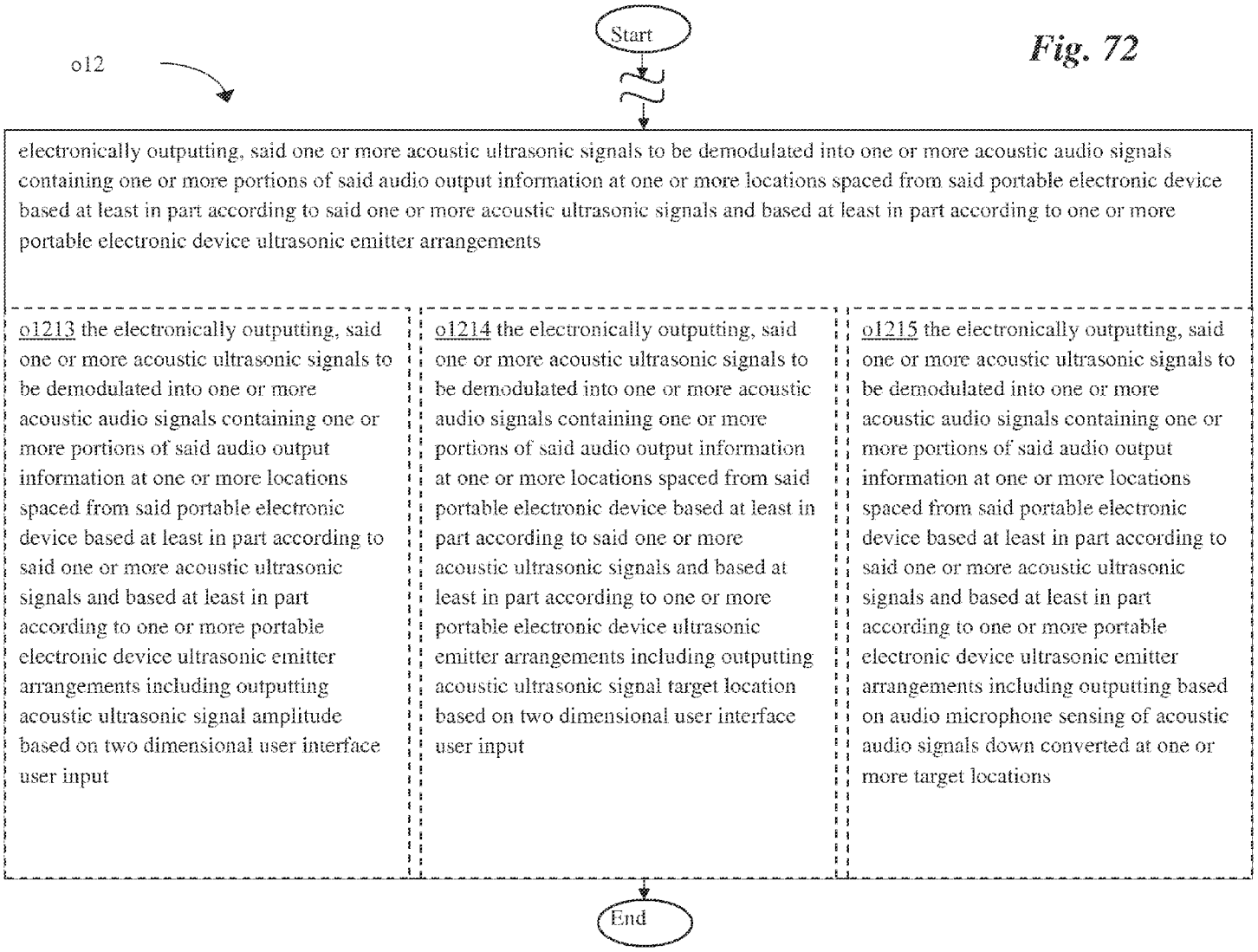
FIG. 72 is a high-level flowchart including exemplary implementations of operation o12 of FIG. 53.

In one or more implementations, as shown in FIG. 72, operation o12 includes an operation o1213 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including outputting acoustic ultrasonic signal amplitude based on two dimensional user interface user input. Origination of an illustratively derived outputting signal amplitude component group can be accomplished through skilled in the art design choice selection of one or more of the above depicted components from one or more of the above depicted subsystems shown in FIG. 25. Components from the outputting signal amplitude component group can be used in implementing execution of the one or more outputting signal amplitude instructions i1213 of FIG. 42, can be used in performance of the outputting signal amplitude electrical circuitry arrangement e1213 of FIG. 35, and/or can be used in otherwise fulfillment of the operation o1213. An exemplary non-transitory signal bearing medium version of the information storage subsystem s200 is depicted in FIG. 42 as bearing the one or more outputting signal amplitude instructions i1213 that when executed will direct performance of the operation o1213. Furthermore, the outputting signal amplitude electrical circuitry arrangement ("elec circ arrange") e1213, when activated, will perform the operation o1213. Also, the outputting signal amplitude module m1213, when executed and/or activated, will direct performance of and/or perform the operation o1213. For instance, in one or more exemplary implementations, the one or more outputting signal amplitude instructions i1213, when executed, direct performance of the operation o1213 in the illustrative depiction as follows, and/or the outputting signal amplitude electrical circuitry arrangement e1213, when activated, performs the operation o1213 in the illustrative depiction as follows, and/or the outputting signal amplitude module m1213, when executed and/or activated, directs performance of and/or performs the operation o1213 in the illustrative depiction as follows, and/or the operation o1213 is otherwise carried out in the illustrative depiction as follows: the electronically outputting, (e.g. using one or more electrostatic transducer portions, etc.) said one or more acoustic ultrasonic signals (e.g. via one or more acoustic ultrasonic signals configured to be demodulated through nonlinear atmospheric interaction to at least in part generate one or more acoustic audio signals, etc.) to be demodulated (e.g. including demodulation by one or more acoustic ultrasonic signals configured to be demodulated through nonlinear interaction with one or more solids to at least in part generate one or more acoustic audio signals, etc.) into one or more acoustic audio signals (e.g. including one or more white noise information containing acoustic audio signals, etc.) containing one or more portions (e.g. including containing temporary portions, etc.) of said audio output information (e.g. including white noise information, etc.) at one or more locations (e.g. exclusive to one or more designated directions, etc.) spaced (e.g. within a distance of an aisle way, etc.) from said portable electronic device (e.g. including one or more two-way radio components, etc.) based at least in part according to (e.g. based according to an entirety, etc.) said one or more acoustic ultrasonic signals (e.g. via one or more acoustic ultrasonic signals including signals having one or more frequencies above 180 kHz, etc.) and based at least in part according to (e.g. based according to an entirety, etc.) one or more portable electronic device ultrasonic emitter arrangements (e.g. including one or more transmitter arrangements, etc.) including outputting acoustic ultrasonic signal amplitude based on two dimensional user interface user input (e.g. including adjustment of amplitude of ultrasonic signals transmitted from a laptop based upon track pad input to the laptop, etc.).

In one or more implementations, as shown in FIG. 72, operation o12 includes an operation o1214 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including outputting acoustic ultrasonic signal target location based on two dimensional user interface user input. Origination of an illustratively derived outputting target location component group can be accomplished through skilled in the art design choice selection of one or more of the above depicted components from one or more of the above depicted subsystems shown in FIG. 25. Components from the outputting target location component group can be used in implementing execution of the one or more outputting target location instructions i1214 of FIG. 42, can be used in performance of the outputting target location electrical circuitry arrangement e1214 of FIG. 35, and/or can be used in otherwise fulfillment of the operation o1214. An exemplary non-transitory signal bearing medium version of the information storage subsystem s200 is depicted in FIG. 42 as bearing the one or more outputting target location instructions i1214 that when executed will direct performance of the operation o1214. Furthermore, the outputting target location electrical circuitry arrangement ("elec circ arrange") e1214, when activated, will perform the operation o1214. Also, the outputting target location module m1214, when executed and/or activated, will direct performance of and/or perform the operation o1214. For instance, in one or more exemplary implementations, the one or more outputting target location instructions i1214, when executed, direct performance of the operation o1214 in the illustrative depiction as follows, and/or the outputting target location electrical circuitry arrangement e1214, when activated, performs the operation o1214 in the illustrative depiction as follows, and/or the outputting target location module m1214, when executed and/or activated, directs performance of and/or performs the operation o1214 in the illustrative depiction as follows, and/or the operation o1214 is otherwise carried out in the illustrative depiction as follows: the electronically outputting, (e.g. from one or more ultrasonic transducer portions, etc.) said one or more acoustic ultrasonic signals (e.g. via multiple acoustic ultrasonic signals configured to be demodulated through mutual interference therewith to at least in part result in one or more acoustic audio signals, etc.) to be demodulated (e.g. including at least in part demodulation by signal down conversion, etc.) into one or more acoustic audio signals (e.g. including varying pitch information containing acoustic audio signals, etc.) containing one or more portions (e.g. including containing steady state portions, etc.) of said audio output information (e.g. including warning tone information, etc.) at one or more locations (e.g. inclusive to one or more designated ears, etc.) spaced (e.g. within a distance from a desk to a chair, etc.) from said portable electronic device (e.g. including one or more security network components, etc.) based at least in part according to (e.g. based according to one or more portions, etc.) said one or more acoustic ultrasonic signals (e.g. via one or more acoustic ultrasonic signals including signals having one or more frequencies above 200 kHz, etc.) and based at least in part according to (e.g. based according to one or more portions, etc.) one or more portable electronic device ultrasonic emitter arrangements (e.g. including one or more air-coupled transducer arrangements, etc.) including outputting acoustic ultrasonic signal target location based on two dimensional user interface user input (e.g. including adjustment of target location of ultrasonic signals transmitted from a laptop based upon track pad input to the laptop, etc.).

In one or more implementations, as shown in FIG. 72, operation o12 includes an operation o1215 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including outputting based on audio microphone sensing of acoustic audio signals down converted at one or more target locations. Origination of an illustratively derived outputting audio microphone component group can be accomplished through skilled in the art design choice selection of one or more of the above depicted components from one or more of the above depicted subsystems shown in FIG. 25. Components from the outputting audio microphone component group can be used in implementing execution of the one or more outputting audio microphone instructions i1215 of FIG. 42, can be used in performance of the outputting audio microphone electrical circuitry arrangement e1215 of FIG. 35, and/or can be used in otherwise fulfillment of the operation o1215. An exemplary non-transitory signal bearing medium version of the information storage subsystem s200 is depicted in FIG. 42 as bearing the one or more outputting audio microphone instructions i1215 that when executed will direct performance of the operation o1215. Furthermore, the outputting audio microphone electrical circuitry arrangement ("elec circ arrange") e1215, when activated, will perform the operation o1215. Also, the outputting audio microphone module m1215, when executed and/or activated, will direct performance of and/or perform the operation o1215. For instance, in one or more exemplary implementations, the one or more outputting audio microphone instructions i1215, when executed, direct performance of the operation o1215 in the illustrative depiction as follows, and/or the outputting audio microphone electrical circuitry arrangement e1215, when activated, performs the operation o1215 in the illustrative depiction as follows, and/or the outputting audio microphone module m1215, when executed and/or activated, directs performance of and/or performs the operation o1215 in the illustrative depiction as follows, and/or the operation o1215 is otherwise carried out in the illustrative depiction as follows: the electronically outputting, (e.g. by one or more membrane speaker portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more note sequence information containing acoustic audio signals, etc.) containing one or more portions (e.g. including containing integrated portions, etc.) of said audio output information (e.g. including instructional lesson material information, etc.) at one or more locations (e.g. inclusive to one or more identified persons, etc.) spaced (e.g. within a distance from a dashboard to a headrest, etc.) from said portable electronic device (e.g. including one or more netbook components, etc.) based at least in part according to (e.g. based according to one or more sections, etc.) said one or more acoustic ultrasonic signals (e.g. via multiple acoustic ultrasonic signals configured to be demodulated through mutual interference therewith to at least in part result in one or more acoustic audio signals, etc.) and based at least in part according to (e.g. based according to one or more sections, etc.) one or more portable electronic device ultrasonic emitter arrangements (e.g. including one or more thin-film membrane arrangements, etc.) including outputting based on audio microphone sensing of acoustic audio signals down converted at one or more target locations (e.g. including adjustment of audio signal amplitude to be down-converted from ultrasonic signals transmitted from a laptop based upon sensing of the down converted audio signals by audio microphone portions located on the laptop, etc.).

Figure 73:
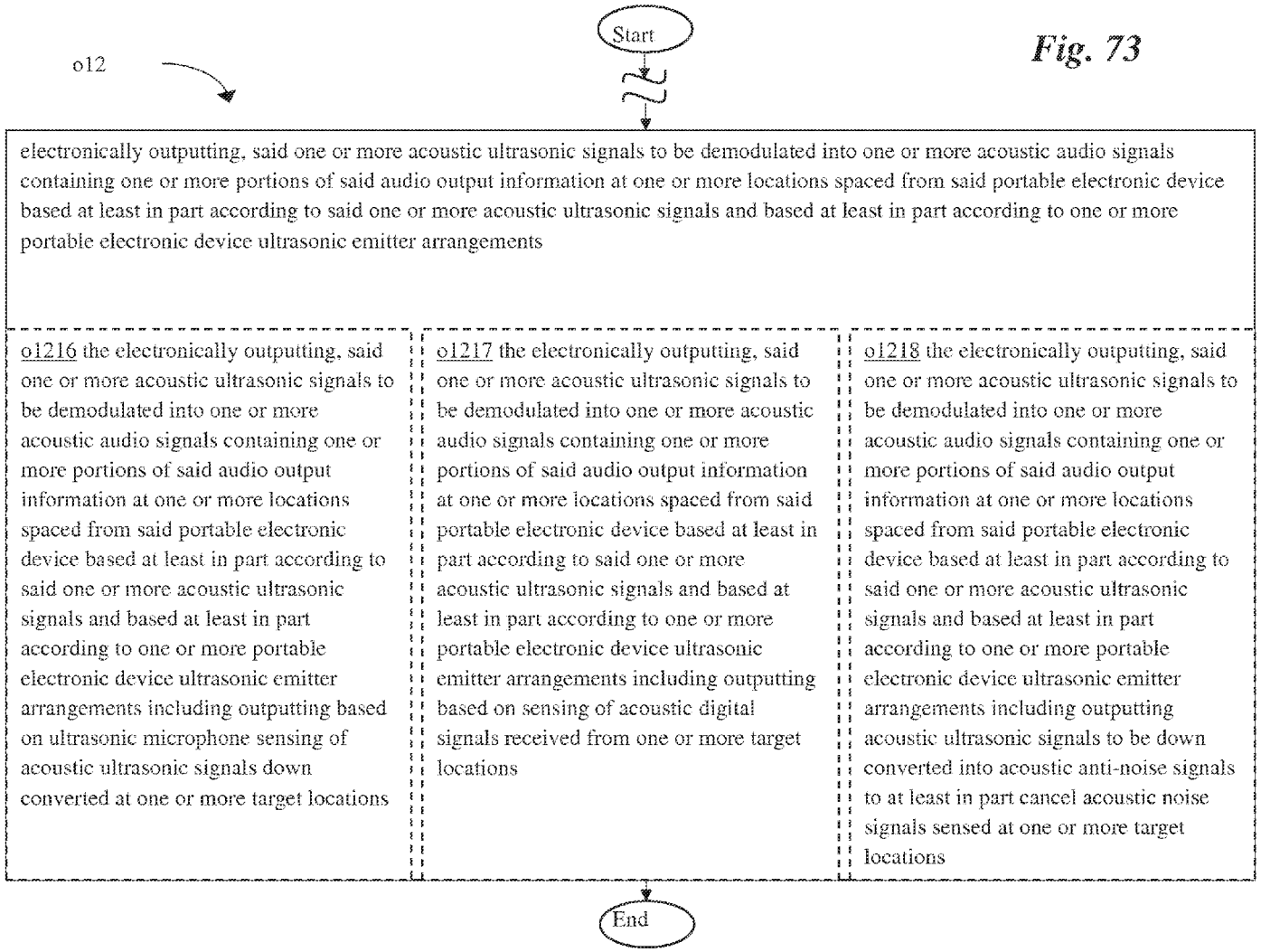
FIG. 73 is a high-level flowchart including exemplary implementations of operation o12 of FIG. 53.

In one or more implementations, as shown in FIG. 73, operation o12 includes an operation o1216 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including outputting based on ultrasonic microphone sensing of acoustic ultrasonic signals down converted at one or more target locations. Origination of an illustratively derived outputting ultrasonic microphone component group can be accomplished through skilled in the art design choice selection of one or more of the above depicted components from one or more of the above depicted subsystems shown in FIG. 25. Components from the outputting ultrasonic microphone component group can be used in implementing execution of the one or more outputting ultrasonic microphone instructions i1216 of FIG. 42, can be used in performance of the outputting ultrasonic microphone electrical circuitry arrangement e1216 of FIG. 35, and/or can be used in otherwise fulfillment of the operation o1216. An exemplary non-transitory signal bearing medium version of the information storage subsystem s200 is depicted in FIG. 42 as bearing the one or more outputting ultrasonic microphone instructions i1216 that when executed will direct performance of the operation o1216. Furthermore, the outputting ultrasonic microphone electrical circuitry arrangement ("elec circ arrange") e1216, when activated, will perform the operation o1216. Also, the outputting ultrasonic microphone module m1216, when executed and/or activated, will direct performance of and/or perform the operation o1216. For instance, in one or more exemplary implementations, the one or more outputting ultrasonic microphone instructions i1216, when executed, direct performance of the operation o1216 in the illustrative depiction as follows, and/or the outputting ultrasonic microphone electrical circuitry arrangement e1216, when activated, performs the operation o1216 in the illustrative depiction as follows, and/or the outputting ultrasonic microphone module m1216, when executed and/or activated, directs performance of and/or performs the operation o1216 in the illustrative depiction as follows, and/or the operation o1216 is otherwise carried out in the illustrative depiction as follows: the electronically outputting, (e.g. via one or more transducer array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more two-way conversation information containing acoustic audio signals, etc.) containing one or more portions (e.g. including containing disparate portions, etc.) of said audio output information (e.g. including classical music selection information, etc.) at one or more locations (e.g. inclusive to one or more predetermined ears, etc.) spaced (e.g. less than confines of a room, etc.) from said portable electronic device (e.g. including one or more ultrabook components, etc.) based at least in part according to (e.g. based according to one or more assemblies, etc.) said one or more acoustic ultrasonic signals (e.g. via one or more acoustic ultrasonic signals configured to be demodulated through nonlinear atmospheric interaction to at least in part generate one or more acoustic audio signals, etc.) and based at least in part according to (e.g. based according to one or more assemblies, etc.) one or more portable electronic device ultrasonic emitter arrangements (e.g. including one or more resonant surface arrangements, etc.) including outputting based on ultrasonic microphone sensing of acoustic ultrasonic signals down converted at one or more target locations (e.g. including adjustment of ultrasonic signal amplitude transmitted from a tablet computer based upon sensing of the ultrasonic signals by ultrasonic microphone portions located on the tablet, etc.).

In one or more implementations, as shown in FIG. 73, operation o12 includes an operation o1217 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including outputting based on sensing of acoustic digital signals received from one or more target locations. Origination of an illustratively derived outputting acoustic digital component group can be accomplished through skilled in the art design choice selection of one or more of the above depicted components from one or more of the above depicted subsystems shown in FIG. 25. Components from the outputting acoustic digital component group can be used in implementing execution of the one or more outputting acoustic digital instructions i1217 of FIG. 42, can be used in performance of the outputting acoustic digital electrical circuitry arrangement e1217 of FIG. 35, and/or can be used in otherwise fulfillment of the operation o1217. An exemplary non-transitory signal bearing medium version of the information storage subsystem s200 is depicted in FIG. 42 as bearing the one or more outputting acoustic digital instructions i1217 that when executed will direct performance of the operation o1217. Furthermore, the outputting acoustic digital electrical circuitry arrangement ("elec circ arrange") e1217, when activated, will perform the operation o1217. Also, the outputting acoustic digital module m1217, when executed and/or activated, will direct performance of and/or perform the operation o1217. For instance, in one or more exemplary implementations, the one or more outputting acoustic digital instructions i1217, when executed, direct performance of the operation o1217 in the illustrative depiction as follows, and/or the outputting acoustic digital electrical circuitry arrangement e1217, when activated, performs the operation o1217 in the illustrative depiction as follows, and/or the outputting acoustic digital module m1217, when executed and/or activated, directs performance of and/or performs the operation o1217 in the illustrative depiction as follows, and/or the operation o1217 is otherwise carried out in the illustrative depiction as follows: the electronically outputting, (e.g. through one or more transducer membrane portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more confidential information containing acoustic audio signals, etc.) containing one or more portions (e.g. including containing beginning portions, etc.) of said audio output information (e.g. including foreign language speech information, etc.) at one or more locations (e.g. inclusive to one or more desired groups of people, etc.) spaced (e.g. less than an arm's length, etc.) from said portable electronic device (e.g. including one or more flip-phone components, etc.) based at least in part according to (e.g. based according to one or more partials, etc.) said one or more acoustic ultrasonic signals (e.g. via one or more acoustic ultrasonic signals configured to be demodulated through nonlinear human tissue interaction to at least in part produce one or more acoustic audio signals, etc.) and based at least in part according to (e.g. based according to one or more partials, etc.) one or more portable electronic device ultrasonic emitter arrangements (e.g. including one or more transmitter arrangements, etc.) including outputting based on sensing of acoustic digital signals received from one or more target locations (e.g. including adjustment of audio signal quality to be down-converted from ultrasonic signals transmitted from a laptop based upon sensing of audio digital signals as part of the down converted audio signals by audio microphone portions located on the laptop, etc.).

In one or more implementations, as shown in FIG. 73, operation o12 includes an operation o1218 for the electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including outputting acoustic ultrasonic signals to be down converted into acoustic anti-noise signals to at least in part cancel acoustic noise signals sensed at one or more target locations. Origination of an illustratively derived outputting acoustic noise component group can be accomplished through skilled in the art design choice selection of one or more of the above depicted components from one or more of the above depicted subsystems shown in FIG. 25. Components from the outputting acoustic noise component group can be used in implementing execution of the one or more outputting acoustic noise instructions i1218 of FIG. 42, can be used in performance of the outputting acoustic noise electrical circuitry arrangement e1218 of FIG. 35, and/or can be used in otherwise fulfillment of the operation o1218. An exemplary non-transitory signal bearing medium version of the information storage subsystem s200 is depicted in FIG. 42 as bearing the one or more outputting acoustic noise instructions i1218 that when executed will direct performance of the operation o1218. Furthermore, the outputting acoustic noise electrical circuitry arrangement ("elec circ arrange") e1218, when activated, will perform the operation o1218. Also, the outputting acoustic noise module m1218, when executed and/or activated, will direct performance of and/or perform the operation o1218. For instance, in one or more exemplary implementations, the one or more outputting acoustic noise instructions i1218, when executed, direct performance of the operation o1218 in the illustrative depiction as follows, and/or the outputting acoustic noise electrical circuitry arrangement e1218, when activated, performs the operation o1218 in the illustrative depiction as follows, and/or the outputting acoustic noise module m1218, when executed and/or activated, directs performance of and/or performs the operation o1218 in the illustrative depiction as follows, and/or the operation o1218 is otherwise carried out in the illustrative depiction as follows: the electronically outputting, (e.g. using one or more transmitter portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more eavesdropping information containing acoustic audio signals, etc.) containing one or more portions (e.g. including containing beginning portions, etc.) of said audio output information (e.g. including lecture formatted information, etc.) at one or more locations (e.g. inclusive to one or more chosen audio receivers, etc.) spaced (e.g. less than a three foot radius, etc.) from said portable electronic device (e.g. including one or more portable computer components, etc.) based at least in part according to (e.g. based according to one or more pieces, etc.) said one or more acoustic ultrasonic signals (e.g. via one or more acoustic ultrasonic signals configured to be demodulated through nonlinear polymeric interaction to at least in part result in one or more acoustic audio signals, etc.) and based at least in part according to (e.g. based according to one or more pieces, etc.) one or more portable electronic device ultrasonic emitter arrangements (e.g. including one or more transducer membrane arrangements, etc.) including outputting acoustic ultrasonic signals to be down converted into acoustic anti-noise signals to at least in part cancel acoustic noise signals sensed at one or more target locations (e.g. including adjustment of anti-noise audio signal amplitude to be down-converted from ultrasonic signals transmitted from a laptop based upon sensing of the noise audio signals by audio microphone portions located on the laptop, etc.).

Figure 74:
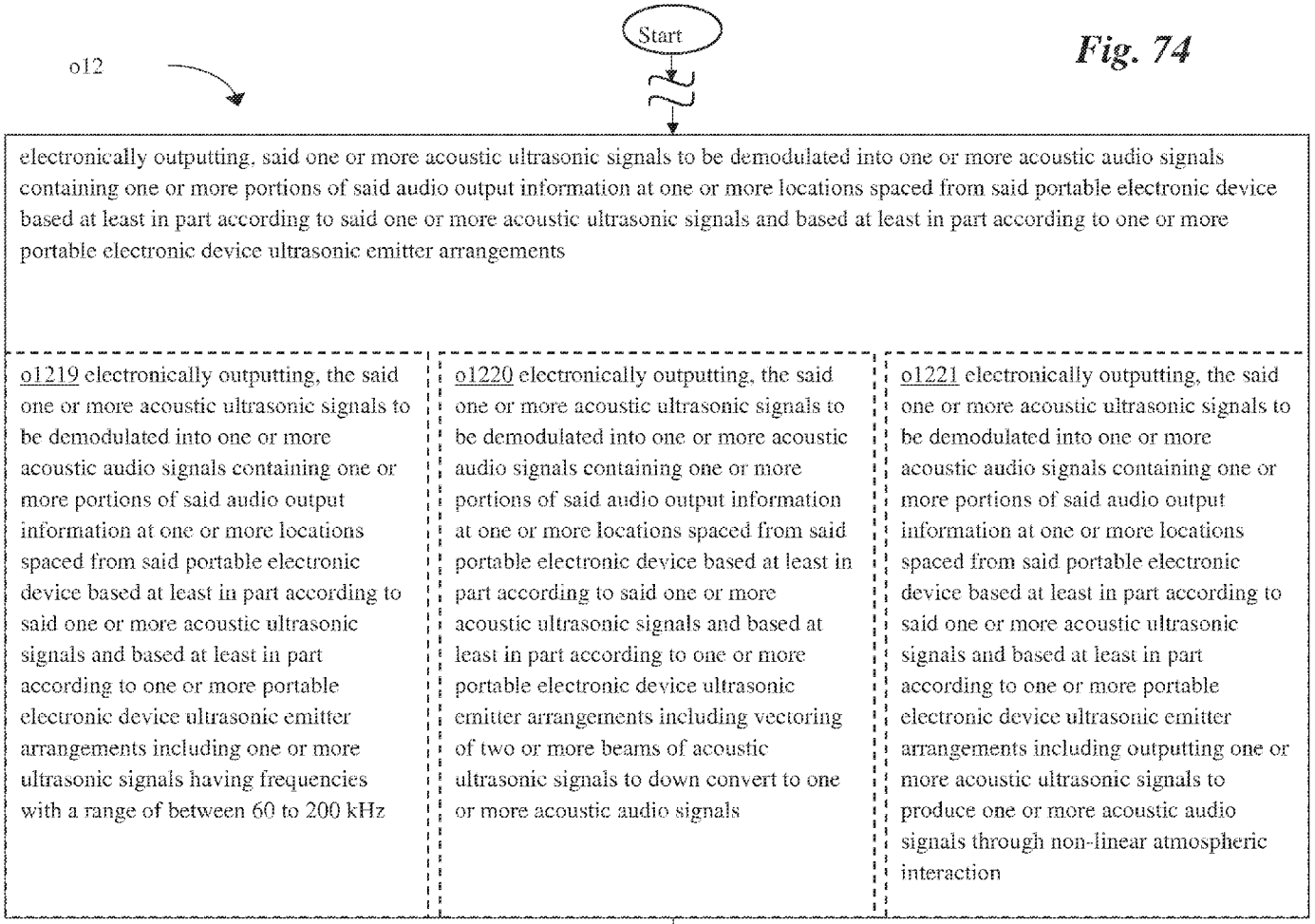
FIG. 74 is a high-level flowchart including exemplary implementations of operation o12 of FIG. 53.

In one or more implementations, as shown in FIG. 74, operation o12 includes an operation o1219 for electronically outputting, the said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including one or more ultrasonic signals having frequencies with a range of between 60 to 200 kHz. Origination of an illustratively derived outputting ultrasonic signals component group can be accomplished through skilled in the art design choice selection of one or more of the above depicted components from one or more of the above depicted subsystems shown in FIG. 25. Components from the outputting ultrasonic signals component group can be used in implementing execution of the one or more outputting ultrasonic signals instructions i1219 of FIG. 42, can be used in performance of the outputting ultrasonic signals electrical circuitry arrangement e1219 of FIG. 35, and/or can be used in otherwise fulfillment of the operation o1219. An exemplary non-transitory signal bearing medium version of the information storage subsystem s200 is depicted in FIG. 42 as bearing the one or more outputting ultrasonic signals instructions i1219 that when executed will direct performance of the operation o1219. Furthermore, the outputting ultrasonic signals electrical circuitry arrangement ("elec circ arrange") e1219, when activated, will perform the operation o1219. Also, the outputting ultrasonic signals module m1219, when executed and/or activated, will direct performance of and/or perform the operation o1219. For instance, in one or more exemplary implementations, the one or more outputting ultrasonic signals instructions i1219, when executed, direct performance of the operation o1219 in the illustrative depiction as follows, and/or the outputting ultrasonic signals electrical circuitry arrangement e1219, when activated, performs the operation o1219 in the illustrative depiction as follows, and/or the outputting ultrasonic signals module m1219, when executed and/or activated, directs performance of and/or performs the operation o1219 in the illustrative depiction as follows, and/or the operation o1219 is otherwise carried out in the illustrative depiction as follows: electronically outputting, (e.g. from one or more signal processor portions, etc.) the said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more pre-recorded information containing acoustic audio signals, etc.) containing one or more portions (e.g. including containing beginning portions, etc.) of said audio output information (e.g. including low frequency audio information, etc.) at one or more locations (e.g. inclusive to one or more selected microphones, etc.) spaced (e.g. less than a distance from a portable device to a person, etc.) from said portable electronic device (e.g. including one or more boombox components, etc.) based at least in part according to (e.g. based according to one or more completions, etc.) said one or more acoustic ultrasonic signals (e.g. via one or more acoustic ultrasonic signals configured to be demodulated through nonlinear apparel interaction to at least in part produce one or more acoustic audio signals, etc.) and based at least in part according to (e.g. based according to one or more completions, etc.) one or more portable electronic device ultrasonic emitter arrangements (e.g. including one or more transducer array arrangements, etc.) including one or more ultrasonic signals having frequencies with a range of between 60 to 200 kHz (e.g. including an acoustic ultrasonic carrier signal including frequency of 150 kHz, etc.).

In one or more implementations, as shown in FIG. 74, operation o12 includes an operation o1220 for electronically outputting, the said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including vectoring of two or more beams of acoustic ultrasonic signals to down convert to one or more acoustic audio signals. Origination of an illustratively derived outputting vectoring component group can be accomplished through skilled in the art design choice selection of one or more of the above depicted components from one or more of the above depicted subsystems shown in FIG. 25. Components from the outputting vectoring component group can be used in implementing execution of the one or more outputting vectoring instructions i1220 of FIG. 43, can be used in performance of the outputting vectoring electrical circuitry arrangement e1220 of FIG. 36, and/or can be used in otherwise fulfillment of the operation o1220. An exemplary non-transitory signal bearing medium version of the information storage subsystem s200 is depicted in FIG. 43 as bearing the one or more outputting vectoring instructions i1220 that when executed will direct performance of the operation o1220. Furthermore, the outputting vectoring electrical circuitry arrangement ("elec circ arrange") e1220, when activated, will perform the operation o1220. Also, the outputting vectoring module m1220, when executed and/or activated, will direct performance of and/or perform the operation o1220. For instance, in one or more exemplary implementations, the one or more outputting vectoring instructions i1220, when executed, direct performance of the operation o1220 in the illustrative depiction as follows, and/or the outputting vectoring electrical circuitry arrangement e1220, when activated, performs the operation o1220 in the illustrative depiction as follows, and/or the outputting vectoring module m1220, when executed and/or activated, directs performance of and/or performs the operation o1220 in the illustrative depiction as follows, and/or the operation o1220 is otherwise carried out in the illustrative depiction as follows: electronically outputting, (e.g. by one or more resonant surface portions, etc.) the said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more processor generated information containing acoustic audio signals, etc.) containing one or more portions (e.g. including containing beginning portions, etc.) of said audio output information (e.g. including low frequency audio information, etc.) at one or more locations (e.g. inclusive to one or more designated surfaces, etc.) spaced (e.g. less than a distance from a display screen to a person, etc.) from said portable electronic device (e.g. including one or more digital audio output components, etc.) based at least in part according to (e.g. based according to full coverage, etc.) said one or more acoustic ultrasonic signals (e.g. via one or more acoustic ultrasonic signals configured to be demodulated through nonlinear interaction with one or more solids to at least in part generate one or more acoustic audio signals, etc.) and based at least in part according to (e.g. based according to full coverage, etc.) one or more portable electronic device ultrasonic emitter arrangements (e.g. including one or more membrane speaker arrangements, etc.) including vectoring of two or more beams of acoustic ultrasonic signals to down convert to one or more acoustic audio signals (e.g. including transmitting two ultrasonic beams having carrier frequencies of 180 kHz that interact nonlinearly in a vicinity of a target listener to down-convert acoustic audio signals being produced by a media show being played on the laptop transmitting the ultrasonic beams, etc.).

In one or more implementations, as shown in FIG. 74, operation o12 includes an operation o1221 for electronically outputting, the said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including outputting one or more acoustic ultrasonic signals to produce one or more acoustic audio signals through non-linear atmospheric interaction. Origination of an illustratively derived outputting atmospheric interaction component group can be accomplished through skilled in the art design choice selection of one or more of the above depicted components from one or more of the above depicted subsystems shown in FIG. 25. Components from the outputting atmospheric interaction component group can be used in implementing execution of the one or more outputting atmospheric interaction instructions i1221 of FIG. 43, can be used in performance of the outputting atmospheric interaction electrical circuitry arrangement e1221 of FIG. 36, and/or can be used in otherwise fulfillment of the operation o1221. An exemplary non-transitory signal bearing medium version of the information storage subsystem s200 is depicted in FIG. 43 as bearing the one or more outputting atmospheric interaction instructions i1221 that when executed will direct performance of the operation o1221. Furthermore, the outputting atmospheric interaction electrical circuitry arrangement ("elec circ arrange") e1221, when activated, will perform the operation o1221. Also, the outputting atmospheric interaction module m1221, when executed and/or activated, will direct performance of and/or perform the operation o1221. For instance, in one or more exemplary implementations, the one or more outputting atmospheric interaction instructions i1221, when executed, direct performance of the operation o1221 in the illustrative depiction as follows, and/or the outputting atmospheric interaction electrical circuitry arrangement e1221, when activated, performs the operation o1221 in the illustrative depiction as follows, and/or the outputting atmospheric interaction module m1221, when executed and/or activated, directs performance of and/or performs the operation o1221 in the illustrative depiction as follows, and/or the operation o1221 is otherwise carried out in the illustrative depiction as follows: electronically outputting, (e.g. via one or more thin-film membrane portions, etc.) the said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more internet based information containing acoustic audio signals, etc.) containing one or more portions (e.g. including containing beginning portions, etc.) of said audio output information (e.g. including classical music selection information, etc.) at one or more locations (e.g. inclusive to one or more identified objects, etc.) spaced (e.g. less than a distance from a portable device to an ear, etc.) from said portable electronic device (e.g. including one or more CD player components, etc.) based at least in part according to (e.g. based in part according to all, etc.) said one or more acoustic ultrasonic signals (e.g. via one or more acoustic ultrasonic signals including signals having one or more frequencies above 60 kHz, etc.) and based at least in part according to (e.g. based in part according to all, etc.) one or more portable electronic device ultrasonic emitter arrangements (e.g. including one or more ultrasonic transducer arrangements, etc.) including outputting one or more acoustic ultrasonic signals to produce one or more acoustic audio signals through non-linear atmospheric interaction (e.g. including transmitting an ultrasonic beam having carrier frequency of 120 kHz that interacts nonlinearly with air in a vicinity of a target listener to down-convert acoustic audio signals being produced by a mp3 file being played on a tablet computer transmitting the ultrasonic beam, etc.).

Figure 75:
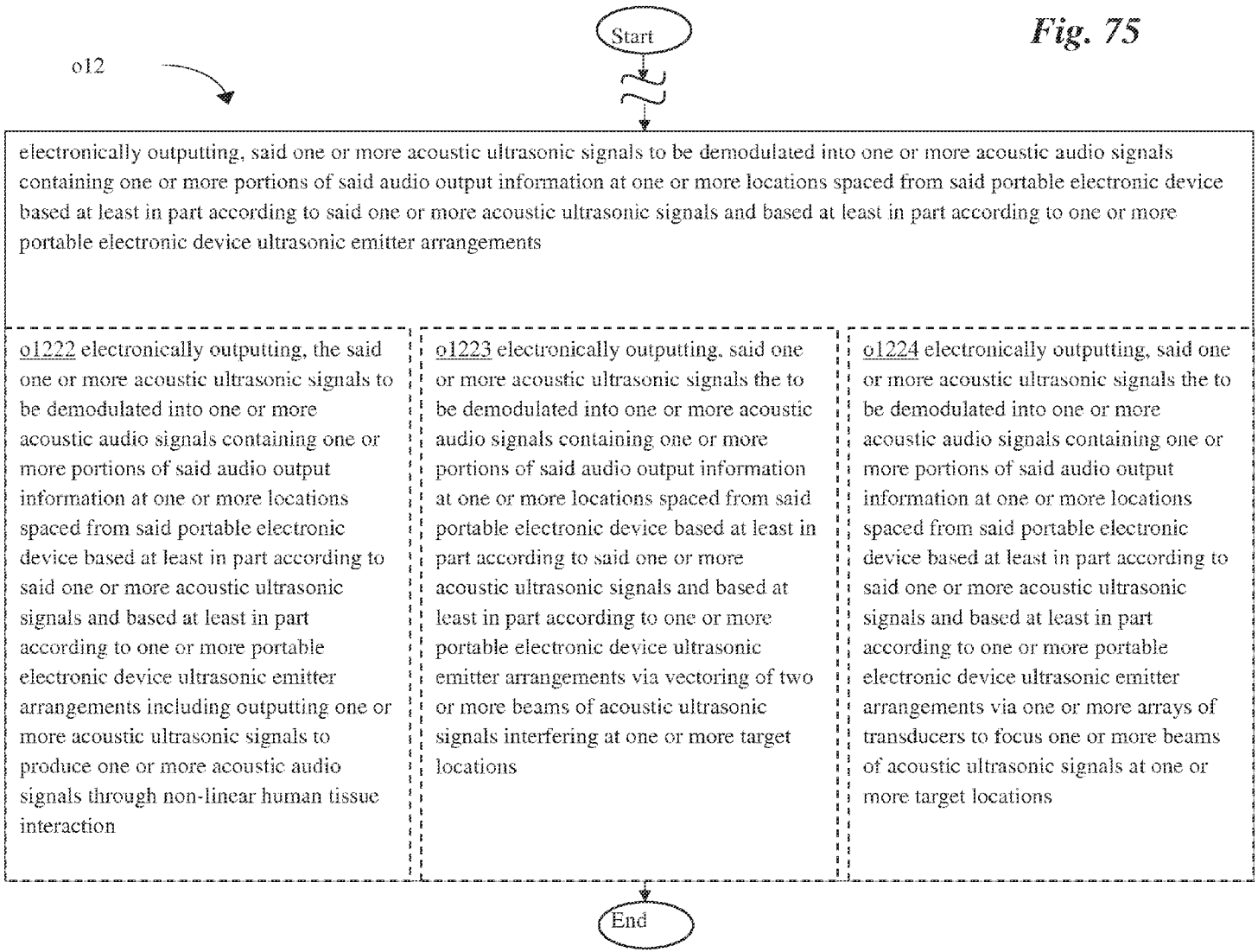
FIG. 75 is a high-level flowchart including exemplary implementations of operation o12 of FIG. 53.

In one or more implementations, as shown in FIG. 75, operation o12 includes an operation o1222 for electronically outputting, the said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including outputting one or more acoustic ultrasonic signals to produce one or more acoustic audio signals through non-linear human tissue interaction. Origination of an illustratively derived outputting human tissue component group can be accomplished through skilled in the art design choice selection of one or more of the above depicted components from one or more of the above depicted subsystems shown in FIG. 25. Components from the outputting human tissue component group can be used in implementing execution of the one or more outputting human tissue instructions i1222 of FIG. 43, can be used in performance of the outputting human tissue electrical circuitry arrangement e1222 of FIG. 36, and/or can be used in otherwise fulfillment of the operation o1222. An exemplary non-transitory signal bearing medium version of the information storage subsystem s200 is depicted in FIG. 43 as bearing the one or more outputting human tissue instructions i1222 that when executed will direct performance of the operation o1222. Furthermore, the outputting human tissue electrical circuitry arrangement ("elec circ arrange") e1222, when activated, will perform the operation o1222. Also, the outputting human tissue module m1222, when executed and/or activated, will direct performance of and/or perform the operation o1222. For instance, in one or more exemplary implementations, the one or more outputting human tissue instructions i1222, when executed, direct performance of the operation o1222 in the illustrative depiction as follows, and/or the outputting human tissue electrical circuitry arrangement e1222, when activated, performs the operation o1222 in the illustrative depiction as follows, and/or the outputting human tissue module m1222, when executed and/or activated, directs performance of and/or performs the operation o1222 in the illustrative depiction as follows, and/or the operation o1222 is otherwise carried out in the illustrative depiction as follows: electronically outputting, (e.g. through one or more air-coupled transducer portions, etc.) the said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more digital audio information containing acoustic audio signals, etc.) containing one or more portions (e.g. including containing beginning portions, etc.) of said audio output information (e.g. including instructional lesson material information, etc.) at one or more locations (e.g. inclusive to one or more predetermined locations, etc.) spaced (e.g. less than a distance from a display screen to an ear, etc.) from said portable electronic device (e.g. including one or more digital music player components, etc.) based at least in part according to (e.g. based in part according to some, etc.) said one or more acoustic ultrasonic signals (e.g. via one or more acoustic ultrasonic signals including signals having one or more frequencies above 80 kHz, etc.) and based at least in part according to (e.g. based in part according to some, etc.) one or more portable electronic device ultrasonic emitter arrangements (e.g. including one or more electrostatic transducer arrangements, etc.) including outputting one or more acoustic ultrasonic signals to produce one or more acoustic audio signals through non-linear human tissue interaction (e.g. including transmitting an ultrasonic beam having carrier frequency of 160 kHz that interacts nonlinearly with human tissue of a target listener to down-convert acoustic audio signals being produced by a video file being played on a smart phone transmitting the ultrasonic beam, etc.).

In one or more implementations, as shown in FIG. 75, operation o12 includes an operation o1223 for electronically outputting, said one or more acoustic ultrasonic signals the to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements via vectoring of two or more beams of acoustic ultrasonic signals interfering at one or more target locations. Origination of an illustratively derived outputting signals interfering component group can be accomplished through skilled in the art design choice selection of one or more of the above depicted components from one or more of the above depicted subsystems shown in FIG. 25. Components from the outputting signals interfering component group can be used in implementing execution of the one or more outputting signals interfering instructions i1223 of FIG. 43, can be used in performance of the outputting signals interfering electrical circuitry arrangement e1223 of FIG. 36, and/or can be used in otherwise fulfillment of the operation o1223. An exemplary non-transitory signal bearing medium version of the information storage subsystem s200 is depicted in FIG. 43 as bearing the one or more outputting signals interfering instructions i1223 that when executed will direct performance of the operation o1223. Furthermore, the outputting signals interfering electrical circuitry arrangement ("elec circ arrange") e1223, when activated, will perform the operation o1223. Also, the outputting signals interfering module m1223, when executed and/or activated, will direct performance of and/or perform the operation o1223. For instance, in one or more exemplary implementations, the one or more outputting signals interfering instructions i1223, when executed, direct performance of the operation o1223 in the illustrative depiction as follows, and/or the outputting signals interfering electrical circuitry arrangement e1223, when activated, performs the operation o1223 in the illustrative depiction as follows, and/or the outputting signals interfering module m1223, when executed and/or activated, directs performance of and/or performs the operation o1223 in the illustrative depiction as follows, and/or the operation o1223 is otherwise carried out in the illustrative depiction as follows: electronically outputting, (e.g. using one or more transmitter portions, etc.) said one or more acoustic ultrasonic signals (e.g. via one or more acoustic ultrasonic signals including signals having one or more frequencies above 200 kHz, etc.) the to be demodulated (e.g. including at least in part demodulation by signal down conversion, etc.) into one or more acoustic audio signals (e.g. including one or more analog audio information containing acoustic audio signals, etc.) containing one or more portions (e.g. including containing beginning portions, etc.) of said audio output information (e.g. including warning tone information, etc.) at one or more locations (e.g. inclusive to one or more desired environments, etc.) spaced (e.g. less than a distance from a portable device to a center of a group, etc.) from said portable electronic device (e.g. including one or more handheld radio components, etc.) based at least in part according to (e.g. based in part according to an entirety, etc.) said one or more acoustic ultrasonic signals (e.g. via one or more acoustic ultrasonic signals including signals having one or more frequencies above 100 kHz, etc.) and based at least in part according to (e.g. based in part according to an entirety, etc.) one or more portable electronic device ultrasonic emitter arrangements (e.g. including one or more piezoelectric transducer arrangements, etc.) via vectoring of two or more beams of acoustic ultrasonic signals interfering at one or more target locations (e.g. including transmitting two ultrasonic beams having carrier frequencies of 200 kHz that interact nonlinearly with each other in a vicinity of a target listener to down-convert acoustic audio signals being produced by an internet broadcast being played on a tablet computer transmitting the ultrasonic beams, etc.).

In one or more implementations, as shown in FIG. 75, operation o12 includes an operation o1224 for electronically outputting, said one or more acoustic ultrasonic signals the to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements via one or more arrays of transducers to focus one or more beams of acoustic ultrasonic signals at one or more target locations. Origination of illustratively derived outputting transducers to focus component group can be accomplished through skilled in the art design choice selection of one or more of the above depicted components from one or more of the above depicted subsystems shown in FIG. 25. Components from the outputting transducers to focus component group can be used in implementing execution of the one or more outputting transducers to focus instructions i1224 of FIG. 43, can be used in performance of the outputting transducers to focus electrical circuitry arrangement e1224 of FIG. 36, and/or can be used in otherwise fulfillment of the operation o1224. An exemplary non-transitory signal bearing medium version of the information storage subsystem s200 is depicted in FIG. 43 as bearing the one or more outputting transducers to focus instructions i1224 that when executed will direct performance of the operation o1224. Furthermore, the outputting transducers to focus electrical circuitry arrangement ("elec circ arrange") e1224, when activated, will perform the operation o1224. Also, the outputting transducers to focus module m1224, when executed and/or activated, will direct performance of and/or perform the operation o1224. For instance, in one or more exemplary implementations, the one or more outputting transducers to focus instructions i1224, when executed, direct performance of the operation o1224 in the illustrative depiction as follows, and/or the outputting transducers to focus electrical circuitry arrangement e1224, when activated, performs the operation o1224 in the illustrative depiction as follows, and/or the outputting transducers to focus module m1224, when executed and/or activated, directs performance of and/or performs the operation o1224 in the illustrative depiction as follows, and/or the operation o1224 is otherwise carried out in the illustrative depiction as follows: electronically outputting, (e.g. from one or more aperture portions, etc.) said one or more acoustic ultrasonic signals (e.g. via one or more acoustic ultrasonic signals including signals having one or more frequencies above 200 kHz, etc.) the to be demodulated (e.g. including at least in part demodulation by signal down conversion, etc.) into one or more acoustic audio signals (e.g. including one or more high frequency audio information containing acoustic audio signals, etc.) containing one or more portions (e.g. including containing beginning portions, etc.) of said audio output information (e.g. including white noise information, etc.) at one or more locations (e.g. inclusive to one or more chosen distances, etc.) spaced (e.g. less than a distance from a display screen to a center of a group, etc.) from said portable electronic device (e.g. including one or more spread spectrum components, etc.) based at least in part according to (e.g. based in part according to one or more portions, etc.) said one or more acoustic ultrasonic signals (e.g. via one or more acoustic ultrasonic signals including signals having one or more frequencies above 120 kHz, etc.) and based at least in part according to (e.g. based in part according to one or more portions, etc.) one or more portable electronic device ultrasonic emitter arrangements (e.g. including one or more electrostrictive transducer arrangements, etc.) via one or more arrays of transducers to focus one or more beams of acoustic ultrasonic signals at one or more target locations (e.g. including an array of transducers on a laptop having a focal point for a beam of acoustic ultrasonic signals of carrier frequency of 120 kHz in a vicinity of an ear of a target listener to be down converted into acoustic audio signals being played on the laptop, etc.).

Figure 76:
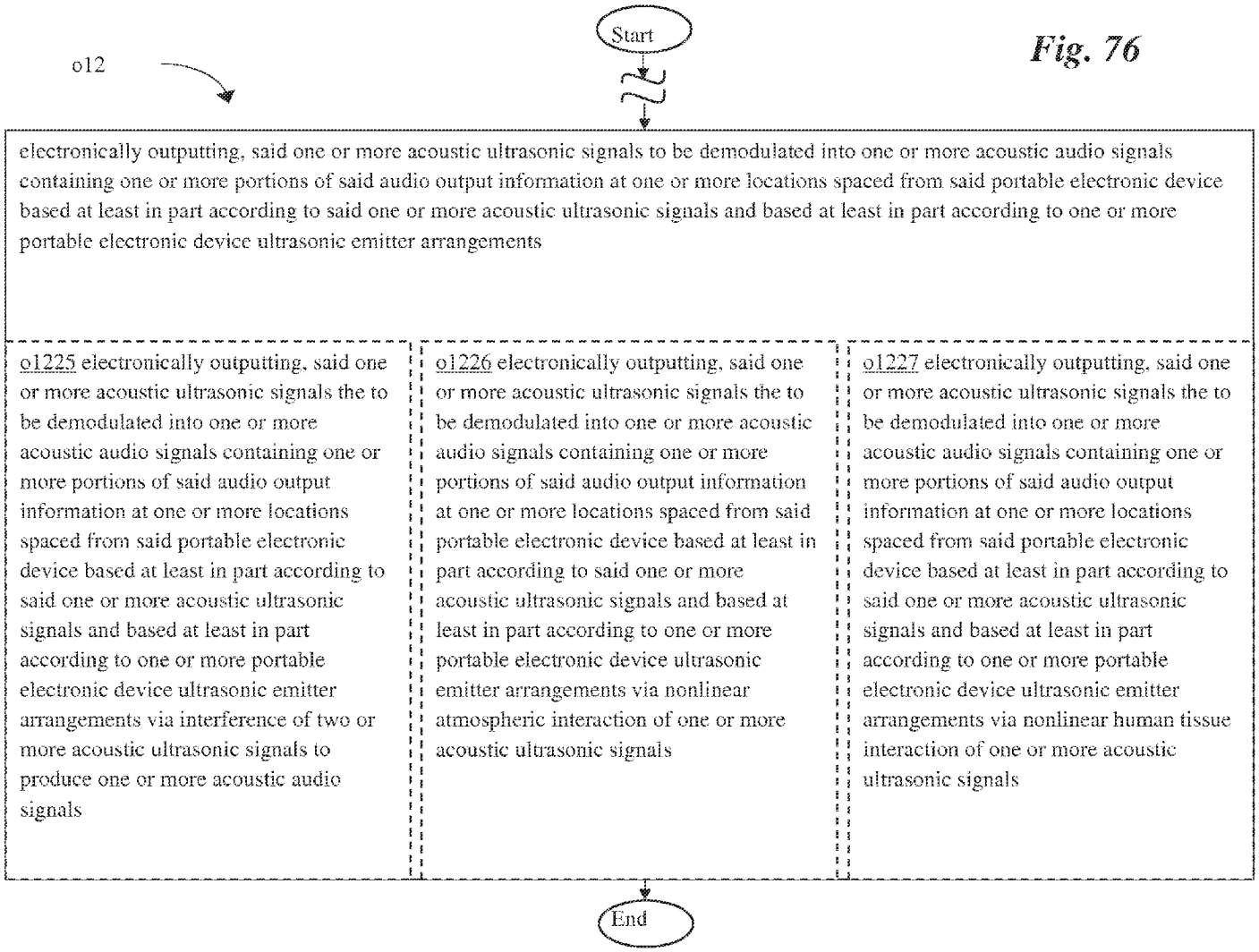
FIG. 76 is a high-level flowchart including exemplary implementations of operation o12 of FIG. 53.

In one or more implementations, as shown in FIG. 76, operation o12 includes an operation o1225 for electronically outputting, said one or more acoustic ultrasonic signals the to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements via interference of two or more acoustic ultrasonic signals to produce one or more acoustic audio signals. Origination of an illustratively derived outputting interference component group can be accomplished through skilled in the art design choice selection of one or more of the above depicted components from one or more of the above depicted subsystems shown in FIG. 25. Components from the outputting interference component group can be used in implementing execution of the one or more outputting interference instructions i1225 of FIG. 43, can be used in performance of the outputting interference electrical circuitry arrangement e1225 of FIG. 36, and/or can be used in otherwise fulfillment of the operation o1225. An exemplary non-transitory signal bearing medium version of the information storage subsystem s200 is depicted in FIG. 43 as bearing the one or more outputting interference instructions i1225 that when executed will direct performance of the operation o1225. Furthermore, the outputting interference electrical circuitry arrangement ("elec circ arrange") e1225, when activated, will perform the operation o1225. Also, the outputting interference module m1225, when executed and/or activated, will direct performance of and/or perform the operation o1225. For instance, in one or more exemplary implementations, the one or more outputting interference instructions i1225, when executed, direct performance of the operation o1225 in the illustrative depiction as follows, and/or the outputting interference electrical circuitry arrangement e1225, when activated, performs the operation o1225 in the illustrative depiction as follows, and/or the outputting interference module m1225, when executed and/or activated, directs performance of and/or performs the operation o1225 in the illustrative depiction as follows, and/or the operation o1225 is otherwise carried out in the illustrative depiction as follows: electronically outputting, (e.g. by one or more transducer portions, etc.) said one or more acoustic ultrasonic signals (e.g. via one or more acoustic ultrasonic signals including signals having one or more frequencies above 200 kHz, etc.) the to be demodulated (e.g. including at least in part demodulation by signal down conversion, etc.) into one or more acoustic audio signals (e.g. including one or more low frequency audio information containing acoustic audio signals, etc.) containing one or more portions (e.g. including containing beginning portions, etc.) of said audio output information (e.g. including varying pitch information, etc.) at one or more locations (e.g. inclusive to one or more selected ranges, etc.) spaced (e.g. less than a distance from a transmitter to a receiver, etc.) from said portable electronic device (e.g. including one or more wireless components, etc.) based at least in part according to (e.g. based in part according to one or more sections, etc.) said one or more acoustic ultrasonic signals (e.g. via one or more acoustic ultrasonic signals including signals having one or more frequencies above 140 kHz, etc.) and based at least in part according to (e.g. based in part according to one or more sections, etc.) one or more portable electronic device ultrasonic emitter arrangements (e.g. including one or more electro-thermo-mechanical film transducer arrangements, etc.) via interference of two or more acoustic ultrasonic signals to produce one or more acoustic audio signals (e.g. including transmitting two ultrasonic beams having carrier frequencies of 60 kHz that interact nonlinearly with each other in a vicinity of a target listener to down-convert acoustic audio signals being produced by a media player on a notebook computer transmitting the ultrasonic beams, etc.).

In one or more implementations, as shown in FIG. 76, operation o12 includes an operation o1226 for electronically outputting, said one or more acoustic ultrasonic signals the to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements via nonlinear atmospheric interaction of one or more acoustic ultrasonic signals. Origination of an illustratively derived outputting nonlinear atmospheric component group can be accomplished through skilled in the art design choice selection of one or more of the above depicted components from one or more of the above depicted subsystems shown in FIG. 25. Components from the outputting nonlinear atmospheric component group can be used in implementing execution of the one or more outputting nonlinear atmospheric instructions i1226 of FIG. 43, can be used in performance of the outputting nonlinear atmospheric electrical circuitry arrangement e1226 of FIG. 36, and/or can be used in otherwise fulfillment of the operation o1226. An exemplary non-transitory signal bearing medium version of the information storage subsystem s200 is depicted in FIG. 43 as bearing the one or more outputting nonlinear atmospheric instructions i1226 that when executed will direct performance of the operation o1226. Furthermore, the outputting nonlinear atmospheric electrical circuitry arrangement ("elec circ arrange") e1226, when activated, will perform the operation o1226. Also, the outputting nonlinear atmospheric module m1226, when executed and/or activated, will direct performance of and/or perform the operation o1226. For instance, in one or more exemplary implementations, the one or more outputting nonlinear atmospheric instructions i1226, when executed, direct performance of the operation o1226 in the illustrative depiction as follows, and/or the outputting nonlinear atmospheric electrical circuitry arrangement e1226, when activated, performs the operation o1226 in the illustrative depiction as follows, and/or the outputting nonlinear atmospheric module m1226, when executed and/or activated, directs performance of and/or performs the operation o1226 in the illustrative depiction as follows, and/or the operation o1226 is otherwise carried out in the illustrative depiction as follows: electronically outputting, (e.g. via one or more speaker portions, etc.) said one or more acoustic ultrasonic signals (e.g. via one or more acoustic ultrasonic signals including signals having one or more frequencies above 200 kHz, etc.) the to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including note sequence information, etc.) at one or more locations (e.g. inclusive to one or more designated directions, etc.) spaced (e.g. less than a distance from a first seat back to a second seat back, etc.) from said portable electronic device (e.g. including one or more frequency division multiplexing components, etc.) based at least in part according to (e.g. based in part according to one or more assemblies, etc.) said one or more acoustic ultrasonic signals (e.g. via one or more acoustic ultrasonic signals including signals having one or more frequencies above 160 kHz, etc.) and based at least in part according to (e.g. based in part according to one or more assemblies, etc.) one or more portable electronic device ultrasonic emitter arrangements (e.g. including one or more polyvinylidene fluoride film transducer arrangements, etc.) via nonlinear atmospheric interaction of one or more acoustic ultrasonic signals (e.g. including transmitting an acoustic ultrasonic signal having carrier frequency of 80 kHz that interacts nonlinearly with air in a vicinity of a target listener to down-convert acoustic audio signals being produced by an audio player of a smart phone transmitting the acoustic ultrasonic signal, etc.).

In one or more implementations, as shown in FIG. 76, operation o12 includes an operation o1227 for electronically outputting, said one or more acoustic ultrasonic signals the to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements via nonlinear human tissue interaction of one or more acoustic ultrasonic signals. Origination of an illustratively derived outputting nonlinear tissue component group can be accomplished through skilled in the art design choice selection of one or more of the above depicted components from one or more of the above depicted subsystems shown in FIG. 25. Components from the outputting nonlinear tissue component group can be used in implementing execution of the one or more outputting nonlinear tissue instructions i1227 of FIG. 43, can be used in performance of the outputting nonlinear tissue electrical circuitry arrangement e1227 of FIG. 36, and/or can be used in otherwise fulfillment of the operation o1227. An exemplary non-transitory signal bearing medium version of the information storage subsystem s200 is depicted in FIG. 43 as bearing the one or more outputting nonlinear tissue instructions i1227 that when executed will direct performance of the operation o1227. Furthermore, the outputting nonlinear tissue electrical circuitry arrangement ("elec circ arrange") e1227, when activated, will perform the operation o1227. Also, the outputting nonlinear tissue module m1227, when executed and/or activated, will direct performance of and/or perform the operation o1227. For instance, in one or more exemplary implementations, the one or more outputting nonlinear tissue instructions i1227, when executed, direct performance of the operation o1227 in the illustrative depiction as follows, and/or the outputting nonlinear tissue electrical circuitry arrangement e1227, when activated, performs the operation o1227 in the illustrative depiction as follows, and/or the outputting nonlinear tissue module m1227, when executed and/or activated, directs performance of and/or performs the operation o1227 in the illustrative depiction as follows, and/or the operation o1227 is otherwise carried out in the illustrative depiction as follows: electronically outputting, (e.g. through one or more cable interface portions, etc.) said one or more acoustic ultrasonic signals (e.g. via one or more acoustic ultrasonic signals including signals having one or more frequencies above 200 kHz, etc.) the to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including two-way conversation information, etc.) at one or more locations (e.g. exclusive to within a vicinity of one or more designated ears, etc.) spaced (e.g. less than a distance from a seat back to a tray table, etc.) from said portable electronic device (e.g. including one or more time division multiplexing components, etc.) based at least in part according to (e.g. based in part according to one or more partials, etc.) said one or more acoustic ultrasonic signals (e.g. via one or more acoustic ultrasonic signals including signals having one or more frequencies above 180 kHz, etc.) and based at least in part according to (e.g. based in part according to one or more partials, etc.) one or more portable electronic device ultrasonic emitter arrangements (e.g. including one or more deposition transducer arrangements, etc.) via nonlinear human tissue interaction of one or more acoustic ultrasonic signals (e.g. including transmitting an acoustic ultrasonic signal having carrier frequency of 130 kHz that interacts nonlinearly with human tissue of a target listener to down-convert acoustic audio signals being produced by a CD player being operated by a business laptop transmitting the acoustic ultrasonic signal, etc.).

Figure 77:
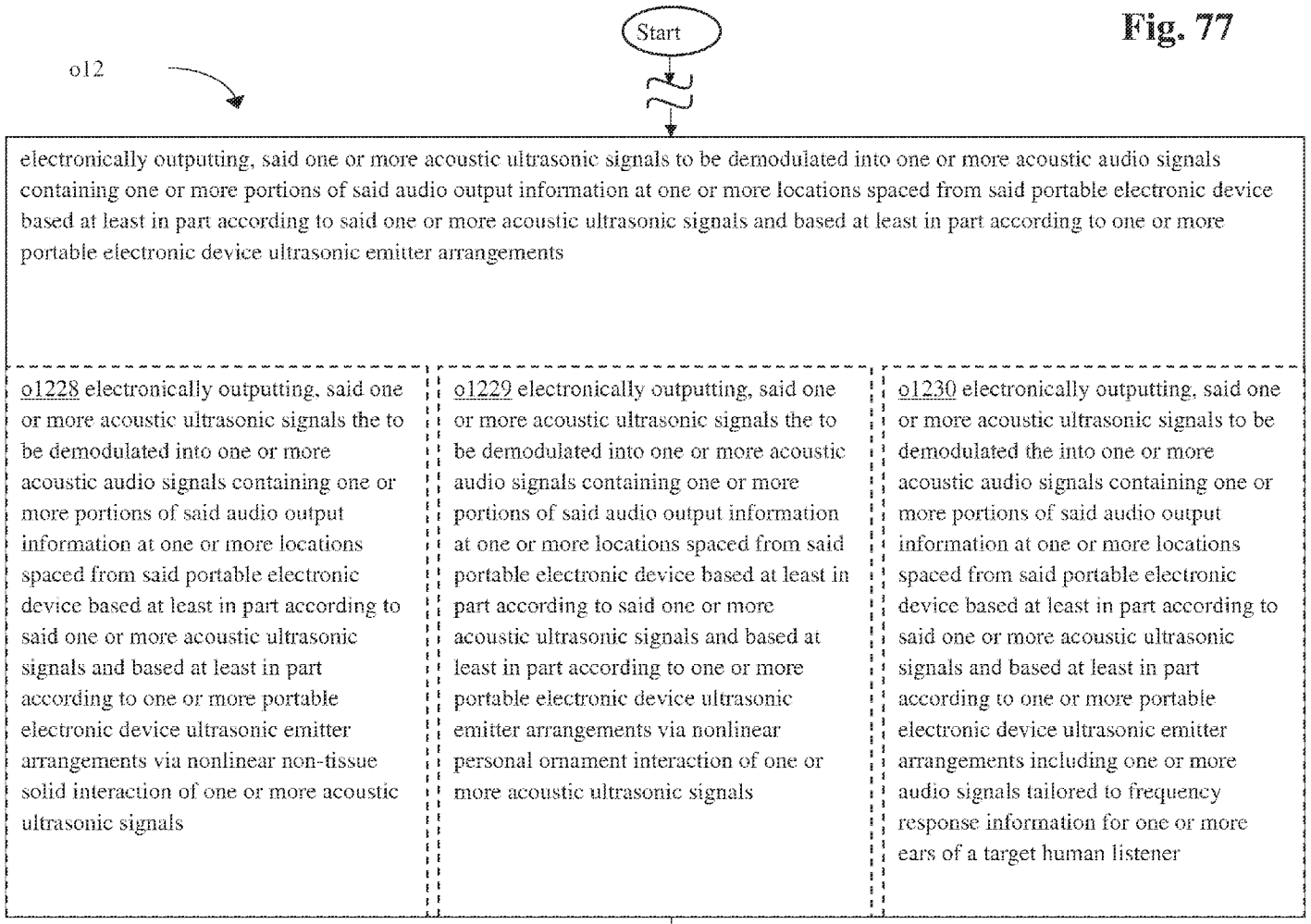
FIG. 77 is a high-level flowchart including exemplary implementations of operation o12 of FIG. 53.

In one or more implementations, as shown in FIG. 77, operation o12 includes an operation o1228 for electronically outputting, said one or more acoustic ultrasonic signals the to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements via nonlinear non-tissue solid interaction of one or more acoustic ultrasonic signals. Origination of an illustratively derived outputting nonlinear non-tissue component group can be accomplished through skilled in the art design choice selection of one or more of the above depicted components from one or more of the above depicted subsystems shown in FIG. 25. Components from the outputting nonlinear non-tissue component group can be used in implementing execution of the one or more outputting nonlinear non-tissue instructions i1228 of FIG. 43, can be used in performance of the outputting nonlinear non-tissue electrical circuitry arrangement e1228 of FIG. 36, and/or can be used in otherwise fulfillment of the operation o1228. An exemplary non-transitory signal bearing medium version of the information storage subsystem s200 is depicted in FIG. 43 as bearing the one or more outputting nonlinear non-tissue instructions i1228 that when executed will direct performance of the operation o1228. Furthermore, the outputting nonlinear non-tissue electrical circuitry arrangement ("elec circ arrange") e1228, when activated, will perform the operation o1228. Also, the outputting nonlinear non-tissue module m1228, when executed and/or activated, will direct performance of and/or perform the operation o1228. For instance, in one or more exemplary implementations, the one or more outputting nonlinear non-tissue instructions i1228, when executed, direct performance of the operation o1228 in the illustrative depiction as follows, and/or the outputting nonlinear non-tissue electrical circuitry arrangement e1228, when activated, performs the operation o1228 in the illustrative depiction as follows, and/or the outputting nonlinear non-tissue module m1228, when executed and/or activated, directs performance of and/or performs the operation o1228 in the illustrative depiction as follows, and/or the operation o1228 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) the to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including confidential information, etc.) at one or more locations (e.g. exclusive to within a vicinity of one or more identified persons, etc.) spaced (e.g. less than a distance of an aisle way, etc.) from said portable electronic device (e.g. including one or more clamshell phone components, etc.) based at least in part according to (e.g. based in part according to one or more pieces, etc.) said one or more acoustic ultrasonic signals (e.g. via one or more acoustic ultrasonic signals including signals having one or more frequencies above 200 kHz, etc.) and based at least in part according to (e.g. based in part according to one or more pieces, etc.) one or more portable electronic device ultrasonic emitter arrangements (e.g. including one or more emitter array arrangements, etc.) via nonlinear non-tissue solid interaction of one or more acoustic ultrasonic signals (e.g. including transmitting an acoustic ultrasonic signal having carrier frequency of 60 kHz that interacts nonlinearly with non-tissue solid near a target listener to down-convert acoustic audio signals stored in memory of a two-way radio transmitting the acoustic ultrasonic signal, etc.).

In one or more implementations, as shown in FIG. 77, operation o12 includes an operation o1229 for electronically outputting, said one or more acoustic ultrasonic signals the to be demodulated into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements via nonlinear personal ornament interaction of one or more acoustic ultrasonic signals. Origination of an illustratively derived outputting nonlinear personal component group can be accomplished through skilled in the art design choice selection of one or more of the above depicted components from one or more of the above depicted subsystems shown in FIG. 25. Components from the outputting nonlinear personal component group can be used in implementing execution of the one or more outputting nonlinear personal instructions i1229 of FIG. 43, can be used in performance of the outputting nonlinear personal electrical circuitry arrangement e1229 of FIG. 36, and/or can be used in otherwise fulfillment of the operation o1229. An exemplary non-transitory signal bearing medium version of the information storage subsystem s200 is depicted in FIG. 43 as bearing the one or more outputting nonlinear personal instructions i1229 that when executed will direct performance of the operation o1229. Furthermore, the outputting nonlinear personal electrical circuitry arrangement ("elec circ arrange") e1229, when activated, will perform the operation o1229. Also, the outputting nonlinear personal module m1229, when executed and/or activated, will direct performance of and/or perform the operation o1229. For instance, in one or more exemplary implementations, the one or more outputting nonlinear personal instructions i1229, when executed, direct performance of the operation o1229 in the illustrative depiction as follows, and/or the outputting nonlinear personal electrical circuitry arrangement e1229, when activated, performs the operation o1229 in the illustrative depiction as follows, and/or the outputting nonlinear personal module m1229, when executed and/or activated, directs performance of and/or performs the operation o1229 in the illustrative depiction as follows, and/or the operation o1229 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) the to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including eavesdropping information, etc.) at one or more locations (e.g. exclusive to within a vicinity of one or more predetermined ears, etc.) spaced (e.g. less than a distance from a desk to a chair, etc.) from said portable electronic device (e.g. including one or more media player components, etc.) based at least in part according to (e.g. based in part according to one or more completions, etc.) said one or more acoustic ultrasonic signals (e.g. via multiple acoustic ultrasonic signals configured to be demodulated through mutual interference therewith to at least in part result in one or more acoustic audio signals, etc.) and based at least in part according to (e.g. based in part according to one or more completions, etc.) one or more portable electronic device ultrasonic emitter arrangements (e.g. including one or more dispersed transducer arrangements, etc.) via nonlinear personal ornament interaction of one or more acoustic ultrasonic signals (e.g. including transmitting an acoustic ultrasonic signal having carrier frequency of 110 kHz that interacts nonlinearly with an ear ring of a target listener to down-convert acoustic audio signals being produced by an mp3 player transmitting the acoustic ultrasonic signal, etc.).

In one or more implementations, as shown in FIG. 77, operation o12 includes an operation o1230 for electronically outputting, said one or more acoustic ultrasonic signals to be demodulated the into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including one or more audio signals tailored to frequency response information for one or more ears of a target human listener. Origination of illustratively derived outputting ears of a target component group can be accomplished through skilled in the art design choice selection of one or more of the above depicted components from one or more of the above depicted subsystems shown in FIG. 25. Components from the outputting ears of a target component group can be used in implementing execution of the one or more outputting ears of a target instructions i1230 of FIG. 43, can be used in performance of the outputting ears of a target electrical circuitry arrangement e1230 of FIG. 36, and/or can be used in otherwise fulfillment of the operation o1230. An exemplary non-transitory signal bearing medium version of the information storage subsystem s200 is depicted in FIG. 43 as bearing the one or more outputting ears of a target instructions i1230 that when executed will direct performance of the operation o1230. Furthermore, the outputting ears of a target electrical circuitry arrangement ("elec circ arrange") e1230, when activated, will perform the operation o1230. Also, the outputting ears of a target module m1230, when executed and/or activated, will direct performance of and/or perform the operation o1230. For instance, in one or more exemplary implementations, the one or more outputting ears of a target instructions i1230, when executed, direct performance of the operation o1230 in the illustrative depiction as follows, and/or the outputting ears of a target electrical circuitry arrangement e1230, when activated, performs the operation o1230 in the illustrative depiction as follows, and/or the outputting ears of a target module m1230, when executed and/or activated, directs performance of and/or performs the operation o1230 in the illustrative depiction as follows, and/or the operation o1230 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) the into one or more acoustic audio signals (e.g. including one or more low frequency acoustic audio signals, etc.) containing one or more portions (e.g. including containing beginning portions, etc.) of said audio output information (e.g. including pre-recorded information, etc.) at one or more locations (e.g. exclusive to within a vicinity of one or more desired groups of people, etc.) spaced (e.g. less than a distance from a dashboard to a headrest, etc.) from said portable electronic device (e.g. including one or more 3G mobile components, etc.) based at least in part according to (e.g. based in part according to full coverage, etc.) said one or more acoustic ultrasonic signals (e.g. via one or more acoustic ultrasonic signals configured to be demodulated through nonlinear atmospheric interaction to at least in part generate one or more acoustic audio signals, etc.) and based at least in part according to (e.g. based in part according to full coverage, etc.) one or more portable electronic device ultrasonic emitter arrangements (e.g. including one or more monitor embedded transducer arrangements, etc.) including one or more audio signals tailored to frequency response information for one or more ears of a target human listener (e.g. including acoustic audio signals tailored each for right and left ears of a target listener to account for loss of hearing by the target listener in calibrated frequency ranges, etc.).

Figure 78:
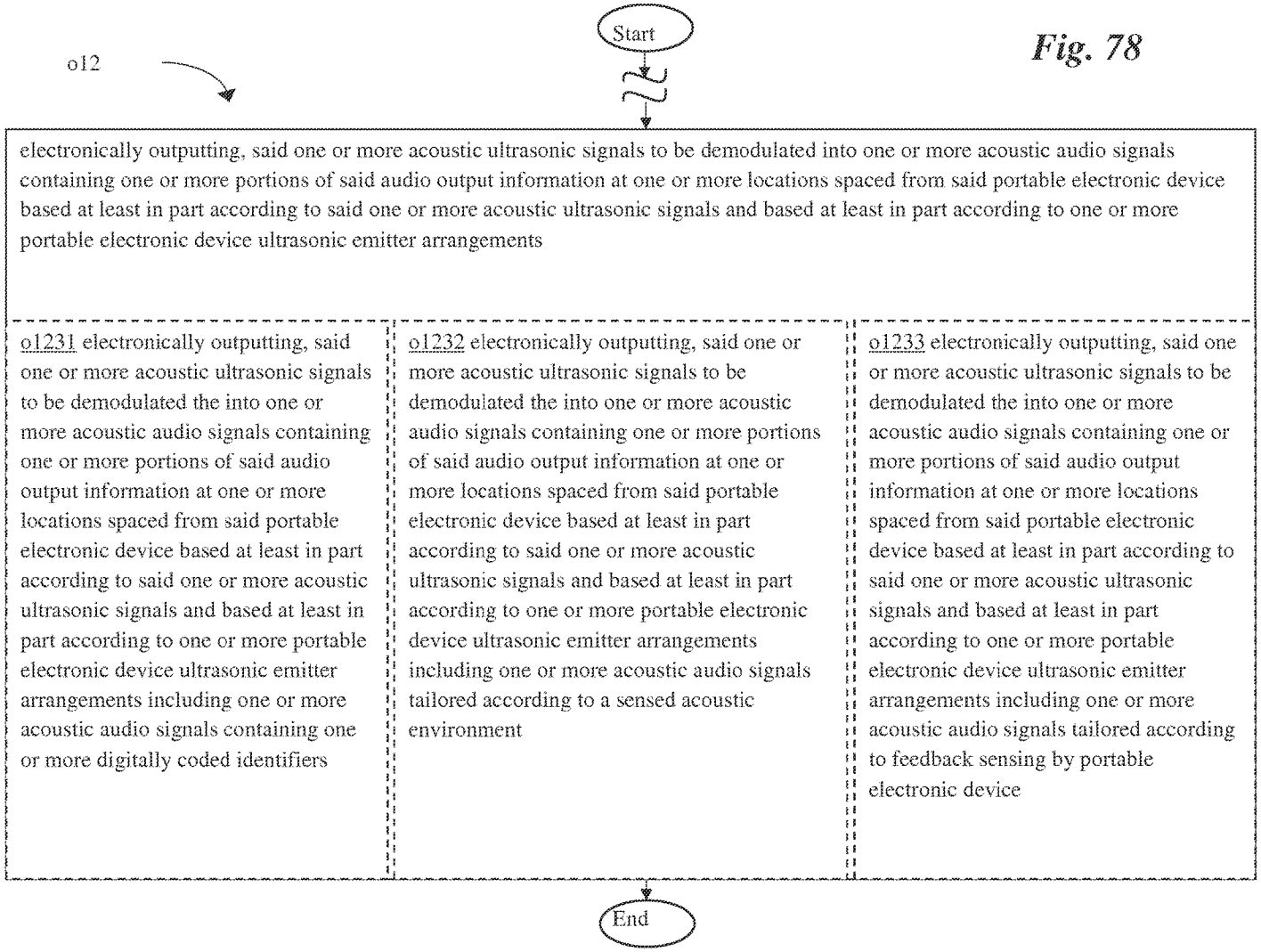
FIG. 78 is a high-level flowchart including exemplary implementations of operation o12 of FIG. 53.

In one or more implementations, as shown in FIG. 78, operation o12 includes an operation o1231 for electronically outputting, said one or more acoustic ultrasonic signals to be demodulated the into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including one or more acoustic audio signals containing one or more digitally coded identifiers. Origination of an illustratively derived outputting digitally coded component group can be accomplished through skilled in the art design choice selection of one or more of the above depicted components from one or more of the above depicted subsystems shown in FIG. 25. Components from the outputting digitally coded component group can be used in implementing execution of the one or more outputting digitally coded instructions i1231 of FIG. 43, can be used in performance of the outputting digitally coded electrical circuitry arrangement e1231 of FIG. 36, and/or can be used in otherwise fulfillment of the operation o1231. An exemplary non-transitory signal bearing medium version of the information storage subsystem s200 is depicted in FIG. 43 as bearing the one or more outputting digitally coded instructions i1231 that when executed will direct performance of the operation o1231. Furthermore, the outputting digitally coded electrical circuitry arrangement ("elec circ arrange") e1231, when activated, will perform the operation o1231. Also, the outputting digitally coded module m1231, when executed and/or activated, will direct performance of and/or perform the operation o1231. For instance, in one or more exemplary implementations, the one or more outputting digitally coded instructions i1231, when executed, direct performance of the operation o1231 in the illustrative depiction as follows, and/or the outputting digitally coded electrical circuitry arrangement e1231, when activated, performs the operation o1231 in the illustrative depiction as follows, and/or the outputting digitally coded module m1231, when executed and/or activated, directs performance of and/or performs the operation o1231 in the illustrative depiction as follows, and/or the operation o1231 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) the into one or more acoustic audio signals (e.g. including one or more low frequency acoustic audio signals, etc.) containing one or more portions (e.g. including containing beginning portions, etc.) of said audio output information (e.g. including processor generated information, etc.) at one or more locations (e.g. exclusive to within a vicinity of one or more chosen audio receivers, etc.) spaced (e.g. more than confines of a room, etc.) from said portable electronic device (e.g. including one or more cellular components, etc.) based at least in part according to (e.g. based according to all, etc.) said one or more acoustic ultrasonic signals (e.g. via one or more acoustic ultrasonic signals configured to be demodulated through nonlinear human tissue interaction to at least in part produce one or more acoustic audio signals, etc.) and based at least in part according to (e.g. based according to all, etc.) one or more portable electronic device ultrasonic emitter arrangements (e.g. including one or more keyboard embedded transducer arrangements, etc.) including one or more acoustic audio signals containing one or more digitally coded identifiers (e.g. including digitally coded identifiers placed in the acoustic audio signals to be used for quality control of down-converted audio signals in a vicinity near a target listener, etc.).

In one or more implementations, as shown in FIG. 78, operation o12 includes an operation o1232 for electronically outputting, said one or more acoustic ultrasonic signals to be demodulated the into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including one or more acoustic audio signals tailored according to a sensed acoustic environment. Origination of an illustratively derived outputting signals tailored component group can be accomplished through skilled in the art design choice selection of one or more of the above depicted components from one or more of the above depicted subsystems shown in FIG. 25. Components from the outputting signals tailored component group can be used in implementing execution of the one or more outputting signals tailored instructions i1232 of FIG. 43, can be used in performance of the outputting signals tailored electrical circuitry arrangement e1232 of FIG. 36, and/or can be used in otherwise fulfillment of the operation o1232. An exemplary non-transitory signal bearing medium version of the information storage subsystem s200 is depicted in FIG. 43 as bearing the one or more outputting signals tailored instructions i1232 that when executed will direct performance of the operation o1232. Furthermore, the outputting signals tailored electrical circuitry arrangement ("elec circ arrange") e1232, when activated, will perform the operation o1232. Also, the outputting signals tailored module m1232, when executed and/or activated, will direct performance of and/or perform the operation o1232. For instance, in one or more exemplary implementations, the one or more outputting signals tailored instructions i1232, when executed, direct performance of the operation o1232 in the illustrative depiction as follows, and/or the outputting signals tailored electrical circuitry arrangement e1232, when activated, performs the operation o1232 in the illustrative depiction as follows, and/or the outputting signals tailored module m1232, when executed and/or activated, directs performance of and/or performs the operation o1232 in the illustrative depiction as follows, and/or the operation o1232 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) the into one or more acoustic audio signals (e.g. including one or more low frequency acoustic audio signals, etc.) containing one or more portions (e.g. including containing beginning portions, etc.) of said audio output information (e.g. including internet based information, etc.) at one or more locations (e.g. exclusive to within a vicinity of one or more selected microphones, etc.) spaced (e.g. more than an arm's length, etc.) from said portable electronic device (e.g. through reception of cable communication packets, etc.) based at least in part according to (e.g. based according to some, etc.) said one or more acoustic ultrasonic signals (e.g. via one or more acoustic ultrasonic signals configured to be demodulated through nonlinear polymeric interaction to at least in part result in one or more acoustic audio signals, etc.) and based at least in part according to (e.g. based according to some, etc.) one or more portable electronic device ultrasonic emitter arrangements (e.g. including one or more device body embedded transducer arrangements, etc.) including one or more acoustic audio signals tailored according to a sensed acoustic environment (e.g. including frequency mixing of acoustic audio signals modulating acoustic ultrasonic signals based upon sensed frequency response of down converted acoustic audio signals near a target listener, etc.).

In one or more implementations, as shown in FIG. 78, operation o12 includes an operation o1233 for electronically outputting, said one or more acoustic ultrasonic signals to be demodulated the into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including one or more acoustic audio signals tailored according to feedback sensing by portable electronic device. Origination of an illustratively derived outputting feedback sensing component group can be accomplished through skilled in the art design choice selection of one or more of the above depicted components from one or more of the above depicted subsystems shown in FIG. 25. Components from the outputting feedback sensing component group can be used in implementing execution of the one or more outputting feedback sensing instructions i1233 of FIG. 43, can be used in performance of the outputting feedback sensing electrical circuitry arrangement e1233 of FIG. 36, and/or can be used in otherwise fulfillment of the operation o1233. An exemplary non-transitory signal bearing medium version of the information storage subsystem s200 is depicted in FIG. 43 as bearing the one or more outputting feedback sensing instructions i1233 that when executed will direct performance of the operation o1233. Furthermore, the outputting feedback sensing electrical circuitry arrangement ("elec circ arrange") e1233, when activated, will perform the operation o1233. Also, the outputting feedback sensing module m1233, when executed and/or activated, will direct performance of and/or perform the operation o1233. For instance, in one or more exemplary implementations, the one or more outputting feedback sensing instructions i1233, when executed, direct performance of the operation o1233 in the illustrative depiction as follows, and/or the outputting feedback sensing electrical circuitry arrangement e1233, when activated, performs the operation o1233 in the illustrative depiction as follows, and/or the outputting feedback sensing module m1233, when executed and/or activated, directs performance of and/or performs the operation o1233 in the illustrative depiction as follows, and/or the operation o1233 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) the into one or more acoustic audio signals (e.g. including one or more low frequency acoustic audio signals, etc.) containing one or more portions (e.g. including containing beginning portions, etc.) of said audio output information (e.g. including digital audio information, etc.) at one or more locations (e.g. exclusive to within a vicinity of one or more designated surfaces, etc.) spaced (e.g. more than a three foot radius, etc.) from said portable electronic device (e.g. including one or more WiFi components, etc.) based at least in part according to (e.g. based according to an entirety, etc.) said one or more acoustic ultrasonic signals (e.g. via one or more acoustic ultrasonic signals configured to be demodulated through nonlinear apparel interaction to at least in part produce one or more acoustic audio signals, etc.) and based at least in part according to (e.g. based according to an entirety, etc.) one or more portable electronic device ultrasonic emitter arrangements (e.g. including one or more device perimeter embedded transducer arrangements, etc.) including one or more acoustic audio signals tailored according to feedback sensing by portable electronic device (e.g. including amplitude adjustment of various frequency bands of acoustic audio signals modulating acoustic ultrasonic signals based upon verbal feedback inputted into a tablet computer by a target listener based upon perceived reception of down converted audio by the target listener, etc.).

Figure 79:
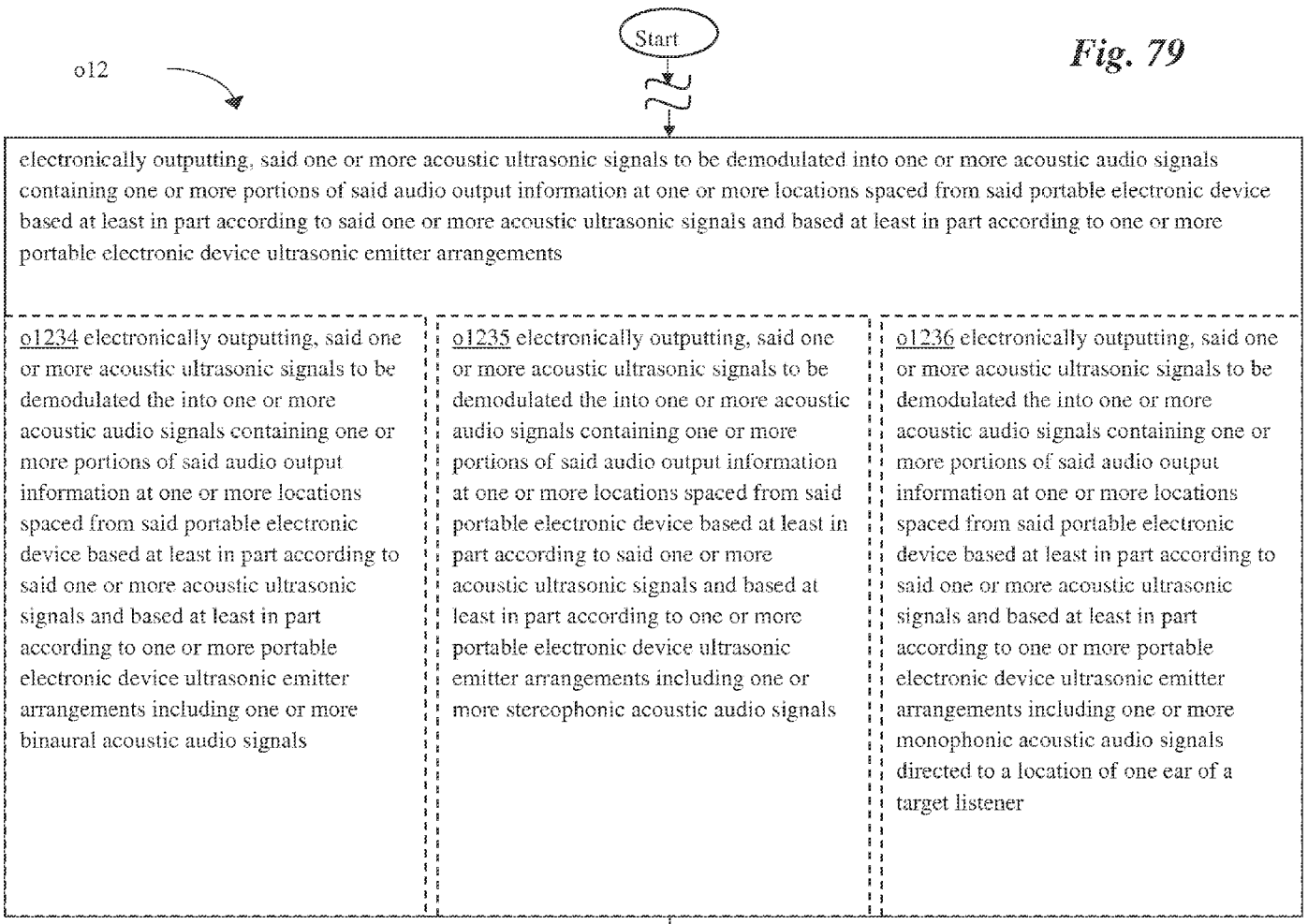
FIG. 79 is a high-level flowchart including exemplary implementations of operation o12 of FIG. 53.

In one or more implementations, as shown in FIG. 79, operation o12 includes an operation o1234 for electronically outputting, said one or more acoustic ultrasonic signals to be demodulated the into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including one or more binaural acoustic audio signals. Origination of an illustratively derived outputting binaural acoustic component group can be accomplished through skilled in the art design choice selection of one or more of the above depicted components from one or more of the above depicted subsystems shown in FIG. 25. Components from the outputting binaural acoustic component group can be used in implementing execution of the one or more outputting binaural acoustic instructions i1234 of FIG. 43, can be used in performance of the outputting binaural acoustic electrical circuitry arrangement e1234 of FIG. 36, and/or can be used in otherwise fulfillment of the operation o1234. An exemplary non-transitory signal bearing medium version of the information storage subsystem s200 is depicted in FIG. 43 as bearing the one or more outputting binaural acoustic instructions i1234 that when executed will direct performance of the operation o1234. Furthermore, the outputting binaural acoustic electrical circuitry arrangement ("elec circ arrange") e1234, when activated, will perform the operation o1234. Also, the outputting binaural acoustic module m1234, when executed and/or activated, will direct performance of and/or perform the operation o1234. For instance, in one or more exemplary implementations, the one or more outputting binaural acoustic instructions i1234, when executed, direct performance of the operation o1234 in the illustrative depiction as follows, and/or the outputting binaural acoustic electrical circuitry arrangement e1234, when activated, performs the operation o1234 in the illustrative depiction as follows, and/or the outputting binaural acoustic module m1234, when executed and/or activated, directs performance of and/or performs the operation o1234 in the illustrative depiction as follows, and/or the operation o1234 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) the into one or more acoustic audio signals (e.g. including one or more low frequency acoustic audio signals, etc.) containing one or more portions (e.g. including containing beginning portions, etc.) of said audio output information (e.g. including analog audio information, etc.) at one or more locations (e.g. exclusive to within a vicinity of one or more identified objects, etc.) spaced (e.g. more than a distance from a portable device to a person, etc.) from said portable electronic device (e.g. including one or more infrared components, etc.) based at least in part according to (e.g. based according to one or more portions, etc.) said one or more acoustic ultrasonic signals (e.g. via one or more acoustic ultrasonic signals configured to be demodulated through nonlinear interaction with one or more solids to at least in part generate one or more acoustic audio signals, etc.) and based at least in part according to (e.g. based according to one or more portions, etc.) one or more portable electronic device ultrasonic emitter arrangements (e.g. including one or more multiple emitter array arrangements, etc.) including one or more binaural acoustic audio signals (e.g. including transmitting independently modulated acoustic ultrasonic signals to be separately down converted at each individual ear of a target listener, etc.).

In one or more implementations, as shown in FIG. 79, operation o12 includes an operation o1235 for electronically outputting, said one or more acoustic ultrasonic signals to be demodulated the into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including one or more stereophonic acoustic audio signals. Origination of an illustratively derived outputting stereophonic acoustic component group can be accomplished through skilled in the art design choice selection of one or more of the above depicted components from one or more of the above depicted subsystems shown in FIG. 25. Components from the outputting stereophonic acoustic component group can be used in implementing execution of the one or more outputting stereophonic acoustic instructions i1235 of FIG. 43, can be used in performance of the outputting stereophonic acoustic electrical circuitry arrangement e1235 of FIG. 36, and/or can be used in otherwise fulfillment of the operation o1235. An exemplary non-transitory signal bearing medium version of the information storage subsystem s200 is depicted in FIG. 43 as bearing the one or more outputting stereophonic acoustic instructions i1235 that when executed will direct performance of the operation o1235. Furthermore, the outputting stereophonic acoustic electrical circuitry arrangement ("elec circ arrange") e1235, when activated, will perform the operation o1235. Also, the outputting stereophonic acoustic module m1235, when executed and/or activated, will direct performance of and/or perform the operation o1235. For instance, in one or more exemplary implementations, the one or more outputting stereophonic acoustic instructions i1235, when executed, direct performance of the operation o1235 in the illustrative depiction as follows, and/or the outputting stereophonic acoustic electrical circuitry arrangement e1235, when activated, performs the operation o1235 in the illustrative depiction as follows, and/or the outputting stereophonic acoustic module m1235, when executed and/or activated, directs performance of and/or performs the operation o1235 in the illustrative depiction as follows, and/or the operation o1235 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) the into one or more acoustic audio signals (e.g. including one or more low frequency acoustic audio signals, etc.) containing one or more portions (e.g. including containing beginning portions, etc.) of said audio output information (e.g. including high frequency audio information, etc.) at one or more locations (e.g. exclusive to within a vicinity of one or more predetermined locations, etc.) spaced (e.g. more than a distance from a display screen to a person, etc.) from said portable electronic device (e.g. including one or more personal digital assistant components, etc.) based at least in part according to (e.g. based according to one or more sections, etc.) said one or more acoustic ultrasonic signals (e.g. inertial sensor, etc.) and based at least in part according to (e.g. based according to one or more sections, etc.) one or more portable electronic device ultrasonic emitter arrangements (e.g. including one or more perimeter arrays, etc.) including one or more stereophonic acoustic audio signals (e.g. including transmitting independently modulated acoustic ultrasonic signals to be down converted with stereophonic separation at the ears of a target listener, etc.).

In one or more implementations, as shown in FIG. 79, operation o12 includes an operation o1236 for electronically outputting, said one or more acoustic ultrasonic signals to be demodulated the into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including one or more monophonic acoustic audio signals directed to a location of one ear of a target listener. Origination of an illustratively derived outputting monophonic acoustic component group can be accomplished through skilled in the art design choice selection of one or more of the above depicted components from one or more of the above depicted subsystems shown in FIG. 25. Components from the outputting monophonic acoustic component group can be used in implementing execution of the one or more outputting monophonic acoustic instructions i1236 of FIG. 43, can be used in performance of the outputting monophonic acoustic electrical circuitry arrangement e1236 of FIG. 36, and/or can be used in otherwise fulfillment of the operation o1236. An exemplary non-transitory signal bearing medium version of the information storage subsystem s200 is depicted in FIG. 43 as bearing the one or more outputting monophonic acoustic instructions i1236 that when executed will direct performance of the operation o1236. Furthermore, the outputting monophonic acoustic electrical circuitry arrangement ("elec circ arrange") e1236, when activated, will perform the operation o1236. Also, the outputting monophonic acoustic module m1236, when executed and/or activated, will direct performance of and/or perform the operation o1236. For instance, in one or more exemplary implementations, the one or more outputting monophonic acoustic instructions i1236, when executed, direct performance of the operation o1236 in the illustrative depiction as follows, and/or the outputting monophonic acoustic electrical circuitry arrangement e1236, when activated, performs the operation o1236 in the illustrative depiction as follows, and/or the outputting monophonic acoustic module m1236, when executed and/or activated, directs performance of and/or performs the operation o1236 in the illustrative depiction as follows, and/or the operation o1236 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) the into one or more acoustic audio signals (e.g. including one or more low frequency acoustic audio signals, etc.) containing one or more portions (e.g. including containing beginning portions, etc.) of said audio output information (e.g. including low frequency audio information, etc.) at one or more locations (e.g. exclusive to within a vicinity of one or more desired environments, etc.) spaced (e.g. more than a distance from a portable device to an ear, etc.) from said portable electronic device (e.g. including one or more smart phone components, etc.) based at least in part according to (e.g. based according to one or more assemblies, etc.) said one or more acoustic ultrasonic signals (e.g. via one or more acoustic ultrasonic signals including signals having one or more frequencies above 60 kHz, etc.) and based at least in part according to (e.g. based according to one or more assemblies, etc.) one or more portable electronic device ultrasonic emitter arrangements (e.g. including one or more polar arrays, etc.) including one or more monophonic acoustic audio signals directed to a location of one ear of a target listener (e.g. including transmitting modulated acoustic ultrasonic signals to be down converted monophonically at an ear of a target listener, etc.).

Figure 80:
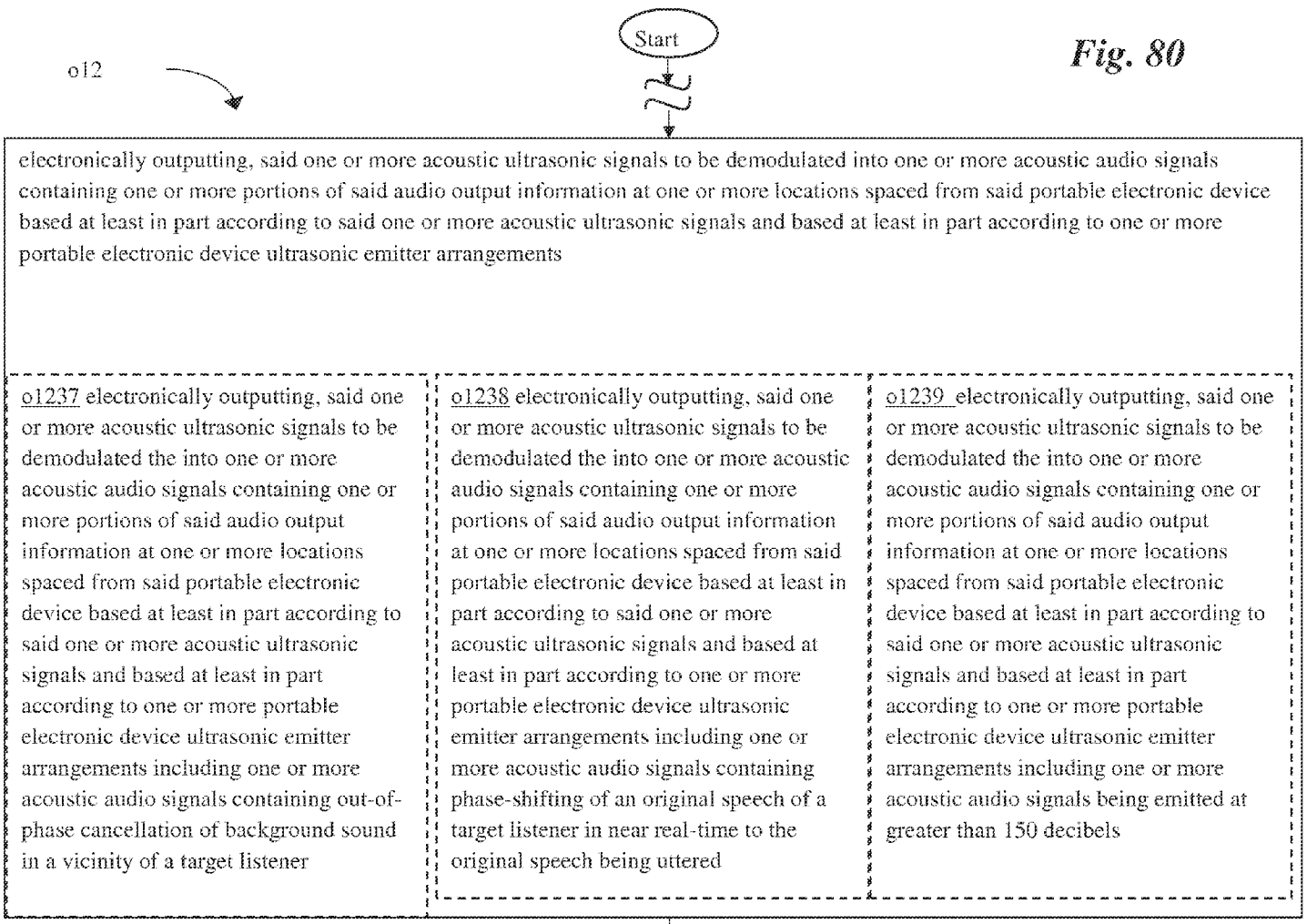
FIG. 80 is a high-level flowchart including exemplary implementations of operation o12 of FIG. 53.

In one or more implementations, as shown in FIG. 80, operation o12 includes an operation o1237 for electronically outputting, said one or more acoustic ultrasonic signals to be demodulated the into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including one or more acoustic audio signals containing out-of-phase cancellation of background sound in a vicinity of a target listener. Origination of an illustratively derived outputting phase cancellation component group can be accomplished through skilled in the art design choice selection of one or more of the above depicted components from one or more of the above depicted subsystems shown in FIG. 25. Components from the outputting phase cancellation component group can be used in implementing execution of the one or more outputting phase cancellation instructions i1237 of FIG. 43, can be used in performance of the outputting phase cancellation electrical circuitry arrangement e1237 of FIG. 36, and/or can be used in otherwise fulfillment of the operation o1237. An exemplary non-transitory signal bearing medium version of the information storage subsystem s200 is depicted in FIG. 43 as bearing the one or more outputting phase cancellation instructions i1237 that when executed will direct performance of the operation o1237. Furthermore, the outputting phase cancellation electrical circuitry arrangement ("elec circ arrange") e1237, when activated, will perform the operation o1237. Also, the outputting phase cancellation module m1237, when executed and/or activated, will direct performance of and/or perform the operation o1237. For instance, in one or more exemplary implementations, the one or more outputting phase cancellation instructions i1237, when executed, direct performance of the operation o1237 in the illustrative depiction as follows, and/or the outputting phase cancellation electrical circuitry arrangement e1237, when activated, performs the operation o1237 in the illustrative depiction as follows, and/or the outputting phase cancellation module m1237, when executed and/or activated, directs performance of and/or performs the operation o1237 in the illustrative depiction as follows, and/or the operation o1237 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) the into one or more acoustic audio signals (e.g. including one or more low frequency acoustic audio signals, etc.) containing one or more portions (e.g. including containing beginning portions, etc.) of said audio output information (e.g. including lecture formatted information, etc.) at one or more locations (e.g. exclusive to within a vicinity of one or more chosen distances, etc.) spaced (e.g. more than a distance from a display screen to an ear, etc.) from said portable electronic device (e.g. including one or more cell phone components, etc.) based at least in part according to (e.g. based according to one or more partials, etc.) said one or more acoustic ultrasonic signals (e.g. via one or more acoustic ultrasonic signals including signals having one or more frequencies above 80 kHz, etc.) and based at least in part according to (e.g. based according to one or more partials, etc.) one or more portable electronic device ultrasonic emitter arrangements (e.g. including one or more orthographic arrays, etc.) including one or more acoustic audio signals containing out-of-phase cancellation of background sound in a vicinity of a target listener (e.g. including transmitting modulated acoustic ultrasonic signals to be down converted with anti-noise cancellation of undesirable audio sensed by a notebook computer transmitting the acoustic ultrasonic signals, etc.).

In one or more implementations, as shown in FIG. 80, operation o12 includes an operation o1238 for electronically outputting, said one or more acoustic ultrasonic signals to be demodulated the into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including one or more acoustic audio signals containing phase-shifting of an original speech of a target listener in near real-time to the original speech being uttered. Origination of an illustratively derived outputting phase-shifting component group can be accomplished through skilled in the art design choice selection of one or more of the above depicted components from one or more of the above depicted subsystems shown in FIG. 25. Components from the outputting phase-shifting component group can be used in implementing execution of the one or more outputting phase-shifting instructions i1238 of FIG. 43, can be used in performance of the outputting phase-shifting electrical circuitry arrangement e1238 of FIG. 36, and/or can be used in otherwise fulfillment of the operation o1238. An exemplary non-transitory signal bearing medium version of the information storage subsystem s200 is depicted in FIG. 43 as bearing the one or more outputting phase-shifting instructions i1238 that when executed will direct performance of the operation o1238. Furthermore, the outputting phase-shifting electrical circuitry arrangement ("elec circ arrange") e1238, when activated, will perform the operation o1238. Also, the outputting phase-shifting module m1238, when executed and/or activated, will direct performance of and/or perform the operation o1238. For instance, in one or more exemplary implementations, the one or more outputting phase-shifting instructions i1238, when executed, direct performance of the operation o1238 in the illustrative depiction as follows, and/or the outputting phase-shifting electrical circuitry arrangement e1238, when activated, performs the operation o1238 in the illustrative depiction as follows, and/or the outputting phase-shifting module m1238, when executed and/or activated, directs performance of and/or performs the operation o1238 in the illustrative depiction as follows, and/or the operation o1238 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) the into one or more acoustic audio signals (e.g. including one or more low frequency acoustic audio signals, etc.) containing one or more portions (e.g. including containing beginning portions, etc.) of said audio output information (e.g. including foreign language speech information, etc.) at one or more locations (e.g. exclusive to within a vicinity of one or more selected ranges, etc.) spaced (e.g. more than a distance from a portable device to a center of a group, etc.) from said portable electronic device (e.g. including one or more laptop components, etc.) based at least in part according to (e.g. based according to one or more pieces, etc.) said one or more acoustic ultrasonic signals (e.g. via one or more acoustic ultrasonic signals including signals having one or more frequencies above 100 kHz, etc.) and based at least in part according to (e.g. based according to one or more pieces, etc.) one or more portable electronic device ultrasonic emitter arrangements (e.g. including one or more three-dimensional arrays, etc.) including one or more acoustic audio signals containing phase-shifting of an original speech of a target listener in near real-time to the original speech being uttered (e.g. including transmitting modulated acoustic ultrasonic signals to be down converted with phase-shifted speech of speech sensed by a tablet transmitting the acoustic ultrasonic signals, etc.).

In one or more implementations, as shown in FIG. 80, operation o12 includes an operation o1239 for electronically outputting, said one or more acoustic ultrasonic signals to be demodulated the into one or more acoustic audio signals containing one or more portions of said audio output information at one or more locations spaced from said portable electronic device based at least in part according to said one or more acoustic ultrasonic signals and based at least in part according to one or more portable electronic device ultrasonic emitter arrangements including one or more acoustic audio signals being emitted at greater than 150 decibels. Origination of an illustratively derived outputting emitted greater component group can be accomplished through skilled in the art design choice selection of one or more of the above depicted components from one or more of the above depicted subsystems shown in FIG. 25. Components from the outputting emitted greater component group can be used in implementing execution of the one or more outputting emitted greater instructions i1239 of FIG. 43, can be used in performance of the outputting emitted greater electrical circuitry arrangement e1239 of FIG. 36, and/or can be used in otherwise fulfillment of the operation o1239. An exemplary non-transitory signal bearing medium version of the information storage subsystem s200 is depicted in FIG. 43 as bearing the one or more outputting emitted greater instructions i1239 that when executed will direct performance of the operation o1239. Furthermore, the outputting emitted greater electrical circuitry arrangement ("elec circ arrange") e1239, when activated, will perform the operation o1239. Also, the outputting emitted greater module m1239, when executed and/or activated, will direct performance of and/or perform the operation o1239. For instance, in one or more exemplary implementations, the one or more outputting emitted greater instructions i1239, when executed, direct performance of the operation o1239 in the illustrative depiction as follows, and/or the outputting emitted greater electrical circuitry arrangement e1239, when activated, performs the operation o1239 in the illustrative depiction as follows, and/or the outputting emitted greater module m1239, when executed and/or activated, directs performance of and/or performs the operation o1239 in the illustrative depiction as follows, and/or the operation o1239 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) the into one or more acoustic audio signals (e.g. including one or more low frequency acoustic audio signals, etc.) containing one or more portions (e.g. including containing beginning portions, etc.) of said audio output information (e.g. including classical music selection information, etc.) at one or more locations (e.g. exclusive to within a vicinity of one or more designated directions, etc.) spaced (e.g. more than a distance from a display screen to a center of a group, etc.) from said portable electronic device (e.g. including one or more tablet computer components, etc.) based at least in part according to (e.g. based according to one or more completions, etc.) said one or more acoustic ultrasonic signals (e.g. via one or more acoustic ultrasonic signals including signals having one or more frequencies above 120 kHz, etc.) and based at least in part according to (e.g. based according to one or more completions, etc.) one or more portable electronic device ultrasonic emitter arrangements (e.g. including one or more scattered arrangements, etc.) including one or more acoustic audio signals being emitted at greater than 150 decibels (e.g. including transmitting modulated acoustic ultrasonic signals to be down converted into an acoustic alarm signal by a security system to be heard at a target location away from an intrusion location, etc.).

Figure 81:
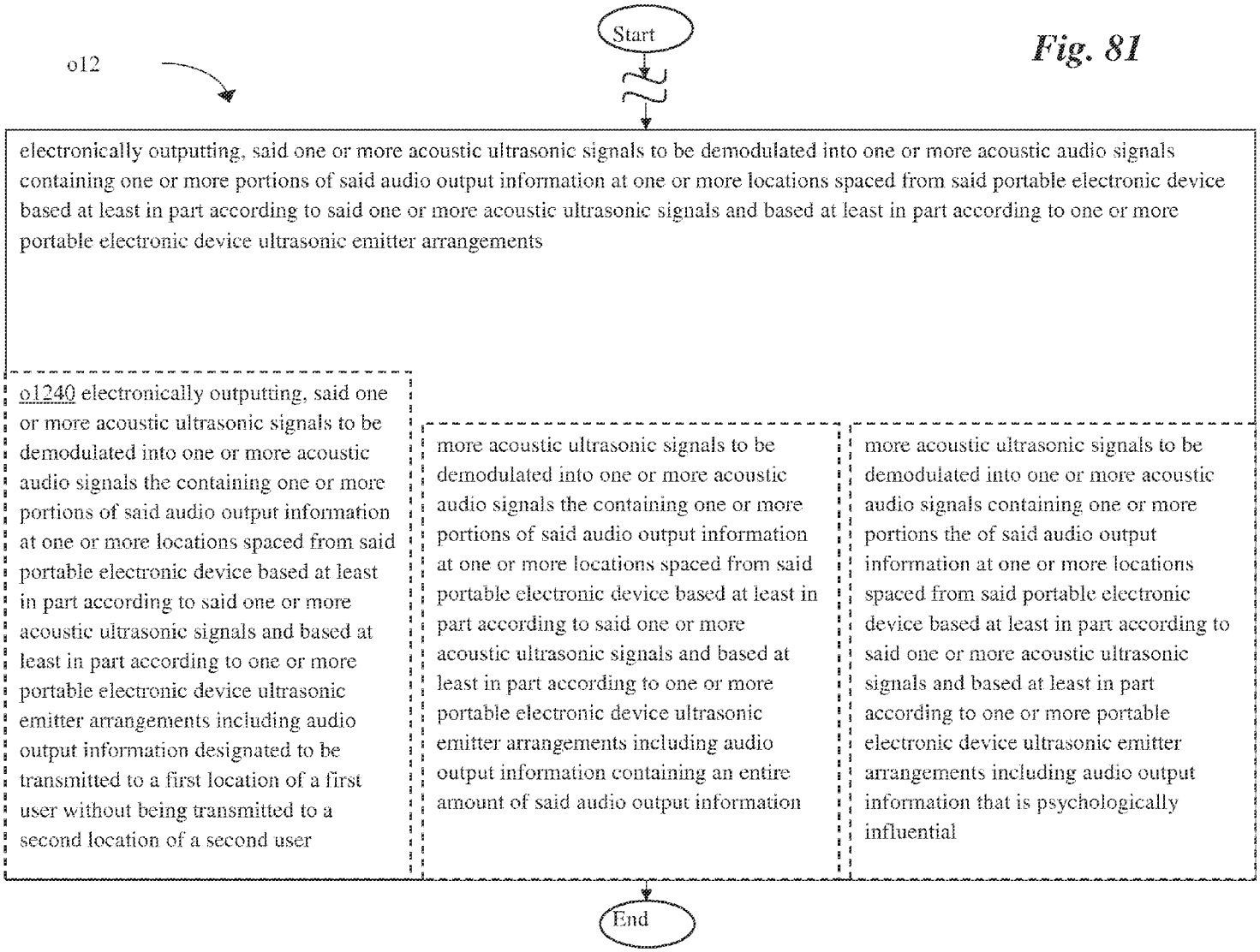
FIG. 81 is a high-level flowchart including exemplary implementations of operation o12 of FIG. 53.

In one or more implementations, as shown in FIG. 81, operation o12 includes an operation o1240 for electronically outputting, said one or more acoustic ultrasonic signals to be demodulated into one or more acoustic audio signals the containing one or more portions of said audio output information at one or more locations spaced from said portable electronic device based at least in part according to said one or more acoustic ultrasonic signals and based at least in part according to one or more portable electronic device ultrasonic emitter arrangements including audio output information designated to be transmitted to a first location of a first user without being transmitted to a second location of a second user. Origination of an illustratively derived outputting information designated component group can be accomplished through skilled in the art design choice selection of one or more of the above depicted components from one or more of the above depicted subsystems shown in FIG. 25. Components from the outputting information designated component group can be used in implementing execution of the one or more outputting information designated instructions i1240 of FIG. 44, can be used in performance of the outputting information designated electrical circuitry arrangement e1240 of FIG. 37, and/or can be used in otherwise fulfillment of the operation o1240. An exemplary non-transitory signal bearing medium version of the information storage subsystem s200 is depicted in FIG. 44 as bearing the one or more outputting information designated instructions i1240 that when executed will direct performance of the operation o1240. Furthermore, the outputting information designated electrical circuitry arrangement ("elec circ arrange") e1240, when activated, will perform the operation o1240. Also, the outputting information designated module m1240, when executed and/or activated, will direct performance of and/or perform the operation o1240. For instance, in one or more exemplary implementations, the one or more outputting information designated instructions i1240, when executed, direct performance of the operation o1240 in the illustrative depiction as follows, and/or the outputting information designated electrical circuitry arrangement e1240, when activated, performs the operation o1240 in the illustrative depiction as follows, and/or the outputting information designated module m1240, when executed and/or activated, directs performance of and/or performs the operation o1240 in the illustrative depiction as follows, and/or the operation o1240 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) the containing one or more portions (e.g. including containing beginning portions, etc.) of said audio output information (e.g. including instructional lesson material information, etc.) at one or more locations (e.g. inclusive to within a vicinity of one or more designated ears, etc.) spaced (e.g. more than a distance from a transmitter to a receiver, etc.) from said portable electronic device (e.g. including one or more mp3 player components, etc.) based at least in part according to (e.g. based according to full coverage, etc.) said one or more acoustic ultrasonic signals (e.g. via one or more acoustic ultrasonic signals including signals having one or more frequencies above 140 kHz, etc.) and based at least in part according to (e.g. based according to full coverage, etc.) one or more portable electronic device ultrasonic emitter arrangements (e.g. including one or more staggered arrays, etc.) including audio output information designated to be transmitted to a first location of a first user without being transmitted to a second location of a second user (e.g. including transmitting to the first user sitting in a chair adjacent the second user, etc.).

In one or more implementations, as shown in FIG. 81, operation o12 includes an operation o1241 for electronically outputting, said one or more acoustic ultrasonic signals to be demodulated into one or more acoustic audio signals the containing one or more portions of said audio output information at one or more locations spaced from said portable electronic device based at least in part according to said one or more acoustic ultrasonic signals and based at least in part according to one or more portable electronic device ultrasonic emitter arrangements including audio output information containing an entire amount of said audio output information. Origination of an illustratively derived outputting information containing component group can be accomplished through skilled in the art design choice selection of one or more of the above depicted components from one or more of the above depicted subsystems shown in FIG. 25. Components from the outputting information containing component group can be used in implementing execution of the one or more outputting information containing instructions i1241 of FIG. 44, can be used in performance of the outputting information containing electrical circuitry arrangement e1241 of FIG. 37, and/or can be used in otherwise fulfillment of the operation o1241. An exemplary non-transitory signal bearing medium version of the information storage subsystem s200 is depicted in FIG. 44 as bearing the one or more outputting information containing instructions i1241 that when executed will direct performance of the operation o1241. Furthermore, the outputting information containing electrical circuitry arrangement ("elec circ arrange") e1241, when activated, will perform the operation o1241. Also, the outputting information containing module m1241, when executed and/or activated, will direct performance of and/or perform the operation o1241. For instance, in one or more exemplary implementations, the one or more outputting information containing instructions i1241, when executed, direct performance of the operation o1241 in the illustrative depiction as follows, and/or the outputting information containing electrical circuitry arrangement e1241, when activated, performs the operation o1241 in the illustrative depiction as follows, and/or the outputting information containing module m1241, when executed and/or activated, directs performance of and/or performs the operation o1241 in the illustrative depiction as follows, and/or the operation o1241 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) the containing one or more portions (e.g. including containing beginning portions, etc.) of said audio output information (e.g. including warning tone information, etc.) at one or more locations (e.g. inclusive to within a vicinity of one or more identified persons, etc.) spaced (e.g. more than a distance from a first seat back to a second seat back, etc.) from said portable electronic device (e.g. including one or more mobile phone components, etc.) based at least in part according to (e.g. based in part according to all, etc.) said one or more acoustic ultrasonic signals (e.g. via one or more acoustic ultrasonic signals including signals having one or more frequencies above 160 kHz, etc.) and based at least in part according to (e.g. based in part according to all, etc.) one or more portable electronic device ultrasonic emitter arrangements (e.g. including one or more linear arrangements, etc.) including audio output information containing an entire amount of said audio output information (e.g. including the audio output information including the entire text of an audio book, etc.).

In one or more implementations, as shown in FIG. 81, operation o12 includes an operation o1242 for electronically outputting, said one or more acoustic ultrasonic signals to be demodulated into one or more acoustic audio signals containing one or more portions the of said audio output information at one or more locations spaced from said portable electronic device based at least in part according to said one or more acoustic ultrasonic signals and based at least in part according to one or more portable electronic device ultrasonic emitter arrangements including audio output information that is psychologically influential. Origination of an illustratively derived outputting psychologically influential component group can be accomplished through skilled in the art design choice selection of one or more of the above depicted components from one or more of the above depicted subsystems shown in FIG. 25. Components from the outputting psychologically influential component group can be used in implementing execution of the one or more outputting psychologically influential instructions i1242 of FIG. 44, can be used in performance of the outputting psychologically influential electrical circuitry arrangement e1242 of FIG. 37, and/or can be used in otherwise fulfillment of the operation o1242. An exemplary non-transitory signal bearing medium version of the information storage subsystem s200 is depicted in FIG. 44 as bearing the one or more outputting psychologically influential instructions i1242 that when executed will direct performance of the operation o1242. Furthermore, the outputting psychologically influential electrical circuitry arrangement ("elec circ arrange") e1242, when activated, will perform the operation o1242. Also, the outputting psychologically influential module m1242, when executed and/or activated, will direct performance of and/or perform the operation o1242. For instance, in one or more exemplary implementations, the one or more outputting psychologically influential instructions i1242, when executed, direct performance of the operation o1242 in the illustrative depiction as follows, and/or the outputting psychologically influential electrical circuitry arrangement e1242, when activated, performs the operation o1242 in the illustrative depiction as follows, and/or the outputting psychologically influential module m1242, when executed and/or activated, directs performance of and/or performs the operation o1242 in the illustrative depiction as follows, and/or the operation o1242 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) the of said audio output information (e.g. including white noise information, etc.) at one or more locations (e.g. inclusive to within a vicinity of one or more predetermined ears, etc.) spaced (e.g. more than a distance from a seat back to a tray table, etc.) from said portable electronic device (e.g. including one or more two-way radio components, etc.) based at least in part according to (e.g. based in part according to some, etc.) said one or more acoustic ultrasonic signals (e.g. via one or more acoustic ultrasonic signals including signals having one or more frequencies above 180 kHz, etc.) and based at least in part according to (e.g. based in part according to some, etc.) one or more portable electronic device ultrasonic emitter arrangements (e.g. including one or more parabolic arrangements, etc.) including audio output information that is psychologically influential (e.g. including audio output from a human relations motivational information, etc.).

Figure 82:
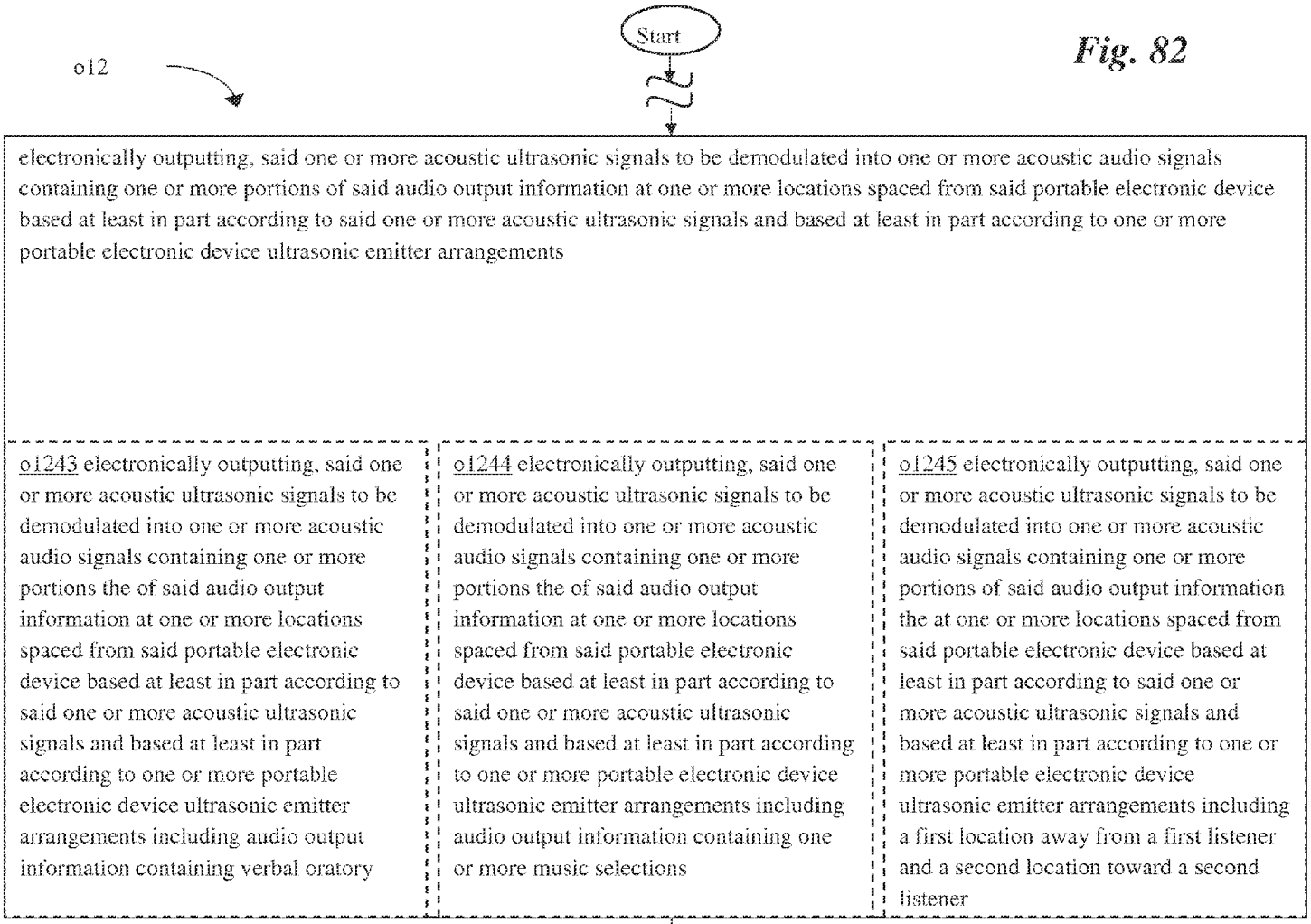
FIG. 82 is a high-level flowchart including exemplary implementations of operation o12 of FIG. 53.

In one or more implementations, as shown in FIG. 82, operation o12 includes an operation o1243 for electronically outputting, said one or more acoustic ultrasonic signals to be demodulated into one or more acoustic audio signals containing one or more portions the of said audio output information at one or more locations spaced from said portable electronic device based at least in part according to said one or more acoustic ultrasonic signals and based at least in part according to one or more portable electronic device ultrasonic emitter arrangements including audio output information containing verbal oratory. Origination of an illustratively derived outputting verbal oratory component group can be accomplished through skilled in the art design choice selection of one or more of the above depicted components from one or more of the above depicted subsystems shown in FIG. 25. Components from the outputting verbal oratory component group can be used in implementing execution of the one or more outputting verbal oratory instructions i1243 of FIG. 44, can be used in performance of the outputting verbal oratory electrical circuitry arrangement e1243 of FIG. 37, and/or can be used in otherwise fulfillment of the operation o1243. An exemplary non-transitory signal bearing medium version of the information storage subsystem s200 is depicted in FIG. 44 as bearing the one or more outputting verbal oratory instructions i1243 that when executed will direct performance of the operation o1243. Furthermore, the outputting verbal oratory electrical circuitry arrangement ("elec circ arrange") e1243, when activated, will perform the operation o1243. Also, the outputting verbal oratory module m1243, when executed and/or activated, will direct performance of and/or perform the operation o1243. For instance, in one or more exemplary implementations, the one or more outputting verbal oratory instructions i1243, when executed, direct performance of the operation o1243 in the illustrative depiction as follows, and/or the outputting verbal oratory electrical circuitry arrangement e1243, when activated, performs the operation o1243 in the illustrative depiction as follows, and/or the outputting verbal oratory module m1243, when executed and/or activated, directs performance of and/or performs the operation o1243 in the illustrative depiction as follows, and/or the operation o1243 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) the of said audio output information (e.g. including varying pitch information, etc.) at one or more locations (e.g. inclusive to within a vicinity of one or more desired groups of people, etc.) spaced (e.g. more than a distance of an aisle way, etc.) from said portable electronic device (e.g. including one or more security network components, etc.) based at least in part according to (e.g. based in part according to an entirety, etc.) said one or more acoustic ultrasonic signals (e.g. via one or more acoustic ultrasonic signals including signals having one or more frequencies above 200 kHz, etc.) and based at least in part according to (e.g. based in part according to an entirety, etc.) one or more portable electronic device ultrasonic emitter arrangements (e.g. including one or more hyperbolic arrangements, etc.) including audio output information containing verbal oratory (e.g. including audio output from political campaign speeches, etc.).

In one or more implementations, as shown in FIG. 82, operation o12 includes an operation o1244 for electronically outputting, said one or more acoustic ultrasonic signals to be demodulated into one or more acoustic audio signals containing one or more portions the of said audio output information at one or more locations spaced from said portable electronic device based at least in part according to said one or more acoustic ultrasonic signals and based at least in part according to one or more portable electronic device ultrasonic emitter arrangements including audio output information containing one or more music selections. Origination of an illustratively derived outputting music selections component group can be accomplished through skilled in the art design choice selection of one or more of the above depicted components from one or more of the above depicted subsystems shown in FIG. 25. Components from the outputting music selections component group can be used in implementing execution of the one or more outputting music selections instructions i1244 of FIG. 44, can be used in performance of the outputting music selections electrical circuitry arrangement e1244 of FIG. 37, and/or can be used in otherwise fulfillment of the operation o1244. An exemplary non-transitory signal bearing medium version of the information storage subsystem s200 is depicted in FIG. 44 as bearing the one or more outputting music selections instructions i1244 that when executed will direct performance of the operation o1244. Furthermore, the outputting music selections electrical circuitry arrangement ("elec circ arrange") e1244, when activated, will perform the operation o1244. Also, the outputting music selections module m1244, when executed and/or activated, will direct performance of and/or perform the operation o1244. For instance, in one or more exemplary implementations, the one or more outputting music selections instructions i1244, when executed, direct performance of the operation o1244 in the illustrative depiction as follows, and/or the outputting music selections electrical circuitry arrangement e1244, when activated, performs the operation o1244 in the illustrative depiction as follows, and/or the outputting music selections module m1244, when executed and/or activated, directs performance of and/or performs the operation o1244 in the illustrative depiction as follows, and/or the operation o1244 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) the of said audio output information (e.g. including note sequence information, etc.) at one or more locations (e.g. inclusive to within a vicinity of one or more chosen audio receivers, etc.) spaced (e.g. more than a distance from a desk to a chair, etc.) from said portable electronic device (e.g. including one or more netbook components, etc.) based at least in part according to (e.g. based in part according to one or more portions, etc.) said one or more acoustic ultrasonic signals (e.g. via multiple acoustic ultrasonic signals configured to be demodulated through mutual interference therewith to at least in part result in one or more acoustic audio signals, etc.) and based at least in part according to (e.g. based in part according to one or more portions, etc.) one or more portable electronic device ultrasonic emitter arrangements (e.g. including one or more enclosed arrangements, etc.) including audio output information containing one or more music selections (e.g. including audio output of a musical concert, etc.).

In one or more implementations, as shown in FIG. 82, operation o12 includes an operation o1245 for electronically outputting, said one or more acoustic ultrasonic signals to be demodulated into one or more acoustic audio signals containing one or more portions of said audio output information the at one or more locations spaced from said portable electronic device based at least in part according to said one or more acoustic ultrasonic signals and based at least in part according to one or more portable electronic device ultrasonic emitter arrangements including a first location away from a first listener and a second location toward a second listener. Origination of an illustratively derived outputting location away component group can be accomplished through skilled in the art design choice selection of one or more of the above depicted components from one or more of the above depicted subsystems shown in FIG. 25. Components from the outputting location away component group can be used in implementing execution of the one or more outputting location away instructions i1245 of FIG. 44, can be used in performance of the outputting location away electrical circuitry arrangement e1245 of FIG. 37, and/or can be used in otherwise fulfillment of the operation o1245. An exemplary non-transitory signal bearing medium version of the information storage subsystem s200 is depicted in FIG. 44 as bearing the one or more outputting location away instructions i1245 that when executed will direct performance of the operation o1245. Furthermore, the outputting location away electrical circuitry arrangement ("elec circ arrange") e1245, when activated, will perform the operation o1245. Also, the outputting location away module m1245, when executed and/or activated, will direct performance of and/or perform the operation o1245. For instance, in one or more exemplary implementations, the one or more outputting location away instructions i1245, when executed, direct performance of the operation o1245 in the illustrative depiction as follows, and/or the outputting location away electrical circuitry arrangement e1245, when activated, performs the operation o1245 in the illustrative depiction as follows, and/or the outputting location away module m1245, when executed and/or activated, directs performance of and/or performs the operation o1245 in the illustrative depiction as follows, and/or the operation o1245 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including two-way conversation information, etc.) the at one or more locations (e.g. inclusive to within a vicinity of one or more selected microphones, etc.) spaced (e.g. more than a distance from a dashboard to a headrest, etc.) from said portable electronic device (e.g. including one or more ultrabook components, etc.) based at least in part according to (e.g. based in part according to one or more sections, etc.) said one or more acoustic ultrasonic signals (e.g. via one or more acoustic ultrasonic signals configured to be demodulated through nonlinear atmospheric interaction to at least in part generate one or more acoustic audio signals, etc.) and based at least in part according to (e.g. based in part according to one or more sections, etc.) one or more portable electronic device ultrasonic emitter arrangements (e.g. including one or more transducer arrangements, etc.) including a first location away from a first listener and a second location toward a second listener (e.g. where the first listener does not have a security clearance and is standing next to a second listener that has a security clearance, etc.).

Figure 83:
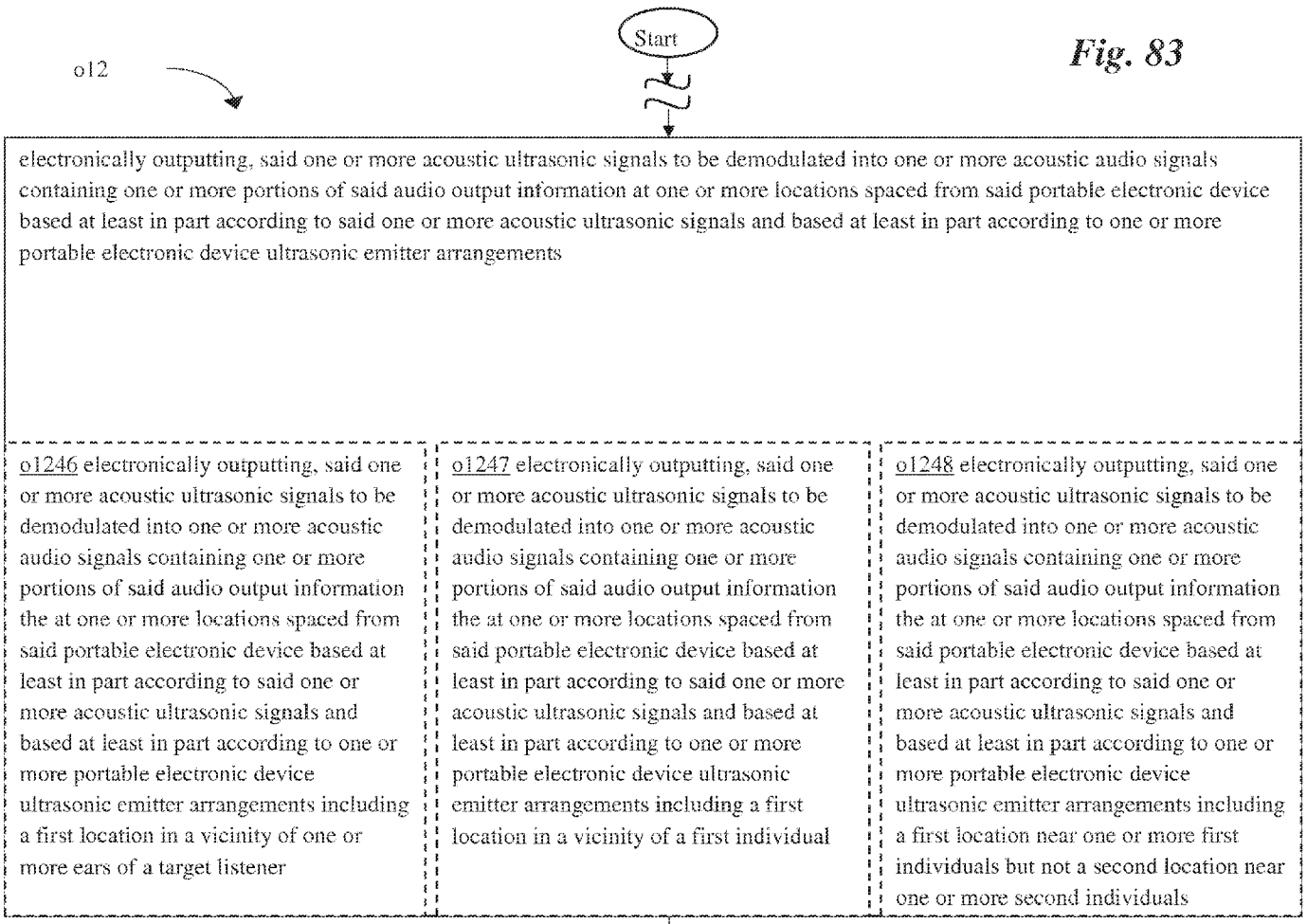
FIG. 83 is a high-level flowchart including exemplary implementations of operation o12 of FIG. 53.

In one or more implementations, as shown in FIG. 83, operation o12 includes an operation o1246 for electronically outputting, said one or more acoustic ultrasonic signals to be demodulated into one or more acoustic audio signals containing one or more portions of said audio output information the at one or more locations spaced from said portable electronic device based at least in part according to said one or more acoustic ultrasonic signals and based at least in part according to one or more portable electronic device ultrasonic emitter arrangements including a first location in a vicinity of one or more ears of a target listener. Origination of an illustratively derived outputting vicinity ears component group can be accomplished through skilled in the art design choice selection of one or more of the above depicted components from one or more of the above depicted subsystems shown in FIG. 25. Components from the outputting vicinity ears component group can be used in implementing execution of the one or more outputting vicinity ears instructions i1246 of FIG. 44, can be used in performance of the outputting vicinity ears electrical circuitry arrangement e1246 of FIG. 37, and/or can be used in otherwise fulfillment of the operation o1246. An exemplary non-transitory signal bearing medium version of the information storage subsystem s200 is depicted in FIG. 44 as bearing the one or more outputting vicinity ears instructions i1246 that when executed will direct performance of the operation o1246. Furthermore, the outputting vicinity ears electrical circuitry arrangement ("elec circ arrange") e1246, when activated, will perform the operation o1246. Also, the outputting vicinity ears module m1246, when executed and/or activated, will direct performance of and/or perform the operation o1246. For instance, in one or more exemplary implementations, the one or more outputting vicinity ears instructions i1246, when executed, direct performance of the operation o1246 in the illustrative depiction as follows, and/or the outputting vicinity ears electrical circuitry arrangement e1246, when activated, performs the operation o1246 in the illustrative depiction as follows, and/or the outputting vicinity ears module m1246, when executed and/or activated, directs performance of and/or performs the operation o1246 in the illustrative depiction as follows, and/or the operation o1246 is otherwise carried out in the illustrative depiction as follows: electronically outputting, (e.g. via one or more multiple emitter array portions, etc.)

said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including confidential information, etc.) the at one or more locations (e.g. inclusive to within a vicinity of one or more designated surfaces, etc.) spaced (e.g. within a confines of a room, etc.) from said portable electronic device (e.g. including one or more flip-phone components, etc.) based at least in part according to (e.g. based in part according to one or more assemblies, etc.) said one or more acoustic ultrasonic signals (e.g. via one or more acoustic ultrasonic signals configured to be demodulated through nonlinear human tissue interaction to at least in part produce one or more acoustic audio signals, etc.) and based at least in part according to (e.g. based in part according to one or more assemblies, etc.) one or more portable electronic device ultrasonic emitter arrangements (e.g. including one or more aperture arrangements, etc.) including a first location in a vicinity of one or more ears of a target listener (e.g. where the first location is near one ear of a target listener, etc.).

In one or more implementations, as shown in FIG. 83, operation o12 includes an operation o1247 for electronically outputting, said one or more acoustic ultrasonic signals to be demodulated into one or more acoustic audio signals containing one or more portions of said audio output information the at one or more locations spaced from said portable electronic device based at least in part according to said one or more acoustic ultrasonic signals and based at least in part according to one or more portable electronic device ultrasonic emitter arrangements including a first location in a vicinity of a first individual. Origination of an illustratively derived outputting vicinity individual component group can be accomplished through skilled in the art design choice selection of one or more of the above depicted components from one or more of the above depicted subsystems shown in FIG. 25. Components from the outputting vicinity individual component group can be used in implementing execution of the one or more outputting vicinity individual instructions i1247 of FIG. 44, can be used in performance of the outputting vicinity individual electrical circuitry arrangement e1247 of FIG. 37, and/or can be used in otherwise fulfillment of the operation o1247. An exemplary non-transitory signal bearing medium version of the information storage subsystem s200 is depicted in FIG. 44 as bearing the one or more outputting vicinity individual instructions i1247 that when executed will direct performance of the operation o1247. Furthermore, the outputting vicinity individual electrical circuitry arrangement ("elec circ arrange") e1247, when activated, will perform the operation o1247. Also, the outputting vicinity individual module m1247, when executed and/or activated, will direct performance of and/or perform the operation o1247. For instance, in one or more exemplary implementations, the one or more outputting vicinity individual instructions i1247, when executed, direct performance of the operation o1247 in the illustrative depiction as follows, and/or the outputting vicinity individual electrical circuitry arrangement e1247, when activated, performs the operation o1247 in the illustrative depiction as follows, and/or the outputting vicinity individual module m1247, when executed and/or activated, directs performance of and/or performs the operation o1247 in the illustrative depiction as follows, and/or the operation o1247 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including eavesdropping information, etc.) the at one or more locations (e.g. inclusive to within a vicinity of one or more identified objects, etc.) spaced (e.g. within an arm's length, etc.) from said portable electronic device (e.g. including one or more portable computer components, etc.) based at least in part according to (e.g. based in part according to one or more partials, etc.) said one or more acoustic ultrasonic signals (e.g. via one or more acoustic ultrasonic signals configured to be demodulated through nonlinear polymeric interaction to at least in part result in one or more acoustic audio signals, etc.) and based at least in part according to (e.g. based in part according to one or more partials, etc.) one or more portable electronic device ultrasonic emitter arrangements (e.g. including one or more transmitter arrangements, etc.) including a first location in a vicinity of a first individual (e.g. where the first location is a desk area of a first individual, etc.).

In one or more implementations, as shown in FIG. 83, operation o12 includes an operation o1248 for electronically outputting, said one or more acoustic ultrasonic signals to be demodulated into one or more acoustic audio signals containing one or more portions of said audio output information the at one or more locations spaced from said portable electronic device based at least in part according to said one or more acoustic ultrasonic signals and based at least in part according to one or more portable electronic device ultrasonic emitter arrangements including a first location near one or more first individuals but not a second location near one or more second individuals. Origination of an illustratively derived outputting near individuals component group can be accomplished through skilled in the art design choice selection of one or more of the above depicted components from one or more of the above depicted subsystems shown in FIG. 25. Components from the outputting near individuals component group can be used in implementing execution of the one or more outputting near individuals instructions i1248 of FIG. 44, can be used in performance of the outputting near individuals electrical circuitry arrangement e1248 of FIG. 37, and/or can be used in otherwise fulfillment of the operation o1248. An exemplary non-transitory signal bearing medium version of the information storage subsystem s200 is depicted in FIG. 44 as bearing the one or more outputting near individuals instructions i1248 that when executed will direct performance of the operation o1248. Furthermore, the outputting near individuals electrical circuitry arrangement ("elec circ arrange") e1248, when activated, will perform the operation o1248. Also, the outputting near individuals module m1248, when executed and/or activated, will direct performance of and/or perform the operation o1248. For instance, in one or more exemplary implementations, the one or more outputting near individuals instructions i1248, when executed, direct performance of the operation o1248 in the illustrative depiction as follows, and/or the outputting near individuals electrical circuitry arrangement e1248, when activated, performs the operation o1248 in the illustrative depiction as follows, and/or the outputting near individuals module m1248, when executed and/or activated, directs performance of and/or performs the operation o1248 in the illustrative depiction as follows, and/or the operation o1248 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including pre-recorded information, etc.) the at one or more locations (e.g. inclusive to within a vicinity of one or more predetermined locations, etc.) spaced (e.g. within a three foot radius, etc.) from said portable electronic device (e.g. including one or more boombox components, etc.) based at least in part according to (e.g. based in part according to one or more pieces, etc.) said one or more acoustic ultrasonic signals (e.g. via one or more acoustic ultrasonic signals configured to be demodulated through nonlinear apparel interaction to at least in part produce one or more acoustic audio signals, etc.) and based at least in part according to (e.g. based in part according to one or more pieces, etc.) one or more portable electronic device ultrasonic emitter arrangements (e.g. including one or more air-coupled transducer arrangements, etc.) including a first location near one or more first individuals but not a second location near one or more second individuals (e.g. where the first and second locations are adjacent seats, etc.).

Figure 84:
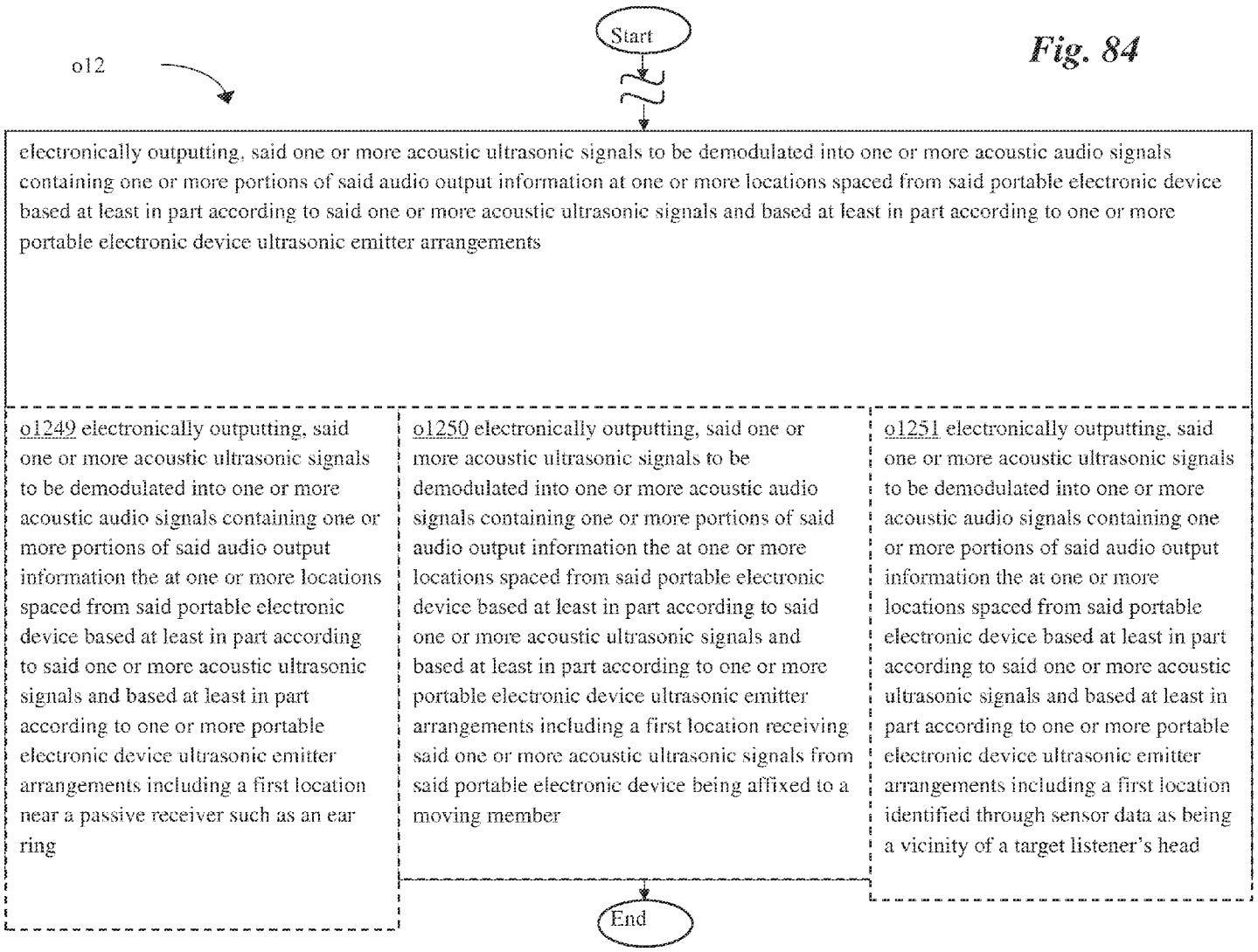
FIG. 84 is a high-level flowchart including exemplary implementations of operation o12 of FIG. 53.

In one or more implementations, as shown in FIG. 84, operation o12 includes an operation o1249 for electronically outputting, said one or more acoustic ultrasonic signals to be demodulated into one or more acoustic audio signals containing one or more portions of said audio output information the at one or more locations spaced from said portable electronic device based at least in part according to said one or more acoustic ultrasonic signals and based at least in part according to one or more portable electronic device ultrasonic emitter arrangements including a first location near a passive receiver such as an ear ring. Origination of an illustratively derived outputting passive receiver component group can be accomplished through skilled in the art design choice selection of one or more of the above depicted components from one or more of the above depicted subsystems shown in FIG. 25. Components from the outputting passive receiver component group can be used in implementing execution of the one or more outputting passive receiver instructions i1249 of FIG. 44, can be used in performance of the outputting passive receiver electrical circuitry arrangement e1249 of FIG. 37, and/or can be used in otherwise fulfillment of the operation o1249. An exemplary non-transitory signal bearing medium version of the information storage subsystem s200 is depicted in FIG. 44 as bearing the one or more outputting passive receiver instructions i1249 that when executed will direct performance of the operation o1249. Furthermore, the outputting passive receiver electrical circuitry arrangement ("elec circ arrange") e1249, when activated, will perform the operation o1249. Also, the outputting passive receiver module m1249, when executed and/or activated, will direct performance of and/or perform the operation o1249. For instance, in one or more exemplary implementations, the one or more outputting passive receiver instructions i1249, when executed, direct performance of the operation o1249 in the illustrative depiction as follows, and/or the outputting passive receiver electrical circuitry arrangement e1249, when activated, performs the operation o1249 in the illustrative depiction as follows, and/or the outputting passive receiver module m1249, when executed and/or activated, directs performance of and/or performs the operation o1249 in the illustrative depiction as follows, and/or the operation o1249 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including processor generated information, etc.) the at one or more locations (e.g. inclusive to within a vicinity of one or more desired environments, etc.) spaced (e.g. within a distance from a portable device to a person, etc.) from said portable electronic device (e.g. including one or more digital audio output components, etc.) based at least in part according to (e.g. based in part according to one or more completions, etc.) said one or more acoustic ultrasonic signals (e.g. via one or more acoustic ultrasonic signals configured to be demodulated through nonlinear interaction with one or more solids to at least in part generate one or more acoustic audio signals, etc.) and based at least in part according to (e.g. based in part according to one or more completions, etc.) one or more portable electronic device ultrasonic emitter arrangements (e.g. including one or more thin-film membrane arrangements, etc.) including a first location near a passive receiver such as an ear ring (e.g. where the ear ring is being worn by a target user, etc.).

In one or more implementations, as shown in FIG. 84, operation o12 includes an operation o1250 for electronically outputting, said one or more acoustic ultrasonic signals to be demodulated into one or more acoustic audio signals containing one or more portions of said audio output information the at one or more locations spaced from said portable electronic device based at least in part according to said one or more acoustic ultrasonic signals and based at least in part according to one or more portable electronic device ultrasonic emitter arrangements including a first location receiving said one or more acoustic ultrasonic signals from said portable electronic device being affixed to a moving member. Origination of an illustratively derived outputting moving member component group can be accomplished through skilled in the art design choice selection of one or more of the above depicted components from one or more of the above depicted subsystems shown in FIG. 25. Components from the outputting moving member component group can be used in implementing execution of the one or more outputting moving member instructions i1250 of FIG. 44, can be used in performance of the outputting moving member electrical circuitry arrangement e1250 of FIG. 37, and/or can be used in otherwise fulfillment of the operation o1250. An exemplary non-transitory signal bearing medium version of the information storage subsystem s200 is depicted in FIG. 44 as bearing the one or more outputting moving member instructions i1250 that when executed will direct performance of the operation o1250. Furthermore, the outputting moving member electrical circuitry arrangement ("elec circ arrange") e1250, when activated, will perform the operation o1250. Also, the outputting moving member module m1250, when executed and/or activated, will direct performance of and/or perform the operation o1250. For instance, in one or more exemplary implementations, the one or more outputting moving member instructions i1250, when executed, direct performance of the operation o1250 in the illustrative depiction as follows, and/or the outputting moving member electrical circuitry arrangement e1250, when activated, performs the operation o1250 in the illustrative depiction as follows, and/or the outputting moving member module m1250, when executed and/or activated, directs performance of and/or performs the operation o1250 in the illustrative depiction as follows, and/or the operation o1250 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including internet based information, etc.) the at one or more locations (e.g. inclusive to within a vicinity of one or more chosen distances, etc.) spaced (e.g. within a distance from a display screen to a person, etc.) from said portable electronic device (e.g. including one or more CD player components, etc.) based at least in part according to (e.g. based in part according to full coverage, etc.) said one or more acoustic ultrasonic signals (e.g. phase difference sensor, etc.) and based at least in part according to (e.g. based in part according to full coverage, etc.) one or more portable electronic device ultrasonic emitter arrangements (e.g. including one or more resonant surface arrangements, etc.) including a first location receiving said one or more acoustic ultrasonic signals from said portable electronic device being affixed to a moving member (e.g., wristwatch on arm, etc.).

In one or more implementations, as shown in FIG. 84, operation o12 includes an operation o1251 for electronically outputting, said one or more acoustic ultrasonic signals to be demodulated into one or more acoustic audio signals containing one or more portions of said audio output information the at one or more locations spaced from said portable electronic device based at least in part according to said one or more acoustic ultrasonic signals and based at least in part according to one or more portable electronic device ultrasonic emitter arrangements including a first location identified through sensor data as being a vicinity of a target listener's head. Origination of an illustratively derived outputting listener's head component group can be accomplished through skilled in the art design choice selection of one or more of the above depicted components from one or more of the above depicted subsystems shown in FIG. 25. Components from the outputting listener's head component group can be used in implementing execution of the one or more outputting listener's head instructions i1251 of FIG. 44, can be used in performance of the outputting listener's head electrical circuitry arrangement e1251 of FIG. 37, and/or can be used in otherwise fulfillment of the operation o1251. An exemplary non-transitory signal bearing medium version of the information storage subsystem s200 is depicted in FIG. 44 as bearing the one or more outputting listener's head instructions i1251 that when executed will direct performance of the operation o1251. Furthermore, the outputting listener's head electrical circuitry arrangement ("elec circ arrange") e1251, when activated, will perform the operation o1251. Also, the outputting listener's head module m1251, when executed and/or activated, will direct performance of and/or perform the operation o1251. For instance, in one or more exemplary implementations, the one or more outputting listener's head instructions i1251, when executed, direct performance of the operation o1251 in the illustrative depiction as follows, and/or the outputting listener's head electrical circuitry arrangement e1251, when activated, performs the operation o1251 in the illustrative depiction as follows, and/or the outputting listener's head module m1251, when executed and/or activated, directs performance of and/or performs the operation o1251 in the illustrative depiction as follows, and/or the operation o1251 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including digital audio information, etc.) the at one or more locations (e.g. inclusive to within a vicinity of one or more selected ranges, etc.) spaced (e.g. within a distance from a portable device to an ear, etc.) from said portable electronic device (e.g. including one or more digital music player components, etc.) based at least in part according to (e.g. based according to all, etc.) said one or more acoustic ultrasonic signals (e.g. via one or more acoustic ultrasonic signals including signals having one or more frequencies above 60 kHz, etc.) and based at least in part according to (e.g. based according to all, etc.) one or more portable electronic device ultrasonic emitter arrangements (e.g. including one or more transmitter arrangements, etc.) including a first location identified through sensor data as being a vicinity of a target listener's head (e.g. where sensor data is visual imagery of a target listener's face, etc.).

Figure 85:
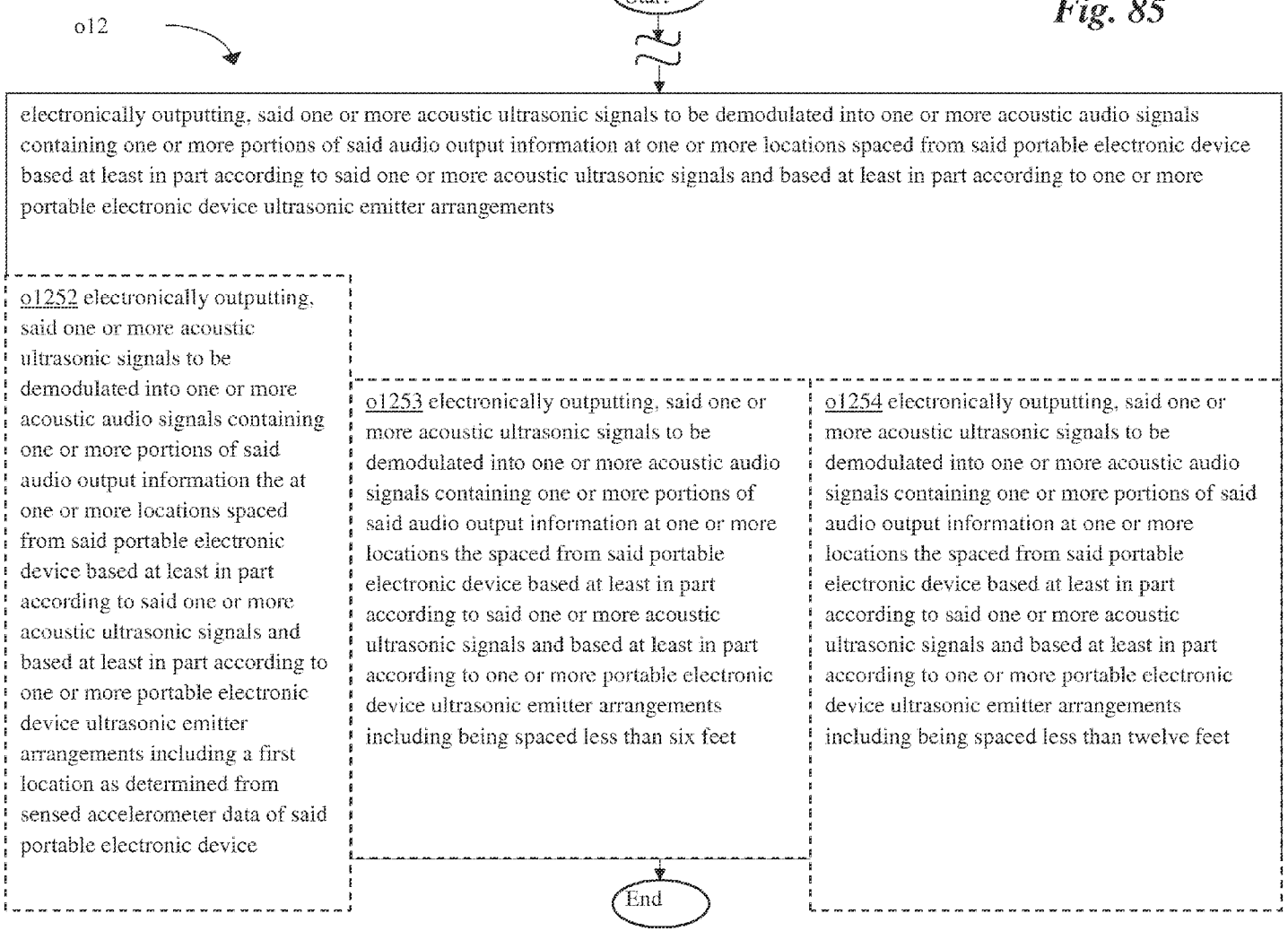
FIG. 85 is a high-level flowchart including exemplary implementations of operation o12 of FIG. 53.

In one or more implementations, as shown in FIG. 85, operation o12 includes an operation o1252 for electronically outputting, said one or more acoustic ultrasonic signals to be demodulated into one or more acoustic audio signals containing one or more portions of said audio output information the at one or more locations spaced from said portable electronic device based at least in part according to said one or more acoustic ultrasonic signals and based at least in part according to one or more portable electronic device ultrasonic emitter arrangements including a first location as determined from sensed accelerometer data of said portable electronic device. Origination of an illustratively derived outputting sensed accelerometer component group can be accomplished through skilled in the art design choice selection of one or more of the above depicted components from one or more of the above depicted subsystems shown in FIG. 25. Components from the outputting sensed accelerometer component group can be used in implementing execution of the one or more outputting sensed accelerometer instructions i1252 of FIG. 44, can be used in performance of the outputting sensed accelerometer electrical circuitry arrangement e1252 of FIG. 37, and/or can be used in otherwise fulfillment of the operation o1252. An exemplary non-transitory signal bearing medium version of the information storage subsystem s200 is depicted in FIG. 44 as bearing the one or more outputting sensed accelerometer instructions i1252 that when executed will direct performance of the operation o1252. Furthermore, the outputting sensed accelerometer electrical circuitry arrangement ("elec circ arrange") e1252, when activated, will perform the operation o1252. Also, the outputting sensed accelerometer module m1252, when executed and/or activated, will direct performance of and/or perform the operation o1252. For instance, in one or more exemplary implementations, the one or more outputting sensed accelerometer instructions i1252, when executed, direct performance of the operation o1252 in the illustrative depiction as follows, and/or the outputting sensed accelerometer electrical circuitry arrangement e1252, when activated, performs the operation o1252 in the illustrative depiction as follows, and/or the outputting sensed accelerometer module m1252, when executed and/or activated, directs performance of and/or performs the operation o1252 in the illustrative depiction as follows, and/or the operation o1252 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including analog audio information, etc.) the at one or more locations (e.g. inclusive to within a vicinity of one or more designated directions, etc.) spaced (e.g. within a distance from a display screen to an ear, etc.) from said portable electronic device (e.g. including one or more handheld radio components, etc.) based at least in part according to (e.g. based according to some, etc.) said one or more acoustic ultrasonic signals (e.g. via one or more acoustic ultrasonic signals including signals having one or more frequencies above 80 kHz, etc.) and based at least in part according to (e.g. based according to some, etc.) one or more portable electronic device ultrasonic emitter arrangements (e.g. including one or more transducer membrane arrangements, etc.) including a first location as determined from sensed accelerometer data of said portable electronic device (e.g. where the accelerometer is located on a smart watch worn on a wrist of a moving arm, etc.).

In one or more implementations, as shown in FIG. 85, operation o12 includes an operation o1253 for electronically outputting, said one or more acoustic ultrasonic signals to be demodulated into one or more acoustic audio signals containing one or more portions of said audio output information at one or more locations the spaced from said portable electronic device based at least in part according to said one or more acoustic ultrasonic signals and based at least in part according to one or more portable electronic device ultrasonic emitter arrangements including being spaced less than six feet. Origination of an illustratively derived outputting six feet component group can be accomplished through skilled in the art design choice selection of one or more of the above depicted components from one or more of the above depicted subsystems shown in FIG. 25. Components from the outputting six feet component group can be used in implementing execution of the one or more outputting six feet instructions i1253 of FIG. 44, can be used in performance of the outputting six feet electrical circuitry arrangement e1253 of FIG. 37, and/or can be used in otherwise fulfillment of the operation o1253. An exemplary non-transitory signal bearing medium version of the information storage subsystem s200 is depicted in FIG. 44 as bearing the one or more outputting six feet instructions i1253 that when executed will direct performance of the operation o1253. Furthermore, the outputting six feet electrical circuitry arrangement ("elec circ arrange") e1253, when activated, will perform the operation o1253. Also, the outputting six feet module m1253, when executed and/or activated, will direct performance of and/or perform the operation o1253. For instance, in one or more exemplary implementations, the one or more outputting six feet instructions i1253, when executed, direct performance of the operation o1253 in the illustrative depiction as follows, and/or the outputting six feet electrical circuitry arrangement e1253, when activated, performs the operation o1253 in the illustrative depiction as follows, and/or the outputting six feet module m1253, when executed and/or activated, directs performance of and/or performs the operation o1253 in the illustrative depiction as follows, and/or the operation o1253 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including high frequency audio information, etc.) at one or more locations (e.g. exclusive to one or more designated ears, etc.) the spaced (e.g. within a distance from a portable device to a center of a group, etc.) from said portable electronic device (e.g. including one or more spread spectrum components, etc.) based at least in part according to (e.g. based according to an entirety, etc.) said one or more acoustic ultrasonic signals (e.g. via one or more acoustic ultrasonic signals including signals having one or more frequencies above 100 kHz, etc.) and based at least in part according to (e.g. based according to an entirety, etc.) one or more portable electronic device ultrasonic emitter arrangements (e.g. including one or more transducer array arrangements, etc.) including being spaced less than six feet (e.g. where spacing depending upon seating arrangements, etc.).

In one or more implementations, as shown in FIG. 85, operation o12 includes an operation o1254 for electronically outputting, said one or more acoustic ultrasonic signals to be demodulated into one or more acoustic audio signals containing one or more portions of said audio output information at one or more locations the spaced from said portable electronic device based at least in part according to said one or more acoustic ultrasonic signals and based at least in part according to one or more portable electronic device ultrasonic emitter arrangements including being spaced less than twelve feet. Origination of an illustratively derived outputting twelve feet component group can be accomplished through skilled in the art design choice selection of one or more of the above depicted components from one or more of the above depicted subsystems shown in FIG. 25. Components from the outputting twelve feet component group can be used in implementing execution of the one or more outputting twelve feet instructions i1254 of FIG. 44, can be used in performance of the outputting twelve feet electrical circuitry arrangement e1254 of FIG. 37, and/or can be used in otherwise fulfillment of the operation o1254. An exemplary non-transitory signal bearing medium version of the information storage subsystem s200 is depicted in FIG. 44 as bearing the one or more outputting twelve feet instructions i1254 that when executed will direct performance of the operation o1254. Furthermore, the outputting twelve feet electrical circuitry arrangement ("elec circ arrange") e1254, when activated, will perform the operation o1254. Also, the outputting twelve feet module m1254, when executed and/or activated, will direct performance of and/or perform the operation o1254. For instance, in one or more exemplary implementations, the one or more outputting twelve feet instructions i1254, when executed, direct performance of the operation o1254 in the illustrative depiction as follows, and/or the outputting twelve feet electrical circuitry arrangement e1254, when activated, performs the operation o1254 in the illustrative depiction as follows, and/or the outputting twelve feet module m1254, when executed and/or activated, directs performance of and/or performs the operation o1254 in the illustrative depiction as follows, and/or the operation o1254 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including low frequency audio information, etc.) at one or more locations (e.g. exclusive to one or more identified persons, etc.) the spaced (e.g. within a distance from a display screen to a center of a group, etc.) from said portable electronic device (e.g. including one or more wireless components, etc.) based at least in part according to (e.g. based according to one or more portions, etc.) said one or more acoustic ultrasonic signals (e.g. via one or more acoustic ultrasonic signals including signals having one or more frequencies above 120 kHz, etc.) and based at least in part according to (e.g. based according to one or more portions, etc.) one or more portable electronic device ultrasonic emitter arrangements (e.g. including one or more membrane speaker arrangements, etc.) including being spaced less than twelve feet (e.g. where spacing is based upon dimensions of conference furniture, etc.).

Figure 86:
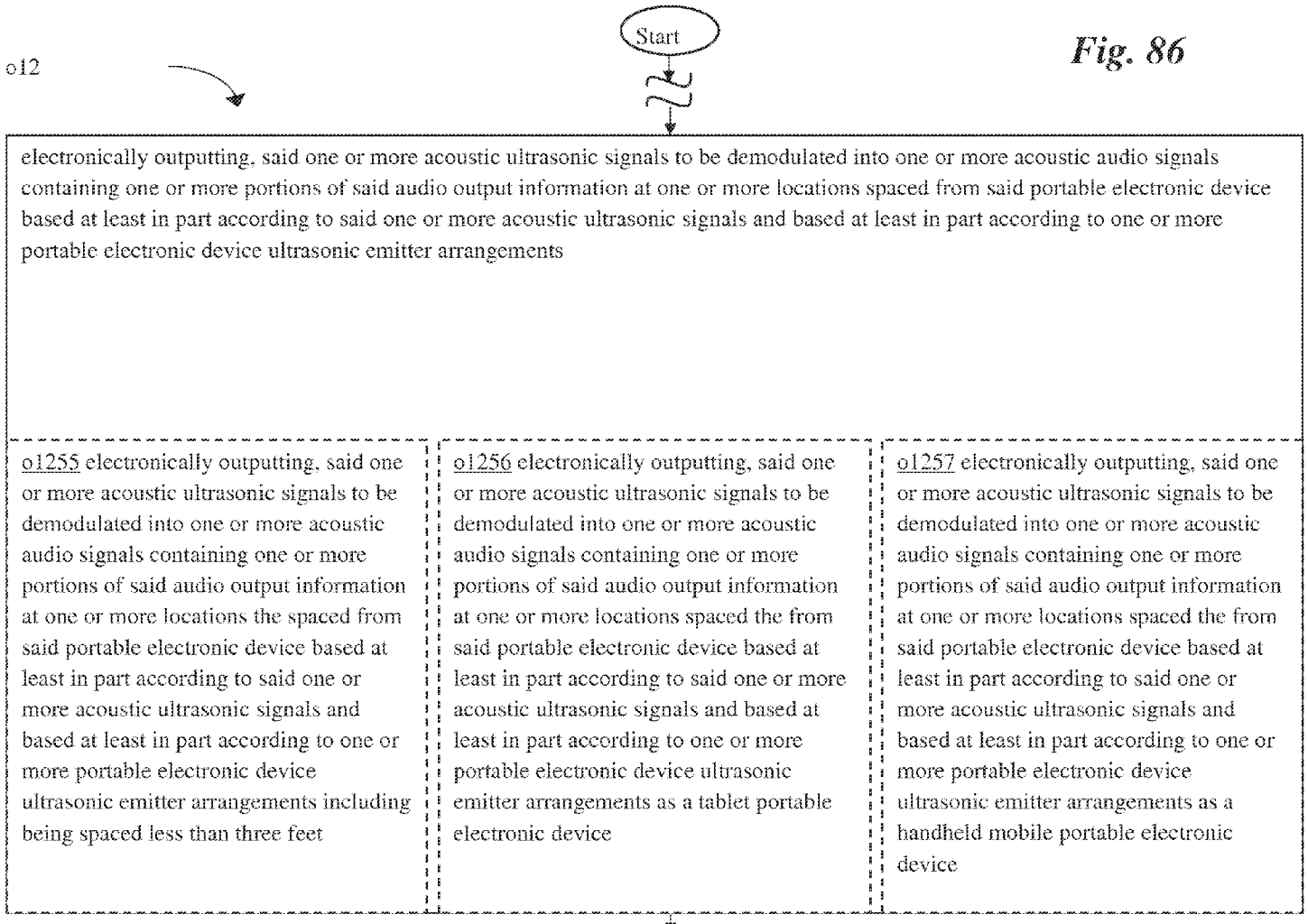
FIG. 86 is a high-level flowchart including exemplary implementations of operation o12 of FIG. 53.

In one or more implementations, as shown in FIG. 86, operation o12 includes an operation o1255 for electronically outputting, said one or more acoustic ultrasonic signals to be demodulated into one or more acoustic audio signals containing one or more portions of said audio output information at one or more locations the spaced from said portable electronic device based at least in part according to said one or more acoustic ultrasonic signals and based at least in part according to one or more portable electronic device ultrasonic emitter arrangements including being spaced less than three feet. Origination of an illustratively derived outputting three feet component group can be accomplished through skilled in the art design choice selection of one or more of the above depicted components from one or more of the above depicted subsystems shown in FIG. 25. Components from the outputting three feet component group can be used in implementing execution of the one or more outputting three feet instructions i1255 of FIG. 44, can be used in performance of the outputting three feet electrical circuitry arrangement e1255 of FIG. 37, and/or can be used in otherwise fulfillment of the operation o1255. An exemplary non-transitory signal bearing medium version of the information storage subsystem s200 is depicted in FIG. 44 as bearing the one or more outputting three feet instructions i1255 that when executed will direct performance of the operation o1255. Furthermore, the outputting three feet electrical circuitry arrangement ("elec circ arrange") e1255, when activated, will perform the operation o1255. Also, the outputting three feet module m1255, when executed and/or activated, will direct performance of and/or perform the operation o1255. For instance, in one or more exemplary implementations, the one or more outputting three feet instructions i1255, when executed, direct performance of the operation o1255 in the illustrative depiction as follows, and/or the outputting three feet electrical circuitry arrangement e1255, when activated, performs the operation o1255 in the illustrative depiction as follows, and/or the outputting three feet module m1255, when executed and/or activated, directs performance of and/or performs the operation o1255 in the illustrative depiction as follows, and/or the operation o1255 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including lecture formatted information, etc.) at one or more locations (e.g. exclusive to one or more predetermined ears, etc.) the spaced (e.g. within a distance from a transmitter to a receiver, etc.) from said portable electronic device (e.g. including one or more frequency division multiplexing components, etc.) based at least in part according to (e.g. based according to one or more sections, etc.) said one or more acoustic ultrasonic signals (e.g. via one or more acoustic ultrasonic signals including signals having one or more frequencies above 140 kHz, etc.) and based at least in part according to (e.g. based according to one or more sections, etc.) one or more portable electronic device ultrasonic emitter arrangements (e.g. including one or more ultrasonic transducer arrangements, etc.) including being spaced less than three feet (e.g. where spacing is based upon use of the portable device as a tablet computer, etc.).

In one or more implementations, as shown in FIG. 86, operation o12 includes an operation o1256 for electronically outputting, said one or more acoustic ultrasonic signals to be demodulated into one or more acoustic audio signals containing one or more portions of said audio output information at one or more locations spaced the from said portable electronic device based at least in part according to said one or more acoustic ultrasonic signals and based at least in part according to one or more portable electronic device ultrasonic emitter arrangements as a tablet portable electronic device. Origination of an illustratively derived outputting emitter arrangements component group can be accomplished through skilled in the art design choice selection of one or more of the above depicted components from one or more of the above depicted subsystems shown in FIG. 25. Components from the outputting emitter arrangements component group can be used in implementing execution of the one or more outputting emitter arrangements instructions i1256 of FIG. 44, can be used in performance of the outputting emitter arrangements electrical circuitry arrangement e1256 of FIG. 37, and/or can be used in otherwise fulfillment of the operation o1256. An exemplary non-transitory signal bearing medium version of the information storage subsystem s200 is depicted in FIG. 44 as bearing the one or more outputting emitter arrangements instructions i1256 that when executed will direct performance of the operation o1256. Furthermore, the outputting emitter arrangements electrical circuitry arrangement ("elec circ arrange") e1256, when activated, will perform the operation o1256. Also, the outputting emitter arrangements module m1256, when executed and/or activated, will direct performance of and/or perform the operation o1256. For instance, in one or more exemplary implementations, the one or more outputting emitter arrangements instructions i1256, when executed, direct performance of the operation o1256 in the illustrative depiction as follows, and/or the outputting emitter arrangements electrical circuitry arrangement e1256, when activated, performs the operation o1256 in the illustrative depiction as follows, and/or the outputting emitter arrangements module m1256, when executed and/or activated, directs performance of and/or performs the operation o1256 in the illustrative depiction as follows, and/or the operation o1256 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including foreign language speech information, etc.) at one or more locations (e.g. exclusive to one or more desired groups of people, etc.) spaced (e.g. within a distance from a first seat back to a second seat back, etc.) the from said portable electronic device (e.g. including one or more time division multiplexing components, etc.) based at least in part according to (e.g. based according to one or more assemblies, etc.) said one or more acoustic ultrasonic signals (e.g. via one or more acoustic ultrasonic signals including signals having one or more frequencies above 160 kHz, etc.) and based at least in part according to (e.g. based according to one or more assemblies, etc.) one or more portable electronic device ultrasonic emitter arrangements (e.g. including one or more electrostatic transducer arrangements, etc.) as a tablet portable electronic device (e.g. where a tablet is used as a laptop replacement, etc.).

In one or more implementations, as shown in FIG. 86, operation o12 includes an operation o1257 for electronically outputting, said one or more acoustic ultrasonic signals to be demodulated into one or more acoustic audio signals containing one or more portions of said audio output information at one or more locations spaced the from said portable electronic device based at least in part according to said one or more acoustic ultrasonic signals and based at least in part according to one or more portable electronic device ultrasonic emitter arrangements as a handheld mobile portable electronic device. Origination of an illustratively derived outputting handheld mobile component group can be accomplished through skilled in the art design choice selection of one or more of the above depicted components from one or more of the above depicted subsystems shown in FIG. 25. Components from the outputting handheld mobile component group can be used in implementing execution of the one or more outputting handheld mobile instructions i1257 of FIG. 44, can be used in performance of the outputting handheld mobile electrical circuitry arrangement e1257 of FIG. 37, and/or can be used in otherwise fulfillment of the operation o1257. An exemplary non-transitory signal bearing medium version of the information storage subsystem s200 is depicted in FIG. 44 as bearing the one or more outputting handheld mobile instructions i1257 that when executed will direct performance of the operation o1257. Furthermore, the outputting handheld mobile electrical circuitry arrangement ("elec circ arrange") e1257, when activated, will perform the operation o1257. Also, the outputting handheld mobile module m1257, when executed and/or activated, will direct performance of and/or perform the operation o1257. For instance, in one or more exemplary implementations, the one or more outputting handheld mobile instructions i1257, when executed, direct performance of the operation o1257 in the illustrative depiction as follows, and/or the outputting handheld mobile electrical circuitry arrangement e1257, when activated, performs the operation o1257 in the illustrative depiction as follows, and/or the outputting handheld mobile module m1257, when executed and/or activated, directs performance of and/or performs the operation o1257 in the illustrative depiction as follows, and/or the operation o1257 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including classical music selection information, etc.) at one or more locations (e.g. exclusive to one or more chosen audio receivers, etc.) spaced (e.g. within a distance from a seat back to a tray table, etc.) the from said portable electronic device (e.g. including one or more clamshell phone components, etc.) based at least in part according to (e.g. based according to one or more partials, etc.) said one or more acoustic ultrasonic signals (e.g. via one or more acoustic ultrasonic signals including signals having one or more frequencies above 180 kHz, etc.) and based at least in part according to (e.g. based according to one or more partials, etc.) one or more portable electronic device ultrasonic emitter arrangements (e.g. including one or more piezoelectric transducer arrangements, etc.) as a handheld mobile portable electronic device (e.g. where a mobile device is used as a smart phone and tablet combination, etc.).

Figure 87:
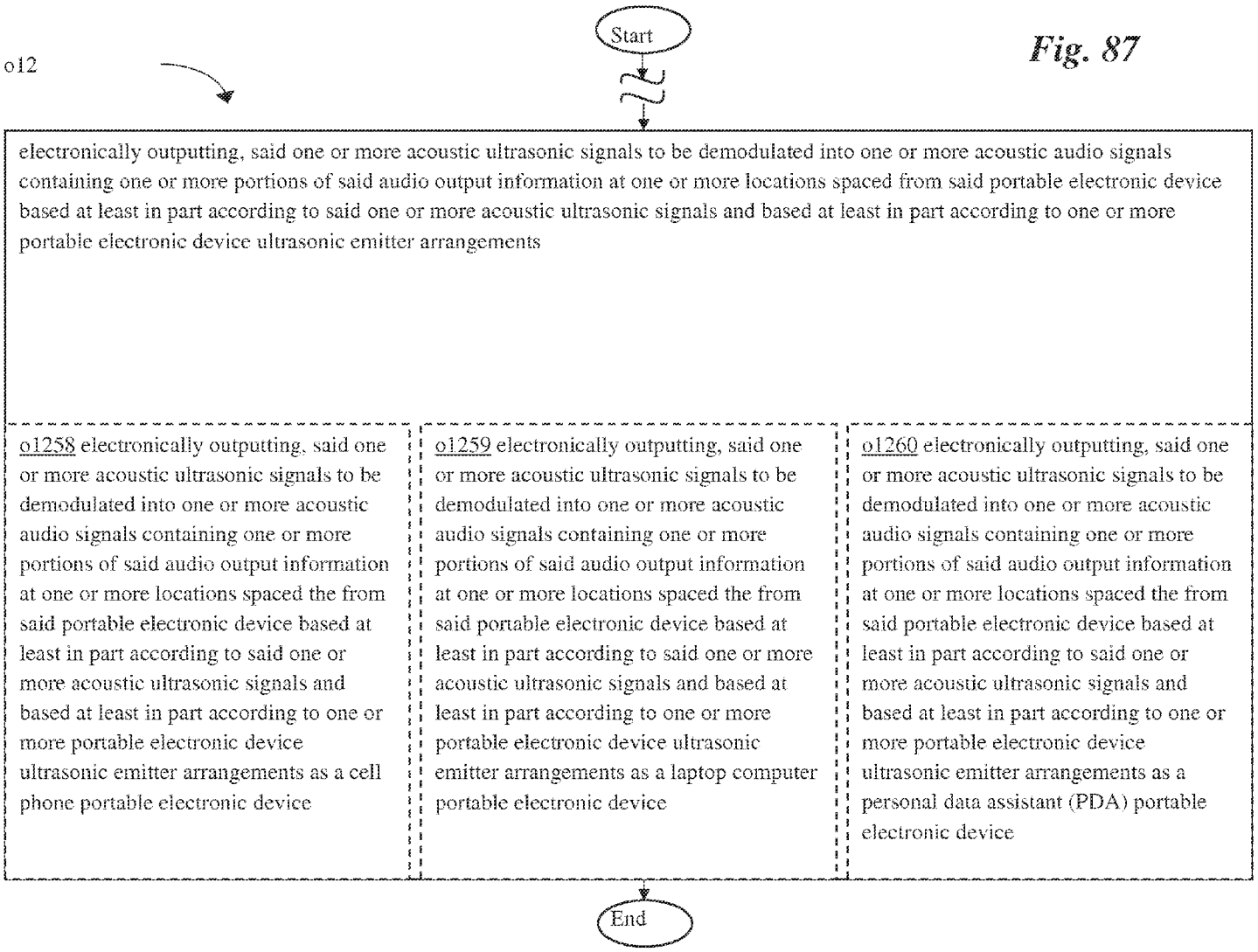
FIG. 87 is a high-level flowchart including exemplary implementations of operation o12 of FIG. 53.

In one or more implementations, as shown in FIG. 87, operation o12 includes an operation o1258 for electronically outputting, said one or more acoustic ultrasonic signals to be demodulated into one or more acoustic audio signals containing one or more portions of said audio output information at one or more locations spaced the from said portable electronic device based at least in part according to said one or more acoustic ultrasonic signals and based at least in part according to one or more portable electronic device ultrasonic emitter arrangements as a cell phone portable electronic device. Origination of an illustratively derived outputting cell phone component group can be accomplished through skilled in the art design choice selection of one or more of the above depicted components from one or more of the above depicted subsystems shown in FIG. 25. Components from the outputting cell phone component group can be used in implementing execution of the one or more outputting cell phone instructions i1258 of FIG. 44, can be used in performance of the outputting cell phone electrical circuitry arrangement e1258 of FIG. 37, and/or can be used in otherwise fulfillment of the operation o1258. An exemplary non-transitory signal bearing medium version of the information storage subsystem s200 is depicted in FIG. 44 as bearing the one or more outputting cell phone instructions i1258 that when executed will direct performance of the operation o1258. Furthermore, the outputting cell phone electrical circuitry arrangement ("elec circ arrange") e1258, when activated, will perform the operation o1258. Also, the outputting cell phone module m1258, when executed and/or activated, will direct performance of and/or perform the operation o1258. For instance, in one or more exemplary implementations, the one or more outputting cell phone instructions i1258, when executed, direct performance of the operation o1258 in the illustrative depiction as follows, and/or the outputting cell phone electrical circuitry arrangement e1258, when activated, performs the operation o1258 in the illustrative depiction as follows, and/or the outputting cell phone module m1258, when executed and/or activated, directs performance of and/or performs the operation o1258 in the illustrative depiction as follows, and/or the operation o1258 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including instructional lesson material information, etc.) at one or more locations (e.g. exclusive to one or more selected microphones, etc.) spaced (e.g. within a distance of an aisle way, etc.) the from said portable electronic device (e.g. including one or more media player components, etc.) based at least in part according to (e.g. based according to one or more pieces, etc.) said one or more acoustic ultrasonic signals (e.g. via one or more acoustic ultrasonic signals including signals having one or more frequencies above 200 kHz, etc.) and based at least in part according to (e.g. based according to one or more pieces, etc.) one or more portable electronic device ultrasonic emitter arrangements (e.g. including one or more electrostrictive transducer arrangements, etc.) as a cell phone portable electronic device (e.g. where a cell phone includes smart phone features, etc.).

In one or more implementations, as shown in FIG. 87, operation o12 includes an operation o1259 for electronically outputting, said one or more acoustic ultrasonic signals to be demodulated into one or more acoustic audio signals containing one or more portions of said audio output information at one or more locations spaced the from said portable electronic device based at least in part according to said one or more acoustic ultrasonic signals and based at least in part according to one or more portable electronic device ultrasonic emitter arrangements as a laptop computer portable electronic device. Origination of an illustratively derived outputting laptop computer component group can be accomplished through skilled in the art design choice selection of one or more of the above depicted components from one or more of the above depicted subsystems shown in FIG. 25. Components from the outputting laptop computer component group can be used in implementing execution of the one or more outputting laptop computer instructions i1259 of FIG. 44, can be used in performance of the outputting laptop computer electrical circuitry arrangement e1259 of FIG. 37, and/or can be used in otherwise fulfillment of the operation o1259. An exemplary non-transitory signal bearing medium version of the information storage subsystem s200 is depicted in FIG. 44 as bearing the one or more outputting laptop computer instructions i1259 that when executed will direct performance of the operation o1259. Furthermore, the outputting laptop computer electrical circuitry arrangement ("elec circ arrange") e1259, when activated, will perform the operation o1259. Also, the outputting laptop computer module m1259, when executed and/or activated, will direct performance of and/or perform the operation o1259. For instance, in one or more exemplary implementations, the one or more outputting laptop computer instructions i1259, when executed, direct performance of the operation o1259 in the illustrative depiction as follows, and/or the outputting laptop computer electrical circuitry arrangement e1259, when activated, performs the operation o1259 in the illustrative depiction as follows, and/or the outputting laptop computer module m1259, when executed and/or activated, directs performance of and/or performs the operation o1259 in the illustrative depiction as follows, and/or the operation o1259 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including warning tone information, etc.) at one or more locations (e.g. exclusive to one or more designated surfaces, etc.) spaced (e.g. within a distance from a desk to a chair, etc.) the from said portable electronic device (e.g. including one or more 3G mobile components, etc.) based at least in part according to (e.g. based according to one or more completions, etc.) said one or more acoustic ultrasonic signals (e.g. via multiple acoustic ultrasonic signals configured to be demodulated through mutual interference therewith to at least in part result in one or more acoustic audio signals, etc.) and based at least in part according to (e.g. based according to one or more completions, etc.) one or more portable electronic device ultrasonic emitter arrangements (e.g. including one or more electro-thermo-mechanical film transducer arrangements, etc.) as a laptop computer portable electronic device (e.g. where a laptop is used as a business desktop computer replacement, etc.).

In one or more implementations, as shown in FIG. 87, operation o12 includes an operation o1260 for electronically outputting, said one or more acoustic ultrasonic signals to be demodulated into one or more acoustic audio signals containing one or more portions of said audio output information at one or more locations spaced the from said portable electronic device based at least in part according to said one or more acoustic ultrasonic signals and based at least in part according to one or more portable electronic device ultrasonic emitter arrangements as a personal data assistant (PDA) portable electronic device. Origination of an illustratively derived outputting PDA component group can be accomplished through skilled in the art design choice selection of one or more of the above depicted components from one or more of the above depicted subsystems shown in FIG.

25. Components from the outputting PDA component group can be used in implementing execution of the one or more outputting PDA instructions i1260 of FIG. 45, can be used in performance of the outputting PDA electrical circuitry arrangement e1260 of FIG. 38, and/or can be used in otherwise fulfillment of the operation o1260. An exemplary non-transitory signal bearing medium version of the information storage subsystem s200 is depicted in FIG. 45 as bearing the one or more outputting PDA instructions i1260 that when executed will direct performance of the operation o1260. Furthermore, the outputting PDA electrical circuitry arrangement ("elec circ arrange") e1260, when activated, will perform the operation o1260. Also, the outputting PDA module m1260, when executed and/or activated, will direct performance of and/or perform the operation o1260. For instance, in one or more exemplary implementations, the one or more outputting PDA instructions i1260, when executed, direct performance of the operation o1260 in the illustrative depiction as follows, and/or the outputting PDA electrical circuitry arrangement e1260, when activated, performs the operation o1260 in the illustrative depiction as follows, and/or the outputting PDA module m1260, when executed and/or activated, directs performance of and/or performs the operation o1260 in the illustrative depiction as follows, and/or the operation o1260 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including white noise information, etc.) at one or more locations (e.g. exclusive to one or more identified objects, etc.) spaced (e.g. within a distance from a dashboard to a headrest, etc.) the from said portable electronic device (e.g. including one or more cellular components, etc.) based at least in part according to (e.g. based according to full coverage, etc.) said one or more acoustic ultrasonic signals (e.g. via one or more acoustic ultrasonic signals configured to be demodulated through nonlinear atmospheric interaction to at least in part generate one or more acoustic audio signals, etc.) and based at least in part according to (e.g. based according to full coverage, etc.) one or more portable electronic device ultrasonic emitter arrangements (e.g. including one or more polyvinylidene fluoride film transducer arrangements, etc.) as a personal data assistant (PDA) portable electronic device (e.g. where a personal data assistant includes smart phone and tablet features, etc.).

Figure 88:
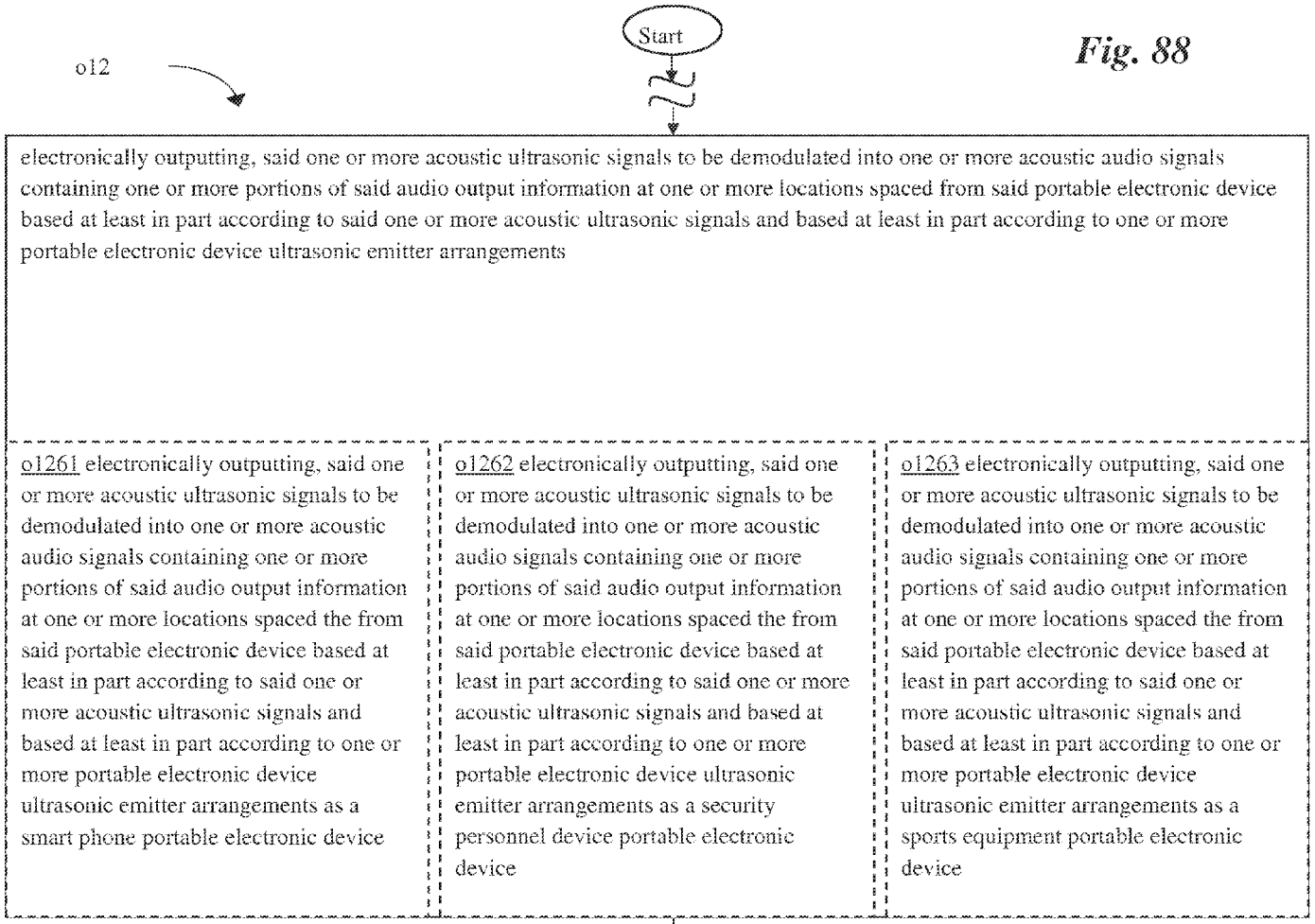
FIG. 88 is a high-level flowchart including exemplary implementations of operation o12 of FIG. 53.

In one or more implementations, as shown in FIG. 88, operation o12 includes an operation o1261 for electronically outputting, said one or more acoustic ultrasonic signals to be demodulated into one or more acoustic audio signals containing one or more portions of said audio output information at one or more locations spaced the from said portable electronic device based at least in part according to said one or more acoustic ultrasonic signals and based at least in part according to one or more portable electronic device ultrasonic emitter arrangements as a smart phone portable electronic device. Origination of an illustratively derived outputting smart phone component group can be accomplished through skilled in the art design choice selection of one or more of the above depicted components from one or more of the above depicted subsystems shown in FIG. 25. Components from the outputting smart phone component group can be used in implementing execution of the one or more outputting smart phone instructions i1261 of FIG. 45, can be used in performance of the outputting smart phone electrical circuitry arrangement e1261 of FIG. 38, and/or can be used in otherwise fulfillment of the operation o1261. An exemplary non-transitory signal bearing medium version of the information storage subsystem s200 is depicted in FIG. 45 as bearing the one or more outputting smart phone instructions i1261 that when executed will direct performance of the operation o1261. Furthermore, the outputting smart phone electrical circuitry arrangement ("elec circ arrange") e1261, when activated, will perform the operation o1261. Also, the outputting smart phone module m1261, when executed and/or activated, will direct performance of and/or perform the operation o1261. For instance, in one or more exemplary implementations, the one or more outputting smart phone instructions i1261, when executed, direct performance of the operation o1261 in the illustrative depiction as follows, and/or the outputting smart phone electrical circuitry arrangement e1261, when activated, performs the operation o1261 in the illustrative depiction as follows, and/or the outputting smart phone module m1261, when executed and/or activated, directs performance of and/or performs the operation o1261 in the illustrative depiction as follows, and/or the operation o1261 is otherwise carried out in the illustrative depiction as follows: electronically outputting said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including varying pitch information, etc.) at one or more locations (e.g. exclusive to one or more predetermined locations, etc.) spaced (e.g. less than confines of a room, etc.) the from said portable electronic device (e.g. through reception of cable communication packets, etc.) based at least in part according to (e.g. based in part according to all, etc.) said one or more acoustic ultrasonic signals (e.g. via one or more acoustic ultrasonic signals configured to be demodulated through nonlinear human tissue interaction to at least in part produce one or more acoustic audio signals, etc.) and based at least in part according to (e.g. based in part according to all, etc.) one or more portable electronic device ultrasonic emitter arrangements (e.g. including one or more deposition transducer arrangements, etc.) as a smart phone portable electronic device (e.g. where a smart phone includes tablet features, etc.).

In one or more implementations, as shown in FIG. 88, operation o12 includes an operation o1262 for electronically outputting, said one or more acoustic ultrasonic signals to be demodulated into one or more acoustic audio signals containing one or more portions of said audio output information at one or more locations spaced the from said portable electronic device based at least in part according to said one or more acoustic ultrasonic signals and based at least in part according to one or more portable electronic device ultrasonic emitter arrangements as a security personnel device portable electronic device. Origination of an illustratively derived outputting security personnel component group can be accomplished through skilled in the art design choice selection of one or more of the above depicted components from one or more of the above depicted subsystems shown in FIG. 25. Components from the outputting security personnel component group can be used in implementing execution of the one or more outputting security personnel instructions i1262 of FIG. 45, can be used in performance of the outputting security personnel electrical circuitry arrangement e1262 of FIG. 38, and/or can be used in otherwise fulfillment of the operation o1262. An exemplary non-transitory signal bearing medium version of the information storage subsystem s200 is depicted in FIG. 45 as bearing the one or more outputting security personnel instructions i1262 that when executed will direct performance of the operation o1262. Furthermore, the outputting security personnel electrical circuitry arrangement ("elec circ arrange") e1262, when activated, will perform the operation o1262. Also, the outputting security personnel module m1262, when executed and/or activated, will direct performance of and/or perform the operation o1262. For instance, in one or more exemplary implementations, the one or more outputting security personnel instructions i1262, when executed, direct performance of the operation o1262 in the illustrative depiction as follows, and/or the outputting security personnel electrical circuitry arrangement e1262, when activated, performs the operation o1262 in the illustrative depiction as follows, and/or the outputting security personnel module m1262, when executed and/or activated, directs performance of and/or performs the operation o1262 in the illustrative depiction as follows, and/or the operation o1262 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including note sequence information, etc.) at one or more locations (e.g. exclusive to one or more desired environments, etc.) spaced (e.g. less than an arm's length, etc.) the from said portable electronic device (e.g. including one or more WiFi components, etc.) based at least in part according to (e.g. based in part according to some, etc.) said one or more acoustic ultrasonic signals (e.g. via one or more acoustic ultrasonic signals configured to be demodulated through nonlinear polymeric interaction to at least in part result in one or more acoustic audio signals, etc.) and based at least in part according to (e.g. based in part according to some, etc.) one or more portable electronic device ultrasonic emitter arrangements (e.g. including one or more emitter array arrangements, etc.) as a security personnel device portable electronic device (e.g. including security personnel walkie-talkies, etc.).

In one or more implementations, as shown in FIG. 88, operation o12 includes an operation o1263 for electronically outputting, said one or more acoustic ultrasonic signals to be demodulated into one or more acoustic audio signals containing one or more portions of said audio output information at one or more locations spaced the from said portable electronic device based at least in part according to said one or more acoustic ultrasonic signals and based at least in part according to one or more portable electronic device ultrasonic emitter arrangements as a sports equipment portable electronic device. Origination of an illustratively derived outputting sports equipment component group can be accomplished through skilled in the art design choice selection of one or more of the above depicted components from one or more of the above depicted subsystems shown in FIG. 25. Components from the outputting sports equipment component group can be used in implementing execution of the one or more outputting sports equipment instructions i1263 of FIG. 45, can be used in performance of the outputting sports equipment electrical circuitry arrangement e1263 of FIG. 38, and/or can be used in otherwise fulfillment of the operation o1263. An exemplary non-transitory signal bearing medium version of the information storage subsystem s200 is depicted in FIG. 45 as bearing the one or more outputting sports equipment instructions i1263 that when executed will direct performance of the operation o1263. Furthermore, the outputting sports equipment electrical circuitry arrangement ("elec circ arrange") e1263, when activated, will perform the operation o1263. Also, the outputting sports equipment module m1263, when executed and/or activated, will direct performance of and/or perform the operation o1263. For instance, in one or more exemplary implementations, the one or more outputting sports equipment instructions i1263, when executed, direct performance of the operation o1263 in the illustrative depiction as follows, and/or the outputting sports equipment electrical circuitry arrangement e1263, when activated, performs the operation o1263 in the illustrative depiction as follows, and/or the outputting sports equipment module m1263, when executed and/or activated, directs performance of and/or performs the operation o1263 in the illustrative depiction as follows, and/or the operation o1263 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including two-way conversation information, etc.) at one or more locations (e.g. exclusive to one or more chosen distances, etc.) spaced (e.g. less than a three foot radius, etc.) the from said portable electronic device (e.g. including one or more infrared components, etc.) based at least in part according to (e.g. based in part according to an entirety, etc.) said one or more acoustic ultrasonic signals (e.g. via one or more acoustic ultrasonic signals configured to be demodulated through nonlinear apparel interaction to at least in part produce one or more acoustic audio signals, etc.) and based at least in part according to (e.g. based in part according to an entirety, etc.) one or more portable electronic device ultrasonic emitter arrangements (e.g. including one or more dispersed transducer arrangements, etc.) as a sports equipment portable electronic device (e.g. incorporated into a sports helmet such as for football or baseball, etc.).

Figure 89:
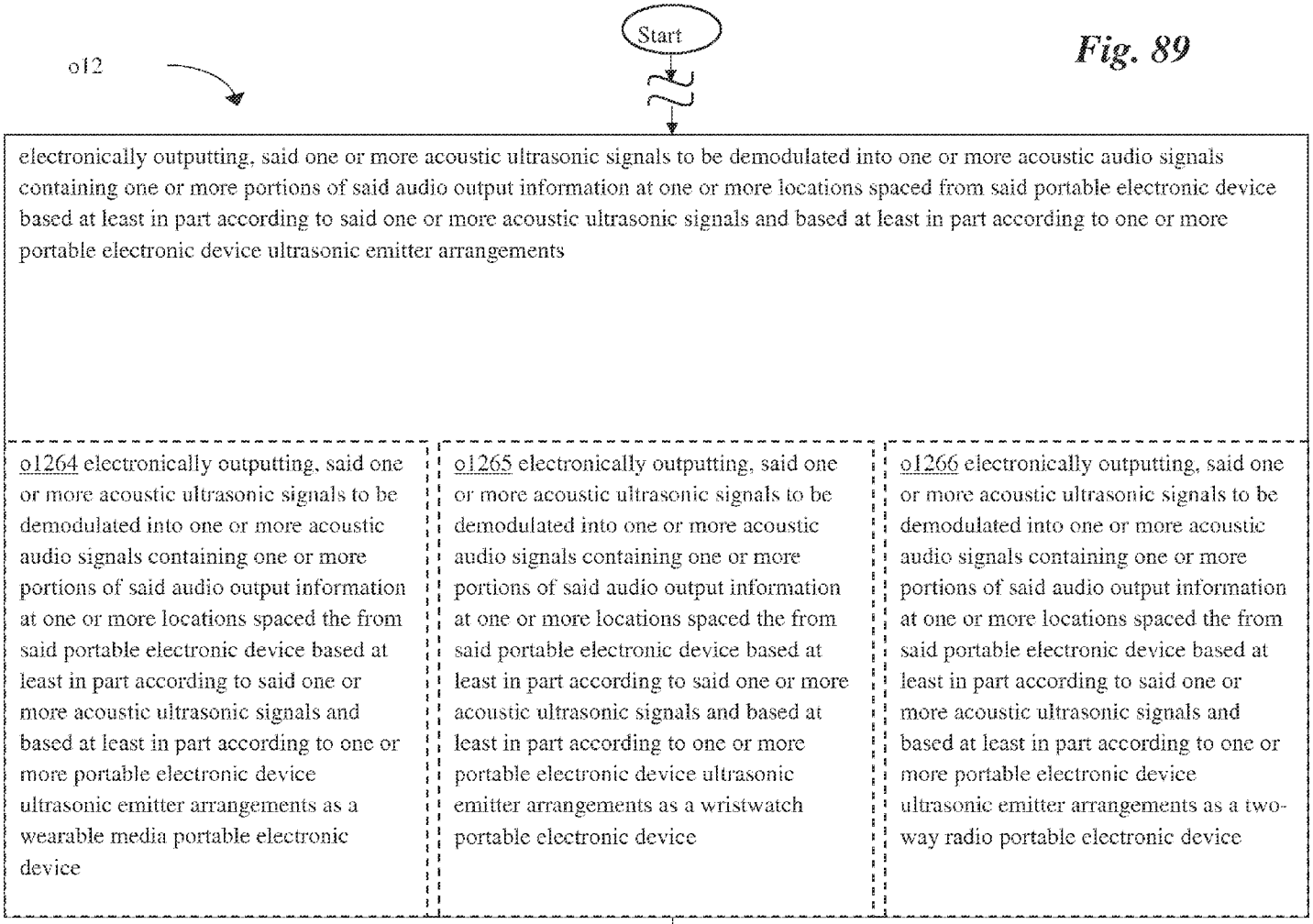
FIG. 89 is a high-level flowchart including exemplary implementations of operation o12 of FIG. 53.

In one or more implementations, as shown in FIG. 89, operation o12 includes an operation o1264 for electronically outputting, said one or more acoustic ultrasonic signals to be demodulated into one or more acoustic audio signals containing one or more portions of said audio output information at one or more locations spaced the from said portable electronic device based at least in part according to said one or more acoustic ultrasonic signals and based at least in part according to one or more portable electronic device ultrasonic emitter arrangements as a wearable media portable electronic device. Origination of an illustratively derived outputting wearable media component group can be accomplished through skilled in the art design choice selection of one or more of the above depicted components from one or more of the above depicted subsystems shown in FIG. 25. Components from the outputting wearable media component group can be used in implementing execution of the one or more outputting wearable media instructions i1264 of FIG. 45, can be used in performance of the outputting wearable media electrical circuitry arrangement e1264 of FIG. 38, and/or can be used in otherwise fulfillment of the operation o1264. An exemplary non-transitory signal bearing medium version of the information storage subsystem s200 is depicted in FIG. 45 as bearing the one or more outputting wearable media instructions i1264 that when executed will direct performance of the operation o1264. Furthermore, the outputting wearable media electrical circuitry arrangement ("elec circ arrange") e1264, when activated, will perform the operation o1264. Also, the outputting wearable media module m1264, when executed and/or activated, will direct performance of and/or perform the operation o1264. For instance, in one or more exemplary implementations, the one or more outputting wearable media instructions i1264, when executed, direct performance of the operation o1264 in the illustrative depiction as follows, and/or the outputting wearable media electrical circuitry arrangement e1264, when activated, performs the operation o1264 in the illustrative depiction as follows, and/or the outputting wearable media module m1264, when executed and/or activated, directs performance of and/or performs the operation o1264 in the illustrative depiction as follows, and/or the operation o1264 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including confidential information, etc.) at one or more locations (e.g. exclusive to one or more selected ranges, etc.) spaced (e.g. less than a distance from a portable device to a person, etc.) the from said portable electronic device (e.g. including one or more personal digital assistant components, etc.) based at least in part according to (e.g. based in part according to one or more portions, etc.) said one or more acoustic ultrasonic signals (e.g. via one or more acoustic ultrasonic signals configured to be demodulated through nonlinear interaction with one or more solids to at least in part generate one or more acoustic audio signals, etc.) and based at least in part according to (e.g. based in part according to one or more portions, etc.) one or more portable electronic device ultrasonic emitter arrangements (e.g. including one or more monitor embedded transducer arrangements, etc.) as a wearable media portable electronic device (e.g. where a smart coat has tablet features, etc.).

In one or more implementations, as shown in FIG. 89, operation o12 includes an operation o1265 for electronically outputting, said one or more acoustic ultrasonic signals to be demodulated into one or more acoustic audio signals containing one or more portions of said audio output information at one or more locations spaced the from said portable electronic device based at least in part according to said one or more acoustic ultrasonic signals and based at least in part according to one or more portable electronic device ultrasonic emitter arrangements as a wristwatch portable electronic device. Origination of an illustratively derived outputting wristwatch component group can be accomplished through skilled in the art design choice selection of one or more of the above depicted components from one or more of the above depicted subsystems shown in FIG. 25. Components from the outputting wristwatch component group can be used in implementing execution of the one or more outputting wristwatch instructions i1265 of FIG. 45, can be used in performance of the outputting wristwatch electrical circuitry arrangement e1265 of FIG. 38, and/or can be used in otherwise fulfillment of the operation o1265. An exemplary non-transitory signal bearing medium version of the information storage subsystem s200 is depicted in FIG. 45 as bearing the one or more outputting wristwatch instructions i1265 that when executed will direct performance of the operation o1265. Furthermore, the outputting wristwatch electrical circuitry arrangement ("elec circ arrange") e1265, when activated, will perform the operation o1265. Also, the outputting wristwatch module m1265, when executed and/or activated, will direct performance of and/or perform the operation o1265. For instance, in one or more exemplary implementations, the one or more outputting wristwatch instructions i1265, when executed, direct performance of the operation o1265 in the illustrative depiction as follows, and/or the outputting wristwatch electrical circuitry arrangement e1265, when activated, performs the operation o1265 in the illustrative depiction as follows, and/or the outputting wristwatch module m1265, when executed and/or activated, directs performance of and/or performs the operation o1265 in the illustrative depiction as follows, and/or the operation o1265 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including eavesdropping information, etc.) at one or more locations (e.g. exclusive to one or more designated directions, etc.) spaced (e.g. less than a distance from a display screen to a person, etc.) the from said portable electronic device (e.g. including one or more smart phone components, etc.) based at least in part according to (e.g. based in part according to one or more sections, etc.) said one or more acoustic ultrasonic signals (e.g. via one or more acoustic ultrasonic signals including signals having one or more frequencies above 60 kHz, etc.) and based at least in part according to (e.g. based in part according to one or more sections, etc.) one or more portable electronic device ultrasonic emitter arrangements (e.g. including one or more keyboard embedded transducer arrangements, etc.) as a wristwatch portable electronic device (e.g. where a smart watch has tablet features, etc.).

In one or more implementations, as shown in FIG. 89, operation o12 includes an operation o1266 for electronically outputting, said one or more acoustic ultrasonic signals to be demodulated into one or more acoustic audio signals containing one or more portions of said audio output information at one or more locations spaced the from said portable electronic device based at least in part according to said one or more acoustic ultrasonic signals and based at least in part according to one or more portable electronic device ultrasonic emitter arrangements as a two-way radio portable electronic device. Origination of an illustratively derived outputting two-way radio component group can be accomplished through skilled in the art design choice selection of one or more of the above depicted components from one or more of the above depicted subsystems shown in FIG. 25. Components from the outputting two-way radio component group can be used in implementing execution of the one or more outputting two-way radio instructions i1266 of FIG. 45, can be used in performance of the outputting two-way radio electrical circuitry arrangement e1266 of FIG. 38, and/or can be used in otherwise fulfillment of the operation o1266. An exemplary non-transitory signal bearing medium version of the information storage subsystem s200 is depicted in FIG. 45 as bearing the one or more outputting two-way radio instructions i1266 that when executed will direct performance of the operation o1266. Furthermore, the outputting two-way radio electrical circuitry arrangement ("elec circ arrange") e1266, when activated, will perform the operation o1266. Also, the outputting two-way radio module m1266, when executed and/or activated, will direct performance of and/or perform the operation o1266. For instance, in one or more exemplary implementations, the one or more outputting two-way radio instructions i1266, when executed, direct performance of the operation o1266 in the illustrative depiction as follows, and/or the outputting two-way radio electrical circuitry arrangement e1266, when activated, performs the operation o1266 in the illustrative depiction as follows, and/or the outputting two-way radio module m1266, when executed and/or activated, directs performance of and/or performs the operation o1266 in the illustrative depiction as follows, and/or the operation o1266 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including pre-recorded information, etc.) at one or more locations (e.g. inclusive to one or more designated ears, etc.) spaced (e.g. less than a distance from a portable device to an ear, etc.) the from said portable electronic device (e.g. including one or more cell phone components, etc.) based at least in part according to (e.g. based in part according to one or more assemblies, etc.) said one or more acoustic ultrasonic signals (e.g. via one or more acoustic ultrasonic signals including signals having one or more frequencies above 80 kHz, etc.) and based at least in part according to (e.g. based in part according to one or more assemblies, etc.) one or more portable electronic device ultrasonic emitter arrangements (e.g. including one or more device body embedded transducer arrangements, etc.) as a two-way radio portable electronic device (e.g. where a walkie-talkie has smart phone features, etc.).

Figure 90:
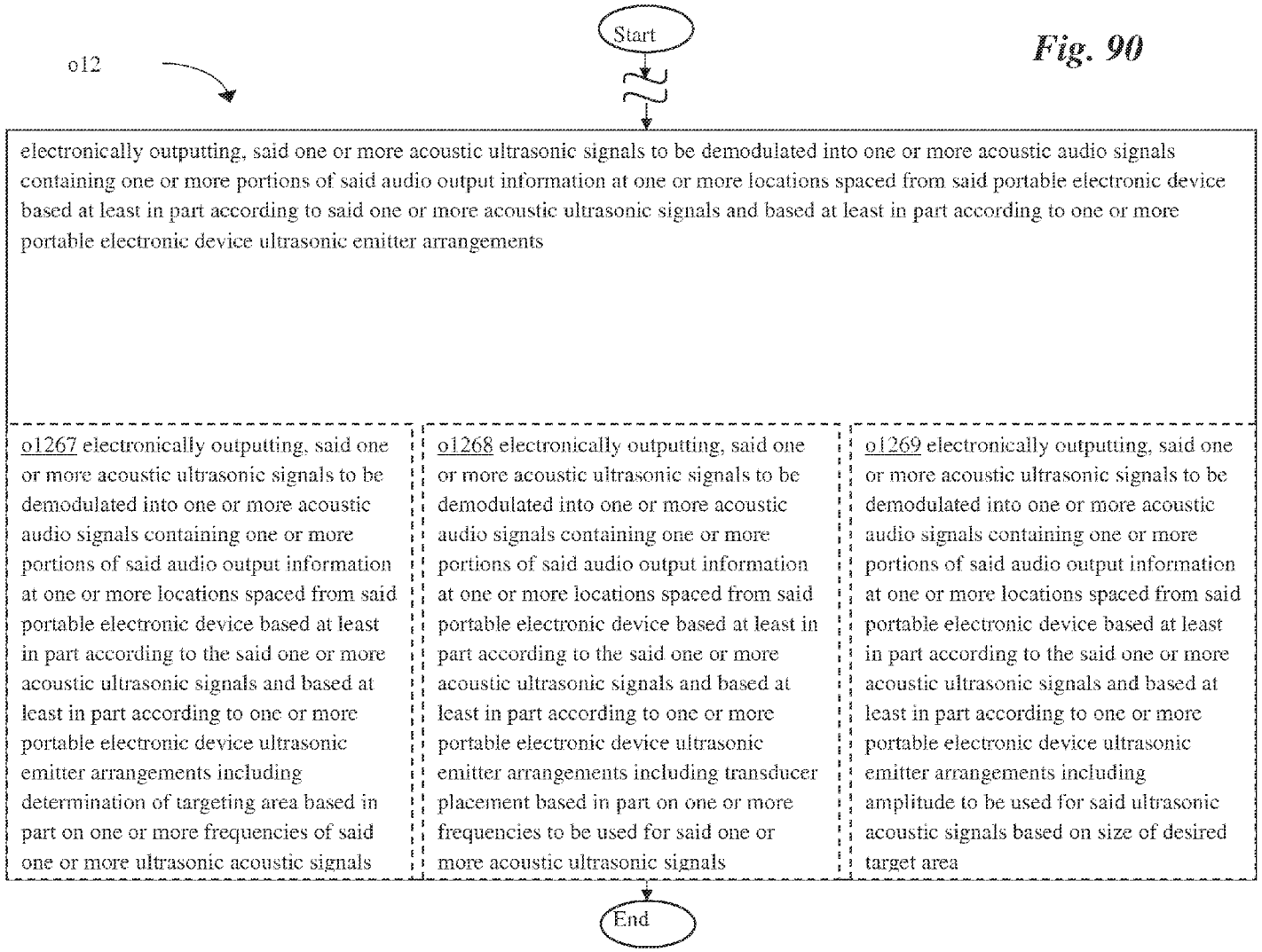
FIG. 90 is a high-level flowchart including exemplary implementations of operation o12 of FIG. 53.

In one or more implementations, as shown in FIG. 90, operation o12 includes an operation o1267 for electronically outputting, said one or more acoustic ultrasonic signals to be demodulated into one or more acoustic audio signals containing one or more portions of said audio output information at one or more locations spaced from said portable electronic device based at least in part according to the said one or more acoustic ultrasonic signals and based at least in part according to one or more portable electronic device ultrasonic emitter arrangements including determination of targeting area based in part on one or more frequencies of said one or more ultrasonic acoustic signals. Origination of an illustratively derived outputting targeting area component group can be accomplished through skilled in the art design choice selection of one or more of the above depicted components from one or more of the above depicted subsystems shown in FIG. 25. Components from the outputting targeting area component group can be used in implementing execution of the one or more outputting targeting area instructions i1267 of FIG. 45, can be used in performance of the outputting targeting area electrical circuitry arrangement e1267 of FIG. 38, and/or can be used in otherwise fulfillment of the operation o1267. An exemplary non-transitory signal bearing medium version of the information storage subsystem s200 is depicted in FIG. 45 as bearing the one or more outputting targeting area instructions i1267 that when executed will direct performance of the operation o1267. Furthermore, the outputting targeting area electrical circuitry arrangement ("elec circ arrange") e1267, when activated, will perform the operation o1267. Also, the outputting targeting area module m1267, when executed and/or activated, will direct performance of and/or perform the operation o1267. For instance, in one or more exemplary implementations, the one or more outputting targeting area instructions i1267, when executed, direct performance of the operation o1267 in the illustrative depiction as follows, and/or the outputting targeting area electrical circuitry arrangement e1267, when activated, performs the operation o1267 in the illustrative depiction as follows, and/or the outputting targeting area module m1267, when executed and/or activated, directs performance of and/or performs the operation o1267 in the illustrative depiction as follows, and/or the operation o1267 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including processor generated information, etc.) at one or more locations (e.g. inclusive to one or more identified persons, etc.) spaced (e.g. less than a distance from a display screen to an ear, etc.) from said portable electronic device (e.g. including one or more laptop components, etc.) based at least in part according to (e.g. based in part according to one or more partials, etc.) the said one or more acoustic ultrasonic signals (e.g. via one or more acoustic ultrasonic signals including signals having one or more frequencies above 100 kHz, etc.) and based at least in part according to (e.g. based in part according to one or more partials, etc.) one or more portable electronic device ultrasonic emitter arrangements (e.g. including one or more device perimeter embedded transducer arrangements, etc.) including determination of targeting area based in part on one or more frequencies of said one or more ultrasonic acoustic signals (e.g. where frequency determines wavelength to influence aperture dimensions and consequential targeting size, etc.).

In one or more implementations, as shown in FIG. 90, operation o12 includes an operation o1268 for electronically outputting, said one or more acoustic ultrasonic signals to be demodulated into one or more acoustic audio signals containing one or more portions of said audio output information at one or more locations spaced from said portable electronic device based at least in part according to the said one or more acoustic ultrasonic signals and based at least in part according to one or more portable electronic device ultrasonic emitter arrangements including transducer placement based in part on one or more frequencies to be used for said one or more acoustic ultrasonic signals. Origination of an illustratively derived outputting transducer placement component group can be accomplished through skilled in the art design choice selection of one or more of the above depicted components from one or more of the above depicted subsystems shown in FIG. 25. Components from the outputting transducer placement component group can be used in implementing execution of the one or more outputting transducer placement instructions i1268 of FIG. 45, can be used in performance of the outputting transducer placement electrical circuitry arrangement e1268 of FIG. 38, and/or can be used in otherwise fulfillment of the operation o1268. An exemplary non-transitory signal bearing medium version of the information storage subsystem s200 is depicted in FIG. 45 as bearing the one or more outputting transducer placement instructions i1268 that when executed will direct performance of the operation o1268. Furthermore, the outputting transducer placement electrical circuitry arrangement ("elec circ arrange") e1268, when activated, will perform the operation o1268. Also, the outputting transducer placement module m1268, when executed and/or activated, will direct performance of and/or perform the operation o1268. For instance, in one or more exemplary implementations, the one or more outputting transducer placement instructions i1268, when executed, direct performance of the operation o1268 in the illustrative depiction as follows, and/or the outputting transducer placement electrical circuitry arrangement e1268, when activated, performs the operation o1268 in the illustrative depiction as follows, and/or the outputting transducer placement module m1268, when executed and/or activated, directs performance of and/or performs the operation o1268 in the illustrative depiction as follows, and/or the operation o1268 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including internet based information, etc.) at one or more locations (e.g. inclusive to one or more predetermined ears, etc.) spaced (e.g. less than a distance from a portable device to a center of a group, etc.) from said portable electronic device (e.g. including one or more tablet computer components, etc.) based at least in part according to (e.g. based in part according to one or more pieces, etc.) the said one or more acoustic ultrasonic signals (e.g. via one or more acoustic ultrasonic signals including signals having one or more frequencies above 120 kHz, etc.) and based at least in part according to (e.g. based in part according to one or more pieces, etc.) one or more portable electronic device ultrasonic emitter arrangements (e.g. including one or more multiple emitter array arrangements, etc.) including transducer placement based in part on one or more frequencies to be used for said one or more acoustic ultrasonic signals (e.g. where transducer size allows for placement along bezels of the portable device, etc.).

In one or more implementations, as shown in FIG. 90, operation o12 includes an operation o1269 for electronically outputting, said one or more acoustic ultrasonic signals to be demodulated into one or more acoustic audio signals containing one or more portions of said audio output information at one or more locations spaced from said portable electronic device based at least in part according to the said one or more acoustic ultrasonic signals and based at least in part according to one or more portable electronic device ultrasonic emitter arrangements including amplitude to be used for said ultrasonic acoustic signals based on size of desired target area. Origination of an illustratively derived outputting amplitude size component group can be accomplished through skilled in the art design choice selection of one or more of the above depicted components from one or more of the above depicted subsystems shown in FIG. 25. Components from the outputting amplitude size component group can be used in implementing execution of the one or more outputting amplitude size instructions i1269 of FIG. 45, can be used in performance of the outputting amplitude size electrical circuitry arrangement e1269 of FIG. 38, and/or can be used in otherwise fulfillment of the operation o1269. An exemplary non-transitory signal bearing medium version of the information storage subsystem s200 is depicted in FIG. 45 as bearing the one or more outputting amplitude size instructions i1269 that when executed will direct performance of the operation o1269. Furthermore, the outputting amplitude size electrical circuitry arrangement ("elec circ arrange") e1269, when activated, will perform the operation o1269. Also, the outputting amplitude size module m1269, when executed and/or activated, will direct performance of and/or perform the operation o1269. For instance, in one or more exemplary implementations, the one or more outputting amplitude size instructions i1269, when executed, direct performance of the operation o1269 in the illustrative depiction as follows, and/or the outputting amplitude size electrical circuitry arrangement e1269, when activated, performs the operation o1269 in the illustrative depiction as follows, and/or the outputting amplitude size module m1269, when executed and/or activated, directs performance of and/or performs the operation o1269 in the illustrative depiction as follows, and/or the operation o1269 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including digital audio information, etc.) at one or more locations (e.g. inclusive to one or more desired groups of people, etc.) spaced (e.g. less than a distance from a display screen to a center of a group, etc.) from said portable electronic device (e.g. including one or more mp3 player components, etc.) based at least in part according to (e.g. based in part according to one or more completions, etc.) the said one or more acoustic ultrasonic signals (e.g. via one or more acoustic ultrasonic signals including signals having one or more frequencies above 140 kHz, etc.) and based at least in part according to (e.g. based in part according to one or more completions, etc.) one or more portable electronic device ultrasonic emitter arrangements (e.g. including one or more perimeter arrays, etc.) including amplitude to be used for said ultrasonic acoustic signals based on size of desired target area (e.g. where target size of approximate ear size allows for low level amplitude for acoustic audio signals down converted from acoustic ultrasonic signals, etc.).

Figure 91:
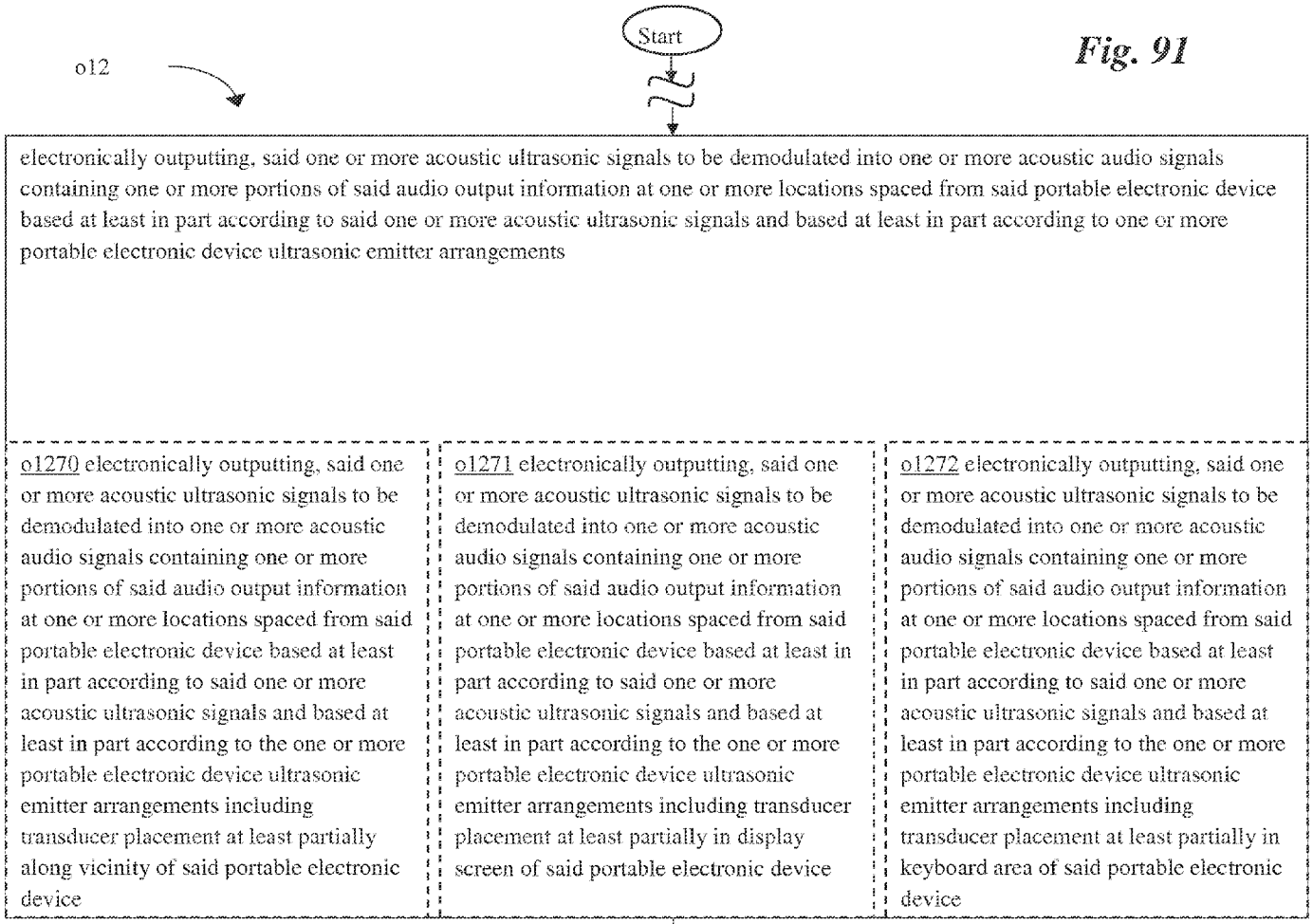
FIG. 91 is a high-level flowchart including exemplary implementations of operation o12 of FIG. 53.

In one or more implementations, as shown in FIG. 91, operation o12 includes an operation o1270 for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to the one or more portable electronic device ultrasonic emitter arrangements including transducer placement at least partially along vicinity of said portable electronic device. Origination of an illustratively derived outputting along vicinity component group can be accomplished through skilled in the art design choice selection of one or more of the above depicted components from one or more of the above depicted subsystems shown in FIG. 25. Components from the outputting along vicinity component group can be used in implementing execution of the one or more outputting along vicinity instructions i1270 of FIG. 45, can be used in performance of the outputting along vicinity electrical circuitry arrangement e1270 of FIG. 38, and/or can be used in otherwise fulfillment of the operation o1270. An exemplary non-transitory signal bearing medium version of the information storage subsystem s200 is depicted in FIG. 45 as bearing the one or more outputting along vicinity instructions i1270 that when executed will direct performance of the operation o1270. Furthermore, the outputting along vicinity electrical circuitry arrangement ("elec circ arrange") e1270, when activated, will perform the operation o1270. Also, the outputting along vicinity module m1270, when executed and/or activated, will direct performance of and/or perform the operation o1270. For instance, in one or more exemplary implementations, the one or more outputting along vicinity instructions i1270, when executed, direct performance of the operation o1270 in the illustrative depiction as follows, and/or the outputting along vicinity electrical circuitry arrangement e1270, when activated, performs the operation o1270 in the illustrative depiction as follows, and/or the outputting along vicinity module m1270, when executed and/or activated, directs performance of and/or performs the operation o1270 in the illustrative depiction as follows, and/or the operation o1270 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including analog audio information, etc.) at one or more locations (e.g. inclusive to one or more chosen audio receivers, etc.) spaced (e.g. less than a distance from a transmitter to a receiver, etc.) from said portable electronic device (e.g. including one or more mobile phone components, etc.) based at least in part according to (e.g. based in part according to full coverage, etc.) said one or more acoustic ultrasonic signals (e.g. via one or more acoustic ultrasonic signals including signals having one or more frequencies above 160 kHz, etc.) and based at least in part according to (e.g. based in part according to full coverage, etc.) the one or more portable electronic device ultrasonic emitter arrangements (e.g. including one or more polar arrays, etc.) including transducer placement at least partially along vicinity of said portable electronic device (e.g. including transducer placement interspaced between keyboard keys, etc.).

In one or more implementations, as shown in FIG. 91, operation o12 includes an operation o1271 for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to the one or more portable electronic device ultrasonic emitter arrangements including transducer placement at least partially in display screen of said portable electronic device. Origination of an illustratively derived outputting display screen component group can be accomplished through skilled in the art design choice selection of one or more of the above depicted components from one or more of the above depicted subsystems shown in FIG. 25. Components from the outputting display screen component group can be used in implementing execution of the one or more outputting display screen instructions i1271 of FIG. 45, can be used in performance of the outputting display screen electrical circuitry arrangement e1271 of FIG. 38, and/or can be used in otherwise fulfillment of the operation o1271. An exemplary non-transitory signal bearing medium version of the information storage subsystem s200 is depicted in FIG. 45 as bearing the one or more outputting display screen instructions i1271 that when executed will direct performance of the operation o1271. Furthermore, the outputting display screen electrical circuitry arrangement ("elec circ arrange") e1271, when activated, will perform the operation o1271. Also, the outputting display screen module m1271, when executed and/or activated, will direct performance of and/or perform the operation o1271. For instance, in one or more exemplary implementations, the one or more outputting display screen instructions i1271, when executed, direct performance of the operation o1271 in the illustrative depiction as follows, and/or the outputting display screen electrical circuitry arrangement e1271, when activated, performs the operation o1271 in the illustrative depiction as follows, and/or the outputting display screen module m1271, when executed and/or activated, directs performance of and/or performs the operation o1271 in the illustrative depiction as follows, and/or the operation o1271 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including high frequency audio information, etc.) at one or more locations (e.g. inclusive to one or more selected microphones, etc.) spaced (e.g. less than a distance from a first seat back to a second seat back, etc.) from said portable electronic device (e.g. including one or more two-way radio components, etc.) based at least in part according to (e.g. based according to all, etc.) said one or more acoustic ultrasonic signals (e.g. via one or more acoustic ultrasonic signals including signals having one or more frequencies above 180 kHz, etc.) and based at least in part according to (e.g. based according to all, etc.) the one or more portable electronic device ultrasonic emitter arrangements (e.g. including one or more orthographic arrays, etc.) including transducer placement at least partially in display screen of said portable electronic device (e.g. including transducer placement behind portions of thin displays, etc.).

In one or more implementations, as shown in FIG. 91, operation o12 includes an operation o1272 for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to the one or more portable electronic device ultrasonic emitter arrangements including transducer placement at least partially in keyboard area of said portable electronic device. Origination of an illustratively derived outputting keyboard area component group can be accomplished through skilled in the art design choice selection of one or more of the above depicted components from one or more of the above depicted subsystems shown in FIG. 25. Components from the outputting keyboard area component group can be used in implementing execution of the one or more outputting keyboard area instructions i1272 of FIG. 45, can be used in performance of the outputting keyboard area electrical circuitry arrangement e1272 of FIG. 38, and/or can be used in otherwise fulfillment of the operation o1272. An exemplary non-transitory signal bearing medium version of the information storage subsystem s200 is depicted in FIG. 45 as bearing the one or more outputting keyboard area instructions i1272 that when executed will direct performance of the operation o1272. Furthermore, the outputting keyboard area electrical circuitry arrangement ("elec circ arrange") e1272, when activated, will perform the operation o1272. Also, the outputting keyboard area module m1272, when executed and/or activated, will direct performance of and/or perform the operation o1272. For instance, in one or more exemplary implementations, the one or more outputting keyboard area instructions i1272, when executed, direct performance of the operation o1272 in the illustrative depiction as follows, and/or the outputting keyboard area electrical circuitry arrangement e1272, when activated, performs the operation o1272 in the illustrative depiction as follows, and/or the outputting keyboard area module m1272, when executed and/or activated, directs performance of and/or performs the operation o1272 in the illustrative depiction as follows, and/or the operation o1272 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including low frequency audio information, etc.) at one or more locations (e.g. inclusive to one or more designated surfaces, etc.) spaced (e.g. less than a distance from a seat back to a tray table, etc.) from said portable electronic device (e.g. including one or more security network components, etc.) based at least in part according to (e.g. based according to some, etc.) said one or more acoustic ultrasonic signals (e.g. via one or more acoustic ultrasonic signals including signals having one or more frequencies above 200 kHz, etc.) and based at least in part according to (e.g. based according to some, etc.) the one or more portable electronic device ultrasonic emitter arrangements (e.g. including one or more three-dimensional arrays, etc.) including transducer placement at least partially in keyboard area of said portable electronic device (e.g. including transducer placement along key spacing of keyboards, etc.).

Figure 92:
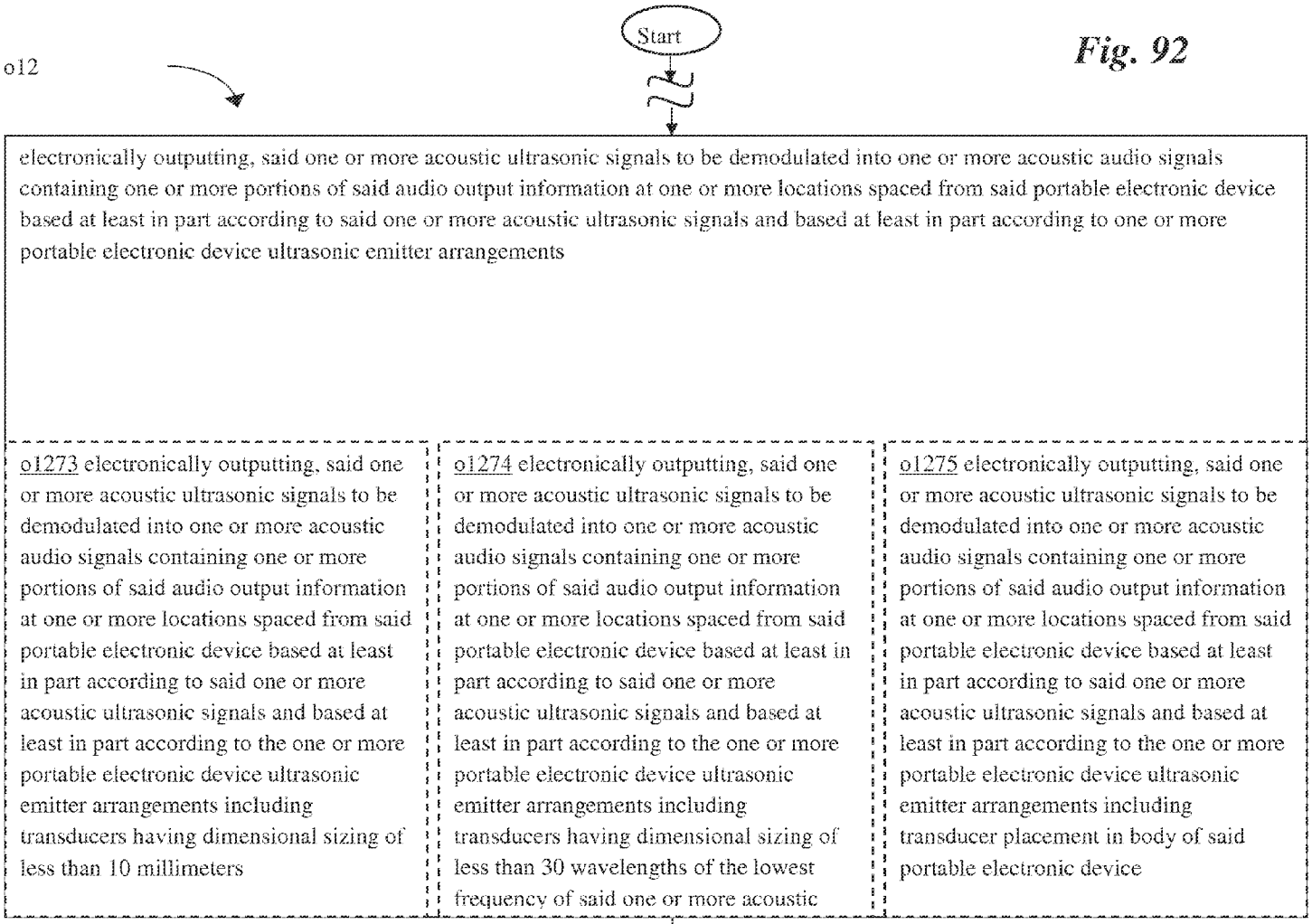
FIG. 92 is a high-level flowchart including exemplary implementations of operation o12 of FIG. 53.

In one or more implementations, as shown in FIG. 92, operation o12 includes an operation o1273 for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to the one or more portable electronic device ultrasonic emitter arrangements including transducers having dimensional sizing of less than 10 millimeters. Origination of an illustratively derived outputting dimensional sizing component group can be accomplished through skilled in the art design choice selection of one or more of the above depicted components from one or more of the above depicted subsystems shown in FIG. 25. Components from the outputting dimensional sizing component group can be used in implementing execution of the one or more outputting dimensional sizing instructions i1273 of FIG. 45, can be used in performance of the outputting dimensional sizing electrical circuitry arrangement e1273 of FIG. 38, and/or can be used in otherwise fulfillment of the operation o1273. An exemplary non-transitory signal bearing medium version of the information storage subsystem s200 is depicted in FIG. 45 as bearing the one or more outputting dimensional sizing instructions i1273 that when executed will direct performance of the operation o1273. Furthermore, the outputting dimensional sizing electrical circuitry arrangement ("elec circ arrange") e1273, when activated, will perform the operation o1273. Also, the outputting dimensional sizing module m1273, when executed and/or activated, will direct performance of and/or perform the operation o1273. For instance, in one or more exemplary implementations, the one or more outputting dimensional sizing instructions i1273, when executed, direct performance of the operation o1273 in the illustrative depiction as follows, and/or the outputting dimensional sizing electrical circuitry arrangement e1273, when activated, performs the operation o1273 in the illustrative depiction as follows, and/or the outputting dimensional sizing module m1273, when executed and/or activated, directs performance of and/or performs the operation o1273 in the illustrative depiction as follows, and/or the operation o1273 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including lecture formatted information, etc.) at one or more locations (e.g. inclusive to one or more identified objects, etc.) spaced (e.g. less than a distance of an aisle way, etc.) from said portable electronic device (e.g. including one or more netbook components, etc.) based at least in part according to (e.g. based according to an entirety, etc.) said one or more acoustic ultrasonic signals (e.g. via multiple acoustic ultrasonic signals configured to be demodulated through mutual interference therewith to at least in part result in one or more acoustic audio signals, etc.) and based at least in part according to (e.g. based according to an entirety, etc.) the one or more portable electronic device ultrasonic emitter arrangements (e.g. including one or more scattered arrangements, etc.) including transducers having dimensional sizing of less than 10 millimeters (e.g. including transducer sizing of approximately 1 mm, etc.).

In one or more implementations, as shown in FIG. 92, operation o12 includes an operation o1274 for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to the one or more portable electronic device ultrasonic emitter arrangements including transducers having dimensional sizing of less than 30 wavelengths of the lowest frequency of said one or more acoustic ultrasonic signals. Origination of an illustratively derived outputting wavelengths of the lowest component group can be accomplished through skilled in the art design choice selection of one or more of the above depicted components from one or more of the above depicted subsystems shown in FIG. 25. Components from the outputting wavelengths of the lowest component group can be used in implementing execution of the one or more outputting wavelengths of the lowest instructions i1274 of FIG. 45, can be used in performance of the outputting wavelengths of the lowest electrical circuitry arrangement e1274 of FIG. 38, and/or can be used in otherwise fulfillment of the operation o1274. An exemplary non-transitory signal bearing medium version of the information storage subsystem s200 is depicted in FIG. 45 as bearing the one or more outputting wavelengths of the lowest instructions i1274 that when executed will direct performance of the operation o1274. Furthermore, the outputting wavelengths of the lowest electrical circuitry arrangement ("elec circ arrange") e1274, when activated, will perform the operation o1274. Also, the outputting wavelengths of the lowest module m1274, when executed and/or activated, will direct performance of and/or perform the operation o1274. For instance, in one or more exemplary implementations, the one or more outputting wavelengths of the lowest instructions i1274, when executed, direct performance of the operation o1274 in the illustrative depiction as follows, and/or the outputting wavelengths of the lowest electrical circuitry arrangement e1274, when activated, performs the operation o1274 in the illustrative depiction as follows, and/or the outputting wavelengths of the lowest module m1274, when executed and/or activated, directs performance of and/or performs the operation o1274 in the illustrative depiction as follows, and/or the operation o1274 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including foreign language speech information, etc.) at one or more locations (e.g. inclusive to one or more predetermined locations, etc.) spaced (e.g. less than a distance from a desk to a chair, etc.) from said portable electronic device (e.g. including one or more ultrabook components, etc.) based at least in part according to (e.g. based according to one or more portions, etc.) said one or more acoustic ultrasonic signals (e.g. via one or more acoustic ultrasonic signals configured to be demodulated through nonlinear atmospheric interaction to at least in part generate one or more acoustic audio signals, etc.) and based at least in part according to (e.g. based according to one or more portions, etc.) the one or more portable electronic device ultrasonic emitter arrangements (e.g. including one or more staggered arrays, etc.) including transducers having dimensional sizing of less than 30 wavelengths of the lowest frequency of said one or more acoustic ultrasonic signals (e.g. including transducer sizing of less than 1 mm, etc.).

In one or more implementations, as shown in FIG. 92, operation o12 includes an operation o1275 for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to the one or more portable electronic device ultrasonic emitter arrangements including transducer placement in body of said portable electronic device. Origination of an illustratively derived outputting placement in body component group can be accomplished through skilled in the art design choice selection of one or more of the above depicted components from one or more of the above depicted subsystems shown in FIG. 25. Components from the outputting placement in body component group can be used in implementing execution of the one or more outputting placement in body instructions i1275 of FIG. 45, can be used in performance of the outputting placement in body electrical circuitry arrangement e1275 of FIG. 38, and/or can be used in otherwise fulfillment of the operation o1275. An exemplary non-transitory signal bearing medium version of the information storage subsystem s200 is depicted in FIG. 45 as bearing the one or more outputting placement in body instructions i1275 that when executed will direct performance of the operation o1275. Furthermore, the outputting placement in body electrical circuitry arrangement ("elec circ arrange") e1275, when activated, will perform the operation o1275. Also, the outputting placement in body module m1275, when executed and/or activated, will direct performance of and/or perform the operation o1275. For instance, in one or more exemplary implementations, the one or more outputting placement in body instructions i1275, when executed, direct performance of the operation o1275 in the illustrative depiction as follows, and/or the outputting placement in body electrical circuitry arrangement e1275, when activated, performs the operation o1275 in the illustrative depiction as follows, and/or the outputting placement in body module m1275, when executed and/or activated, directs performance of and/or performs the operation o1275 in the illustrative depiction as follows, and/or the operation o1275 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including classical music selection information, etc.) at one or more locations (e.g. inclusive to one or more desired environments, etc.) spaced (e.g. less than a distance from a dashboard to a headrest, etc.) from said portable electronic device (e.g. including one or more flip-phone components, etc.) based at least in part according to (e.g. based according to one or more sections, etc.) said one or more acoustic ultrasonic signals (e.g. via one or more acoustic ultrasonic signals configured to be demodulated through nonlinear human tissue interaction to at least in part produce one or more acoustic audio signals, etc.) and based at least in part according to (e.g. based according to one or more sections, etc.) the one or more portable electronic device ultrasonic emitter arrangements (e.g. including one or more linear arrangements, etc.) including transducer placement in body of said portable electronic device (e.g. including transducer placement within the user interface of the portable electronic device, etc.).

Figure 93:
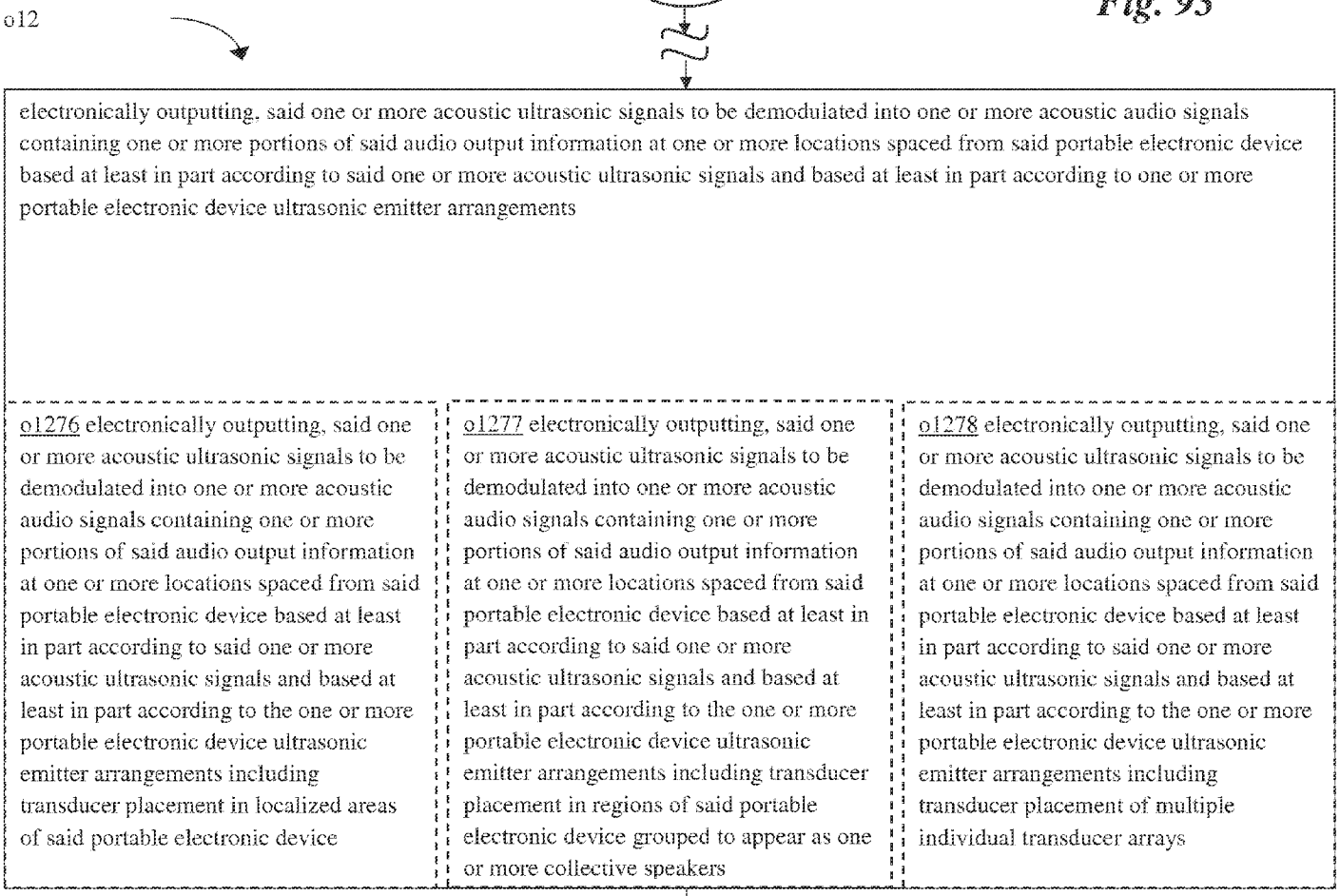
FIG. 93 is a high-level flowchart including exemplary implementations of operation o12 of FIG. 53.

In one or more implementations, as shown in FIG. 93, operation o12 includes an operation o1276 for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to the one or more portable electronic device ultrasonic emitter arrangements including transducer placement in localized areas of said portable electronic device. Origination of an illustratively derived outputting localized areas component group can be accomplished through skilled in the art design choice selection of one or more of the above depicted components from one or more of the above depicted subsystems shown in FIG. 25. Components from the outputting localized areas component group can be used in implementing execution of the one or more outputting localized areas instructions i1276 of FIG. 45, can be used in performance of the outputting localized areas electrical circuitry arrangement e1276 of FIG. 38, and/or can be used in otherwise fulfillment of the operation o1276. An exemplary non-transitory signal bearing medium version of the information storage subsystem s200 is depicted in FIG. 45 as bearing the one or more outputting localized areas instructions i1276 that when executed will direct performance of the operation o1276. Furthermore, the outputting localized areas electrical circuitry arrangement ("elec circ arrange") e1276, when activated, will perform the operation o1276. Also, the outputting localized areas module m1276, when executed and/or activated, will direct performance of and/or perform the operation o1276. For instance, in one or more exemplary implementations, the one or more outputting localized areas instructions i1276, when executed, direct performance of the operation o1276 in the illustrative depiction as follows, and/or the outputting localized areas electrical circuitry arrangement e1276, when activated, performs the operation o1276 in the illustrative depiction as follows, and/or the outputting localized areas module m1276, when executed and/or activated, directs performance of and/or performs the operation o1276 in the illustrative depiction as follows, and/or the operation o1276 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including instructional lesson material information, etc.) at one or more locations (e.g. inclusive to one or more chosen distances, etc.) spaced (e.g. more than confines of a room, etc.) from said portable electronic device (e.g. including one or more portable computer components, etc.) based at least in part according to (e.g. based according to one or more assemblies, etc.) said one or more acoustic ultrasonic signals (e.g. via one or more acoustic ultrasonic signals configured to be demodulated through nonlinear polymeric interaction to at least in part result in one or more acoustic audio signals, etc.) and based at least in part according to (e.g. based according to one or more assemblies, etc.) the one or more portable electronic device ultrasonic emitter arrangements (e.g. including one or more parabolic arrangements, etc.) including transducer placement in localized areas of said portable electronic device (e.g. including placement within speaker like shaped arrays of transducers, etc.).

In one or more implementations, as shown in FIG. 93, operation o12 includes an operation o1277 for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to the one or more portable electronic device ultrasonic emitter arrangements including transducer placement in regions of said portable electronic device grouped to appear as one or more collective speakers. Origination of an illustratively derived outputting collective speakers component group can be accomplished through skilled in the art design choice selection of one or more of the above depicted components from one or more of the above depicted subsystems shown in FIG. 25. Components from the outputting collective speakers component group can be used in implementing execution of the one or more outputting collective speakers instructions i1277 of FIG. 45, can be used in performance of the outputting collective speakers electrical circuitry arrangement e1277 of FIG. 38, and/or can be used in otherwise fulfillment of the operation o1277. An exemplary non-transitory signal bearing medium version of the information storage subsystem s200 is depicted in FIG. 45 as bearing the one or more outputting collective speakers instructions i1277 that when executed will direct performance of the operation o1277. Furthermore, the outputting collective speakers electrical circuitry arrangement ("elec circ arrange") e1277, when activated, will perform the operation o1277. Also, the outputting collective speakers module m1277, when executed and/or activated, will direct performance of and/or perform the operation o1277. For instance, in one or more exemplary implementations, the one or more outputting collective speakers instructions i1277, when executed, direct performance of the operation o1277 in the illustrative depiction as follows, and/or the outputting collective speakers electrical circuitry arrangement e1277, when activated, performs the operation o1277 in the illustrative depiction as follows, and/or the outputting collective speakers module m1277, when executed and/or activated, directs performance of and/or performs the operation o1277 in the illustrative depiction as follows, and/or the operation o1277 is otherwise carried out in the illustrative depiction as follows: electronically outputting, (e.g. through emitter array, via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including warning tone information, etc.) at one or more locations (e.g. inclusive to one or more selected ranges, etc.) spaced (e.g. more than an arm's length, etc.) from said portable electronic device (e.g. including one or more boombox components, etc.) based at least in part according to (e.g. based according to one or more partials, etc.) said one or more acoustic ultrasonic signals (e.g. via one or more acoustic ultrasonic signals configured to be demodulated through nonlinear apparel interaction to at least in part produce one or more acoustic audio signals, etc.) and based at least in part according to (e.g. based according to one or more partials, etc.) the one or more portable electronic device ultrasonic emitter arrangements (e.g. including one or more hyperbolic arrangements, etc.) including transducer placement in regions of said portable electronic device grouped to appear as one or more collective speakers (e.g. including placement within arrays of transducers, etc.).

In one or more implementations, as shown in FIG. 93, operation o12 includes an operation o1278 for electronically outputting, said one or more acoustic ultrasonic signals to be demodulated into one or more acoustic audio signals containing one or more portions of said audio output information at one or more locations spaced from said portable electronic device based at least in part according to said one or more acoustic ultrasonic signals and based at least in part according to the one or more portable electronic device ultrasonic emitter arrangements including transducer placement of multiple individual transducer arrays. Origination of an illustratively derived outputting multiple arrays component group can be accomplished through skilled in the art design choice selection of one or more of the above depicted components from one or more of the above depicted subsystems shown in FIG. 25. Components from the outputting multiple arrays component group can be used in implementing execution of the one or more outputting multiple arrays instructions i1278 of FIG. 45, can be used in performance of the outputting multiple arrays electrical circuitry arrangement e1278 of FIG. 38, and/or can be used in otherwise fulfillment of the operation o1278. An exemplary non-transitory signal bearing medium version of the information storage subsystem s200 is depicted in FIG. 45 as bearing the one or more outputting multiple arrays instructions i1278 that when executed will direct performance of the operation o1278. Furthermore, the outputting multiple arrays electrical circuitry arrangement ("elec circ arrange") e1278, when activated, will perform the operation o1278. Also, the outputting multiple arrays module m1278, when executed and/or activated, will direct performance of and/or perform the operation o1278. For instance, in one or more exemplary implementations, the one or more outputting multiple arrays instructions i1278, when executed, direct performance of the operation o1278 in the illustrative depiction as follows, and/or the outputting multiple arrays electrical circuitry arrangement e1278, when activated, performs the operation o1278 in the illustrative depiction as follows, and/or the outputting multiple arrays module m1278, when executed and/or activated, directs performance of and/or performs the operation o1278 in the illustrative depiction as follows, and/or the operation o1278 is otherwise carried out in the illustrative depiction as follows: electronically outputting, (e.g. via one or more multiple emitter array portions, etc.) said one or more acoustic ultrasonic signals (e.g. via one or more acoustic ultrasonic signals including signals having one or more frequencies above 200 kHz, etc.) to be demodulated (e.g. including at least in part demodulation by signal down conversion, etc.) into one or more acoustic audio signals (e.g. including one or more low frequency acoustic audio signals, etc.) containing one or more portions (e.g. including containing beginning portions, etc.) of said audio output information (e.g. including white noise information, etc.) at one or more locations (e.g. inclusive to one or more designated directions, etc.) spaced (e.g. more than a three foot radius, etc.) from said portable electronic device (e.g. including one or more digital audio output components, etc.) based at least in part according to (e.g. based according to one or more pieces, etc.) said one or more acoustic ultrasonic signals (e.g. via one or more acoustic ultrasonic signals configured to be demodulated through nonlinear interaction with one or more solids to at least in part generate one or more acoustic audio signals, etc.) and based at least in part according to (e.g. based according to one or more pieces, etc.) the one or more portable electronic device ultrasonic emitter arrangements (e.g. including one or more enclosed arrangements, etc.) including transducer placement of multiple individual transducer arrays (e.g. including placement in arrays regarding down conversion interaction between ultrasonic beams from more than one array, etc.).

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The one or more instructions discussed herein may be, for example, computer executable and/or logic-implemented instructions. In some implementations, signal-bearing medium as articles of manufacture may store the one or more instructions. In some implementations, the signal bearing medium may include a computer-readable medium. In some implementations, the signal-bearing medium may include a recordable medium. In some implementations, the signal-bearing medium may include a communication medium.

Those having skill in the art will recognize that the state of the art has progressed to the point where there is little distinction left between hardware and software implementations of aspects of systems; the use of hardware or software is generally (but not always, in that in certain contexts the choice between hardware an d software can become significant) a design choice representing cost vs. efficiency tradeoffs. Those having skill in the art will appreciate that there are various vehicles by which processes and/or systems and/or other technologies described herein can be effected (e.g., hardware, software, and/or firmware in one or more machines or articles of manufacture), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation that is implemented in one or more machines or articles of manufacture; or, yet again alternatively, the implementer may opt for some combination of hardware, software, and/or firmware in one or more machines or articles of manufacture (limited to patentable subject matter under 35 USC 101). Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations will typically employ optically-oriented hardware, software, and or firmware in one or more machines or articles of manufacture.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof (limited to patentable subject matter under 35 U.S.C. 101). In one embodiment, several portions of the subject matter described herein may be implemented via Application Specific Integrated Circuitry (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuitry, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure (limited to patentable subject matter under 35 USC 101). In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, (e.g., transmitter, receiver, transmission logic, reception logic, etc.), etc.).

Electro-mechanical System Support

In a general sense, those skilled in the art will recognize that the various embodiments described herein can be implemented, individually and/or collectively, by various types of electro-mechanical systems having a wide range of electrical components such as hardware, software, firmware, and/or virtually any combination thereof; and a wide range of components that may impart mechanical force or motion such as rigid bodies, spring or torsional bodies, hydraulics, electro-magnetically actuated devices, and/or virtually any combination thereof. Consequently, as used herein "electro-mechanical system" includes, but is not limited to, electrical circuitry operably coupled with a transducer (e.g., an actuator, a motor, a piezoelectric crystal, a Micro Electro Mechanical System (MEMS), etc.), electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), electrical circuitry forming a communications device (e.g., a modem, communications switch, optical-electrical equipment, etc.), and/or any non-electrical analog thereto, such as optical or other analogs (e.g., graphene based circuitry). Those skilled in the art will also appreciate that examples of electro-mechanical systems include but are not limited to a variety of consumer electronics systems, medical devices, as well as other systems such as motorized transport systems, factory automation systems, security systems, and/or communication/computing systems. Those skilled in the art will recognize that electro-mechanical as used herein is not necessarily limited to a system that has both electrical and mechanical actuation except as context may dictate otherwise.

Electrical Circuitry Support

In a general sense, those skilled in the art will recognize that the various aspects described herein which can be implemented, individually and/or collectively, by a wide range of hardware, software, firmware, and/or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), and/or electrical circuitry forming a communications device (e.g., a modem, communications switch, optical-electrical equipment, etc.). Those having skill in the art will recognize that the subject matter described herein may be implemented in an analog or digital fashion or some combination thereof.

Image Processing System Support

Those skilled in the art will recognize that at least a portion of the devices and/or processes described herein can be integrated into an image processing system. Those having skill in the art will recognize that a typical image processing system generally includes one or more of a system unit housing, a video display device, memory such as volatile or non-volatile memory, processors such as microprocessors or digital signal processors, computational entities such as operating systems, drivers, applications programs, one or more interaction devices (e.g., a touch pad, a touch screen, an antenna, etc.), control systems including feedback loops and control motors (e.g., feedback for sensing lens position and/or velocity; control motors for moving/distorting lenses to give desired focuses). An image processing system may be implemented utilizing suitable commercially available components, such as those typically found in digital still systems and/or digital motion systems.

Data Processing System Support

Those skilled in the art will recognize that at least a portion of the devices and/or processes described herein can be integrated into a data processing system. Those having skill in the art will recognize that a data processing system generally includes one or more of a system unit housing, a video display device, memory such as volatile or non-volatile memory, processors such as microprocessors or digital signal processors, computational entities such as operating systems, drivers, graphical user interfaces, and applications programs, one or more interaction devices (e.g., a touch pad, a touch screen, an antenna, etc.), and/or control systems including feedback loops and control motors (e.g., feedback for sensing position and/or velocity; control motors for moving and/or adjusting components and/or quantities). A data processing system may be implemented utilizing suitable commercially available components, such as those typically found in data computing/communication and/or network computing/communication systems.

Software as Patentable Subject Matter Support

The claims, description, and drawings of this application may describe one or more of the instant technologies in operational/functional language, for example as a set of operations to be performed by a computer. Such operational/functional description in most instances would be understood by one skilled the art as specifically-configured hardware (e.g., because a general purpose computer in effect becomes a special purpose computer once it is programmed to perform particular functions pursuant to instructions from program software).

Importantly, although the operational/functional descriptions described herein are understandable by the human mind, they are not abstract ideas of the operations/functions divorced from computational implementation of those operations/functions. Rather, the operations/functions represent a specification for the massively complex computational machines or other means. As discussed in detail below, the operational/functional language must be read in its proper technological context, i.e., as concrete specifications for physical implementations.

The logical operations/functions described herein are a distillation of machine specifications or other physical mechanisms specified by the operations/functions such that the otherwise inscrutable machine specifications may be comprehensible to the human mind. The distillation also allows one of skill in the art to adapt the operational/functional description of the technology across many different specific vendors' hardware configurations or platforms, without being limited to specific vendors' hardware configurations or platforms.

Some of the present technical description (e.g., detailed description, drawings, claims, etc.) may be set forth in terms of logical operations/functions. As described in more detail in the following paragraphs, these logical operations/functions are not representations of abstract ideas, but rather representative of static or sequenced specifications of various hardware elements. Differently stated, unless context dictates otherwise, the logical operations/functions will be understood by those of skill in the art to be representative of static or sequenced specifications of various hardware elements. This is true because tools available to one of skill in the art to implement technical disclosures set forth in operational/functional formats—tools in the form of a high-level programming language (e.g., C, java, visual basic), etc.), or tools in the form of Very high speed Hardware Description Language ("VHDL," which is a language that uses text to describe logic circuits)—are generators of static or sequenced specifications of various hardware configurations. This fact is sometimes obscured by the broad term "software," but, as shown by the following explanation, those skilled in the art understand that what is termed "software" is a shorthand for a massively complex interchaining/specification of ordered-matter elements. The term "ordered-matter elements" may refer to physical components of computation, such as assemblies of electronic logic gates, molecular computing logic constituents, quantum computing mechanisms, etc.

For example, a high-level programming language is a programming language with strong abstraction, e.g., multiple levels of abstraction, from the details of the sequential organizations, states, inputs, outputs, etc., of the machines that a high-level programming language actually specifies. See, e.g., Wikipedia, High-level programming language, http://en.wikipedia.org/wiki/High-level_programming_language (as of Jun. 5, 2012, 21:00 GMT). In order to facilitate human comprehension, in many instances, high-level programming languages resemble or even share symbols with natural languages. See, e.g., Wikipedia, Natural language, http://en.wikipedia.org/wiki/Natural_language (as of Jun. 5, 2012, 21:00 GMT).

It has been argued that because high-level programming languages use strong abstraction (e.g., that they may resemble or share symbols with natural languages), they are therefore a "purely mental construct." (e.g., that "software"—a computer program or computer programming—is somehow an ineffable mental construct, because at a high level of abstraction, it can be conceived and understood in the human mind). This argument has been used to characterize technical description in the form of functions/operations as somehow "abstract ideas." In fact, in technological arts (e.g., the information and communication technologies) this is not true.

The fact that high-level programming languages use strong abstraction to facilitate human understanding should not be taken as an indication that what is expressed is an abstract idea. In fact, those skilled in the art understand that just the opposite is true. If a high-level programming language is the tool used to implement a technical disclosure in the form of functions/operations, those skilled in the art will recognize that, far from being abstract, imprecise, "fuzzy," or "mental" in any significant semantic sense, such a tool is instead a near incomprehensibly precise sequential specification of specific computational machines—the parts of which are built up by activating/selecting such parts from typically more general computational machines over time (e.g., clocked time). This fact is sometimes obscured by the superficial similarities between high-level programming languages and natural languages. These superficial similarities also may cause a glossing over of the fact that high-level programming language implementations ultimately perform valuable work by creating/controlling many different computational machines.

The many different computational machines that a high-level programming language specifies are almost unimaginably complex. At base, the hardware used in the computational machines typically consists of some type of ordered matter (e.g., traditional electronic devices (e.g., transistors), deoxyribonucleic acid (DNA), quantum devices, mechanical switches, optics, fluidics, pneumatics, optical devices (e.g., optical interference devices), molecules, etc.) that are arranged to form logic gates. Logic gates are typically physical devices that may be electrically, mechanically, chemically, or otherwise driven to change physical state in order to create a physical reality of Boolean logic.

Logic gates may be arranged to form logic circuits, which are typically physical devices that may be electrically, mechanically, chemically, or otherwise driven to create a physical reality of certain logical functions. Types of logic circuits include such devices as multiplexers, registers, arithmetic logic units (ALUs), computer memory, etc., each type of which may be combined to form yet other types of physical devices, such as a central processing unit (CPU)—the best known of which is the microprocessor. A modern microprocessor will often contain more than one hundred million logic gates in its many logic circuits (and often more than a billion transistors). See, e.g., Wikipedia, Logic gates, http://en.wikipedia.org/wiki/Logic_gates (as of Jun. 5, 2012, 21:03 GMT).

The logic circuits forming the microprocessor are arranged to provide a microarchitecture that will carry out the instructions defined by that microprocessor's defined Instruction Set Architecture. The Instruction Set Architecture is the part of the microprocessor architecture related to programming, including the native data types, instructions, registers, addressing modes, memory architecture, interrupt and exception handling, and external Input/Output. See, e.g., Wikipedia, Computer architecture, http://en.wikipedia.org/wiki/Computer_architecture (as of Jun. 5, 2012, 21:03 GMT).

The Instruction Set Architecture includes a specification of the machine language that can be used by programmers to use/control the microprocessor. Since the machine language instructions are such that they may be executed directly by the microprocessor, typically they consist of strings of binary digits, or bits. For example, a typical machine language instruction might be many bits long (e.g., 32, 64, or 128 bit strings are currently common). A typical machine language instruction might take the form "11110000101011110000111100111111" (a 32 bit instruction).

It is significant here that, although the machine language instructions are written as sequences of binary digits, in actuality those binary digits specify physical reality. For example, if certain semiconductors are used to make the operations of Boolean logic a physical reality, the apparently mathematical bits "1" and "0" in a machine language instruction actually constitute a shorthand that specifies the application of specific voltages to specific wires. For example, in some semiconductor technologies, the binary number "1" (e.g., logical "1") in a machine language instruction specifies around +5 volts applied to a specific "wire" (e.g., metallic traces on a printed circuit board) and the binary number "0" (e.g., logical "0") in a machine language instruction specifies around −5 volts applied to a specific "wire." In addition to specifying voltages of the machines' configuration, such machine language instructions also select out and activate specific groupings of logic gates from the millions of logic gates of the more general machine. Thus, far from abstract mathematical expressions, machine language instruction programs, even though written as a string of zeros and ones, specify many, many constructed physical machines or physical machine states.

Machine language is typically incomprehensible by most humans (e.g., the above example was just ONE instruction, and some personal computers execute more than two billion instructions every second). See, e.g., Wikipedia, Instructions per second, http://en.wikipedia.org/wiki/Instructions_per_second (as of Jun. 5, 2012, 21:04 GMT). Thus, programs written in machine language—which may be tens of millions of machine language instructions long—are incomprehensible. In view of this, early assembly languages were developed that used mnemonic codes to refer to machine language instructions, rather than using the machine language instructions' numeric values directly (e.g., for performing a multiplication operation, programmers coded the abbreviation "mult," which represents the binary number "011000" in MIPS machine code). While assembly languages were initially a great aid to humans controlling the microprocessors to perform work, in time the complexity of the work that needed to be done by the humans outstripped the ability of humans to control the microprocessors using merely assembly languages.

At this point, it was noted that the same tasks needed to be done over and over, and the machine language necessary to do those repetitive tasks was the same. In view of this, compilers were created. A compiler is a device that takes a statement that is more comprehensible to a human than either machine or assembly language, such as "add 2+2 and output the result," and translates that human understandable statement into a complicated, tedious, and immense machine language code (e.g., millions of 32, 64, or 128 bit length strings). Compilers thus translate high-level programming language into machine language.

This compiled machine language, as described above, is then used as the technical specification which sequentially constructs and causes the interoperation of many different computational machines such that humanly useful, tangible, and concrete work is done. For example, as indicated above, such machine language—the compiled version of the higher-level language—functions as a technical specification which selects out hardware logic gates, specifies voltage levels, voltage transition timings, etc., such that the humanly useful work is accomplished by the hardware.

Thus, a functional/operational technical description, when viewed by one of skill in the art, is far from an abstract idea. Rather, such a functional/operational technical description, when understood through the tools available in the art such as those just described, is instead understood to be a humanly understandable representation of a hardware specification, the complexity and specificity of which far exceeds the comprehension of most any one human. With this in mind, those skilled in the art will understand that any such operational/functional technical descriptions—in view of the disclosures herein and the knowledge of those skilled in the art—may be understood as operations made into physical reality by (a) one or more interchained physical machines, (b) interchained logic gates configured to create one or more physical machine(s) representative of sequential/combinatorial logic(s), (c) interchained ordered matter making up logic gates (e.g., interchained electronic devices (e.g., transistors), DNA, quantum devices, mechanical switches, optics, fluidics, pneumatics, molecules, etc.) that create physical reality representative of logic(s), or (d) virtually any combination of the foregoing. Indeed, any physical object which has a stable, measurable, and changeable state may be used to construct a machine based on the above technical description. Charles Babbage, for example, constructed the first computer out of wood and powered by cranking a handle.

Thus, far from being understood as an abstract idea, those skilled in the art will recognize a functional/operational technical description as a humanly-understandable representation of one or more almost unimaginably complex and time sequenced hardware instantiations. The fact that functional/operational technical descriptions might lend themselves readily to high-level computing languages (or high-level block diagrams for that matter) that share some words, structures, phrases, etc. with natural language simply cannot be taken as an indication that such functional/operational technical descriptions are abstract ideas, or mere expressions of abstract ideas. In fact, as outlined herein, in the technological arts this is simply not true. When viewed through the tools available to those of skill in the art, such functional/operational technical descriptions are seen as specifying hardware configurations of almost unimaginable complexity.

As outlined above, the reason for the use of functional/operational technical descriptions is at least twofold. First, the use of functional/operational technical descriptions allows near-infinitely complex machines and machine operations arising from interchained hardware elements to be described in a manner that the human mind can process (e.g., by mimicking natural language and logical narrative flow). Second, the use of functional/operational technical descriptions assists the person of skill in the art in understanding the described subject matter by providing a description that is more or less independent of any specific vendor's piece(s) of hardware.

The use of functional/operational technical descriptions assists the person of skill in the art in understanding the described subject matter since, as is evident from the above discussion, one could easily, although not quickly, transcribe the technical descriptions set forth in this document as trillions of ones and zeroes, billions of single lines of assembly-level machine code, millions of logic gates, thousands of gate arrays, or any number of intermediate levels of abstractions. However, if any such low-level technical descriptions were to replace the present technical description, a person of skill in the art could encounter undue difficulty in implementing the disclosure, because such a low-level technical description would likely add complexity without a corresponding benefit (e.g., by describing the subject matter utilizing the conventions of one or more vendor-specific pieces of hardware). Thus, the use of functional/operational technical descriptions assists those of skill in the art by separating the technical descriptions from the conventions of any vendor-specific piece of hardware.

In view of the foregoing, the logical operations/functions set forth in the present technical description are representative of static or sequenced specifications of various ordered-matter elements, in order that such specifications may be comprehensible to the human mind and adaptable to create many various hardware configurations. The logical operations/functions disclosed herein should be treated as such, and should not be disparagingly characterized as abstract ideas merely because the specifications they represent are presented in a manner that one of skill in the art can readily understand and apply in a manner independent of a specific vendor's hardware implementation.

Mote System Support

Those skilled in the art will recognize that at least a portion of the devices and/or processes described herein can be integrated into a mote system. Those having skill in the art will recognize that a typical mote system generally includes one or more memories such as volatile or non-volatile memories, processors such as microprocessors or digital signal processors, computational entities such as operating systems, user interfaces, drivers, sensors, actuators, applications programs, one or more interaction devices (e.g., an antenna USB ports, acoustic ports, etc.), control systems including feedback loops and control motors (e.g., feedback for sensing or estimating position and/or velocity; control motors for moving and/or adjusting components and/or quantities). A mote system may be implemented utilizing suitable components, such as those found in mote computing/communication systems. Specific examples of such components entail such as Intel Corporation's and/or Crossbow Corporation's mote components and supporting hardware, software, and/or firmware.

Licensing System Support Language

Those skilled in the art will recognize that it is common within the art to implement devices and/or processes and/or systems, and thereafter use engineering and/or other practices to integrate such implemented devices and/or processes and/or systems into more comprehensive devices and/or processes and/or systems. That is, at least a portion of the devices and/or processes and/or systems described herein can be integrated into other devices and/or processes and/or systems via a reasonable amount of experimentation. Those having skill in the art will recognize that examples of such other devices and/or processes and/or systems might include—as appropriate to context and application—all or part of devices and/or processes and/or systems of (a) an air conveyance (e.g., an airplane, rocket, helicopter, etc.), (b) a ground conveyance (e.g., a car, truck, locomotive, tank, armored personnel carrier, etc.), (c) a building (e.g., a home, warehouse, office, etc.), (d) an appliance (e.g., a refrigerator, a washing machine, a dryer, etc.), (e) a communications system (e.g., a networked system, a telephone system, a Voice over IP system, etc.), (f) a business entity (e.g., an Internet Service Provider (ISP) entity such as Comcast Cable, Qwest, Southwestern Bell, etc.), or (g) a wired/wireless services entity (e.g., Sprint, Cingular, Nextel, etc.), etc.

Extraterritorial Use Language

In certain cases, use of a system or method may occur in a territory even if components are located outside the territory. For example, in a distributed computing context, use of a distributed computing system may occur in a territory even though parts of the system may be located outside of the territory (e.g., relay, server, processor, signal-bearing medium, transmitting computer, receiving computer, etc. located outside the territory).

A sale of a system or method may likewise occur in a territory even if components of the system or method are located and/or used outside the territory. Further, implementation of at least part of a system for performing a method in one territory does not preclude use of the system in another territory.

Residual Incorporation Language

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

Not Limited to Implementations Described Language

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

Not Limited to Human User Language

Although user XXX is shown/described herein as a single illustrated figure, those skilled in the art will appreciate that user XXX may be representative of a human user, a robotic user (e.g., computational entity), and/or substantially any combination thereof (e.g., a user may be assisted by one or more robotic agents) unless context dictates otherwise. Those skilled in the art will appreciate that, in general, the same may be said of "sender" and/or other entity-oriented terms as such terms are used herein unless context dictates otherwise.

Plural Terms Language

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

Operably-Coupled Language

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

Active/Inactive Component Language

In some instances, one or more components may be referred to herein as "configured to," "configured by," "configurable to," "operable/operative to," "adapted/adaptable," "able to," "conformable/conformed to," etc. Those skilled in the art will recognize that such terms (e.g. "configured to") generally encompass active-state components and/or inactive-state components and/or standby-state components, unless context requires otherwise.

Cloud Computing Standard Language

For the purposes of this application, "cloud" computing may be understood as described in the cloud computing literature. For example, cloud computing may be methods and/or systems for the delivery of computational capacity and/or storage capacity as a service. The "cloud" may refer to one or more hardware and/or software components that deliver or assist in the delivery of computational and/or storage capacity, including, but not limited to, one or more of a client, an application, a platform, an infrastructure, and/or a server The cloud may refer to any of the hardware and/or software associated with a client, an application, a platform, an infrastructure, and/or a server. For example, cloud and cloud computing may refer to one or more of a computer, a processor, a storage medium, a router, a switch, a modem, a virtual machine (e.g., a virtual server), a data center, an operating system, a middleware, a firmware, a hardware back-end, a software back-end, and/or a software application. A cloud may refer to a private cloud, a public cloud, a hybrid cloud, and/or a community cloud. A cloud may be a shared pool of configurable computing resources, which may be public, private, semi-private, distributable, scalable, flexible, temporary, virtual, and/or physical. A cloud or cloud service may be delivered over one or more types of network, e.g., a mobile communication network, and the Internet.

As used in this application, a cloud or a cloud service may include one or more of infrastructure-as-a-service ("IaaS"), platform-as-a-service ("PaaS"), software-as-a-service ("SaaS"), and/or desktop-as-a-service ("DaaS"). As a non-exclusive example, IaaS may include, e.g., one or more virtual server instantiations that may start, stop, access, and/or configure virtual servers and/or storage centers (e.g., providing one or more processors, storage space, and/or network resources on-demand, e.g., EMC and Rackspace). PaaS may include, e.g., one or more software and/or development tools hosted on an infrastructure (e.g., a computing platform and/or a solution stack from which the client can create software interfaces and applications, e.g., Microsoft Azure). SaaS may include, e.g., software hosted by a service provider and accessible over a network (e.g., the software for the application and/or the data associated with that software application may be kept on the network, e.g., Google Apps, SalesForce). DaaS may include, e.g., providing desktop, applications, data, and/or services for the user over a network (e.g., providing a multi-application framework, the applications in the framework, the data associated with the applications, and/or services related to the applications and/or the data over the network, e.g., Citrix). The foregoing is intended to be exemplary of the types of systems and/or methods referred to in this application as "cloud" or "cloud computing" and should not be considered complete or exhaustive.

Use of Trademarks in Specification Language

This application may make reference to one or more trademarks, e.g., a word, letter, symbol, or device adopted by one manufacturer or merchant and used to identify and/or distinguish his or her product from those of others. Trademark names used herein are set forth in such language that makes clear their identity, that distinguishes them from common descriptive nouns, that have fixed and definite meanings, or, in many if not all cases, are accompanied by other specific identification using terms not covered by trademark. In addition, trademark names used herein have meanings that are well-known and defined in the literature, or do not refer to products or compounds for which knowledge of one or more trade secrets is required in order to divine their meaning All trademarks referenced in this application are the property of their respective owners, and the appearance of one or more trademarks in this application does not diminish or otherwise adversely affect the validity of the one or more trademarks. All trademarks, registered or unregistered, that appear in this application are assumed to include a proper trademark symbol, e.g., the circle R or bracketed capitalization (e.g., [trademark name]), even when such trademark symbol does not explicitly appear next to the trademark. To the extent a trademark is used in a descriptive manner to refer to a product or process, that trademark should be interpreted to represent the corresponding product or process as of the date of the filing of this patent application.

Caselaw-Driven Clarification Language

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A computationally-implemented method comprising:

(a) electronically providing audio output information to one or more portions of a portable electronic device to be outputted from said portable electronic device via one or more acoustic ultrasonic signals, including at least:

(1) inserting digital information into said audio output information, the inserted digital information being configured to facilitate tracking of acoustic audio reception quality at one or more locations spaced from said portable electronic device; and (b) electronically outputting, said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, including at least:

(1) determining one or more positions associated with one or more ears of one or more target listeners;

wherein at least one of (1) the electronically providing audio output information to one or more portions of a portable electronic device to be outputted from said portable electronic device via one or more acoustic ultrasonic signals or (2) the electronically outputting, said one or more acoustic ultrasonic signals to be demodulated into one or more human audible frequency signals is performed at least in part with one or more processing devices.

2. A computer program product comprising:

one or more non-transitory mediums bearing at least one or more executable instructions that when executed on at least one computing device, cause the at least one computing device to at least:

(a) electronically provide audio output information to one or more portions of a portable electronic device to be outputted from said portable electronic device via one or more acoustic ultrasonic signals, including at least:

(1) insert digital information into said audio output information, the inserted digital information being configured to facilitate tracking of acoustic audio reception quality at one or more locations spaced from said portable electronic device; and (b) electronically output, said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, including at least:

(1) determine one or more positions associated with one or more ears of one or more target listeners.

3. A computationally-implemented system comprising:

(a) circuitry for electronically providing audio output information to one or more portions of a portable electronic device to be outputted from said portable electronic device via one or more acoustic ultrasonic signals, including at least:

(1) circuitry for inserting digital information into said audio output information, the inserted digital information being configured to facilitate tracking of acoustic audio reception quality at one or more locations spaced from said portable electronic device; and (b) circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, including at least:

(1) circuitry for determining one or more positions associated with one or more ears of one or more target listeners;

and wherein the circuitry for electronically providing audio output information to one or more portions of a portable electronic device to be outputted from said portable electronic device via one or more acoustic ultrasonic signals and the circuitry for electronically outputting said one or more acoustic ultrasonic signals to be demodulated into one or more human audible frequency signals are both implemented at least in part with hardware.

4. The computationally-implemented system of claim 3, wherein the circuitry for electronically providing audio output information to one or more portions of a portable electronic device to be outputted from said portable electronic device via one or more acoustic ultrasonic signals comprises:

at least one of:

circuitry for electronically providing audio output information to one or more portions of the portable electronic device to be outputted from said portable electronic device via one or more acoustic ultrasonic signals through one or more data storage portions of said portable electronic device;

circuitry for electronically providing audio output information to one or more portions of the portable electronic device to be outputted from said portable electronic device via one or more acoustic ultrasonic signals via one or more wireless communication portions of said portable electronic device; or circuitry for electronically providing audio output information to one or more portions of the portable electronic device to be outputted from said portable electronic device via one or more acoustic ultrasonic signals through one or more microphone portions of said portable electronic device.

5. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the portable electronic device to be outputted from said portable electronic device via one or more acoustic ultrasonic signals via one or more audio signal processing portions of said portable electronic device.

6. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the portable electronic device to be outputted from said portable electronic device via one or more acoustic ultrasonic signals through one or more internet communication portions of said portable electronic device.

7. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the portable electronic device to be outputted from said portable electronic device via one or more acoustic ultrasonic signals via one or more software portions of said portable electronic device.

8. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the portable electronic device to be outputted from said portable electronic device via one or more acoustic ultrasonic signals through one or more disk player portions of said portable electronic device.

9. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the portable electronic device to be outputted from said portable electronic device via one or more acoustic ultrasonic signals via one or more media player portions of said portable electronic device.

10. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the portable electronic device to be outputted from said portable electronic device via one or more acoustic ultrasonic signals through one or more audio player portions of said portable electronic device.

11. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the portable electronic device to be outputted from said portable electronic device via one or more acoustic ultrasonic signals via one or more text recognition portions of said portable electronic device.

12. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the portable electronic device to be outputted from said portable electronic device via one or more acoustic ultrasonic signals including one or more microprocessor portions of said portable electronic device.

13. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing said audio output information to one or more portions of the portable electronic device to be outputted from said portable electronic device via one or more acoustic ultrasonic signals including one or more digital processor portions of said portable electronic device for inserting digital information into said audio output information.

14. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the a portable electronic device to be outputted from said portable electronic device via one or more acoustic ultrasonic signals as one or more electronic tablet computer systems.

15. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the a portable electronic device to be outputted from said portable electronic device via one or more acoustic ultrasonic signals as one or more electronic handheld mobile device systems.

16. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the portable electronic device to be outputted from said portable electronic device via one or more acoustic ultrasonic signals as one or more electronic cell phone systems.

17. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the portable electronic device to be outputted from said portable electronic device via one or more acoustic ultrasonic signals as one or more electronic portable laptop systems.

18. The computationally-implemented system of claim 3, wherein the circuitry for electronically providing audio output information to one or more portions of a portable electronic device to be outputted from said portable electronic device via one or more acoustic ultrasonic signals comprises:

circuitry for electronically providing audio output information to one or more portions of the portable electronic device to be outputted from said portable electronic device via one or more acoustic ultrasonic signals from one or more collections of one or more ultrasonic transducers of the portable electronic devices.

19. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting including at least outputting according to a sensed acoustic environment proximate one or more target listeners.

20. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting including at least outputting to compensate for Doppler frequency shifting due to movement of said portable electronic device.

21. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting including at least outputting one or more acoustic ultrasonic signals for ranging one or more target listeners.

22. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting including at least outputting acoustic ultrasonic signal amplitude based at least partly on two dimensional user interface user input.

23. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting including at least outputting acoustic ultrasonic signal target location based at least partly on two dimensional user interface user input.

24. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting including at least outputting based at least partly on audio microphone sensing of one or more characteristics of human audible frequency signals down converted at one or more target locations.

25. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting including at least outputting based at least partly on ultrasonic microphone sensing of acoustic ultrasonic signals down converted at one or more target locations.

26. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting including at least outputting based at least partly on sensing of acoustic digital signals received from one or more target locations.

27. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting including at least outputting acoustic ultrasonic signals to be down converted into acoustic anti-noise signals to at least in part cancel acoustic noise signals sensed at one or more target locations.

28. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting including at least outputting one or more acoustic ultrasonic signals to produce one or more human audible frequency signals through non-linear atmospheric interaction.

29. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for determining at least a targeting area size based at least in part on one or more frequencies of said one or more ultrasonic acoustic signals.

30. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting said one or more acoustic ultrasonic signals at least partly with one or more transducers placed based at least in part on one or more frequencies to be used for said one or more acoustic ultrasonic signals.

31. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting said one or more acoustic ultrasonic signals wherein said one or more acoustic ultrasonic signals include at least one amplitude that is based at least in part on a size of a desired target area, wherein the size of the desired target area corresponds to a size of at least a portion of an ear of a target listener.

32. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting said one or more acoustic ultrasonic signals at least partly with one or more transducers placed at least partially along a vicinity of said portable electronic device.

33. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting said one or more acoustic ultrasonic signals at least partly with one or more transducers concealed from view through integration at least partly within a display screen of said portable electronic device.

34. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting said one or more acoustic ultrasonic signals at least partly with one or more transducers integrated within a keyboard of said portable electronic device.

35. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting said one or more acoustic ultrasonic signals at least partly with one or more transducers having a dimensional sizing of less than 10 millimeters.

36. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for electronically outputting said one or more acoustic ultrasonic signals at least partly with one or more transducers having a dimensional sizing of less than 30 wavelengths of a lowest frequency of said one or more acoustic ultrasonic signals.

37. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

at least one of:

circuitry for electronically outputting said one or more acoustic ultrasonic signals at least partly with one or more transducers placed along one or more key spacings of one or more keyboards; or circuitry for electronically outputting said one or more acoustic ultrasonic signals at least partly with one or more transducers interspaced between one or more keyboard keys.

38. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

one or more portable electronic device ultrasonic emitter arrangements including at least one transducer concealed from view at least in part through placement of the at least one transducer behind at least a portion of a thin display of said portable electronic device.

39. The computationally-implemented system of claim 3, wherein the circuitry for electronically outputting said one or more acoustic ultrasonic signals to be demodulated into one or more human audible frequency signals containing one or more portions of said audio output information at one or more locations spaced from said portable electronic device based at least in part on said one or more acoustic ultrasonic signals and based at least in part on one or more portable electronic device ultrasonic emitter arrangements, comprises:

circuitry for embedding one or more digitally coded human audible frequency acoustic audio signals in one or more acoustic ultrasonic signals.

40. The computationally-implemented system of claim 3, wherein the circuitry for inserting digital information into said audio output information, the inserted digital information being configured to facilitate tracking of acoustic audio reception quality at one or more locations spaced from said portable electronic device comprises:

circuitry for inserting into said audio output information at least one or more digital signatures configured to facilitate tracking of acoustic audio reception quality at one or more locations spaced from said portable electronic device.

41. The computationally-implemented system of claim 3, wherein the circuitry for inserting digital information into said audio output information, the inserted digital information being configured to facilitate tracking of acoustic audio reception quality at one or more locations spaced from said portable electronic device comprises:

circuitry for inserting into said audio output information at least one or more digitally coded identifiers configured to facilitate quality control of down-converted audio signals in a vicinity near a target listener.

42. The computationally-implemented system of claim 3, further comprising:

circuitry for determining that one or more persons proximate to the one or more target listeners are not authorized to audibly receive information encoded in the one or more acoustic ultrasonic signals based at least in part on input from imaging circuitry; and circuitry for electronically steering the acoustic ultrasonic signals to one or more positions associated with one or more ears of the one or more target listeners but avoiding transmitting the acoustic ultrasonic signals to the one or non-authorized persons proximate to the one or more target listeners.

* * * * *